United States Patent [19]

Crawford et al.

[11] 4,245,576

[45] Jan. 20, 1981

[54] PLEATING MACHINE

[75] Inventors: William B. Crawford, Greensboro; Anthony T. Solomon, Reidsville, both of N.C.

[73] Assignee: Burlington Industries, Inc., Greensboro, N.C.

[21] Appl. No.: 933,091

[22] Filed: Aug. 11, 1978

Related U.S. Application Data

[60] Continuation of Ser. No. 835,724, Sep. 22, 1977, abandoned, which is a division of Ser. No. 610,045, Sep. 3, 1975, Pat. No. 4,073,246.

[51] Int. Cl.[2] ..... D05B 97/00; D05B 35/08

[52] U.S. Cl. ..... 112/262.1; 223/30

[58] Field of Search ..... 112/262.1, 134, 132, 112/121.11, 121.14, 121.29, 141, 144, 146, 147, 2; 223/28, 30, 31

[56] References Cited

U.S. PATENT DOCUMENTS

| | | | |
|---|---|---|---|
| 3,277,851 | 10/1966 | Dobner et al. | 112/141 X |
| 3,802,361 | 4/1974 | Block | 112/134 |
| 3,822,034 | 7/1974 | Lawson | 223/28 |
| 3,824,964 | 7/1974 | Ryan | 112/134 X |
| 3,906,877 | 9/1975 | Rockerath et al. | 112/141 |
| 4,042,154 | 8/1977 | Lawson | 223/28 |
| 4,067,277 | 1/1978 | Solomon et al. | 112/262 |
| 4,079,682 | 3/1978 | Nishiwaki | 223/30 X |

*Primary Examiner*—Peter P. Nerbun

*Attorney, Agent, or Firm*—Cushman, Darby & Cushman

[57] ABSTRACT

A pleating machine for automatically forming pleated drapes from blank drapery panels. The pleating machine is comprised of six stations which cooperate automatically under the control of a controller. The pleating machine is comprised of a loading station, a loop-forming station, an overhead transfer assembly, a corner sewing station, at least one pleat and sewing station and at least one ejection assembly. After a drapery panel is loaded in the pleating machine, the machine automatically forms a header in the panel, determines the spacing required to form pleats uniformly across the panel just loaded and forms uniformly spaced single loops along the header. Thereafter, the corners of the header are sewn, and the entire panel is transferred to the pleat and sewing station, where each loop is formed into a pleat and sewn. After the last pleat is sewn the entire panel is ejected. The pleating machine can simultaneously deal with a plurality of drapery panels so as to continuously produce completed drapes that are ready for shipping.

65 Claims, 54 Drawing Figures

846
888
886
884
882
890
880
916
910
908
904
912
906
902
896
894
920
922
918
926
924
914
892
938
930
936
934
932
940
928
900
898
893A
893B 1200
1198
1186
1164
1646
1670
30
30
1568
1560
1608
1610
1612
1622
1623
1316
1315
1319
10307
1317
1520
1522
1532
1536
1588
1528
1596
1600
1602
1572
1538
1540
1526
1597
1495
1490
1494
1491
1493
1492
1487
1483
1478
1485
1493
1496
1497
1550
1494
1499
1498
1492B
1492A
1497
1502
1492
1479

Fig. 30
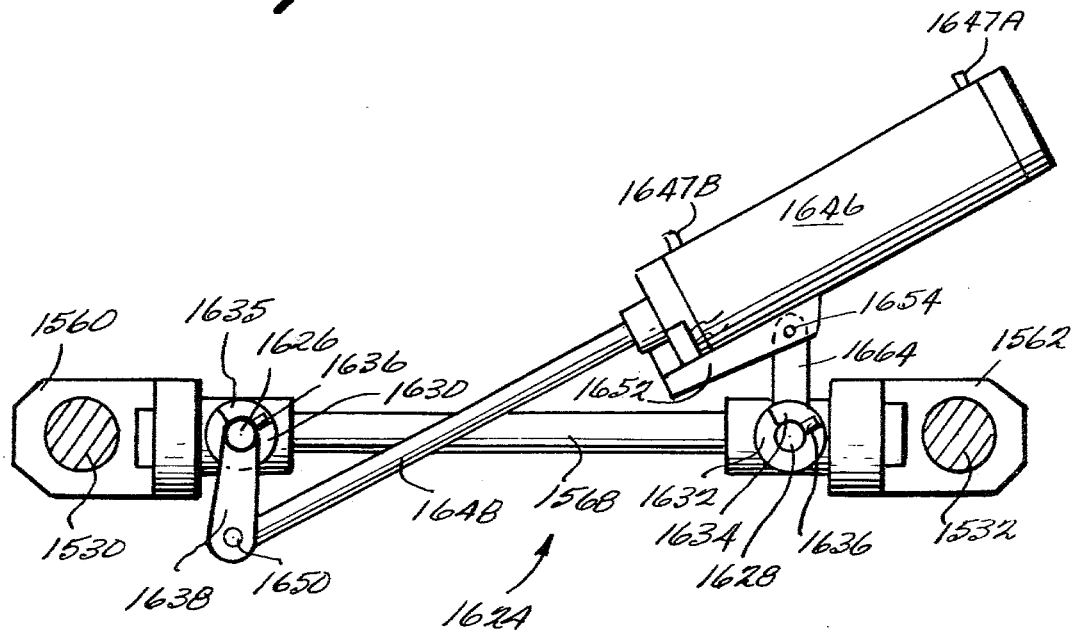
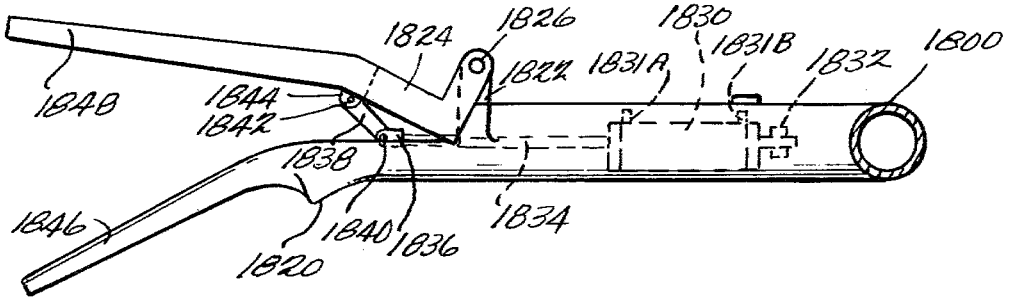
Fig. 32

FROM FIG. 36B

1634
STARTER FOR M1
TO MS1
STARTER FOR M7
TO MS7
JOG RUN
S22
STARTER M2
TO MS2
INPUT 10405
LEFT
S46
S48
STARTER FOR M3
TO MS3
RIGHT
STARTER FOR M4
TO MS4
INPUT 10406
S34
S36
STARTER FOR M5
TO MS5
STARTER FOR M6
TO MS6
STARTER FOR M8L (LEFT FEED)
TO MS8-L
STARTER FOR M8 (RIGHT FEED)
TO MS8-R

SV2
CLOSED
PANEL TOP CLAMP
00500
SV4
ROTATED
SV5
NORMAL
00501
00507
LOADING BAR ROTATATION
Cmy1
SV6
CLOSED
00502
PANEL SIDE CLAMP
SV8
EXTENDED
SV10
RETRACTED
00503
00510
LOADING BAR TRANSFER
Cmy3
SV12
OPEN
SCISSORS
SV14
CLOSED
00504
00511
Cmy 4
SV16
UP
SV18
DOWN
00505
00512
VERTICAL LOOP BLADES
Cmy5
SV20
CLOSED
SV22
OPEN
00506
00513
LOOP FORMER CLAMP
Cmy6
SV24
00514
SCISSORS STOP
TO FIG 39B

PLEATING MACHINE

This is a continuation of application Ser. No. 835,724 filed Sept. 22, 1977, now abandoned, which is a division of application Ser. No. 610,045, filed Sept. 3, 1975, now U.S. Pat. No. 4,073,246.

BACKGROUND OF THE INVENTION AND PRIOR ART

For many years the process of taking material and making draperies has been a hand operation. This has been due in part to the wide variations of window sizes and because of the widely differing tastes that individuals have in drapes, both in terms of fabric and style.

While a large portion of the drapery industry is still in the custom hand-made business, a significant portion of the industry is now trying to standardize drapery production and many attempts to speed up the hand process have been suggested.

Almost all of the recent approaches have revolved around attachments for sewing machines or for attachments to the table on which the sewing machine was supported. One of the early devices is disclosed in the Gellman U.S. Pat. No. 2,669,955. This consisted of a stationary blade and two movable blades mounted on and adjacent the stationary blade. The operator would place the fabric over the stationary blade and thence downward into the recesses formed between the stationary blade and the movable blades. The operator would then move the movable blades toward the central stationary blade and thus retain the fabric within that area and then the fabric would be bent over the outside surfaces of the movable blades and the cloth would then be slid off of the device in the form of a folded triple pleat. This device was usually mounted somewhere adjacent the sewing machine and after the operator had formed the pleat, the operator would move the pleat to the sewing machine needle and secure the folded triple pleat.

Firestein et al, U.S. Pat. No. 3,331,345 automated the Gellman-type apparatus by having the blades be hydraulically operated. After the operator had placed the material between two sets of blades, one stationary and one movable, she could then depress a switch and the movable blades would move toward the stationary pair to form a triple pleat. This speeded the operation up since the operator did not have to hand-fold the material around a series of blades since this was now being done by the hydraulically operated blades.

In addition to attempts to speed up the forming of the sections of the triple pleat, the operators faced an additional problem of accurately spacing the pleats along the length of the drapery panel. An attempt to solve this problem involved the placing of score marks or fold lines in the buckram or stiffening portion of the upper edge of the drapery panel. If the operator centered these score lines in her pleat forming attachment, the pleats formed therearound would be substantially equally spaced both along the top of the panel and from each of the two edges. Also, U.S. Pat. No. 3,712,520 used a strip of thermoplastic which was shaped and creased so as to be readily foldable into a form to be used in forming the header into uniformly spaced pleats. The creases are at preselected intervals, however, and cannot be easily varied from one spacing width to another.

Another solution to the problem of spacing pleats was made for use in the custom field and consisted of a set of manually operated lazy tongs which had weighted clamps. These devices were usually 10 to 15 feet in length and would serve to help the operator space the location of pleats so that they were relatively uniformly spaced along long lengths of drapery panels. The panel would be placed in the lazy tongs device which was at its fully open position, the operator would then close the device allowing loops to form between the weighted clamps. When the lazy tongs were drawn together, she would then by hand and by eye, adjust the height of the loops extending inbetween the clamps so that the material extending away from each of the end clamps was approximately equal. The operator would then hand staple the loops that were formed thereby and in this way aid the next operator who would form triple pleats. Following the hand-forming of pleats, the pleats would be sewn and the staples removed.

A recent example of another attempt at more fully automating the drapery-making process is Firestein et al U.S. Pat. No. 3,661,103. In this apparatus, after the buckram and the initial hem have been made in the cloth by hand or in some other device, the drapery panel is placed by hand in the machine so that one corner of the panel comes underneath and can be held by the sewing machine. Thereafter, the corner is sewn, following which a measuring device in the form of a rotatable bar is moved against the cloth and pulls the cloth down in an inclined supporting surface, with the sewn corner still being held by the sewing machine. A sufficient amount of the drapery panel is pulled so that there will be sufficient material for forming one triple pleat and to allow for spacing the first pleat from the corner that has just been sewn. Thereafter, one triple pleat is automatically formed. After the pleat is formed, it is transferred again to gripping means associated with the sewing machine and the sewing machine needle and the pleat is then sewn. While the sewn pleat is being retained by the gripping means associated with the sewing machine, the device for measuring out another length of fabric again operates and pulls another length of drapery material so that the next pleat can be formed. Again, the amount of fabric pulled will allow for spacing between this next and the previous pleat. This process then continues one pleat at a time until the desired number of pleats have been formed with the final operation being the sewing of the second corner of the panel.

This machine suffers from the problem that it is not a relatively fast operating piece of equipment, that the amount of fabric that is to be pulled must be hand-fed to the machine and aligned by the operator based on the length of fabric that is going to be formed into a drape. Applicants have found that drapery panels are not of a consistent width and thus the operator of this machine, if she were to correctly place each of the pleats on each succeeding panel, would need to make a separate adjustment for each panel going through the machine. Further, there is no precise control over the top edge of the panel nor of the amount of material pulled and the device deals only with one pleat at a time.

Other examples of attempts to more fully automate the pleat-forming operation and to solve the problem of correctly spacing the pleats one from the other equally along the length of the panel can be shown by Lawson, U.S. Pat. No. 3,822,034 and Ryan, U.S. Pat. No. 3,824,964.

Lawson shows a pleat forming device which slightly extends the capabilities of the earlier patents dealing with pleat spacing but has still not automated the process. The device uses a movable lazy tongs device, a plurality of pleat formers, a series of scales and a tacking device. The operator measures the panel's width and determines how many pleats are desired. The operator then sets some pointers, enters some information into an undescribed control system which apparently activates the lazy tong device. The panel is aligned with scale marks by the operator, the tongs activated and thereafter pleats are formed. Following pleat formation the pleats are stapled and the panel is removed for further processing elsewhere.

Ryan is very similar to Firestein et al 3,661,103 in that successive pleats are made in a panel and then sewn. The panel has had a header portion preformed thereon and the side hems have already been sewn.

The operator must pre-set the machine for the required pleat take-up and spacing after measuring the panel's width. Also, the operator must set the distance for the first and last pleats from the panel's corners. After loading one end of the panel the operator must guide the panel through the machine by keeping the top edge aligned with a guide fixed to the machine. Thereafter, the successively formed pleats are sewn.

Other patents known to applicant are as follows: U.S. Pat. Nos. 3,667,667; 3,802,609; 3,823,452; 3,760,746; 3,767,091; 3,724,729; 2,915,997 and 2,988,027.

Nowhere in the prior art has there been a drapery-making machine which has worked with the entire width of a panel nor with a plurality of panels all at one time. Further, none work sufficiently fast so as to be competitively superior to a skilled operator who was making drapes by hand. Furthermore, the prior devices discussed herein suffer from the problem that there still need to be many operator functions and operate-made dial settings in order to prepare the machine to properly space pleats along the length of the panel. Only single pleats are being dealt with and the performance of the machines still depends on operators.

SUMMARY OF THE INVENTION

The present invention is comprised of a machine that requires the operator to merely place the top edge of a drapery blank on the loading assembly and press a start switch. Thereafter, the machine under the control of a controller will perform the subsequent operations without operator assistance other than bobbin changes, repair of thread breaks, etc. The entire width of the drapery panel is under the control of the machine at all times, the pleat spacing is simultaneously accomplished for all loops across the top of the drapery panel and all the spaced loops are under machine control throughout the various stages of production.

The spacing of the loops and pleats will be automatically changed for each succeeding panel loaded into the machine without any requirement that the operator measure panels and manually adjust the machine.

The finished drapes will each be of substantially the same width, about twenty five inches wide. In order to accomplish this, with panels of varying widths, the depth of the pleats is varied automatically within the amount of material placed in the loops during the loop forming sequence.

In addition, the present invention can handle a plurality of panels simultaneously which greatly increases the speed with which completed drapes can be formed.

Further, the machine performs all the required processing steps required to form a panel blank into a completed drape which includes folding the initial top hem or header, simultaneously spacing a plurality of loops across the width of the header to fit that specific panel, sewing corners of the header, folding and sewing pleats within the previously formed loops and ejecting a finished completed panel.

The present invention consists of novel apparatus and method which is more fully disclosed in the detailed description which follows in conjunction with the accompanying drawings, and more particularly defined in the appended claims.

BRIEF DESCRIPTION OF THE DRAWINGS

In the accompanying drawings which form part of the instant specification and which are to be read in conjunction therewith and in which like reference numerals are used to indicate like parts in the various views.

FIG. 30 is an enlarged detail of the pleat sewing locking mechanism taken along line 30—30 of FIG. 27;

FIG. 32 is a horizontal sectional view of the doffing arm clamp taken along line 32—32 of FIG. 3;

IN THE DRAWINGS

Figure 1:
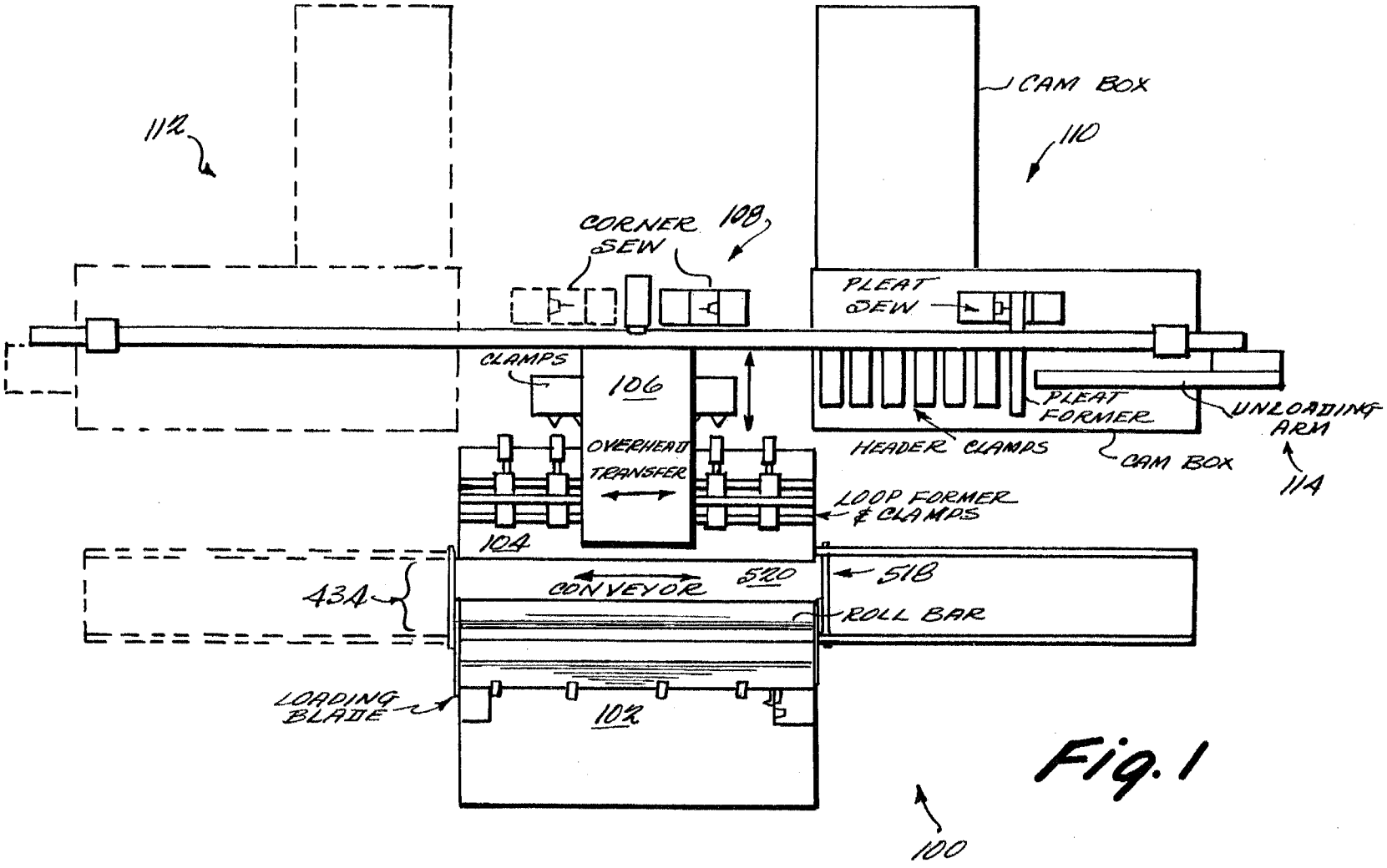
FIG. 1 is a diagrammatic plan view of the pleating apparatus.

Referring now to the above drawings, the pleating machine which comprises this invention is set forth in the top plan view of FIG. 1 and is generally indicated at 100. The pleating machine consists of a series of sections or assemblies which, as described hereinafter, perform different processing steps on blank drapery panels. When the drapery panel is removed from the machine having gone through all the various processing steps the panel will have been formed into a completed drape.

There are six general assemblies, the loading assembly 102, the loop forming assembly 104, the overhead transfer unit 106, the corner sew station 108, right and left pleating and sewing stations 110 and 112, respectively and right and left ejection stations, 114, 116 respectively.

While two pleating and sewing stations are shown, it is to be understood that any number of pleating and sewing stations can be used with this apparatus with the final number depending only upon the desires of the users and the capability of the machine operators. In addition, it is also within the contemplation of this application that two or more of the pleating machines as shown in FIG. 1 could be placed adjacent one another so that several could be operated simultaneously under the control of one operator.

Referring now to FIG. 1, after the panel has been loaded into the loading assembly 102 by the operator, a start button 10017 is pushed causing the loading assembly 102 to rotate 180° thereby forming a hem in the upper portion of the panel. After inspecting the header thus formed a start-run bottom 10016 is pushed causing the panel to be transferred into the loop-forming assembly 104 and is retained such that the previously formed hem is clamped securely. The loading assembly 102 returns to its load position, the tail of the panel is forced to drop down between the loading assembly 102 and the loop-forming assembly 104.

The loop-forming assembly 104 is then actuated and a series of loops of uniform height are spaced uniformly along the width of the drapery panel.

Following the formation of loops, the entire panel is transferred to the overhead transfer unit 106 and the panel is transferred from the loop-forming assembly 104 to a corner-sewing station 108.

At the corner-sewing station 108, the two exterior corners of the header previously formed by the loading assembly are sewn simultaneously.

Following this procedure, the overhead transfer assembly 106 will transfer the entire panel to a pleating and sewing station where pleats are successively formed, pinned and clamped within the previously formed loops and then sewn. When the last pleat has been formed and sewn, the panel is released and a suitable ejection device ejects the completed panel and places it on a suitable truck or carrier.

Figure 4:
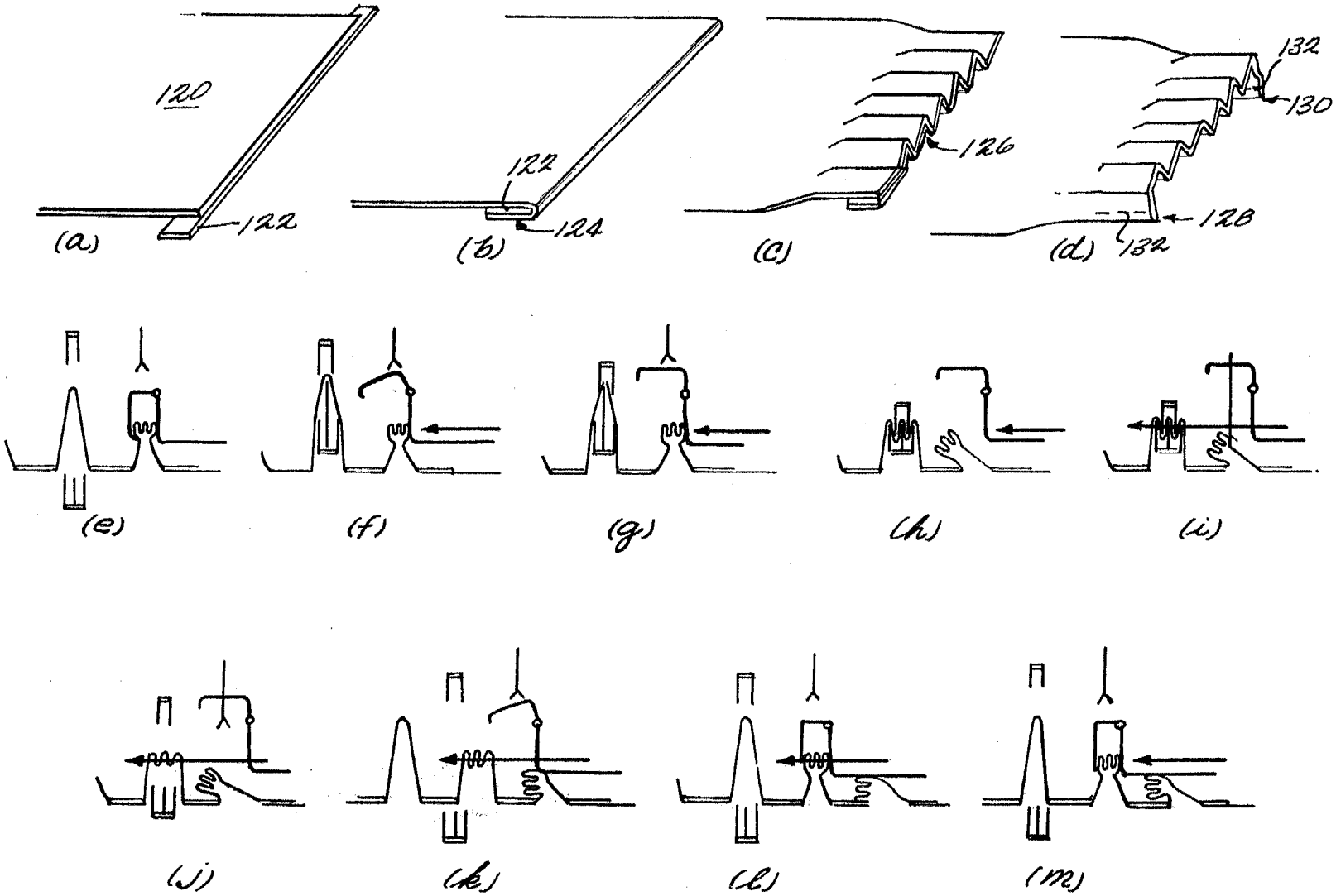
FIG. 4 diagrammatically shows the processing steps performed on drapery panels by the present invention.

In order to more fully understand the functioning of the various above-identified assemblies, reference is now made to FIG. 4 which shows the various processing steps through which the blank drapery panel will be taken between the time the drapery panel is loaded by the operator in the loading assembly 102 and a completed drape is ejected from the machine.

It will be noticed that there are 13 blocks in FIG. 4 indicated as 4*a*–4*m* with blocks a through d showing the drapery panel 120 from a side view, while blocks e through m show the various stages through which the loops 126 are taken as they are processed from loops into pleats.

In 4*a* the drapery panel 120 is still in a flat condition with a strip of buckram 122 having been applied along the leading edge of the panel. It should be noted that it is this leading edge of the panel on which the buckram has been attached that will be loaded into the loading assembly 102.

In 4*b* the drapery panel 120 has had a header portion 124 formed along the top end of the panel with the ends of the buckram having been folded over by the operator so that the strip of buckram is between the layers of fabric which form the header portion 124.

In 4*c* the header portion of the drapery panel 120 has been compressed together and a plurality of single loops 126 have been formed in the header portion 124. The forming of the header portion into single loops is accomplished at the loop forming assembly 104 and it should be noted that each of the loops 126 is equally spaced from each of the other loops and from each end of the panel 120.

In 4*d* the corners 128, 130 of the header panel 120 are hanging downwardly and the corners, 128, 130 of the header portion 124 have been sewn in the corner sewing station 108 forming the line of stitching shown at 132.

While blocks 5–13 will be more fully discussed hereinafter, it can be generally pointed out that each of the single loops which has been formed by the loop forming assembly will be successively formed into pleats with each pleat thereafter being successively sewn. Thus, an overall view is provided in FIG. 4 for the handling steps of the drapery panel.

Figure 2:
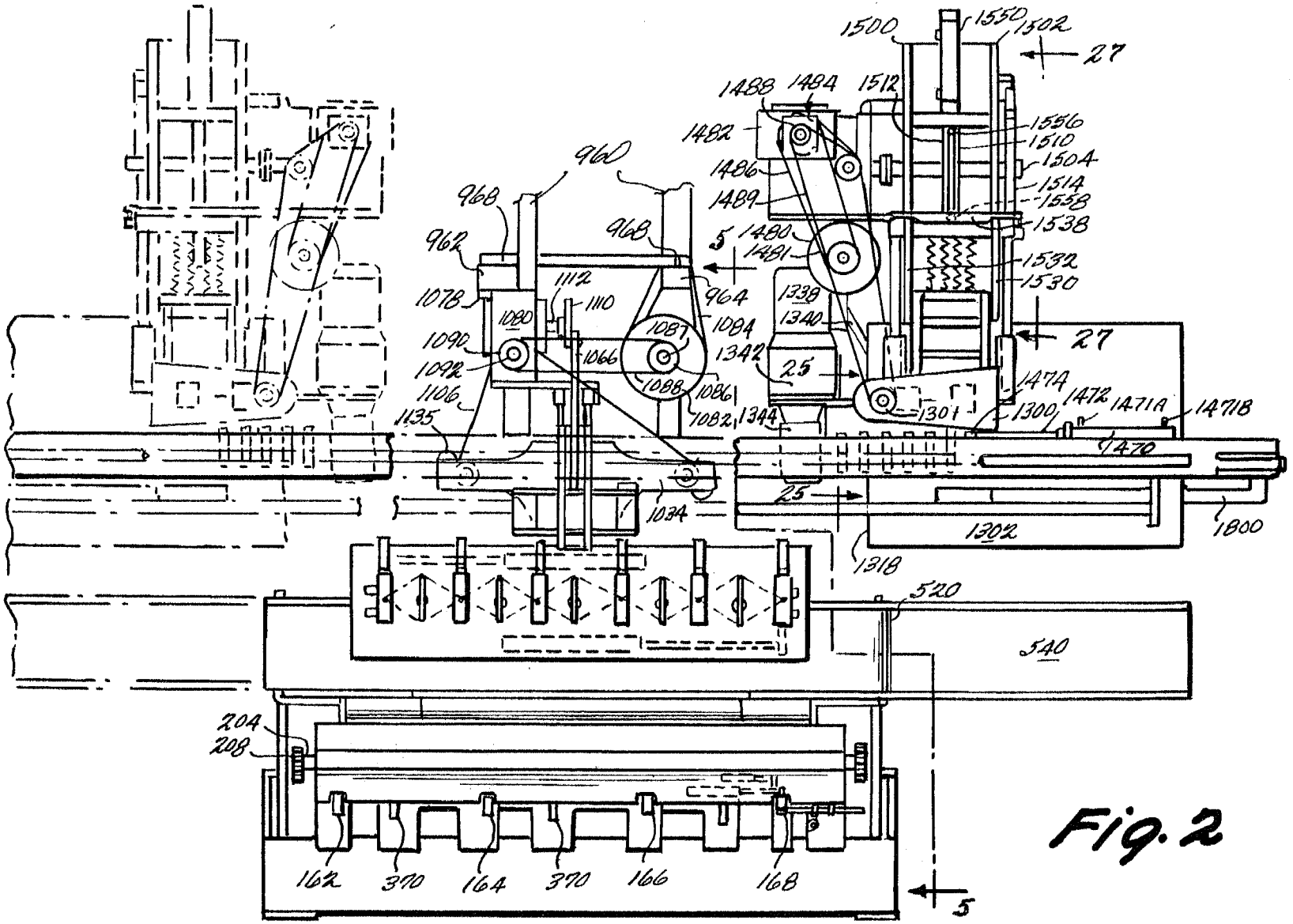
FIG. 2 is a detailed plan view of the pleating apparatus.

FIG. 2 shows a more detailed plan view of the pleating machine and it will be noted that only one of the pleating stations, specifically the right pleating station 110, is shown in detail while the left pleating station 112 is only partially shown. The pleating stations are identical in structure and operation with one merely being the mirror image of the other. Therefore, for purposes of further description, references to the right pleating station, unless otherwise indicated, can be considered as being identical for the left pleating station.

Figure 5:
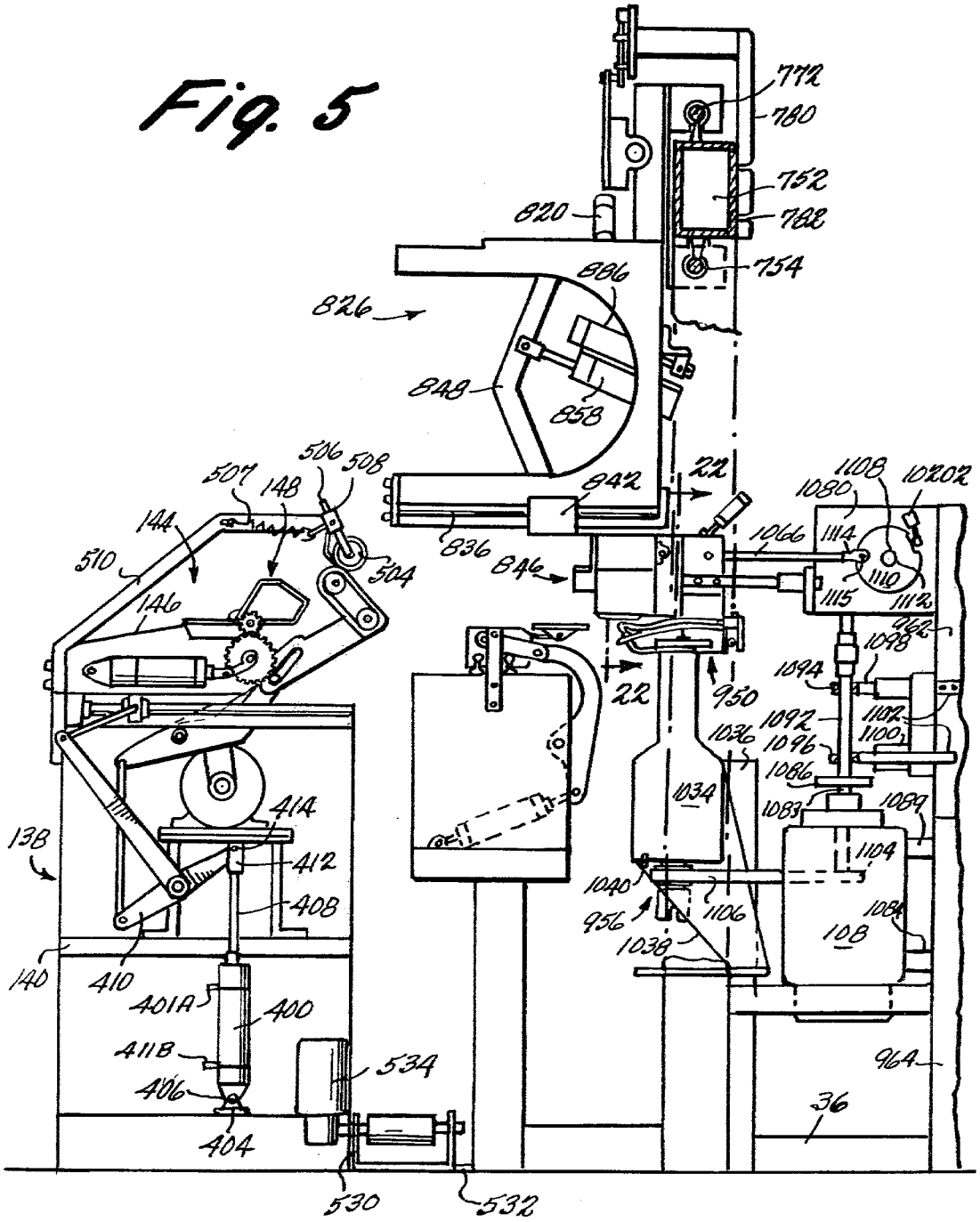
FIG. 5 is a partial sectional view taken along 5—5 of FIG. 2.
Figure 6:
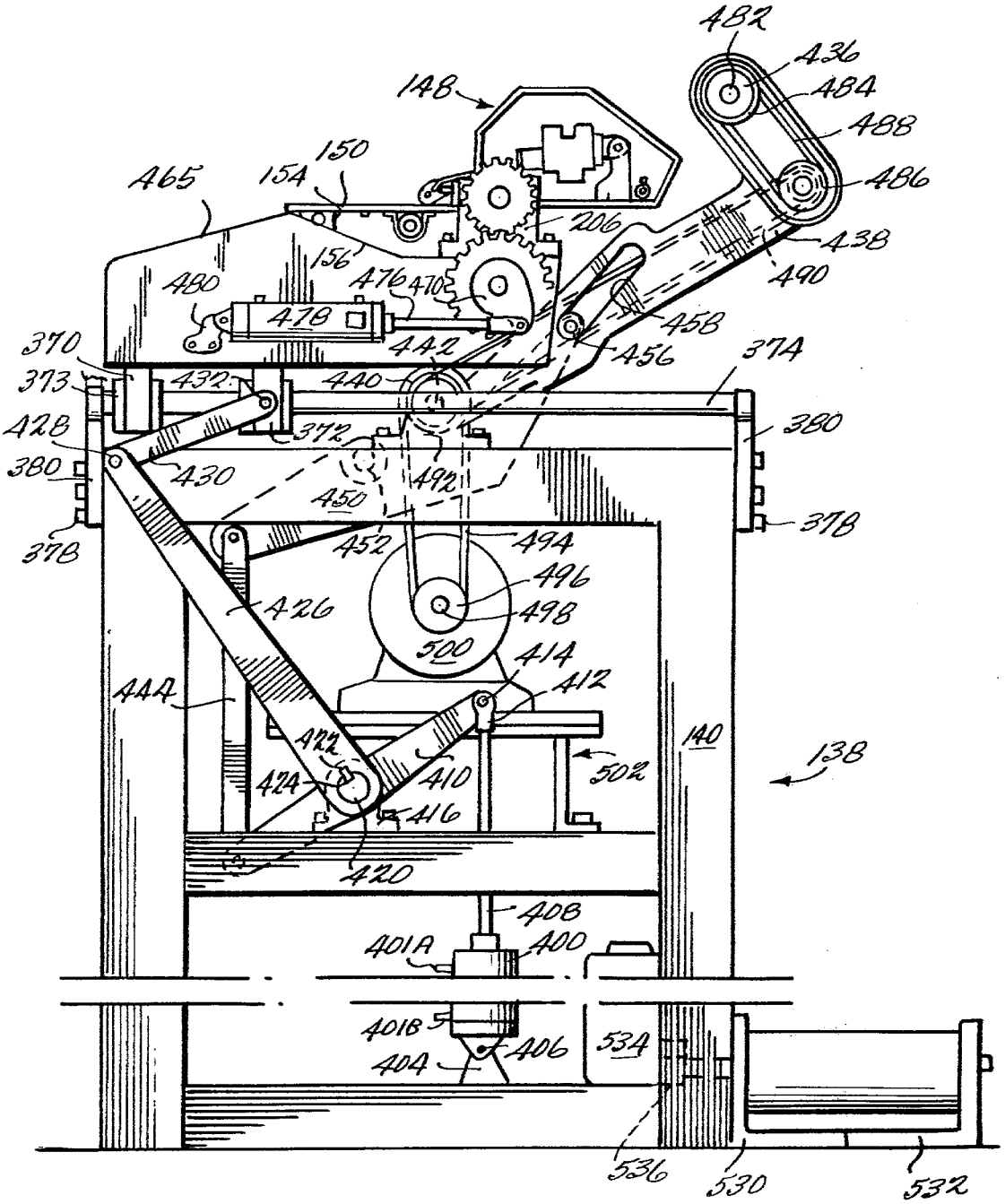
FIG. 6 is a side elevation of the loading assembly of the pleating machine shown in its initial said position.
Figure 7:
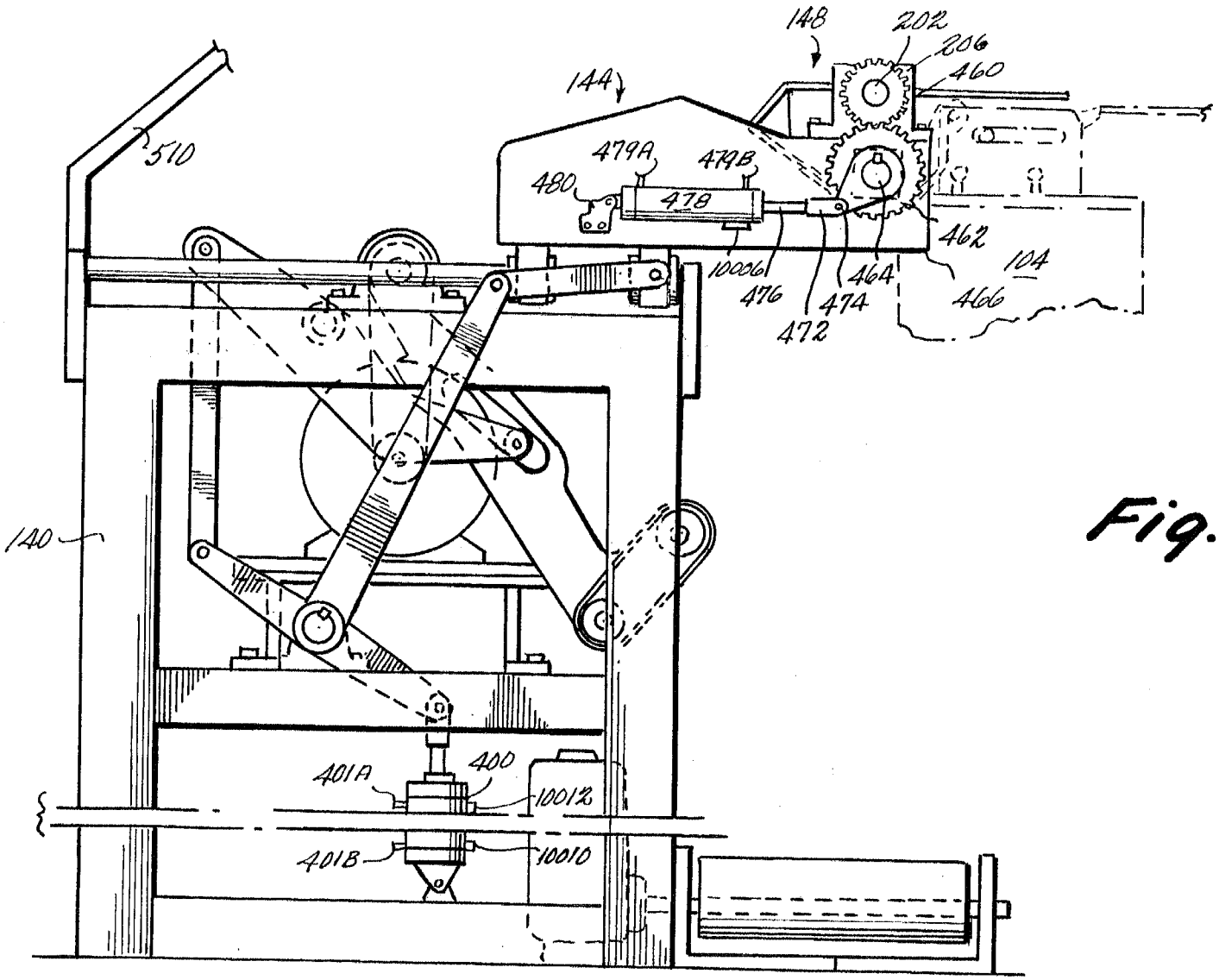
FIG. 7 is a view similar to FIG. 6 showing the loading assembly in it actuated position in engagement with the loop forming assembly.

The loading assembly 102, as shown in FIGS. 5, 6, and 7, and is comprised of a fixed lower portion 138, having an inner frame 140 on which an outer housing or corner 142 is secured by any convenient means, and a movable upper portion 144 which is comprised of an internal frame 145 on which is made a support structure 146 and a rotatable loading bar assembly 148.

The support structure 148, has a sloping top surface portion which serves as the initial support surface for the drapery panel as it is being loaded into the loading assembly 102. The support structure 148 extends the full width of the movable upper portion 144 as is shown in FIG. 2 and thus also allows the operator to smooth out and flatten the top portion of the drapery panel 120 prior to initiating the loading cycle.

The rotatable loading bar 148 is positioned just behind surface 146. As will be noticed in FIGS. 5, 8, 8A, and 9, the loading bar is comprised of a bottom support plate 150 which has a series of tongues or extensions 152 extending toward the support structure 146 when the loading bar 148 is in its initial load position. Stops 154 attached to the inside wall 156 of support structure 146 will properly align and limit the forward rotation of loading bar 148.

Figure 8:
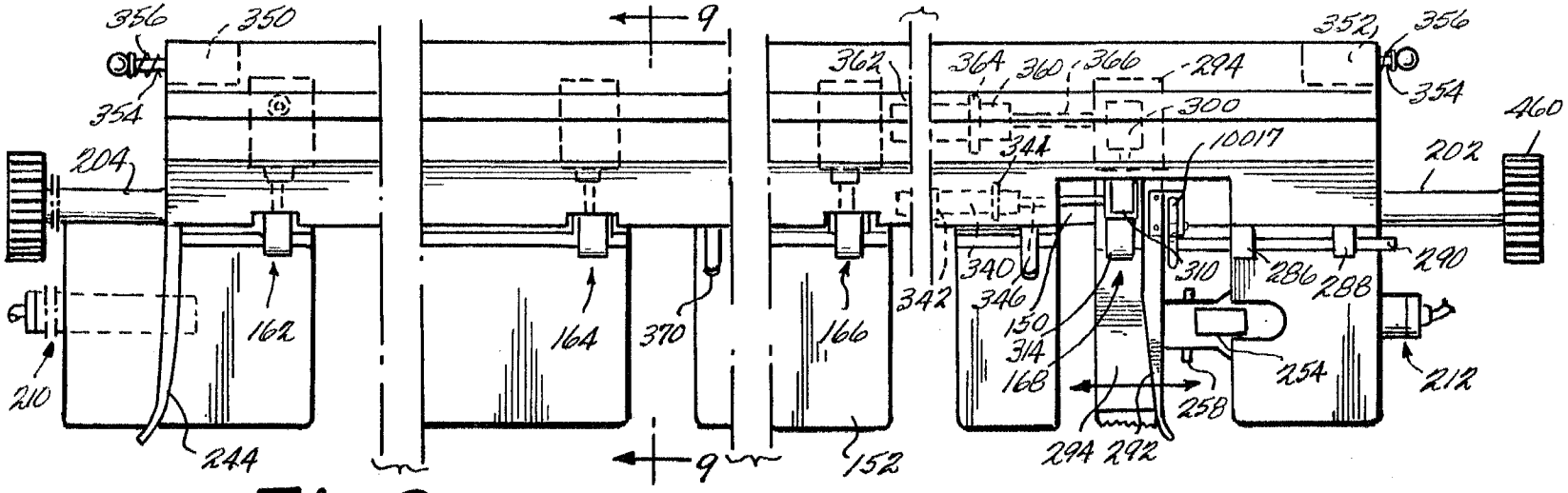
FIG. 8 is a top plan view of the loading bar shown in FIGS. 6 and 7.

Also secured to the support plate 150 is a housing 160 which serves as a cover for the loading bar and the clamping mechanisms. Located on support plate 150 are clamp mechanisms 162, 164, 166, 168 as shown in FIGS. 2 and 8. Clamp mechanisms 162, 164 and 166 are not mounted so as to be slidably movable with respect to plate 150. However, clamp mechanism 168 is slidably mounted on plate 150 as will be described hereinafter.

Figure 9:
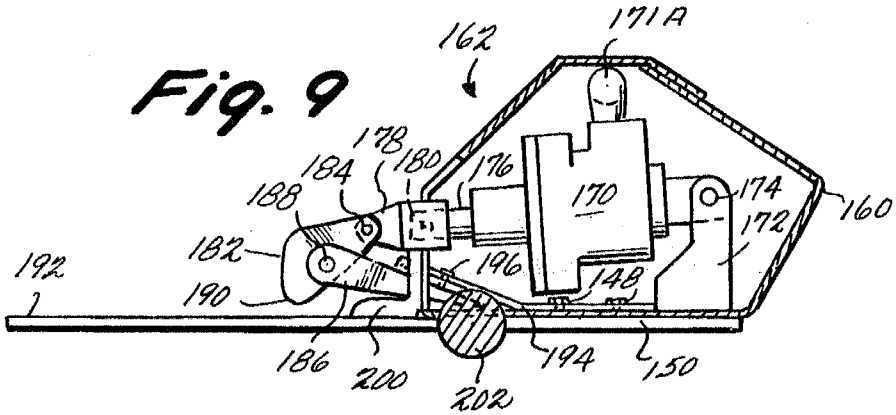
FIG. 9 is a cross-sectional view through the loading bar taken along line 9—9 of FIG. 8.

Referring to FIG. 9 and clamp mechanism 162 which is the same as clamp mechanisms 164 and 166 clamp mechanism 162 is comprised of an air cylinder 170 which is mounted to plate 150 by means of a u-shaped mounting bracket 172 and a pin 174 which is retained in bracket 172 by any suitable means such as a cotter pin or snap rings. Since mounting pins used throughout can be likewise retained, unless otherwise stated such pins will be retained in brackets or connecting links by snap rings or cotter pins (not shown). There are numerous air cylinders, such as 170, referred to in this specification. All are connected to a source of compressed air, not shown and a compressed air supply at 80 psi is used herein. All cylinders are actuated by controller controlled solenoid valves, to be described hereinafter with the cylinder return being provided by a second controller operated valve to give positive control, or by a spring loaded valve which when actuated by controller 1920 compresses the spring a by a spring loaded drive rod within the cylinder. Air port 171A is provided to connect cylinder 170 to the source of air under the control of controller 1920 and the solenoid valve SV-2. Cylinder 170 is provided with a spring loaded drive rod and when valve SV-2 is deenergized, port 171A is opened to the atmosphere to allow the spring to return the cylinder to its normal unclamped position. The cylinder drive arm 176 is attached to a connecting link 178 by means of a pin 180. The clamp foot 182 which performs the actual clamping operation so as to retain the drapery panel between the clamp foot 182 and the support plate 150 is attached to connecting link 178 by means of a pin 184. The clamp foot 182 is also pivotally secured to a clamp pivot 186 shaped as a clevis by pin 188, thus allowing the clamp foot 182 to be pivoted about pin 188 so that the bottom edge 190 will be forced into contact with the plate 150 or the fabric therebetween. Since the clamp foot 182 rotates down toward plate 150, the rotation of the clamp foot 182 during clamping will tend to cause the fabric placed thereunder to be pulled into the clamp mechanism thereby aiding in the loading of the panel. The clamp pivot 186 is secured to a spring arm 194 as by screws 196 and the spring arm 194 is in turn secured to the support plate 150 as by screws 198. The spring arm 194 serves to provide a downward force on the clamp pivot 186 when the air cylinder 170 is operated. In addition, an L-shaped bracket 200 is provided along the forward wall of housing 160 so as to provide additional strengthening support for the forward wall of housing 160. Also shown is one of the loading bar mounting shafts 202. Shaft 202 together with shaaft 204 rotatably support the loading bar on the upper portion frame by means of bearing blocks 206 and 208, respectively, (one of which may be seen in FIG. 7).

Side clamps 210 and 212 are provided at the left and right ends of loading bar 148, respectively, as shown in FIG. 8. Each clamp is side mounted to the bottom support plate 150 when the loading bar 148 is in its unrotated load position. In addition, side clamp 210 is fixed while side clamp 212 is movable laterally along with clamp mechanism 168 as will be explained hereinafter.

Figure 13:
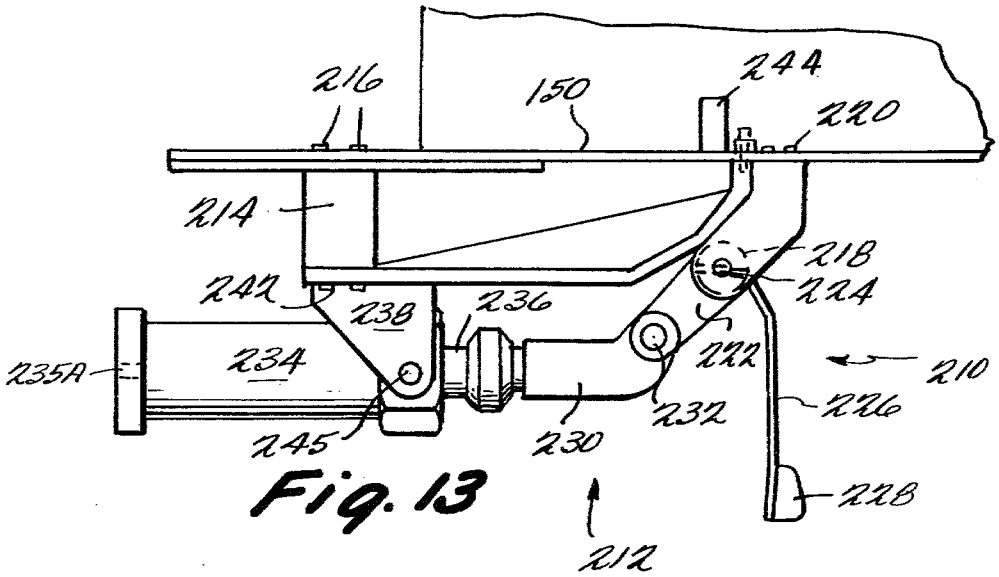
FIG. 13 is a fragmentary side elevation of the fixed side clamp at the other end of the loading bar.

Referring to FIG. 13, side clamp 210 is comprised of a mounting bracket 214 which is secured to the bottom of plate 150 by screws 216 or by any other convenient method. A second mounting bracket 218 is likewise secured to the bottom of surface 150 by screws 220. The end of bracket 218 is shaped as a clevis and a connecting link 222 is rotatably secured therein by pin 224. A spring clamp 226 having a pressure foot 228 is secured to link 222 such that when link 222 is rotated counterclockwise, pressure foot 228 will come into contact with plate 150. A drive link 230 is rotatably secured to connecting link 222 by pin 232 and the drive link 230 is drivenly connected to air cylinder 234 by a cylinder drive rod 236. Cylinder 234 is provided with air port 235A and is connected to the compressed air supply by controller activated valve SV-6. A generally U-shaped cylinder mounting bracket 238 is mounted to bracket 214 by screws 242 and cylinder 234 is rotatably mounted to bracket 238 by pivot screws 240. Located on the upper surface of plate 150 is a loading guide wall 244 which serves to align the left edge of the drapery panel 120 with the left side of the loop forming assembly 104.

Figure 11:
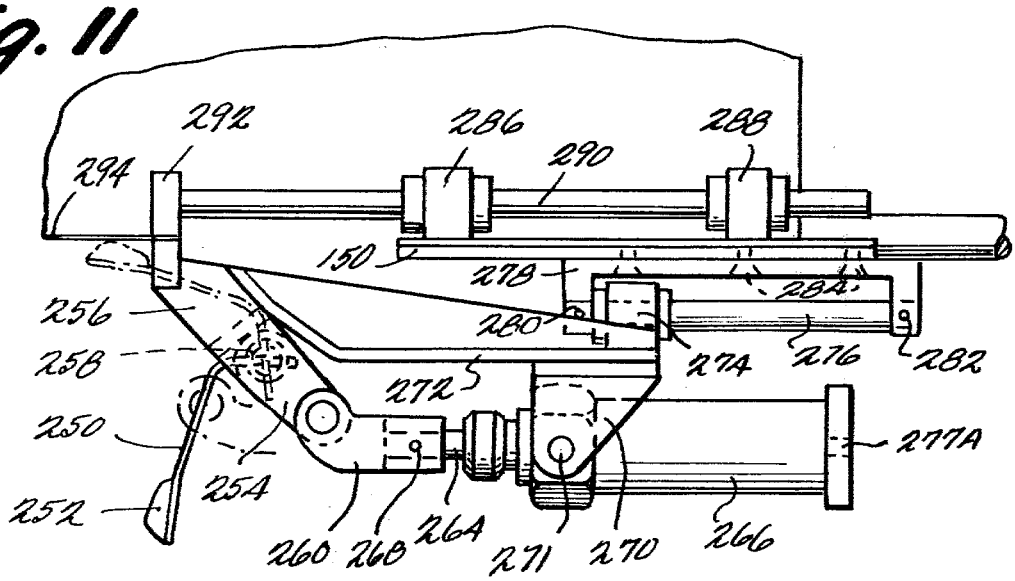
FIG. 11 is a fragmentary side elevation of the movable side clamp at one end of the loading bar.
Figure 12:
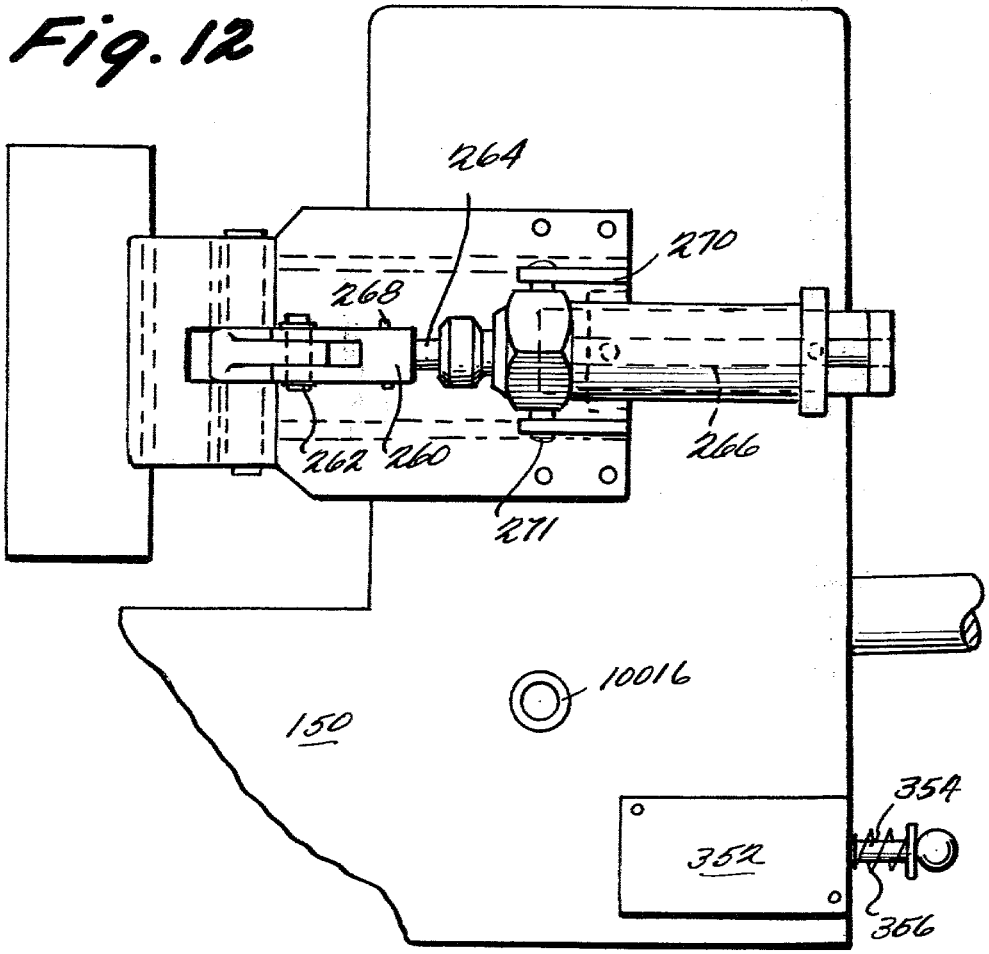
FIG. 12 is a fragmentary bottom plan view of the underside of the loading bar showing the side clamp of FIG. 11.

The movable side clamp 212, located on the right end of loading bar 148 and shown in FIGS. 11 and 12, is comprised of a spring clamp 250 to which a pressure foot 252 is affixed. The pressure feet 778 and 752 can be constructed sufficient so as to securely grip the edge of the drapery panel. The spring clamp 250 is secured to a drive link 254 which is in turn rotatably mounted on mounting bracket 256 by pin 258. Drive link 254 is rotatably connected to a connecting link 260 by means of pin 262. The connecting link 260 is connected to the driving shaft 264 of the air cylinder 266 by means of a pin 268. Cylinder 266 is provided with air port 277A which is connected to the air supply through controller operated valve SV-6. The air cylinder 266 is itself rotatably secured in a clevis or U-shaped bracket 270 as by pivot screws 271 which in turn is secured to a support plate 272. Plate 272 is mounted on a slidable bearing block 274 which slidably engages a shaft 276 secured in a U-shaped bracket 278 by means of pins 280 and 282, respectively. The U-shaped bracket is in turn connected to support plate 150 such as by screws 284.

Mounted on plate 150 are lineal bearing blocks 286 and 288 which slidably support shaft 290. Shaft 290 is welded or otherwise secured to a vertical support and guide plate 292 from which a horizontal plate 294 extends. While plate 294 can be attached to plate 292 by any convenient method, the structure must be rigid and welding is a preferred method. Connected to the bottom part of the vertical plate 292 is the bracket 256 which is provided with an opening through which shaft 258 extends and is supported thereby. Further, the support plate 272 is welded to bracket 256 as shown.

The horizontal support plate 294 is thus supported from beneath by the clamp assembly together with plate 272 and from above by plate 292 and shaft 290. Further, plate 294 can be moved sideways since shaft 290 can slide within bearings 286 and 288 and bearing 274 can slide along shaft 276.

Figure 8A:
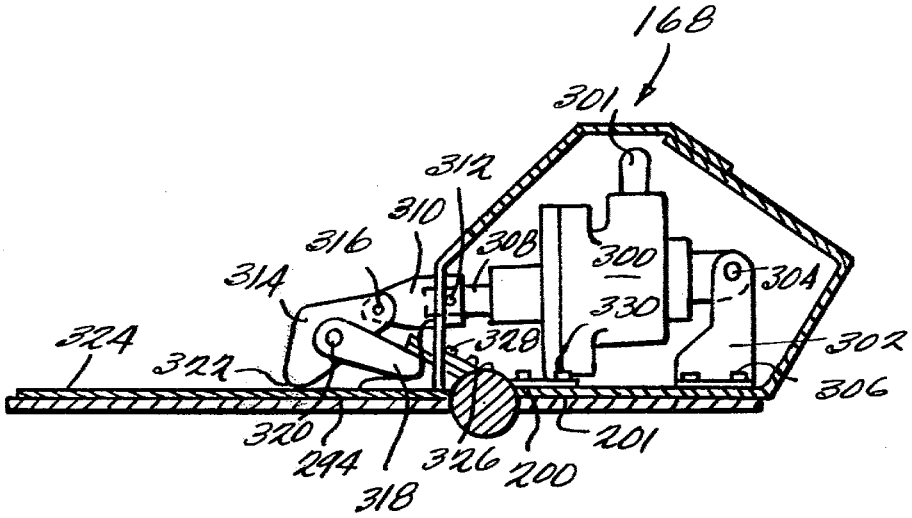
FIG. 8A is a cross-sectional view through the movable loading bar clamp.

Turning to FIGS. 8 and 8*a*, the loading bar clamp mechanism 168 is mounted on plate 294 the same way in which clamp mechanism 162 is mounted on plate 150. The clamp mechanism 168 is comprised of an air cylinder 300 rotatably mounted on a supporting bracket 302 by pin 304. The bracket 302 is in turn secured to plate 294 as by screws 306. Cylinder 300 has air port 301 and means for connection to an air supply (not shown), through valve SV-2. The cylinder drive arm 308 is attached to a connecting link 310 by means of pin 312 and a clamp foot 314 is rotatably connected to connecting link 310 by pin 316 and to a clamp pivot 318 by pin 320.

The clamp pivot 318 is shaped like a clevis and since the clamp foot 314 is pivotally secured therein by pin 320, the clamp foot 314 can pivot when the cylinder 300 is actuated so that the bottom edge 322 of foot 314 will be forced into or toward plate 294 or the fabric therebetween. As was the case with clamp mechanisms 162-166, the pivoting of clamp foot 314 will tend to pull the fabric into the clamp, and a layer of rubber or cork 324 could optionally be provided on surface 322 of clamp foot 314.

The clamp pivot 318 is self-secured to a spring arm 326 as, for example, by screws 328 and the spring arm 326 is secured to plate 294 by screws 330. Here again, the spring arm 326 provides a downward force on the clamp pivot 318 when the clamp foot 314 is in its clamped position.

As shown in FIG. 8 a linear resistor 340 is secured to plate 150 by any convenient means as, for example, straps 342 and 344. A slidable resistor arm 346 passes through the resistor 340 and is secured to the vertical support plate 292. The upper portion of the vertical support plate 292 serves as the guide for the right side of the panel as it is loaded on the loading bar 148. In loading a panel, after the left side of the panel is positioned adjacent the left side quide wall 244 whose position is fixed, the slidable assembly on which clamp 168 is mounted is moved by the operator so that the vertical plate or guide wall 292 touches the right-hand edge of the panel 120.

When the vertical plate or guide wall 292 is moved, the resistor arm 346 is likewise moved and when the wall 292 is touching the right-hand edge of the panel 120, a value for the resistor 340 will be set for that panel.

When the loading bar 148 is rotated, so that the bottom of support plate 150 faces upwardly, side clamps 210 and 212 will close and the process will stop. Since the presser feet 228 and 252 are retained on spring arms 226 and 250, the rotation of the assembly and springiness of arms 226 and 250 will tend to pull the header portion tight. While the process is stopped, it may be necessary, however, that the side clamps 210 or 212 be opened so the header portion 124 may be flattened or otherwise treated. In order to accomplish this, air valve overrides 350 and 352 as shown in FIG. 8 are provided for side clamps 210 and 212, respectively. Each is a conventional air line bypass valve 352 operated by a drive rod 354 which is held in an extended position by spring 356. When the rod is pushed in, the air supply to the respective cylinder is cut off and the cylinder drive rod is withdrawn back into the cylinder, opening that particular side clamp. When the operator releases the rod 354, air is restored to the cylinder and that side clamp will again close on the fabric.

As an optional feature, means to stretch the header can be provided. Referring to FIG. 8 an air cylinder 360 can be mounted by straps 362 and 364 on plate 150 behind the lineal resistor 340, so that the cylinder drive rod 366 will contact the mounting bracket 302 for clamp mechanism 168. Since clamp mechanism 168 will slide, the activation of cylinder 360 would force the drive rod 366 against bracket 302, thereby pushing the slidable clamp mechanism 168 away from the other clamp mechanisms 162, 164 and 166, thus stretching the header. Since the stretching should only occur when the panel was clamped in the loaded bar 148, the air for stretch cylinder 360 would be tapped off the air line that feeds cylinders 400 and 402 mentioned hereafter.

Figure 10:
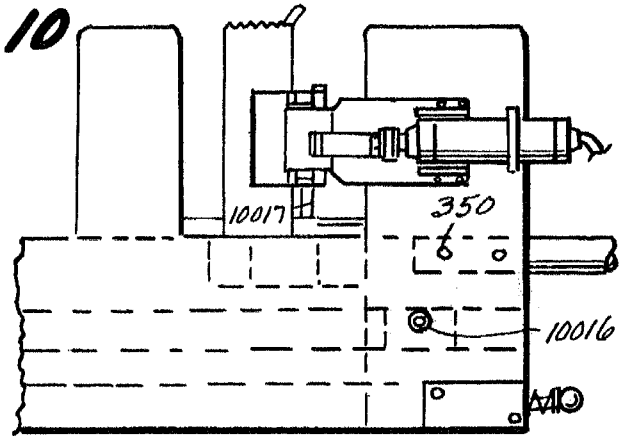
FIG. 10 is a fragmentary plan view of the underside of one end of the loading bar.

When the operator is satisfied that the header portion 124 is correctly formed, the start/run pushbutton 10016 shown in FIGS. 10 and 12 is pressed by the operator and the process will continue automatically thereafter unless stopped by the operator or by a thread break.

As shown in FIG. 2, the loading bar 148 can also be provided with guides 370 which are secured to the front of housing 160 so as to help guide the panel into the clamping mechanisms.

As shown in FIGS. 5–7 the movable upper portion 144 is slidingly mounted on the lower portion 138 by being mounted to two sets of front and rear bearing blocks 370 and 372, respectively, which are provided with internal lineal bearings 373 which are slidingly retained on right and left transfer rails 374 and 376, respectively. The transfer rails are mounted by any convenient means, such as by bolts 378, to the lower assembly frame 140 by support plates 380.

Turning now to FIGS. 6 and 7, the movement of the upper portion 144 of the loading assembly is controlled by cylinders 400 and 402 pivotally mounted to the loading assembly frame 140 by means of cylinder mounts 404 and pins 406. Cylinders 400 and 402 drive similar linkages on opposite sides of the loading assembly and for descriptive purposes, the right-hand side linkage is hereafter described. In addition, air ports 401A and 401B and 403B are shown which will be used respectively to connect the cylinders 400 and 402 to the 80 psi air source through controller operated valves SV-8 and SV-10. The cylinder drive arm 408 is pivotally attached to the driving pivot link 410 by means of a connecting link 412 and pin 414.

The driving pivot link 410 is rotatably mounted to the loading assembly frame 140 by means of a bearing block 416 bolted to frame 140 by bolts 418. A shaft 420 is rotatably secured within bearing block 416 and the driving pivot link 410 is secured to shaft 420 by means of a key and key slot, not shown. Also secured to shaft 420 by means of a key 422 in key slot 424 is the loading bar transfer link 426 which is in turn connected by pin 428 to the loading bar transfer drag link 430.

As indicated above, transfer rails 374 and 376 are mounted on opposite sides of the loading assembly frame 140 by means of support plates 380 and extend along the sides of frame 140. The movable upper portion 144 of the loading assembly 102 is mounted to the bearing blocks 372 and 374 such as by welding to the upper movable portion frame 145. However, the bearing blocks 370 and 372 could also be bolted or otherwise secured to frame 145. The rear bearing blocks 372 are provided with a thrust pivot pin 432 which is rotatably secured to the transfer drag link 430.

At the end of the transfer motion when the panel is transferred from the loading assembly to the loop-forming assembly, it is of course important that the remaining portion of the drape be deposited in the opening provided between the loading assembly 102 and the loop forming assembly 104 generally indicated at 434 in FIG. 1. To accomplish this, a tail roller 436 which extends the full width of the loading assembly frame 436 is provided. The tail roller is needed, however, only when the drapery panel is secured in the loop-forming assembly. Therefore, in order for the upper portion of the loading assembly 144 to be moved rearwardly toward the loop-forming assembly 106, it is essential that the roller 436 be in its lowered position as shown in FIG. 7. The roller 436 is rotatably secured in a roller elbow link 438 which is rotatably mounted to bearing block 440 by means of a shaft 442. The roller elbow link 438 is under the control of cylinders 400 and 402 on the respective sides of the loading assembly and driving pivot link 410. The tail roller transfer link 444 is rotatably attached to the opposite end of the driving pivot link 410 by means of pin 446 and the roller transfer link 444 in turn is rotatably attached by means of pin 448 to the roller driving pivot link 450. The roller driving pivot link 450 is rotatably mounted to frame 140 by means of a mounting pin 452 and bearing means 454. Attached to the driving end of the roller driving pivot link 450 is a cam follower 456 which slidably engages camming slot 458 provided in the roller elbow link 438. FIG. 6 shows the loading assembly 162 in its load position with the cylinder driving arm 408 in its extended position. In this mode the driving pivot link 410 has been moved in a counterclockwise direction which serves to rotate the loading bar transfer link 426 in a counterclockwise direction forcing the movable upper portion 144 toward the front of the loading assembly. Likewise, the tail roller transfer link 444 is moved in a downward direction which causes the roller driving pivot link 450 to also be moved in a counterclockwise direction pulling the cam follower 456 to the bottom of cam slot 458 which causes the roller elbow link 438 to likewise move in a counterclockwise direction which assures that the tail roller 436 will be at its highest position directly behind the loading bar 148. As shown in FIG. 7 when the cylinder 400 is energized so that the cylinder driving arm 408 is retracted into cylinder 400 the driving pivot link 410 will be caused to move in a clockwise direction which causes the loading bar transfer link 426 to also move in a counterclockwise direction and causes the tail roller transfer link 444 to move upwardly. When the loading bar transfer link 426 is rotated in a clockwise direction the transfer drag link 420 is caused to move rearwardly, and since the transfer drag link 430 is rotatably attached to the transfer bearing block 372, the upper portion of the loading assembly 144 will likewise be caused to move in a rearward direction toward the loop assembly 104.

Because the tail roller transfer link 444 has been caused to move upwardly the roller driving pivot link 450 will be caused to pivot in a clockwise direction about shaft 452 as was the driving pivot link 410. The cam follower 456 will likewise move in a clockwise direction and it will move in the cam slot 458 which causes the roller elbow link 438 to pivot in a clockwise direction about shaft 442. Since one end of the roller elbow link 438 is fixed to the bearing 440, movement of the roller elbow link 438 in a clockwise direction will cause the outer portion securing the tail roller 436 to rotate in a clockwise direction about shaft 442 so that at the end of its rotation the tail roller 436 will be in a lowered position as shown in FIG. 7, out of the path of the upper movable portion 144.

Turning now to FIGS. 6 and 8 the shaft 202 on the right side of the loading bar 148 has a driving gear 460 affixed to the right end. Driving gear 460 is in drivingly engaging contact with eccentric gear 462 and is held on a shaft 464 by means of a key 466. The other end of shaft 464 is journalled through the side wall 465 of the movable upper portion 144 and is rotatably mounted in a bearing block (not shown), which is in turn secured to the frame for the upper movable portion 144 of the loading assembly. Also affixed to the shaft 464 is a plate 470, the bottom end of which is formed as a clevis and into which a connecting link 472 is secured by means of pin 474. Secured to connecting link 472 is the driving rod 476 for an air cylinder 478 which is mounted to the upper movable portion 144 by means of a cylinder mount 480. cylinder 478 is provided with air ports 479A and 479B for connecting cylinder 478 to the previously mentioned air source through the controller actuated valves SV-4 and SV-5. Thus, the rotational positioning of the loading bar 148 is under the control of cylinder 478 and the respective gearing drive train which consists of the gear 460 and 462.

As shown in FIG. 6 with the drive rod 476 at its most inward position within cylinder 478, the driving gear 462 and plate 470 have been rotated in a clockwise condition which drives the gear 460 in a counterclockwise position and thus causes the loading bar 148 to be in its normal load position with the clamp mechanisms 162, 164, 166 and 168 exposed to the top of the loading assembly.

When cylinder 478 is activated, the drive rod 476 moves outwardly away from cylinder 478. When this occurs the plate 470 will be moved in a counterclockwise direction as will shaft 464. The eccentric gear 462 being likewise secured to shaft 464 will be caused to move in a counterclockwise direction which will in turn drive the loading bar gear 460 in a clockwise direction thus causing the loading bar 148 to likewise move in a clockwise direction. Thus, the position of the loading bar will be as shown in FIG. 7. Since the drapery panel 120 was held by clamp mechanisms 162, 164, 166 and 168 against the support plate 150, the rotation of the loading bar will cause a fold in the drapery panel to be produced which fold will comprise the header portion 124 of the drapery panel 122.

The tail roller 436 is mounted on the roller elbow link 438 by means of a shaft 482 which in turn is secured by means of a key slot (not shown) or any other appropriate device to a geared pulley 484. A second geared pulley 486 is provided at the most forward portion of the roller elbow link 438 and a gearing belt 488 runs between the pulleys 484 and 486. The pulley 486 is powered by belt 490 which in turn is connected to a geared pulley 492 affixed to shaft 442. The pulley 492 is in turn operated by means of a geared belt 494 which is secured about a gear belt pulley 496 which is affixed to the motor shaft 498 of the motor 500. The motor 500 is mounted on the loading assembly frame 140 by means of any conventional motor mount such as the one shown at 502.

Referring to FIG. 5 optional pressure rollers 504 can be provided to engage the tail roller 436. The pressure rollers 504 are each affixed on each end of the load assembly to a spring loaded link 506 which is itself secured to a bracket 508 which is rotatably mounted on braces 510 and 512 mounted on the right and left sides of the loading assembly, respectively, by means of pins 514. Braces 510 and 512 are in turn connected to the front of the loading assembly such as to the front support plates 380 by means of bolts 516. Braces 510 and 512 and the pressure roller 504 will not need to be rotated out of the path of the upper movable portion 144 of loading assembly 102 since braces 510 and 512 support the pressure roller 504 high enough so that there is sufficient clearance for the upper movable portion 144 to pass underneath.

Also shown in FIG. 1 is a conveyor 518 between the load and loop-forming assemblies. The conveyor 518 is only as long as the load assembly is wide and is comprised of an endless belt 520 supported at each end by rollers 522 and 524. The rollers are in turn supported on shafts 526, 528, respectively, while shafts 526 and 528 are rotatably mounted in angle irons 530 and 532 as shown in FIG. 7. The shaft 528 is drivingly connected to motor 534 by any conventional means such as a gear box 536. On each side of the conveyor 518, trays 538 and 540 are provided to receive the tail of the panel being conveyed. The conveyor 518 is only as wide as the loading assembly since the motor 534 is alternately operated to convey the tail of the panel in the same direction the panel is moved by the overhead transfer unit. Thus, a drapery panel once conveyed to the right or left much not remain on the conveyor or it will be moved in the reverse direction the next time the conveyor is moved in that opposite direction. Therefore, the conveyor will serve to move the tail of the drapery panel into one of the trays 538 or 540.

The loading assembly is the first operational step in the pleating operation and when the start button 10017 is activated the automatic sequencing of the pleating machine will be initiated. After the clamp mechanisms 162, 164, 166 and 168 have secured one layer of fabric and the buckram, the loading bar 148 will be rotated 180° so as to fold the top hem in the panel. The sides of the top hem are then gripped and will be slightly pulled as the drapery panel is advanced to the next operation so as to ensure a full width extension by means of the side clamps 210 and 212. The process is stopped beforehand to allow for an operator check. Subsequently, the start/run pushbutton 10016 is depressed and the upper portion of the loading assembly 144 is moved in a rearward direction toward the loop-forming assembly until the position as shown in FIG. 7 is reached. As the loading assembly 144 advances, the top hem is slightly pulled to eliminate possible wrinkles. In this position the header portion of the drapery panel will be positioned directly over the looping assembly and will thus be in position to have the panel transferred from the loading assembly 102 to the loop-forming assembly 104.

LOOP-FORMING ASSEMBLY

Figure 14:
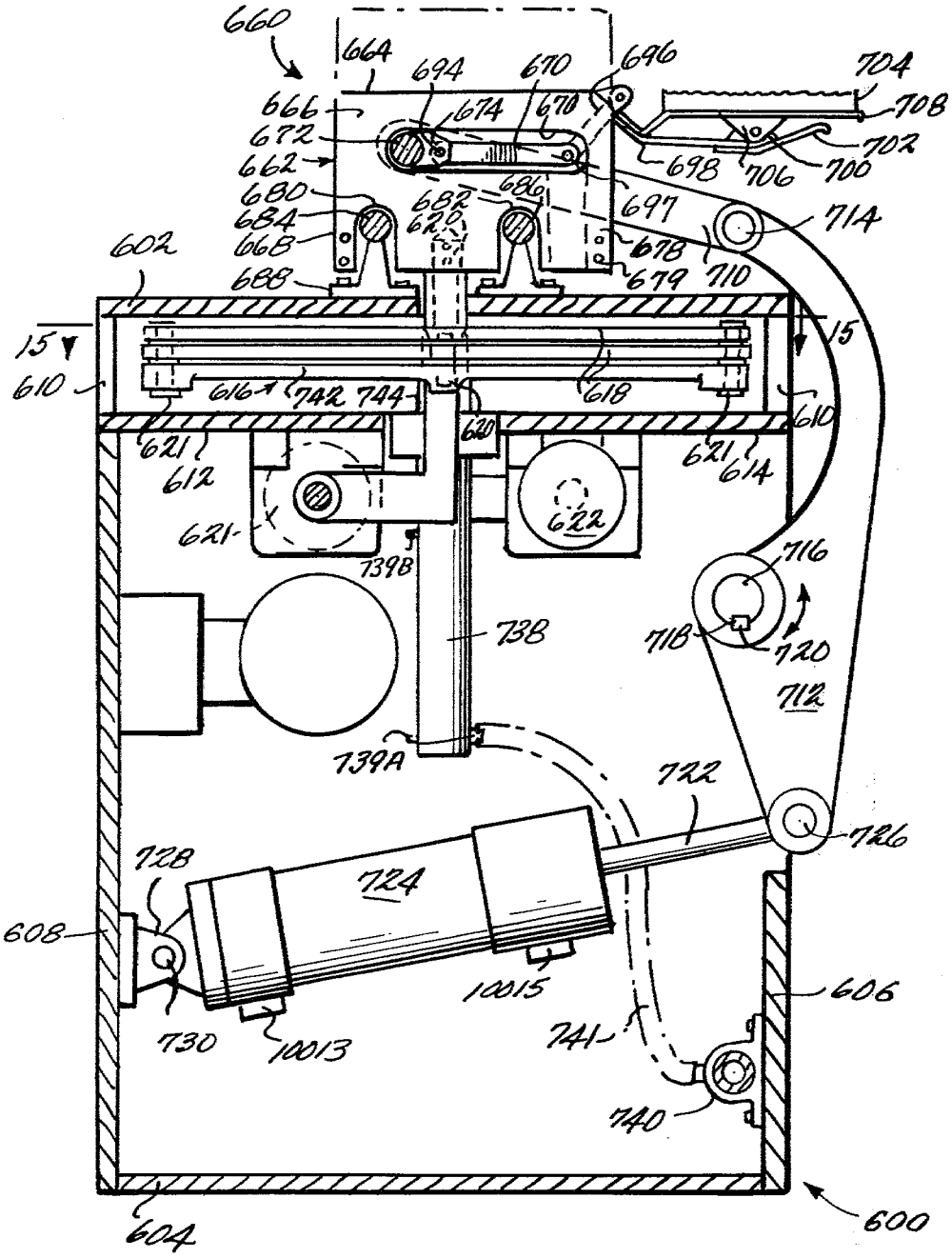
FIG. 14 is a vertical section through the loop forming assembly.

Reference to FIG. 2 will show that the loop-forming assembly 104 is positioned directly behind the loading assembly 102. As shown in FIG. 14 the loop-forming assembly is comprised of a internal frame 400, a top support wall 602, a bottom plate 604 and right and left end plates 606 and 608, respectively. Secured to the top support plate are a series of spacer plates 610 and secured to these are front and rear support plates separated just below the top support plate and identified as 612 and 614, respectively.

Figure 15:
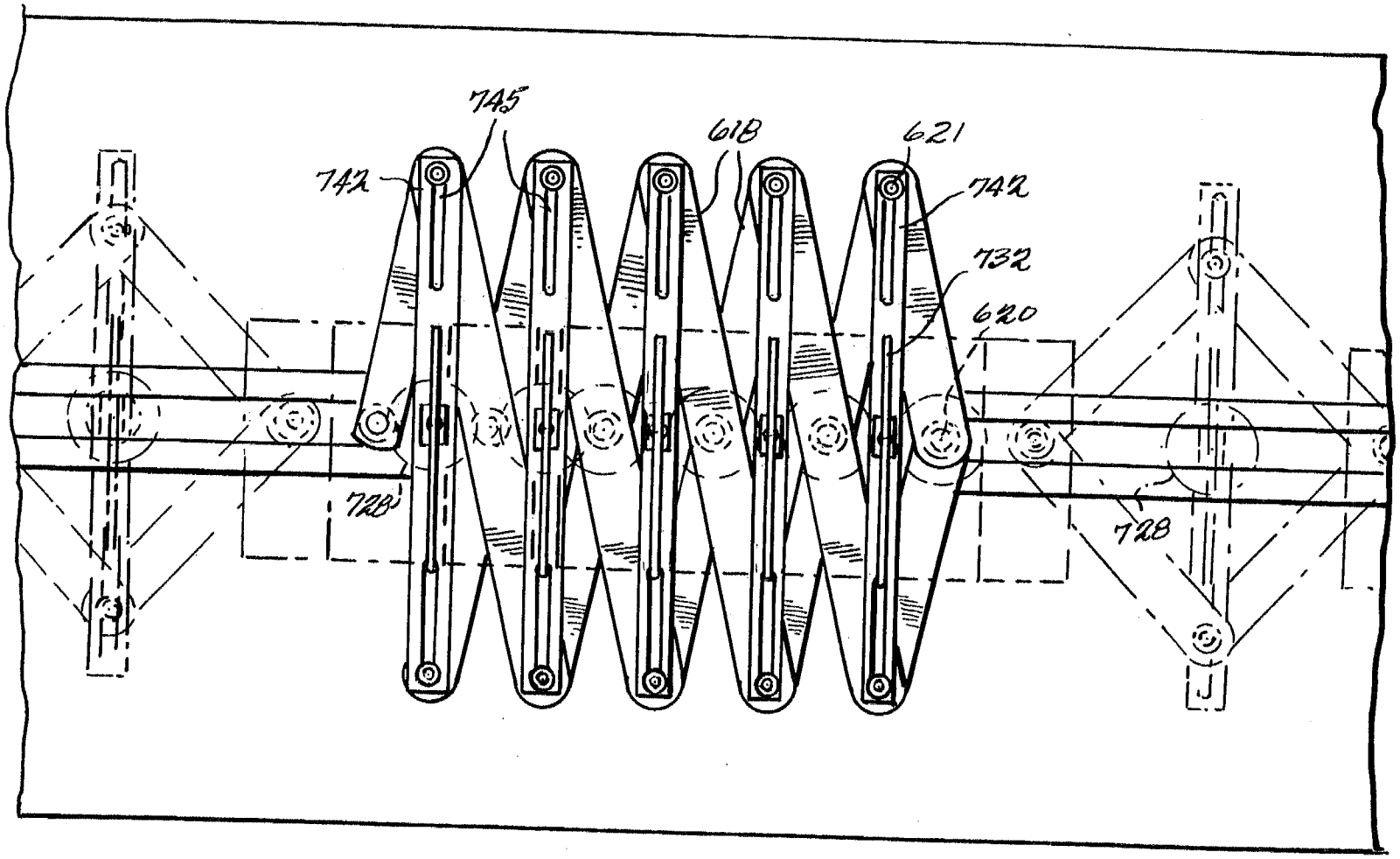
FIG. 15 is a sectional plan view of the scissors assembly in the loop forming assembly taken substantially along the line 15—15 of FIG. 14.

The front and rear support plates 612 and 614 are separated by a space of about two inches and are likewise spaced from the top plate 602 about two inches. Located within the space between the front and rear support plates 612 and 614 and the top plate 602 is the expander scissors assembly 616 which assembly is commonly referred to as a set of lazy tongs. As shown in FIG. 15 the scissors assembly 616 is comprised of a series of scissors arms 618 which are secured together by means of center scissors pins 620 and side pins 621.

Figure 17:
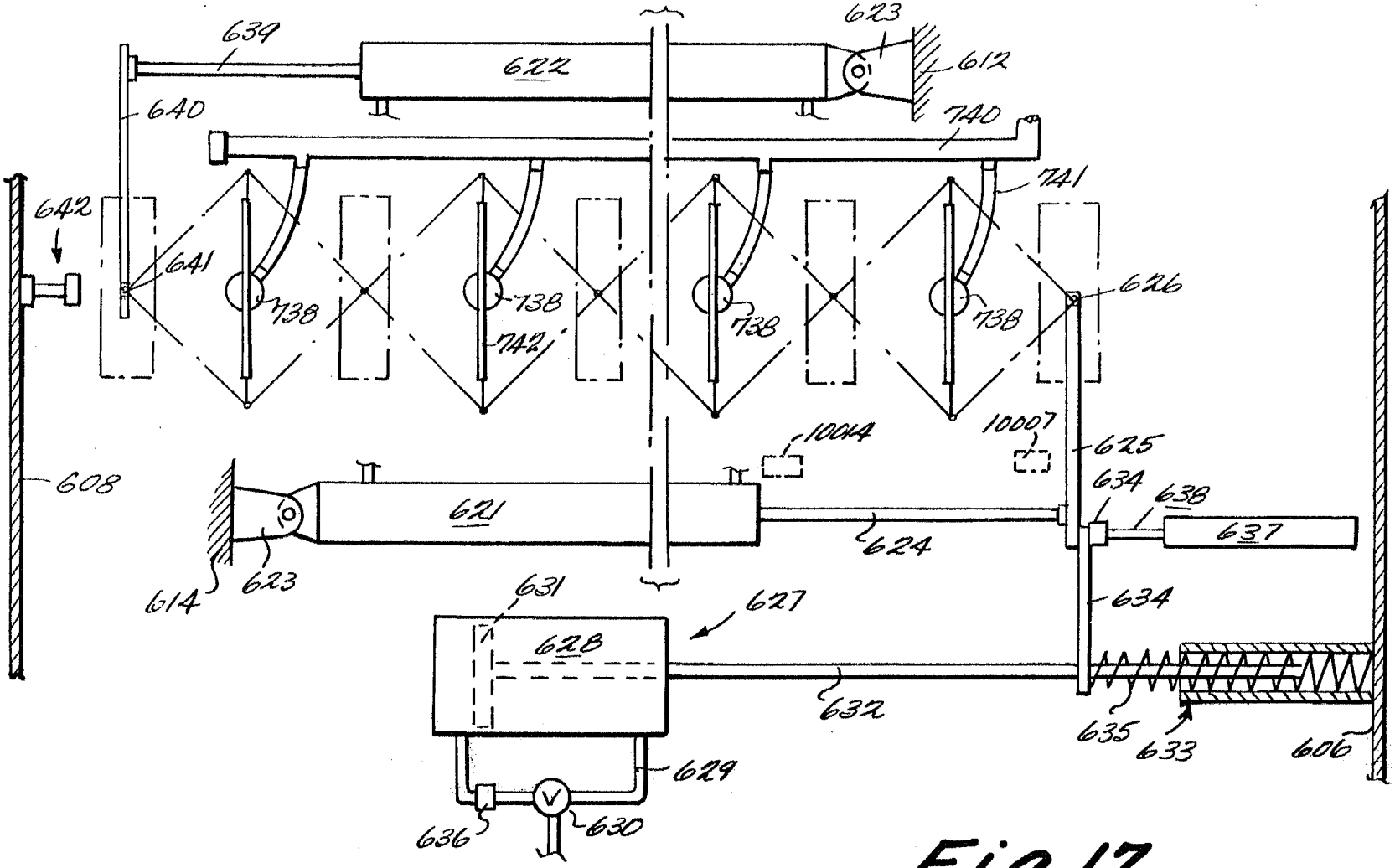
FIG. 17 is a diagrammatic showing of the scissors assembly actuating and stop mechanism.

The expanding and contracting of the scissors assembly 616 is controlled by two cylinders 621 and 622, as shown diagramatically in FIG. 17. Cylinder 622 is secured to the front support plate 612 by suitable support means such as brackets 623, while cylinder 621 is mounted on the rear support plate 614 by similar brackets 623.

Cylinder 621 has a drive rod 624 which has a drive lug 625 attached to the forward end thereof which is attached to the right end scissor pin 626. Mounted beneath cylinder 621 is a hydraulic stop device 627 which is comprised of a hydraulic fluid reservoir 628, a by-pass flow line 629 having a solenoid operated valve 630 in line therewith. A piston 631 located within the reservoir 628 is connected to a drive shaft 632 which slides within a guide device 633 mounted on the right end plate 606. A drive lug 634 is secured to shaft 632 and spring 635 extends between drive lug 634 and the end plate 606. Spring 635 acts as a return device for drive shaft 632 when the air cylinder retracts or closes the scissors assembly. An optional flow control device 636 can be placed in the by-pass line 629 to allow for control over flow rates.

The drive lug 634 also serves to adjust the linear resistor 637 by moving the resistor shaft 638 which is fixed to drive lug 634.

Another scissors drive cylinder 622 has a drive rod 639 which is connected to a drive lug 640 to which the left end scissor pin 641 is rotatably attached. A fixed stop 642 is mounted on the left end plate 608 and will stop the left end of the scissors assembly 616. The stop 642 is also aligned with the guide wall 244 on the left side of the loading bar 148.

As pointed out hereinbefore, it is essential that the pleats be uniformly spaced across the width of the completed panel. This problem is compounded since the panels tend to be of varying widths, usually between 39 and 42 inches. Previously, operators have had to measure the panel prior to performing any pleating functions thereon so as to be able to determine where individual pleats should be formed along the width of the fabric. The movable guide wall 292 and loop clamp assembly clamp mechanism 168 together with linear resistor 637, the scissor cylinder 671 and reservoir 628 are part of a width measuring system which is built into this pleating machine.

Figure 39A:
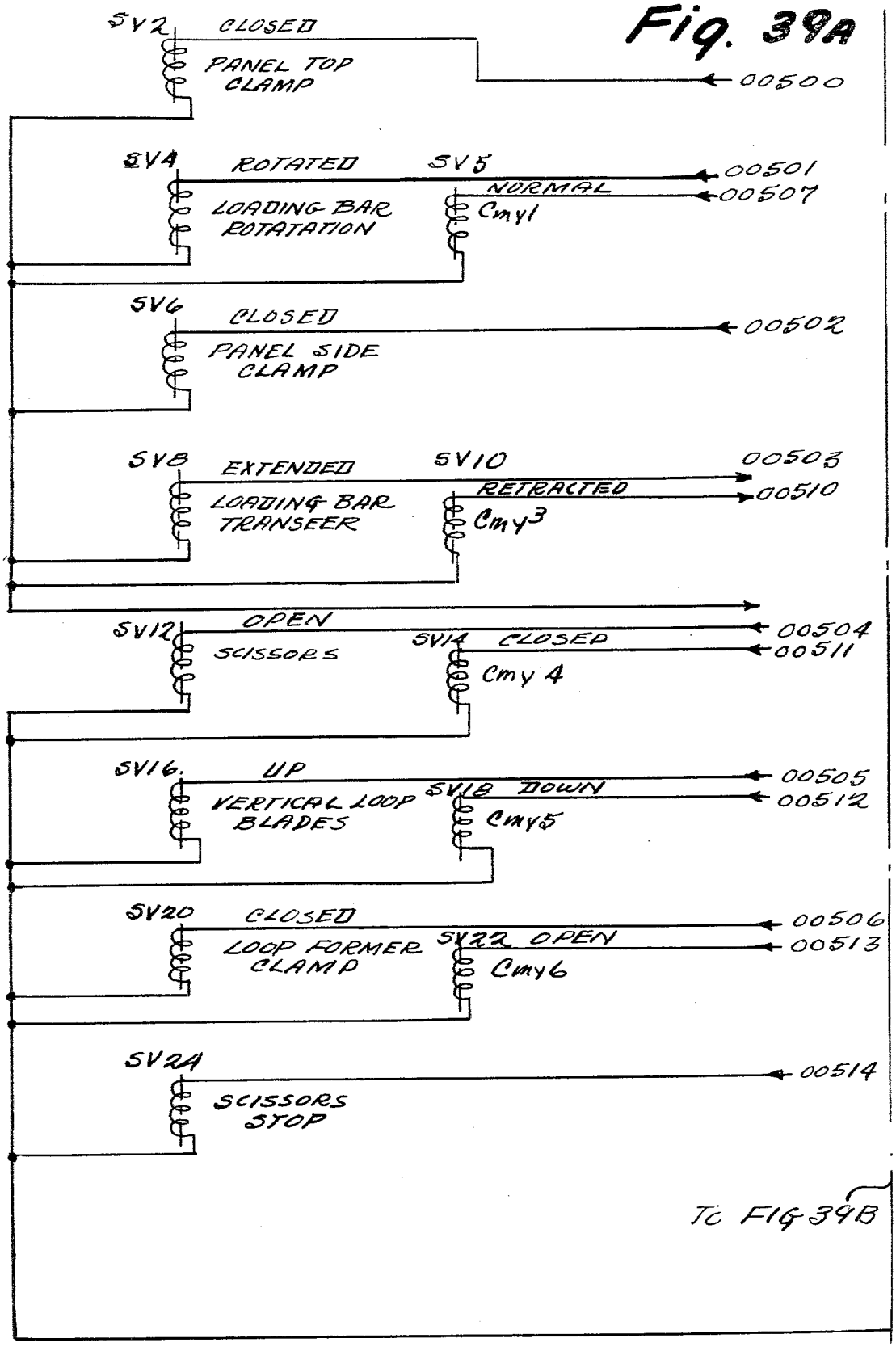
FIGS. 39A and 39B show the load and loop forming control circuits.
Figure 39B:
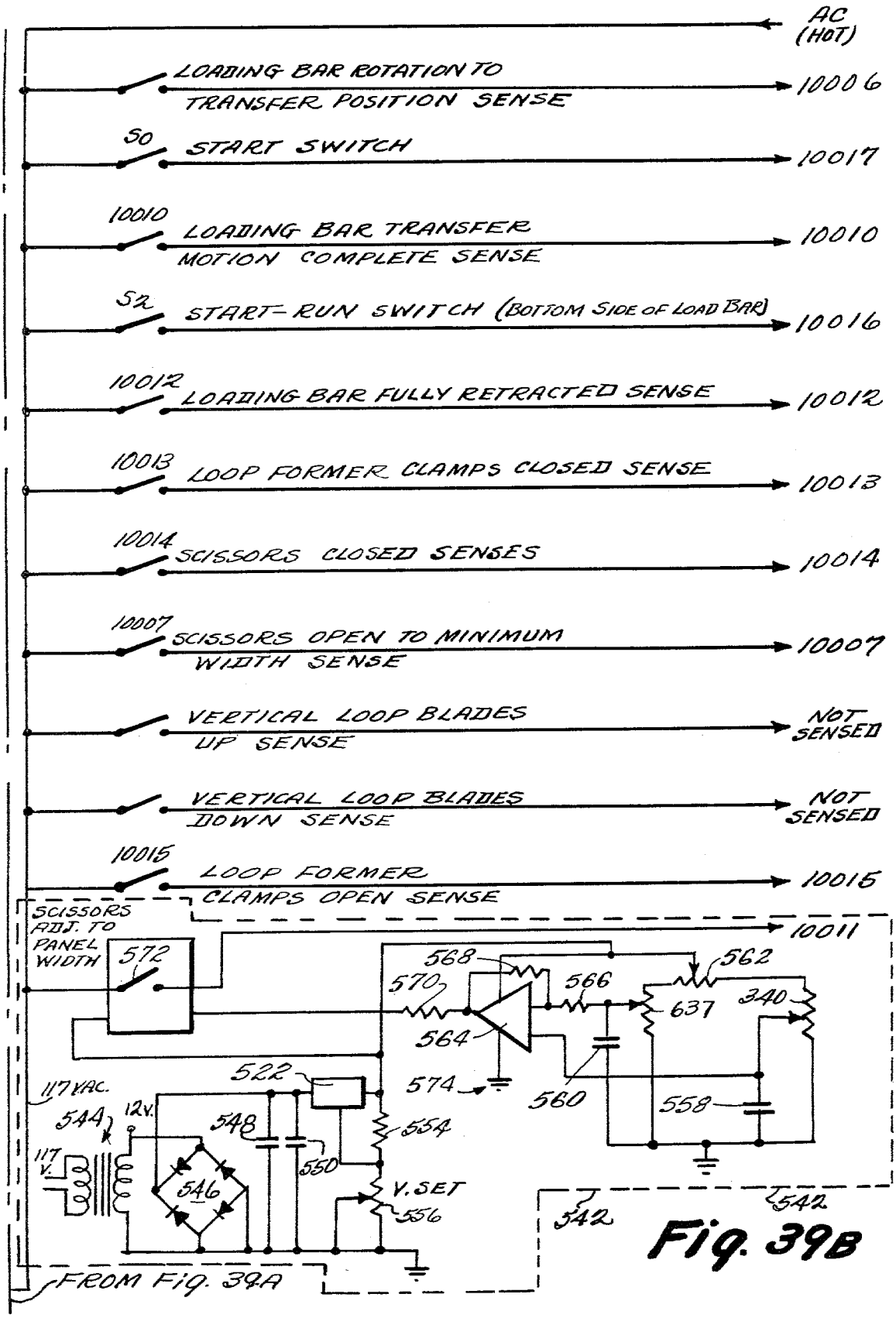

Referring to FIG. 39B a width measuring circuit is located within the dotted line box 542. The circuit itself is comprised of a transformer 544 which transforms the 117 volt input to a 12 volt output operating current for this circuit. A full wave bridge rectifier 546 provides a DC output to power the circuit and capacitors 548 and 550 are in parallel with the bridge 546 and serve to filter the output from the full wave rectifier 546. Capacitor 548 is a 1500 microfarad capacitor while capacitor 550 is a 0.22 microfarad capacitor.

The voltage regulator 552 is connected to the output side of the bridge 546 and serves to provide a steady-state voltage to the system. A 300 ohm resistor 554 and a 1,000 ohm potentiometer 556 are provided to control the necessary voltage for the remainder of the circuit. Preferably, the voltage regulator is set to provide 15 volts to this width measuring circuit.

The measuring function of this circuit is provided by the two 500 ohm/in linear resistors 340 and 637, respectively, and each has 0.1 microfarad filter capacitors 558 and 560 in line therewith together with a variable 200 ohm resistor 562. In order to provide a suitable signal, a solid-state operational amplifier 564 is provided in a resistor network comprised of resistors 566, 568 and 570.

The operational amplifier 564 controls the activation of a suitable switch 572 which can be a relay or a solid-state device such as an SCR or a triac. When switch 572 is turned "on" the controller will see the input signal 10011 that the scissor adjustment is correct and will accordingly by output signal 00514 close the solenoid operated valve 630 in the flow line 629 of the hydraulic stop device 627.

The linear resistors 340 and 637 are each 500 ohm/in resistors having a four inch stroke. The linear resistor 340 is set by the operator when the laterally movable wall 292 is positioned against the right corner of the drapery panel. Therefore, the resistance value of linear resistor 340 is established for a particular panel when the wall 292 is moved or adjusted for the proper width of that drapery panel then being loaded onto the machine by the operator.

Linear resistor 637, on the other hand, is set when the shaft 638 is moved by the drive lug 625 and in turn by scissor cylinder 621.

Until the value of resistors 340 and 637 are equal, the operational amplifier 564 will connect the current path through to ground indicated at 574. When the resistance values equalize, the amplifier 564 will change state and allow flow through switch 572 thereby effecting the stopping of further opening of the scissor assembly 616.

The loops which are formed in the drapery panel are formed by means of loop clamps 660. Six such loop clamps are shown as presently being used in FIG. 2, which allows the production of a standard width panel of about 25 inches, plus or minus about half an inch, having five pleats evenly spaced across the top. It should be understood, however, that any number of such loop clamps could be used depending only upon the number of pleats that were to be produced along the top of the drapery panel. Applicants have found that the width of 25 inches is approximately an industry standard and is uniquely suitable to producing standard width drapes. Further, finished drapes of such width could be joined together to produce wider drapes if such were desired.

Figure 16:
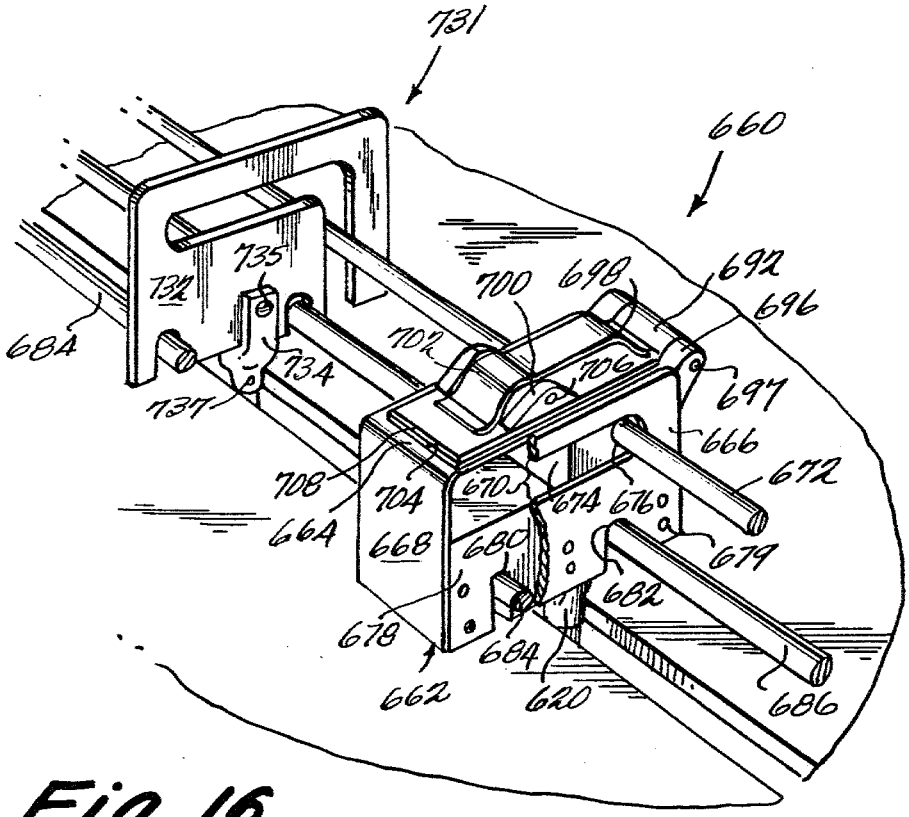
FIG. 16 is a perspective view of the loop forming clamps and loop blades of the loop forming assembly.

Referring to FIGS. 14 and 16, each of the loop clamps 660 is comprised of a housing 662 which consists of a top plate 664, side plates 666 and a front plate 668 which can be joined together in any suitable fashion as, for example, by welding. A slot 670 is provided in each of the side walls so as to receive and direct the movement of a clamp actuating shaft 672.

Located within housing 662 is a sliding block 674 having an internal bearing 676 through which the actuating rod 672 is rotatably mounted. In the bottom portion of housing 662 a bearing block 678 is provided which has two bearing surfaces 680 and 682 for engaging rails 684 and 686, respectively. The rails 684 and 686 are mounted to the top plate 602 by means of rail supports 688 which are spaced out along the length of rails 684 and 686.

The bearing block 678 is secured to the side plates 666 of the clamp housing 662 as by screws 679. In addition, the center scissor connector pin 620 is suitably retained as by a pin (not shown) in the bearing block 678 as shown by the phantom lines in FIG. 14. Thus, the scissors assembly 616 together with the loop clamps 660 are all slidingly supported by rails 684 and 686.

The connecting link 692 is rotatably connected to the sliding block 674 by means of a pin 694 and in turn is rotatably connected to the loop clamp arm hinge 696 as by pin 697. The loop clamp arm 698 is connected to the loop clamp arm hinge as by welding or soldering, such as silver soldering, and the loop clamp top pivot lug 700 is likewise secured to the loop clamp arm 698 also by any convenient method, such as silver soldering. Connected to the top of the loop clamp arm such as by welding or silver soldering is a spring clamp arm 702.

The clamp portion itself consists of a plate 704 to which is mounted a clamp pivot mount 706 by any convenient means such as by screws (not shown) or soldering. Mounted on the opposite side from the pivot mount, which is the side which will come into contact with the loop clamp top plate 664, is a rubber or cork layer 708 which will provide a better gripping surface so that the fabric will not slip once the clamp is engaged.

The clamp arm 698 is actuated as indicated previously when the sliding block 674 is slid rearwardly within the loop clamp housing 662 by means of the actuating rod or shaft 672 by similar sets of actuating linkages at each end of the loop assembly 104. The actuating shaft 672 is rotatably connected on each end to a drag link 710, each of which in turn, is rotatably mounted to a clamp actuating arm 712 by means of a pin 714. The clamp actuating arm is pivotally mounted to the loop assembly frame 600 by means of a shaft 716 which is provided with a keyway 718 into which key 720 is inserted so as to affix the clamp actuating arm 712. The bottom end of the clamp actuating arm 712 is rotatably mounted through a clevis formed in the bottom of actuating arm 712 to the drive shaft 722 of cylinder 724 by a pin 726. Of course, another cylinder 725 is smilarly mounted at the left end of the assembly. The cylinder 724 is in turn mounted to the loop assembly frame 600 by means of a pivot bracket 728 and pin 730. In operation, when the cylinder 724 is actuated by the controller 1920, the cylinder drive arm 722 is moved into cylinder 724 which rotates the loop clamp actuating arm 712 clockwise. The clockwise motion of the clamp actuator arm 712 causes the drag link to move rearwardly as will the clamp actuating shaft 672 which in turn moves the sliding block 674 to the rear of housing 662. As the sliding block 674 is moved rearwardly, the connector link 692 is likewise moved rearwardly which causes the hinge 696 and the loop clamp arm to be rotated in a counterclockwise fashion which serves to move the clamp plate 704 over to meet with the top plate 646 of the loop clamp 660. When the clamp plate 704 is in a fully closed position, as shown in FIG. 16, the rubber or cork pad 708 will be in contact with the fabric, with the fabric lying between the rubber pad and the top plate 664 of the loop clamp 660.

Mounted between each loop clamp 660 is a loop blade assembly generally indicated at 731. Each loop blade assembly is comprised of a loop blade 732 having suitable cut out portions as shown to allow the blade to fit around rails 684 and 686 and rod 672. The blade 732 is connected to a connecting link 734, as by welding or screws 735, which is attached to a cylinder drive rod 736 by pin 737. The drive rod 736 is driven by air cylinder 738 which is provided with air ports 739 which will be connected to an air manifold 740 mounted to frame 600 by flexible hoses 741. The connecting air hoses must be of sufficient length to allow the loop blade assemblies 731 to slide with the scissor assembly 616.

Each loop blade assembly 731 is mounted to a support plate 742 which in turn is mounted on the scissors assembly 616 by pins 621 and snap rings and slide washers 743 as shown in FIG. 15. Each support plate 742 is provided with a mounting collar 744 to which the air cylinder 738 is attached by any suitable means such as screws (not shown). Further, each support plate 742 is provided with slots 745 through which pins 621 extend and in which pins 621 slide. Thus, during expansion and contraction of the scissors assembly 616, the support plate 742 and thus loop blade assembly 731 will be moved uniformly along with loop clamps 660 and be precisely placed between the loop clamps 660.

In operation, the loop-forming assembly 104, serves to form five equally spaced loops along the header portion 1124 of the drapery panel that has been transferred from the loading assembly 102 to the loop-forming assembly 104, with an equal amount of material in each loop from which pleats will subsequently be shaped. The loop former 104 has the ability to handle a variable width panel, as explained hereinabove, usually from 39 to 42 inches in width, as does the loading assembly 102. The scissors assembly 616 will be expanded to a position until the width forming circuit provides a signal to energize the stop solenoid valve 630, with the signal to stop the expansion of the scissors assembly 616 being used on the width of the panel which has just been placed in the loading assembly 102 by the operator. When the loading bar 148 is in position over the loop former 104, the six loop clamps 660 will be closed due to the actuation of cylinders 724 and 725 so as to secure the panel at the base of the loops. Subsequently, the loading bar 148 will be returned to its initial position and the tail roller 436 will come into contact with the remaining portion of the drapery panel 120 and serve to advance the remaining portion of that panel into the space between the load and loop-forming assemblies. Thereafter, the loop-forming clamps 660 are caused to be pulled together by the energization of the air cylinders 621 and 622 in a reverse direction from which they were energized in order to expand the scissors mechanism 616 to its expanded panel receiving position. As the loop-forming clamps 660 are being brought together as the scissors mechanism 616 is closed, the loop blades 732 which are moving together along with the contraction of the scissors mechanism 146, are raised due to the energization of cylinder 736. With the raising of the loop blades 732, the material which is being compressed between the clamp members 660 is being formed into an upright single loop as shown in block 3 of FIG. 4. Once the loop clamps 660 have come to their fully closed position, which will be in the center of the loop-forming assembly 104, the loops themselves being in an upright position are likewise in a position to be secured by the clamps of the overhead transfer assembly and moved on to another station for additional processing.

Turning now to FIGS. 39A and 39B which show the control circuit for the load and loop-forming assemblies 102 and 104, respectively, there are two portions of this circuit with which we are now concerned since the width measuring circuit shown in the dotted line box indicated at 542 was previously discussed.

In the output portion of the circuit, as shown in FIG. 39A, the solenoids SV-2 through SV-24 control the actuation of the air cylinders discussed previously within the discussions for the load and loop-forming assemblies.

The output 00500 controls solenoid valve 2 which controls the actuation or the connection of the panel top clamp mechanisms 162, 164, 166 and 168 and, more specifically the air cylinders 170 and 300. Each one of these cylinders is controlled by this one solenoid-operated air valve. When the solenoid is operated by the controller 1920 the valve will be moved so as to connect the air cylinders 170 and 300 to the 80-lb/square inch supply of air, thereby closing the clamp mechanisms 162-168. When the output signal 00500 is removed, a spring within the air cylinders 170 and 300 (not shown) will return the plunger and thus the respective drive rods to their initial open position, thus causing the clamp mechanisms to open.

The outputs 00501 and 00507 respectively actuate solenoid air valves SV-4 and SV-5, with SV-4 controlling the rotation of the loading bar 148 by actuating air cylinder 478 with solenoid SV-5 controlling the return of air cylinder 478 to its normal position such that the loading bar 148 would be unrotated. Thus the air valve 478 is under positive control by the controller both for its being actuated to cause the rotation of the loading bar 148, and likewise its actuation causing the return of the loading bar 148 to its normal load position. This latter signal is referred to in the program which follows as function CMY1.

Output 00502 from the controller causes the solenoid-operated air valve SV-6 to be actuated which causes the closing of the panel side clamps 234 and 266, each being controlled by this one valve. When the output signal 00502 is removed by the controller, a spring in each of the panel side clamp cylinders 234 and 266 (not shown) will cause the cylinder drive rods to return to their normal positions so that the panel side clamps would be opened.

Controller outputs 00503 and 00510 respectively operate solenoid air valves SV-8 and SV-10 which control the actuation of air cylinders 400 and 402 and thereby the transferring of the panel from the loading bar to the loop-forming assembly. The output signal 00503 controls SV-8 and causes the cylinders 400 and 402 to be extended into the transfer position while output 00510 is complementary function CMY3 and causes the air cylinders 400 and 402 to retract from the transfer position to their initial load position. Here again, there is no spring for return purposes either in the air cylinders 400 or 402 nor in the solenoid air valves SV-8 and SV-10. It is important that the transferring motion be under the positive control of the controller both in transferring and retracting modes. Therefore, the return function for the cylinders is kept as a controller function.

The controller outputs 00504 and 00511 respectively control solenoid air valves SV-12 and SV-14 which respectively control air cylinders 621 and 622 and thus the opening and closing of the scissors assembly 616. Output signal 00504 causes the actuation of the solenoid valve SV-12 which causes the scissors assembly to be opened, while output signal 00511 causes actuation of solenoid valve SV-14 or the complementary function CMY4 which causes the air cylinders 621 and 622 to close the scissors assembly 616. Here again it is desirable to have the cylinders 621 and 622 under positive control of the controller both for their initial actuation causing the cylinder drive rod to extend and for the return of the cylinder drive rod causing the closing of the scissors assembly 616.

Output signals 00505 and 00512 respectively control solenoid air valves SV-16 and SV-18 which respectively control the actuation of air cylinder 638 and thus the movement of the loop blades 732. Output signal 00505 causes the solenoid valve SV-16 to move the vertical loop blades into their up or raised position, while output 00512 causes the return of the drive rod into cylinder 638, which is complementary function CMY5, which returns the loop blades down to their initial position.

Controller outputs 00506 and 00513 respectively control solenoid air valves SV-20 and SV-22 which control the actuation and return of air cylinders 724 and 725 which respectively open and close the loop clamps 660. The output signal 00506 causes the solenoid valve SV-20 to be actuated which causes the cylinders 724 and 725 to extend their respective drive rods, closing the loop clamps 660 while the complementary function CMY6 or output 00513 actuate solenoid air valve SV-22 which causes the drive rods and cylinders 724 and 725 to return to their initial unretracted position so as to open the loop clamps 660.

The controller output 00514 controls the solenoid valve SV-24 which is the same as solenoid valve 630 which controls the stopping of the scissors in response to the width circuit previously discussed. The output signal 00514 causes the solenoid to close which prevents further flow of hydraulic fluid through the bypass line 629 which allows hydraulic fluid to pass from one side of the hydraulic chamber 628 to the other. A spring is provided in the valve so that upon the removal of output signal 00514 the valve SV-24 or 630 will return to its initial position, allowing the valve to open and hydraulic fluid to once again flow.

Turning now to the input side of the load and loop-forming control circuits, the respective switches which provide input signals to the controller are set forth. Beginning at the top of the figure, an AC hot line is provided and the first switch is 10006 which senses the rotation of loading bar 148 into its transfer position. This produces an input I-10006. 10006 is a reed switch which is operated by air cylinder 478 when the air cylinder 478 is in its transfer mode. A magnet is provided on the drive shaft, and when the magnet passes by reed switch 10006, the switch is tripped causing the formation of input signal I-10006.

The start switch 10017 is located on the transfer loading bar 148 and will be actuated by the operator in order to cause the clamping of the drapery panel 120. Upon actuation of this signal, the input signal I-10017 will be produced.

The switch 10010 is located on the bottom of cylinder 400 and is comprised of a reed switch that is operated by a magnet located on the drive shaft for cylinder 400. When the drive shaft is fully retracted into cylinder 400, the reed switch 10010 will be actuated, causing the formation of input signal I-10010 indicating to the controller 1920 that the transfer of the loading bar motion is completed.

The switch 10016, or the start/run switch, is located on the bottom of the loading bar 148 and will be depressed by the operator once she is satisfied that the header portion that has been formed is satisfactory and on being depressed will produce input signal I-10016 to the controller.

The switch 10012 is located on the top of cylinder 400 and when the drive rod is fully extended, which causes the upper movable portion 144 of the loading assembly to be moved forward to its load position, the reed switch 10012 will be actuated by the drive rod and produce input signal I-10012, indicating that the loading bar 148 has been sensed as being fully retracted.

The switch 10013 is located on the rear portion of air cylinder 724 and again is a reed switch that is operated by the drive arm of the cylinder 724. When the drive rod for cylinder 724 is fully retracted into cylinder 724, a magnet attached on that drive rod will activate the reed switch 10013 producing input signal I-10013 to the controller and thus indicate that the loop clamps 660 have been closed.

The switches 10014 and 10007 are actuated by the air cylinder 621 in the loop-forming assembly 104. Both are reed switches, and both are controlled by a magnet attached to the drive arm of cylinder 621. When the drive arm is fully retracted into cylinder 621, the switch 10014 will be activated, producing input signal I-10014 indicating that the scissors assembly 616 is closed, and when the switch 10007 is closed by the extension of the drive rod of cylinder 621, input signal I-10007 will be produced indicating to the controller that the scissors assembly 616 has been opened to its minimum width.

There is no sensing of the vertical loop blades being in either their up or down position, and switch 10015 is also a reed switch which is attached to cylinder 724 and is tripped by a magnet on the drive rod for cylinder 724 when that drive rod is fully extended, thus producing the input signal I-10015 indicating that the loop clamps 660 are opened. As indicated previously, the input signal I-10011 to the controller indicates that the width detection circuit shown in the dotted line block 542 has sensed the linear resistors 340 and 637 as being equal and with thus cause the formation of output signal 00514, stopping further extension of the scissors assembly 616.

OVERHEAD TRANSFER ASSEMBLY

Figure 3:
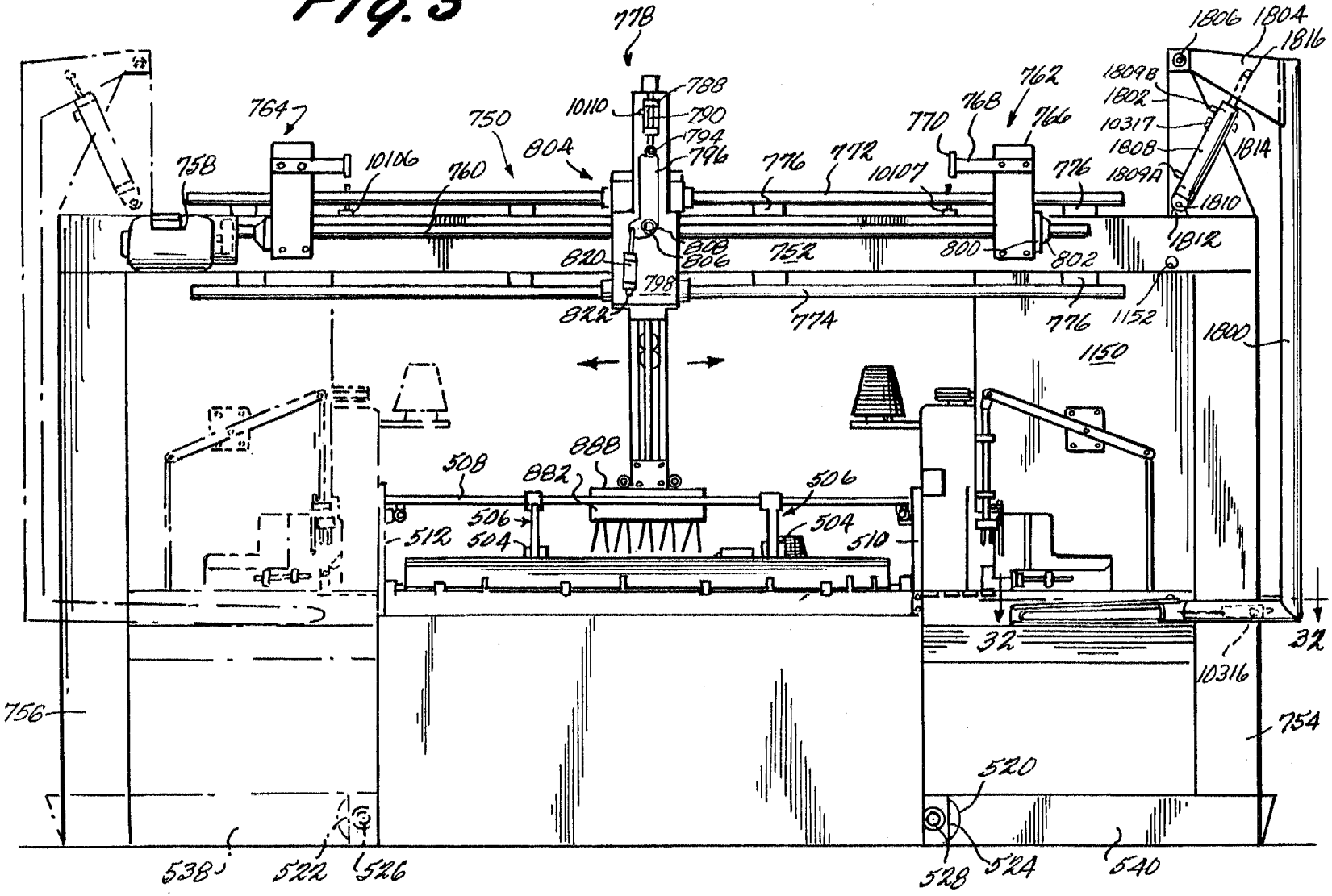
FIG. 3 is a front elevational view of the pleating apparatus.

In discussing the last three sections of this pleating machine, we are concerned with what can be considered as being the rear portion of the pleating machine. Referring to FIG. 3, the pleating stations, the corner sewing station and the overhead transfer assembly are all mounted on the rear frame generally indicated at 750 which is primarily comprised of an overhead beam 752, right and left side beams 754 and 756, respectively, and supporting structures for the pleat and sew stations which will be referred to hereinafter.

Still referring to FIG. 3, a motor 758 is mounted on the upper left-hand portion of the overhead beam 752 and by suitable gearing is connected to the overhead drive shaft 760. Likewise, right and left stopping units for the overhead transfer are also mounted to the overhead beam and are shown at 762 and 764, respectively. Both of these stop units are identical, one merely being the mirror image of the other, and they comprise a mounting plate 766 and a stopping arm 768 to the end of which is affixed a stop lug 770 which can be secured to the stopping arm 768 by any suitable means such as welding or screws. Top and bottom rails on which the overhead transfer unit will traverse are shown at 772 an 774, respectively, and are mounted to the overhead transfer by means of a plurality of railway supports 776.

Figures 18, 19:
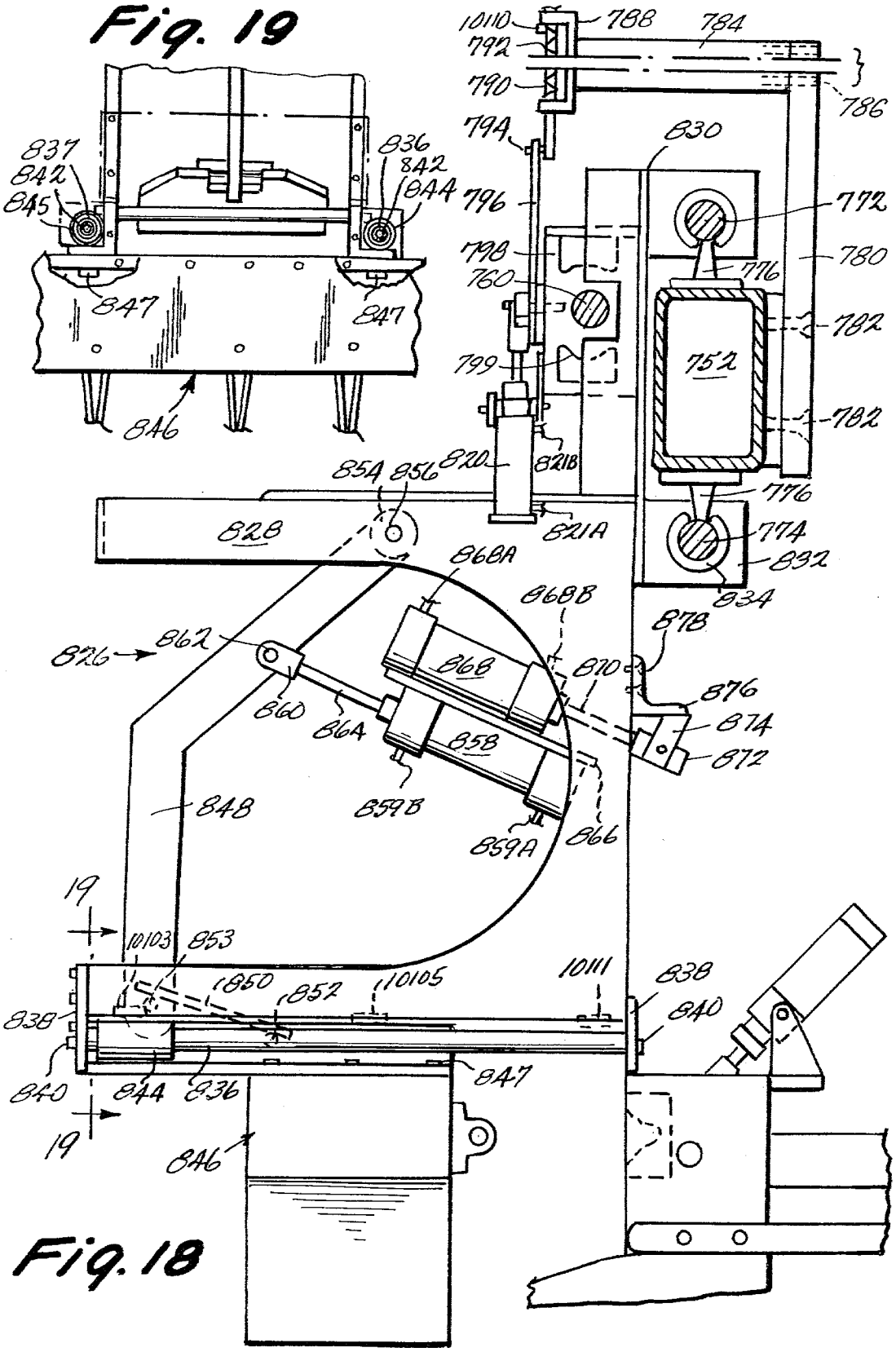
FIG. 18 is a fragmentary vertical section through the overhead transfer assembly of the pleating machine.
FIG. 19 is a vertical section through the overhead transfer assembly taken along line 19—19 of FIG. 18.

Referring both to FIG. 3 and FIG. 18, the centering mechanism 778, serves to stop the movement of the overhead transfer assembly when returning from either one of the pleating stations directly in the center of the machine so that the overhead transfer unit 106 is aligned with both the loop forming assembly 104 and the corner sewing station 108. The centering mechanism is mounted on the overhead beam 752 by means of a vertical support arm 780 and is affixed to the overhead beam 752 by any convenient method such as by screws 782. A horizontal support arm 784 is affixed to the top end of the vertical support arm 780, again by any convenient method such as by welding or screws 786. Welded to the front of the horizontal support arm is a generally U-shaped follower support 788 in which a follower arm 790 is spring mounted so that it will be forced downwardly by spring 792. The follower comprises a roller 794 which will engage the overhead transfer unit into actuating cam arm 796 which is mounted to a housing 798 containing a linear actuator 799 and through which the drive shaft 760 extends. The support plate 766 for the stop arm 768 is mounted to the overhead 752 by means of a mounting plate 800. The mounting plate 800 is provided with an opening through which the drive shaft 760 also extends and bearing means 802 are provided on the mounting plate 800 and serve to rotatably support the drive shaft to the overhead beam 752. Thus, the motor 758 when energized will rotate, cause the drive shaft 760 to rotate through the bearings 802 and through the linear actuator 799 located within housing 798 of the overhead transfer assembly.

The liner actuator 799 is a conventional device, one example being a Textol Linear Actuator Model AA-75-1¼ manufactured by Textol Systems, Inc., Carlstadt, N.J.

Again referring to FIGS. 3 and 18 the conveyor assembly referred to generally at 804, is comprised of the actuating cam 796 which is rotatably fixed to the drive shaft 806 of the linear actuator 799 by means of mounting collar 808 and set screws (not shown). A pivot lug 810 welded to the cam arm 796 and rotatably attached to the pivot lug 810 is a connector clevis 812 by a snap ring 814. The connector 812 in turn is secured to the drive shaft 818 of the cylinder 820 by pin 816. The cylinder 820 is affixed to the overhead transfer frame 828 by means of a mounting bracket 822 and pin 824 and is provided with air ports 821A and 821B which are connected to the air supply (not shown) through controller operated valves SV-36 and SV-38 for left and right movements, respectively.

When the cylinder 820 is energized by the controller, the actuating cam 7 will be rotated either in a clockwise or counterclockwise direction depending on whether a movement to the right or to the left is desired. When the actuating cam is turned, the shaft 806 which is attached to the linear actuator 799 will cause bearings (not shown) located within the linear actuator 799 to be rotated so as to engage the rotating drive shaft 760 thereby causing the overhead transfer unit 106 to move in the direction set by the linear actuator 799 and cam arm 796. When the overhead transfer unit 106 arrives in an aligned position with the right or left pleating station, the stop lug 770 will contact the actuating cam arm 796 and cause the actuating cam arm 796 to again rotate the linear actuator 799 back to its normal position and thus remove the linear actuator 799 from its driving relationship with the drive shaft 760. When this occurs, the overhead transfer unit will stop its transversing motion and will be in correct alignment with the pleating station so that a transfer of the header portion 124 of the drapery panel 120 can be effected from the overhead transfer unit 106 to the pleating station clamps. It should also be pointed out that, when the cylinder 820 is energized, the conveying assembly 124 will likewise be energized so as to move in the same direction as the overhead transfer unit and thus serve to carry the remaining portion of the drapery panel to the correct pleating station.

Turning now to FIGS. 18 and 19, the overhead transfer carriage assembly generally indicated at 826, the carriage assembly is comprised of a transfer frame 828 which in turn is connected to a support plate 830 on which the drive housing 798 is mounted. Mounted to the rear side of the support plate 830 are bearing blocks 832 having bearings 834 located therein. The bearing blocks 832 through bearings 834 are mounted on the rails 772 and 774 and it is on these rails that the overhead transfer unit 106 will move and by which the overhead transfer unit 106 is supported.

Fixed to the bottom of the overhead transfer frame 828 are two rails 836, 837 which are held in place by rail supports 838. The rail supports 838 are secured to the frame 828 by means of screws 840 or by any other convenient method such as by welding. Bearings 842 are slidingly retained on rails 836 and 837 and secured to the bearings 842 on support brackets 844 and 845. A clamp assembly 846 is attached to support brackets as by screws 847.

The bearings 842 are arranged so as to be transversely movable along rails 837 by an actuating drive arm 848 which is affixed to the loop clamp assembly 846 by means of a pivotable plate 850 and rod 852. Pin 853 rotatably secures the pivotal plate 850 to drive arm 848. The loop clamp assembly actuating drive arm 848 is mounted to the upper portion of frame 828 by means of a rotatable clevis 854 and a pin 856. The actuating drive arm 848 is connected to an air cylinder 858 by means of a clevis connector link 860, a pin 862 and the cylinder drive shaft 864. The cylinder 858 is provided with air ports 859A and 859B and is itself mounted to a support plate 866 which is secured to the frame 828 by any convenient means. A second cylinder 868 which is provided with air ports 868A and 868B is also mounted to support plate 866. The drive shaft 870 of cylinder 868 is connected to a clevis connecting link 872 which is connected to a connecting lug 874 mounted to an L-shaped bracket 876 which is attached by screws 878 to the frame 828.

Figures 20, 21:
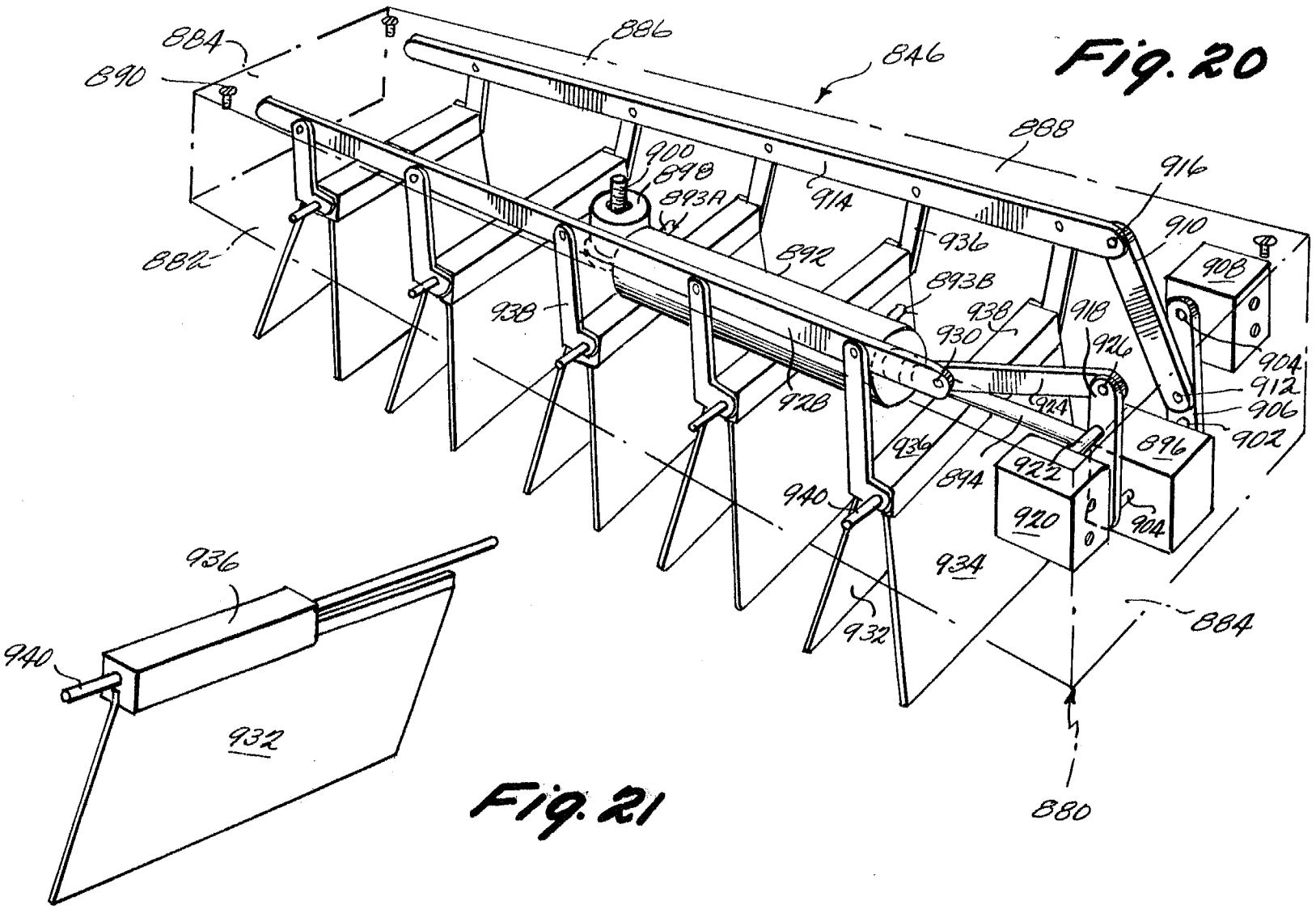
FIG. 20 is a diagrammatic perspective of the loop clamp assembly of the overhead transfer assembly showing the actuating linkage.
FIG. 21 is a perspective view of one of the loop clamp blades.

Turning now to FIGS. 20 and 21 the overhead transfer loop clamp assembly 846 is comprised of a housing structure 880 having a front wall 882, side walls 884, a rear wall 886 and a top support plate 888 which is secured as by screws 890.

Attached to the top support plate 888 of the housing 880 is a cylinder 892 having a driving shaft 894. The drive shaft 894 has a drive lug 896 secured thereto. The cylinder itsef is mounted by means of a rubber bushing-type cylinder mount 898 and screw 900, thus giving the cylinder 892 some ability to rock in its mounting.

The drive lug 896 has two pivot lugs 902 and 904 extending therefrom. Pivot lug 902 is connected to a drive link 906, the top of which is pivotally connected to a mounted block 908 by a pivot lug 909 while block 908 is attached to front wall 882 by screws (not shown). A connecting link 910 is rotatably connected to drive link 906 by pin 912, and a clamp coupling arm 914 is connected to link 910 by pin 916. Pivot lug 904 is rotatably connected to a drive link 918 which is pivotally mounted on mounting block 920 by a pivot lug 922. The drive link 918 is connected to a connecting link 924 by pin 926 with connecting link 924 being connected to coupling arm 928 by pin 930.

A plurality of loop clamps are provided and each clamp is comprised of two blades 932 and 934 which are respectively connected to pivot bars 936 and 938. The pivot bars 936 and 938 are secured together by rod 940 and respectively to coupling arms 914 and 928. The rods 940 are mounted to the front and rear walls 882, 886, respectively, and rods are retained therein as by snap rings (not shown).

When the cylinder 892 is actuated by means of a solenoid valve which is under the control of the controller, the drive lug 896 is moved forward causing the drive links 906 and 918 to be rotated in a clockwise direction. In addition, the connecting links 910 and 924 are likewise moved with link 910 causing coupling arm 914 to move in the same direction as the drive lug while link 924 causes coupling arm 928 to moved in the opposite direction.

This movement by coupling arms 914 and 928 causes pivot bars 936 to be rotated in a counterclockwise direction while pivot bars 938 are rotated in a clockwise direction about rod 940 which causes the loop clamp blades 932 and 934 to be moved toward each other. Reversal of the cylinder would, of course, result in the opposite effect of opening clamp blades 932 and 934.

Figure 40:
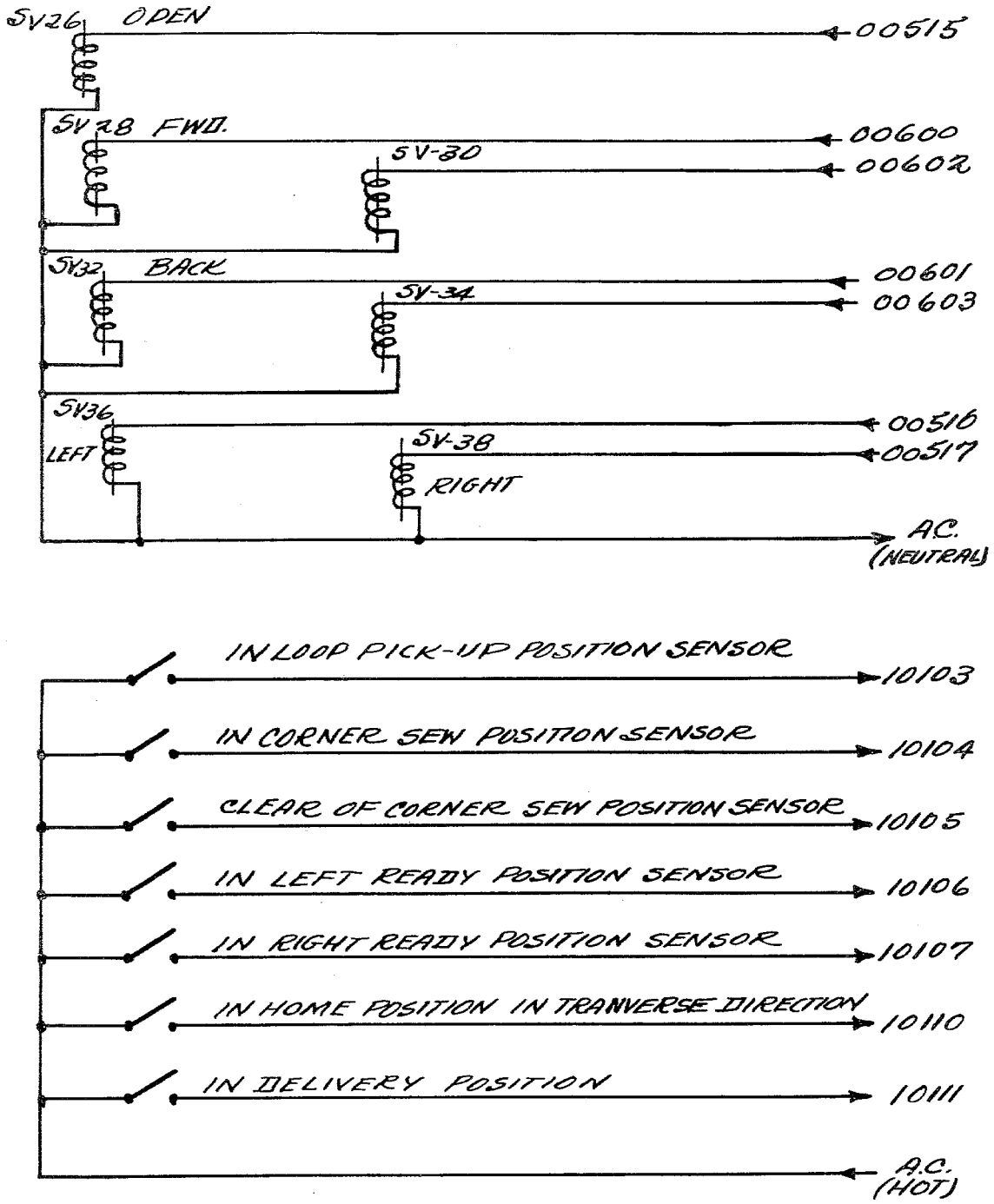
FIG. 40 shows the overhead transfer unit control circuit.

The solenoid operated air valves under the control of the controller which control the operation of the air cylinders associated with the overhead transfer unit 106 are shown in the top part of the circuit diagram in FIG. 40.

Valve SV-26 controls cylinder 892 for opening the pickup clamps, solenoid valve SV-28 and SV-30 control the forward motion imparted to the clamp assembly 846 by cylinders 858 and 868, solenoid valves SV-32 and SV-34 control the backward movement of the clamp assembly 846 caused by the same cylinders 858 an 868 and solenoid valves SV-36 and SV-38, control the movement of the overhead transfer unit 106 to the left and right, respectively, by controlling the actuation of cylinder 820.

Air valve SV-26 is activated by the controller output signal 00515 which causes the air cylinder 892 to be actuated causing the loop blades 923 and 934 to be closed. When the output signal 00515 is removed, a return spring within the valve SV-26 shifts the air flow to air port 893B, which causes the cylinder to be returned to its initial position which thereby opens the loop blades 932 and 934.

The forward motion of the loop clamp actuator drive arm 848, as indicated above, is under the control of air cylinders 858 and 868. The forward movement of cylinders 858 and 868 are, respectively, controlled by output signals 00600 and 00602, which respectively actuate valves SV-28 and SV-30. With valves SV-28 and SV-30 actuated to their forward mode, air will be supplied to inlet ports 859A and 869A which will cause the forward movement of drive arm 848.

The rearward movement of the actuator drive arm 848, and the return of cylinders 858 and 868 is under the control of output signals 00601 and 00603, respectively, which activate solenoid valves SV-32 and SV-34. When valves SV-32 and SV-34 are activated, the air source is changed to air ports 859B and 869B, respectively, which causes the rearward movement of the drive arm 848. The activation of cylinder 868 and the arrangement for closing and opening air ports 869A and 869B is such that when the loop clamp assembly 846 is back in the corner sew position, both air ports 869A and 869B are open so that during the corner sewing indexing motion, the cylinder drive rod 870 will be allowed to index in a like fashion within air cylinder 868.

The activation of air cylinder 820 is controlled by output signals 00516 and 00517, which respectively cause left and right movements with the left movements being controlled by valve SV-36 and right movements controlled by valve SV-38. As was the cause with air cylinder 868, following the initial activation of air cylinder 820, the valves SV-36 and SV-38, after the removal of the respective output signal thereto, will allow both air ports 821A and 821B to be open to the atmosphere so that the actuating cam 796 will be freely movable when that cam comes into contact with the stop assemblies 762 and 764.

In addition, a number of sensors are associated with the overhead transfer unit 106 which provide input signals to the controller. These are set forth in the upper and middle portions of FIG. 3.

Referring to FIG. 3, switches 10106 and 10107 are shown as being mounted to the overhead beam 752 adjacent the left and right stops 564 and 562, respectively. Each is provided with a switch arm which is contacted by the overhead transfer unit 106 as the overhead transfer unit approaches the left and right pleat stations and produce input signals I-10106 and I-10107 indicating to the controller that the overhead transfer unit 106 is in a ready position.

In FIG. 18 six switches are shown and all can be magnet actuated reed switches. Switch 10110 is located so as to be actuated by follower cam 790 and will produce input signal I-10110 when the overhead transfer unit 106 returns to its centered initial position following a traversing movement to either the left or right pleat station. Switch 10104 is located in the latch housing 1052 and is actuated by a magnet located on the rear of the loop clamp housing 880. Thus, when the loop clamp housing moves into its clamped condition in the corner sew area, switch 10104 is tripped producing input signal I-10104 thereby indicating the overhead transfer unit 106 is in the corner sew position.

Switches 10103, 10105 and 10111 are all mounted on the overhead transfer frame 828 as shown in FIG. 18 and will be actuated by the movement of the loop clamp housing 880. Switch 10103, located in the forward part of frame 828, will, when tripped, produce input signal I-10103 indicating that the overhead transfer unit is in the loop pick-up position. Switch 10105, located in the central part of frame 828 will, when tripped, produce input signal I-10105 indicating that the overhead transfer unit is in home lateral (axial) position and clear of the corner sew station. Switch 10111 is positioned at the rear of frame 828 and produces input signal I-10111 when tripped indicating that the overhead transfer unit is in position to deliver a drapery panel to a pleat and sew station.

A CORNER SEW STATION

Reference is now made to FIGS. 2, 5, 18, 22, 23 and 24. The corner sew station 108 is comprised of a plurality of subassemblies, the clamping assembly being generally shown in FIG. 23 as 950, the lock and latch assembly shown in 24 at 952, the indexing assembly generally shown in FIG. 5 at 954, and the sewing assembly generally indicated at 956.

Turning first to FIG. 5, the corner sewing section frame, generally indicated at 958, is attached to the frame 750, which runs down the center of the machine and to the rear of the loading and loop-forming assemblies. Specifically, the bottom framing members 960 are attached to the bottom frame 750 and extend horizontally rearwardly from frame 750. Attached to the horizontal bottom frames are vertical frames 962 and 964 and a horizontal supporting plate 966 attached to and between frame members 962 and 964 as by bolts 968.

Figure 23:
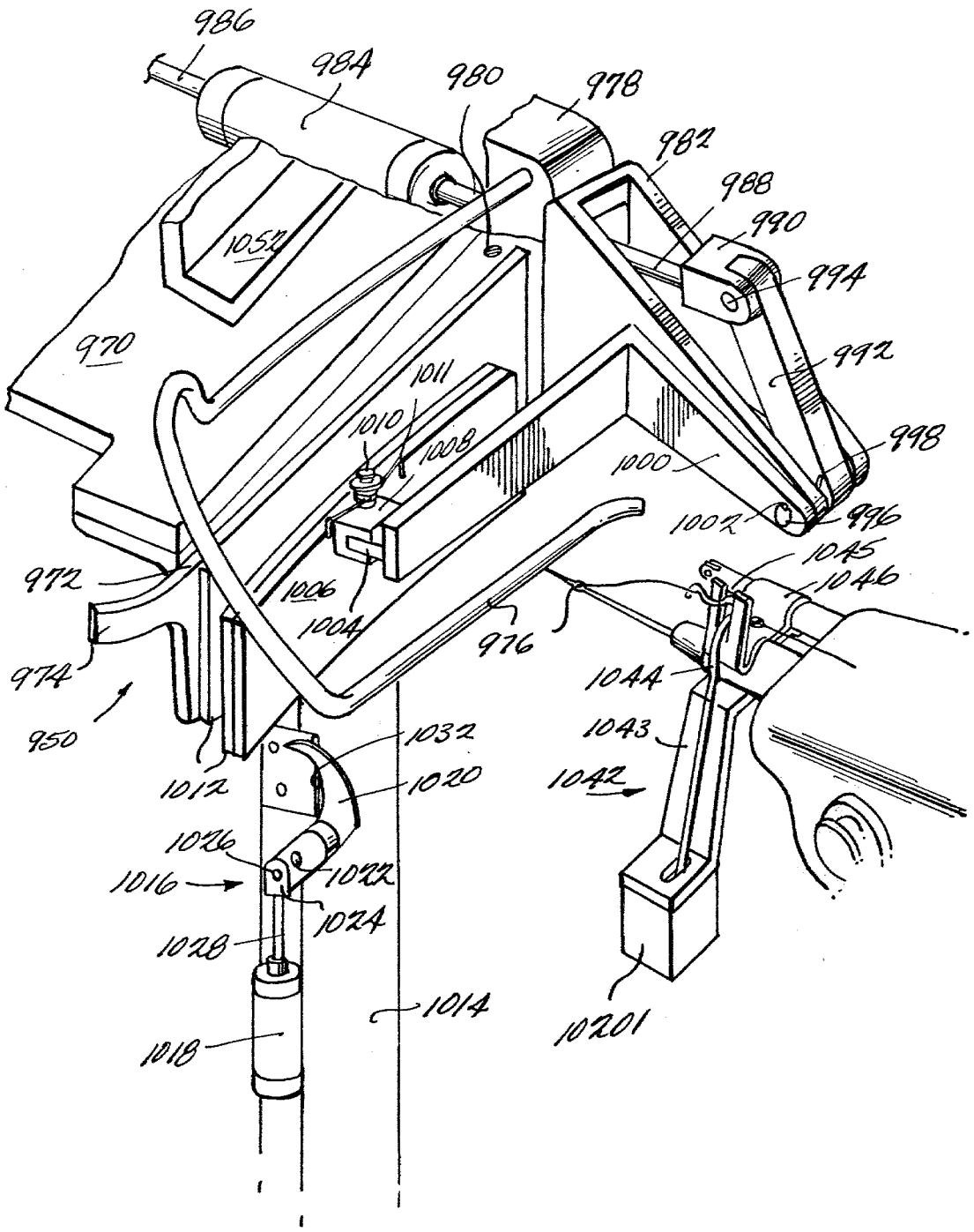
FIG. 23 is a fragmentary perspective view of one side of the corner sew mechanism.

Each end of the header is held by identical right and left clamp assemblies 950 and 951. FIG. 23 shows the right clamp assembly 950 in detail. Clamping assembly 950 is attached to a mounting plate 970 which is mounted beneath the latch housing 1052. Attached to each side of the mounting bracket is the clamp bed 972 which has an angled outer projection 974 which serves to guide the corner of the header panel as it is brought into the corner-sewing station. Likewise a flap guide 976 is provided on the opposite side from the clamp bed 972 so as to also help guide the corner of the drapery panel into the corner sewing station. The flap guide 976 is secured in a mounting lug 978 which is attached to the mounting bracket 970 by means of screws 980.

Attached below the mounting lug 978 and to the rear portion of mounting bracket 970 is a clevis type mounting bracket 982. An air operated cylinder 984 operates both the right and left side clamp assemblies 950 and 951 through a movable drive rod 986 which controls clamp assembly 951 and a non-movable or fixed drive shaft 988, attached to the other side of cylinder 984, operates clamp assembly 950. Each drive rod is provided with a clevis type rod end 990 and the drive rods 986 and 988 can be attached to an identical rod end 990 by any convenient means such as by welding or set screws (not shown). A crank link 992 is rotatably secured within the rod 990 by means of pins 994, while the other end of crank link 992 is attached to a pin 996 by means of a keyway in pin 996 and key 998. The pin 996 is rotatably mounted within the forward end of the mounting bracket 982 by any convenient means such as lock washers and has a crank arm 1000 secured thereto by means of a keyway and key 1002. The crank arm 1000 is provided with an extension 1004. The clamp press bar 1006 is provided with a mounting lug 1008 having a slot formed therein into which the extension 1004 will fit with the extension 1004 being held in the mounting lug 1008 by means of screw 1010. As was previously the case with clamps used in this machine, the surfaces of the clamp bed 972 and the clamp press bar 1006 can be provided with either a cork or a rubber layer such as indicated at 1012.

Figure 22:
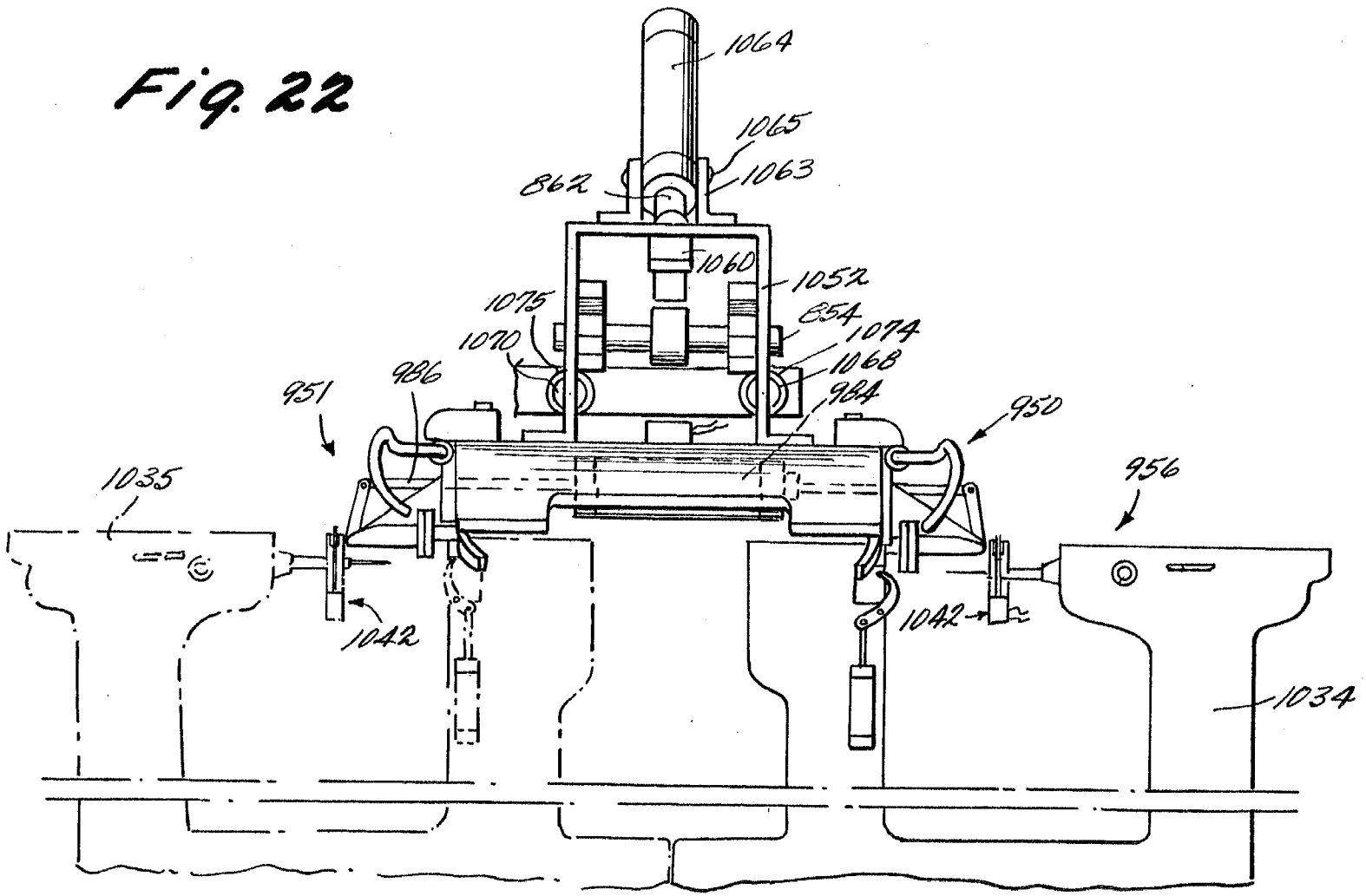
FIG. 22 is a fragmentary front elevation of the corner sew station taken along line 22—22 of FIG. 5.

Turning to FIG. 3 a mounting plate 1014 is provided for the purpose of supporting the cutter assembly indicated on the bobbin bed on the sewing machines 1034, 1035 at 1016. The cutter assembly is comprised of a cylinder 1018 mounted on plate 1014 by mounting block 1019. The cylinders 1018 are a Bimba, Model 041-NR. A cutting knife 1020 is mounted to the support bar 1014 by means of a mounting pin 1022. The cylinder is attached to the cutter knife 1020 by means of a push arm type connecting link 1024 which drives arm 1026 fixed to the knife 1020 and the push arm 1024 is in turn connected to the drive rod 1028 of the cylinder 1018. The base for the cutter 1030 is attached to plate 1014 so as to be in the path of travel of the cutting knife 1020 and is provided with a sharpened leading edge 1032. The thread will be drawn through the cutter assembly as the header panel is withdrawn from the corner-sewing unit and upon actuation of cylinder 1018 by the controller 1920 the knive 1020 will be drawn across the cutting base 1030 and when the thread is contacted between the cutting knife and the sharpened edge 1032 of the cutter base 1030, the thread will be severed. Also shown in FIG. 22 are the sewing machines 1034 and 1035. While any sewing machine can be used these are Singer Sewing Machines, Model 47W70 and are mounted on a vertical support rod 1036 by mounting bracket 1038 attached to the machines by any convenient method such as screws 1040. The sewing machine is provided with a needle 1041 and since the sewing machine 1034 is of a conventional type further description of the sewing machine will not be provided herein.

A thread break detector is provided for each sewing machine 1034 and 1035 and is generally indicated at 1042 and is comprised of a mounting bracket 1043 which is suitably secured to the sewing machine so as to be in alignment with the thread feed for needle 1041. A microswitch 10201 is mounted to bracket 1043 and is operated by tripwire 1044. The tripwire 1044 is shaped so as to fit around the sewing machine and extend through a slit 1045 provided in the upper portion of bracket 1043 as is shown. The needle thread 1046 will pass behind bracket 1043 and hold tripwire 1044 in slot 1045. If thread 1046 breaks, the tripwire will spring out of slot 1045 opening switch 10201 and produce an input signal I-10201.

Figure 24:
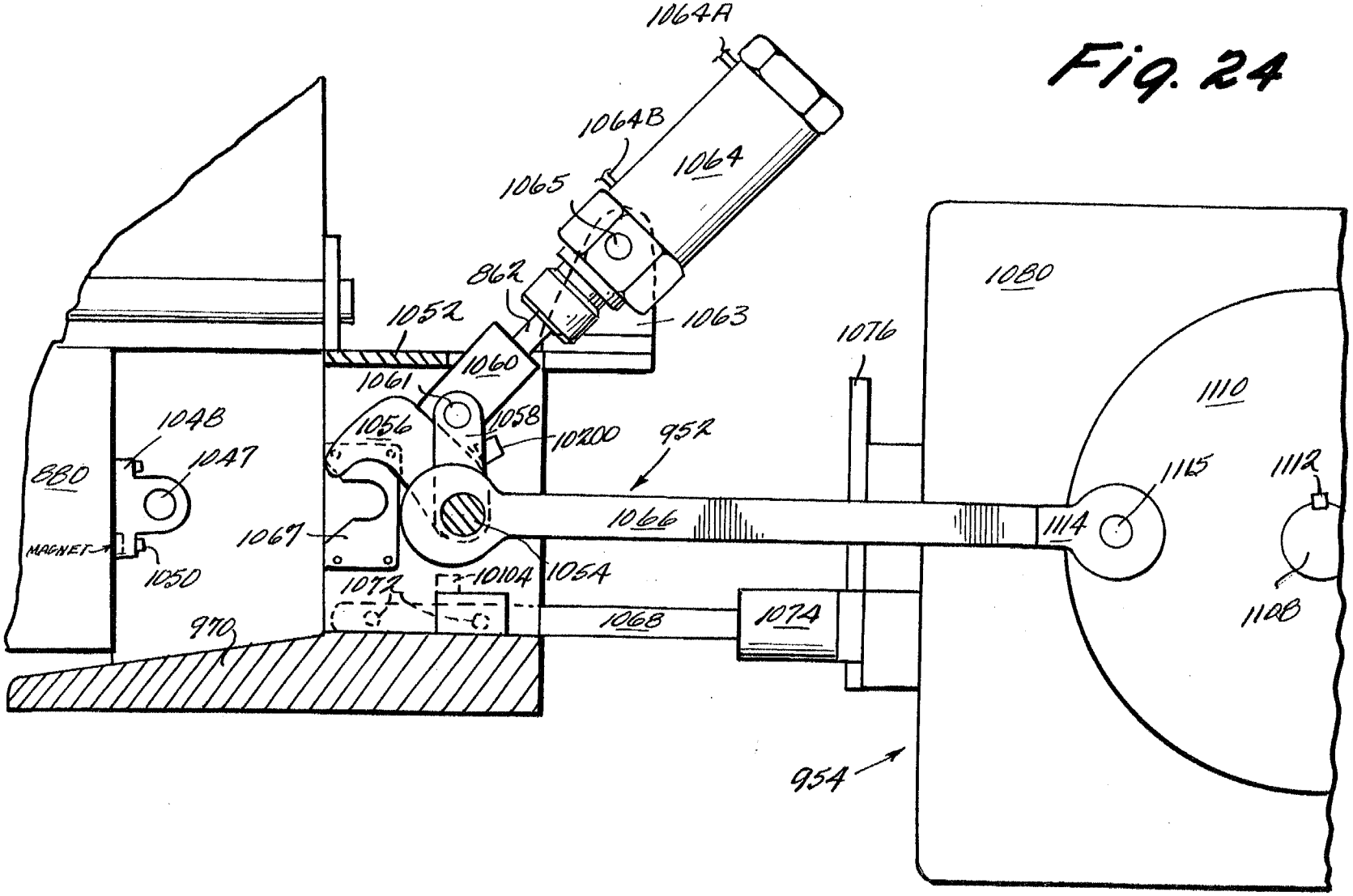
FIG. 24 is an enlarged fragmentary view of the corner sew station locking and indexing mechanisms.

Turning now to FIG. 24, the loop clamp housing 880 is in a secured position or locked position by means of the locking corner sewing lock assembly 952. Mounted to the rear plate of the loop clamp housing 880 is a shaft or bar 1047 by means of two bar supports 1048 which are secured to the loop clamp housing 880 by means of screws 1050. The lock assembly 952 is comprised of a lock housing 1052 which supports a central shaft 854. The shaft 854 extends across the latch housing 1052 and is held in place as by snap rings or with any other convenient device. Attached to the shaft 1054 is the lock latch 1056 which is provided with a central upward projection 1058. The projection 1058 is connected to the driving rod 862 of the cylinder 1064 by a clevis type rod end 1060 and 1061. When the cylinder 1064 is energized by the controller 1920, such that the driving rod 862 is moved, the shaft 1054 is rotated in a counter clockwise direction and the lock latch 1056 will be brought into engagement with the bar 1047. The assembly will be unlocked when the shaft 1054 is rotated clockwise.

Also attached to the shaft 1054 is the connecting rod 1066 for the indexing assembly 954. The latch housing 1052 is supported by right and left support rods 1068 and 1070, respectively, which are secured to the latch housing as by bolts 1072. The support rods are held in right and left bearings 1074 and 1075, respectively, which in turn are secured to the support plate 1076. As shown in FIG. 2, the support plate 1076 is secured to the front of the indexing assembly which in turn is secured to the vertical support bar 962.

As shown in FIGS. 2 and 5, the indexing assembly 954 is comprised of a right angled gear reducer 1080 which is powered by motor 1082 which, for example, could be an Amco TE 3/4 horsepower 1750 rmp 230 volt motor. The motor 1082 is attached to frame member 964 by means of motor mounts 1084. The drive shaft 1083 from the motor is connected to a pulley 1086 which in turn is connected by means of the V-belt 1088 to pulley 1090 which is secured to shaft 1092. The shaft 1092 is rotatably secured to the frame member 962 by means of bearings 1094 and 1096 which in turn are connected to support rods 1098 and 1100 which are bolted to the frame member 962 by bolts 1102. Also attached to the shaft 1092 is a geared pulley 1104 which serves to drive or energize the sewing machines 1034 and 1035 by means of a geared belt 1106. The upper end of shaft 1092 serves to operate the gear reducer 1080 which in turn powers a shaft 1108 to which a drive crank 1110 is attached by means of a key 1112. The connecting rod 1066 of the indexing assembly is connected to the drive crank 1110 by means of a connecting link 1114 rotatably attached to arm 1115 on crank 1110.

Figure 41:
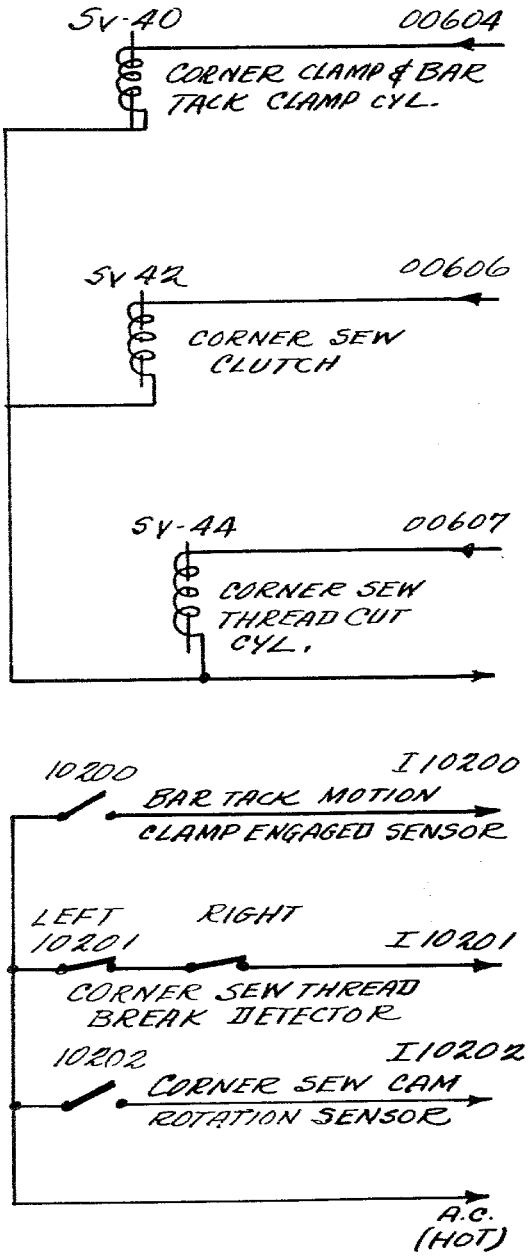
FIG. 41 shows the corner sew control circuit.

In FIG. 41 the control circuit for solenoid-operated air valves is set forth, specifically for solenoid valves SV-40, SV-42, and SV-44.

Valve SV-40 is actuated by output signal 00604 from the controller and when actuated connects cylinders 1064 and 984 to the air supply via air ports 965A and 985A, respectively, thereby closing the corner clamp assemblies 950 and 951 and the lock latch 1056. Valve SV-40 is provided with an internal return spring (not shown) so that upon removal of output signal 00604 the return spring will cause a change in the air connection to cylinders 1064 and 984 by connecting air ports 965B and 985B, respectively, to the air supply so as to unclamp clamp assemblies 950 and 951 and unlocking the latch 1056.

Valve SV-42 is activated by controller output 00606 and in turn regulates the actuation of the corner sew clutch in a similar fashion. Since the corner sew clutch and brake are part of the standard Amco motor, further discussion thereof is ommitted.

Valve SV-44 is actuated by controller output signal 00607 and when actuated connects air cylinder 1018 to the air supply via air port 1019A, thereby causing the needle thread to be cut following a completion of the corner sew cycle. The cylinder 1018 is provided with an internal spring (not shown) to effect the return of the cutting assembly back to its initial position by returning the cylinder drive rod 1028 to its fully extended position. Upon removal of output signal 00607, the air port 1019A is opened to the atmosphere so as to allow the spring to return the cylinder to its initial position.

There are three sensing devices associated with the corner sew station. Switch 10200 is mounted behind the lock latch 1056 and is a normally closed switch. The spring-loaded switch actuating lever is held "in" next to the switch when the lock latch 1056 is unrotated or in its "unlock" position. However, when lock latch 1056 is rotated counterclockwise, to its lock position the switch activating lever is allowed to move away from switch 10200 thereby closing the switch and producing input signal I-10200. This indicates to the controller that the lock latch 1056 has been rotated to its "lock" position.

Switch 10201 has previously been described and indicates to the controller, through input signal I-10201, when the needle thread 1046 has broken.

Switch 10202 is a lever-activated switch mounted on the side of gear reducer 1080 so that the switch lever 1116 can ride on drive crank drive 1110. As shown in FIG. 5, the drive crank 1110 has a cut-out portion 1118 when the switch lever 1116 is positioned at the end of the corner sew cycle. The switch 10202 can be set so as to indicate to the controller when the drive crank 1110 is rotating, thereby indicating that the corner sew cycle is in progress. In this instance, the switch 10202 would be closed, producing input signal I-10202 when the switch lever 1116 was out of the cut out 1118 and on the surface of drive crank 1110. Alternatively, switch 10202 could be set to indicate the completion of the corner sew cycle, which involves one revolution of the drive crank 1110. In this instance, the switch 10202 would be closed, producing input signal I-10202 when the switch lever 1116 again dropped into cut out 1118.

Figure 42:
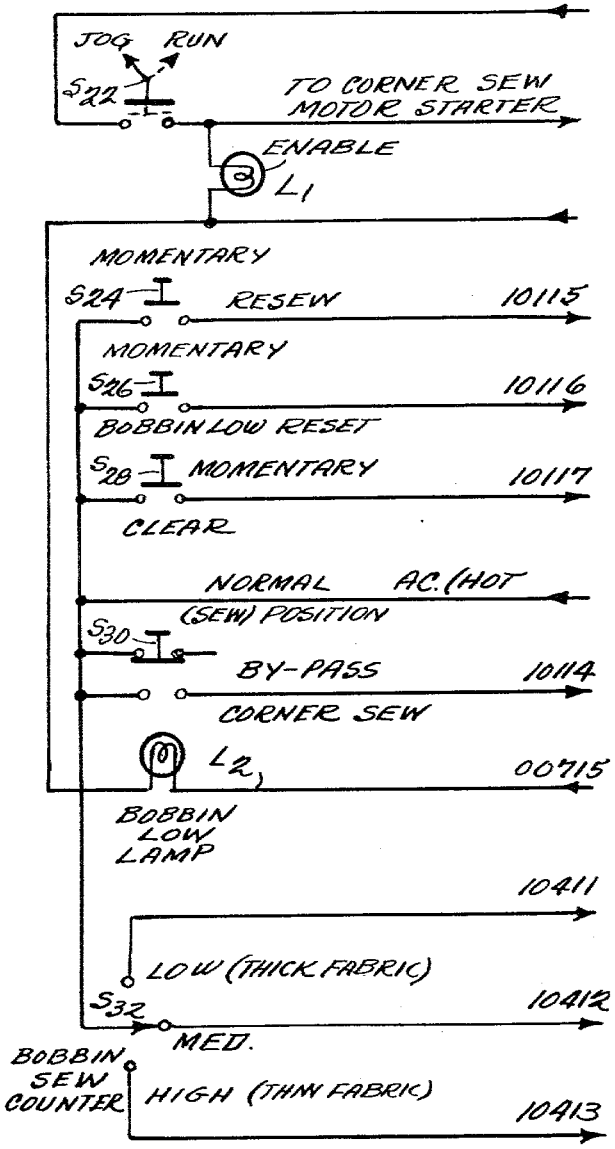
FIG. 42 shows the corner sew control panel circuit.

The circuit for the control panel of the corner sew station is shown in FIG. 42. As indicated hereinafter, the corner sew station is subject to being in either a jog or a run condition, the jog condition allowing the operator to step the sewing apparatus through the sewing sequence while the run condition will allow for automatic operation of the sewing sequence. When the corner sew station is in the run mode, the lamp L-1 will be connected in the circuit and thereby turned "on" so as to provide a visual indication that the run switch is energized. Lamp L-1 is located on the corner sew or main control panel or anywhere convenient to the operator.

The momentary switch 10115 and input signal 10115 will cause the corner sew cycle to be repeated to resew the header panel should the opertor consider that the seam which was initially formed needed to be redone. Likewise, when the sewing machine bobbin has run out of thread and has been replaced by a full bobbin, the operator can hit momentary switch 10116 producing input signal I-10116 to reset the bobbin thread low detection apparatus.

The clear switch 10117 which produces input signal I-10117 will indicate to the controller 1920 that the corner sew station 108 will be returned to its initial position and that the station will be cleared of a panel. In addition, the operator has a bypass switch 10114 which produces input signal I-10114 which instructs the controller to have the corner sewing operation bypassed by the controller if for some reason the operator considered that was desirable.

In addition to the thread break monitoring, a system is provided for monitoring the amount of thread remaining on the corner sew bobbin. Switches 10411, 10412 and 10413 are part of a rotary switch and serve to place a low, medium or high counter, CTR9, CTR10 and CTR11, respectively, in circuit with the corner sew clutch circuit. Each of these counters is preset at a specific count level and will usually be set at 50, 60 and 70 counts respectively. Each time the corner sew clutch output signal SCLL (00606) is generated by the controller, the selected counter will be advanced one count and at the end of the preset count will generate a corner sew bobbin low signal (see program rung 85) SBLO (00002) which in turn will produce the controller output signal 00715 and light lamp L-2, the bobbin low lamp which can also be mounted on the corner sew or main control panel so as to provide the operator with a visual indication of the bobbin low condition. It is to be understood that the output signal 00715 could also be used to turn on any type of audible alerting device as well as the lamp L-2.

The selection of counter CTR9 and CTR10 or CTR11 depends on the type of fabric being sewn. If the fabric is heavy, more thread will be required for each line of stitching, and thus the low counter CTR9 will be placed in circuit by setting the rotary switch to switch 10411. If the fabric is light, less thead will be needed, and the high counter CTR11 will be placed in circuit through switch 10413. If the fabric is of medium weight, counter CTR10 will be placed in circuit through switch 10412.

PLEATING AND SEWING STATION

The final assembly point in the processing sequence through which the drapery panel is moved takes place at either the right or left pleating and sew station indicated in FIG. 1 generally at 110 and 112, respectively. Both pleating and sewing stations are comprised of the same element and in view of the travel of the overhead transfer unit 106, the elements will be arranged in the same order. Therefore, for ease of description, it is believed that a complete understanding of the pleating and sewing stations can be accomplished through the description of the right pleat and sew station 110.

Referring first to FIGS. 2 and 3, the right pleat and sew station 110 is located on the right-hand side of the overhead beam 752. Connected to the overhead beam 752 on the right side is a support plate 1150 which is attached to the overhead and side beams by means such as bolts 1152. The plate 1150 could, however, be also attached to the framing members as by welding, or any other conventional securing method.

Figure 25:
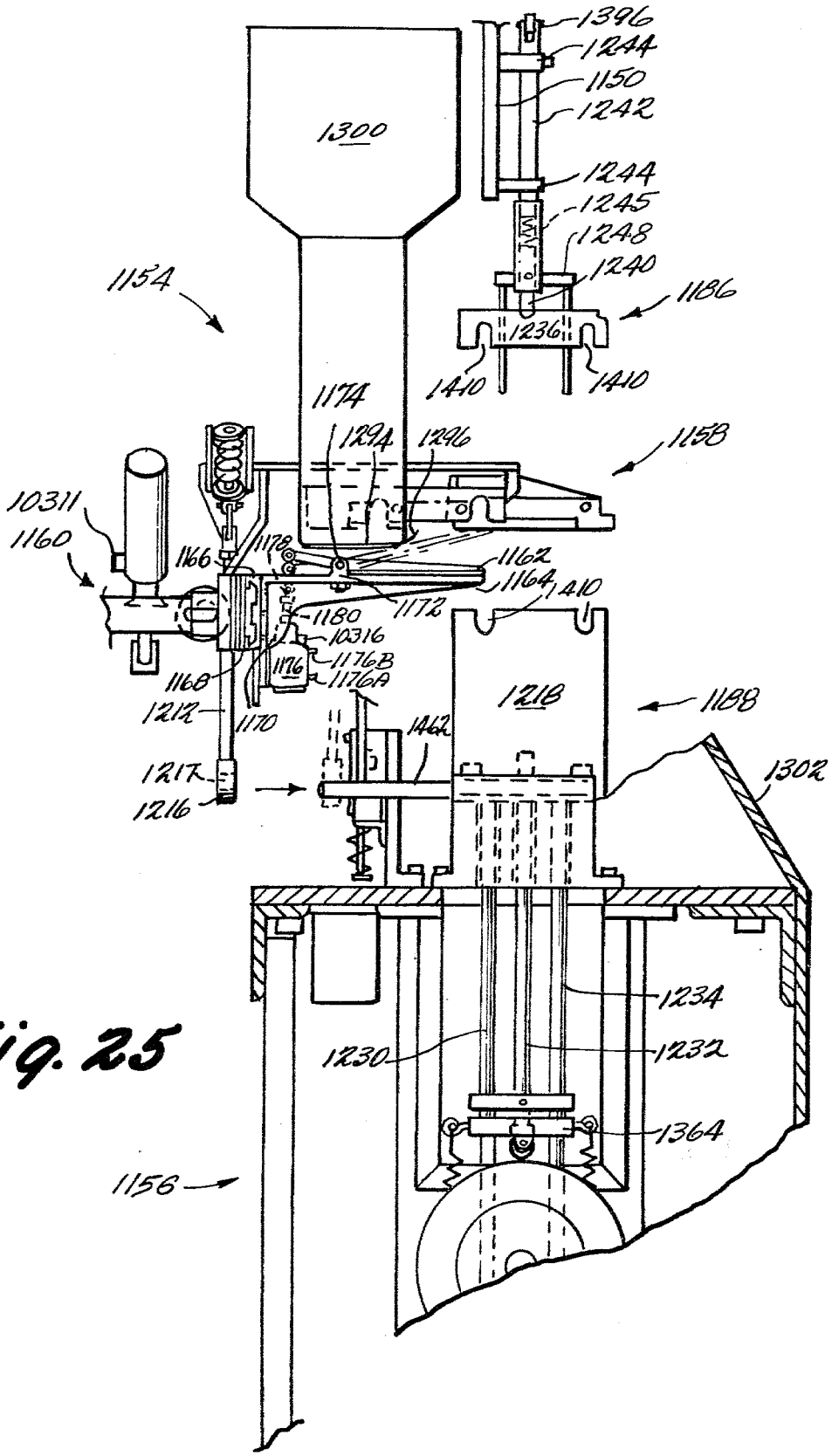
FIG. 25 is a sectional view with parts omitted for clarity taken substantially along line 25—25 of FIG. 2.
Figure 33:
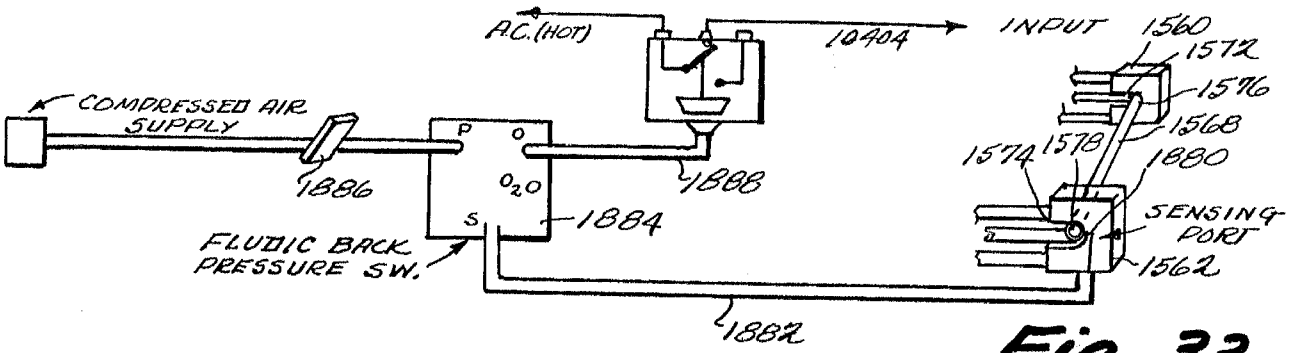
FIG. 33 is a diagrammatic showing of a fluidic back pressure sensing device.
Figure 27:
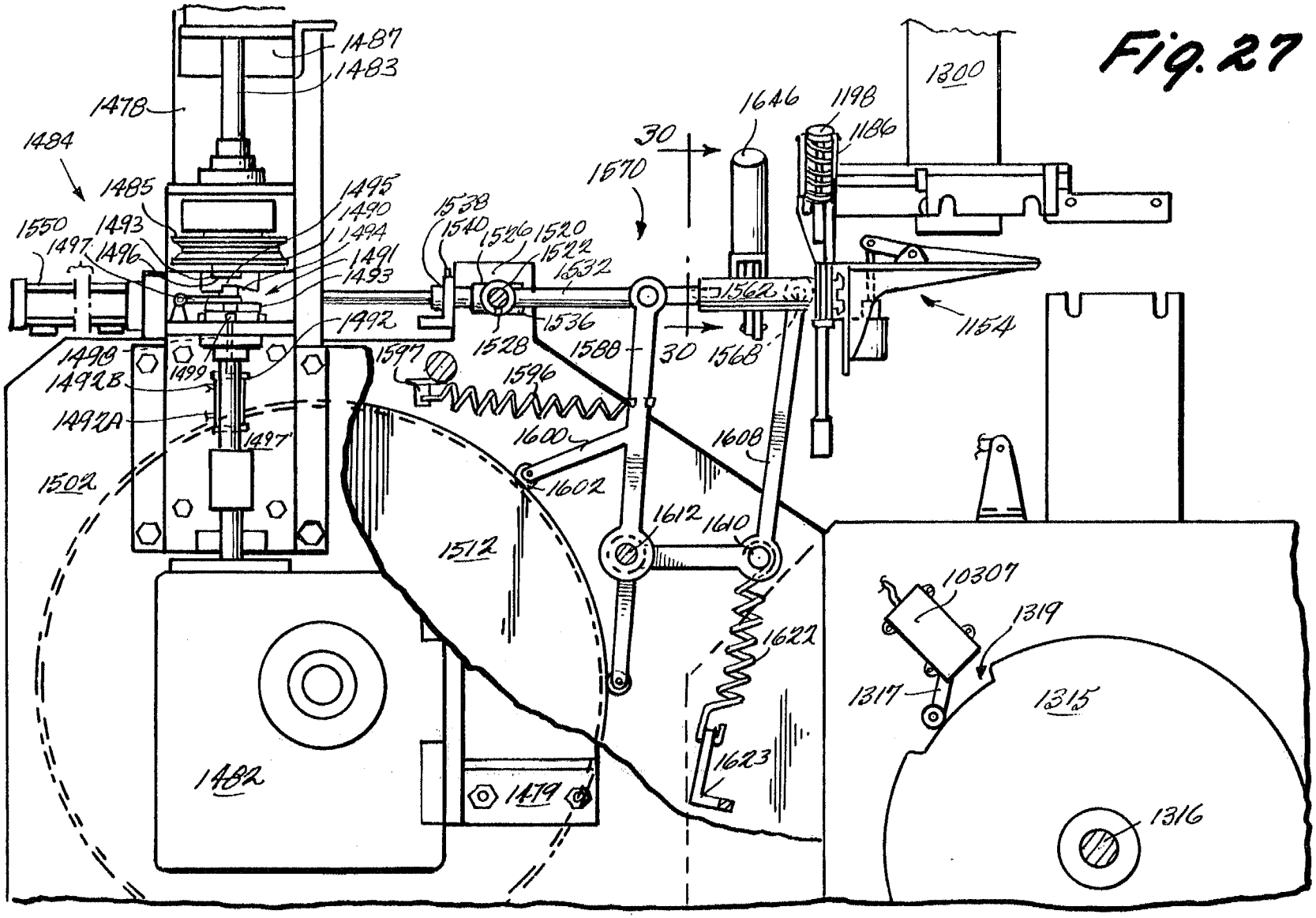
FIG. 27 is a fragmentary side elevation showing the pleat sewing actuating mechanism and the header clamp in a retracted position.

With reference to FIGS. 25 and 27 each pleat and sew stations consists of a plurality of subassemblies which include the header clamp or pleat clamp assembly generally indicated at 1154, a camming assembly 1156, a sewing assembly 1158 and an indexing assembly 1160.

The header clamp assembly 1154, as shown in FIGS. 25, 26 and 27 is located directly beneath the overhead beam 752 and on top of cam assembly 1156, while the sewing assembly 1158 and indexing assembly 1160 are located to the rear of beam 752. The header clamp assembly 1154 is comprised of upper and lower head clamp members 1162 and 1164, respectively.

The lower header clamp 1164 is attached to the indexing slide member 1166 and is comprised of a rear portion from which spaced fingers 1165A-1165F extend.

The upper header clamp 1162 is pivotally mounted to the lower header clamp 1164 as described hereinafter. The upper head clamp 1162 is also comprised of a rear portion from which fingers 1163A-1163F extend.

When the upper header clamp 1162 is in a closed position, the fingers 1163A-1163F are in a clamping relationship with the complementary fingers of the lower header clamp 1164 or 1165A-1165F, respectively.

The spacing between the header clamp fingers is such that the header portion 124 of th drapery panel 120 is clamped in the same way it was clamped by the loop clamp mechanisms 660 in that the fabric between the bottom of loops 126 is between the header clamp fingers. This is shown by the phantom lines in FIG. 26B representing the header portion 124 of panel 120. The indexing slide member 1166 which is slidably mounted on an index guide 1168 and the index guide 1168 are in turn connected to a linkage portion of the indexing assembly 1160 as will be described hereinafter.

As was indicated, the lower header clamp member is secured as by bolts 1170 to the indexing slide member 1166. The upper header clamp member 1162 is secured to the lower member 1164 by means of pivotal link connections 1172 in which shaft 1174, which is connected to the upper header clamp 1162 part of the upper header clamp member, is rotatably secured.

The upper header clamp member is rotated within the link connections 1172 by cylinder 1176 which is connected to the rear portion of the upper header clamp member by a connecting link 1178 and by drive shaft 1180.

Figure 26A:
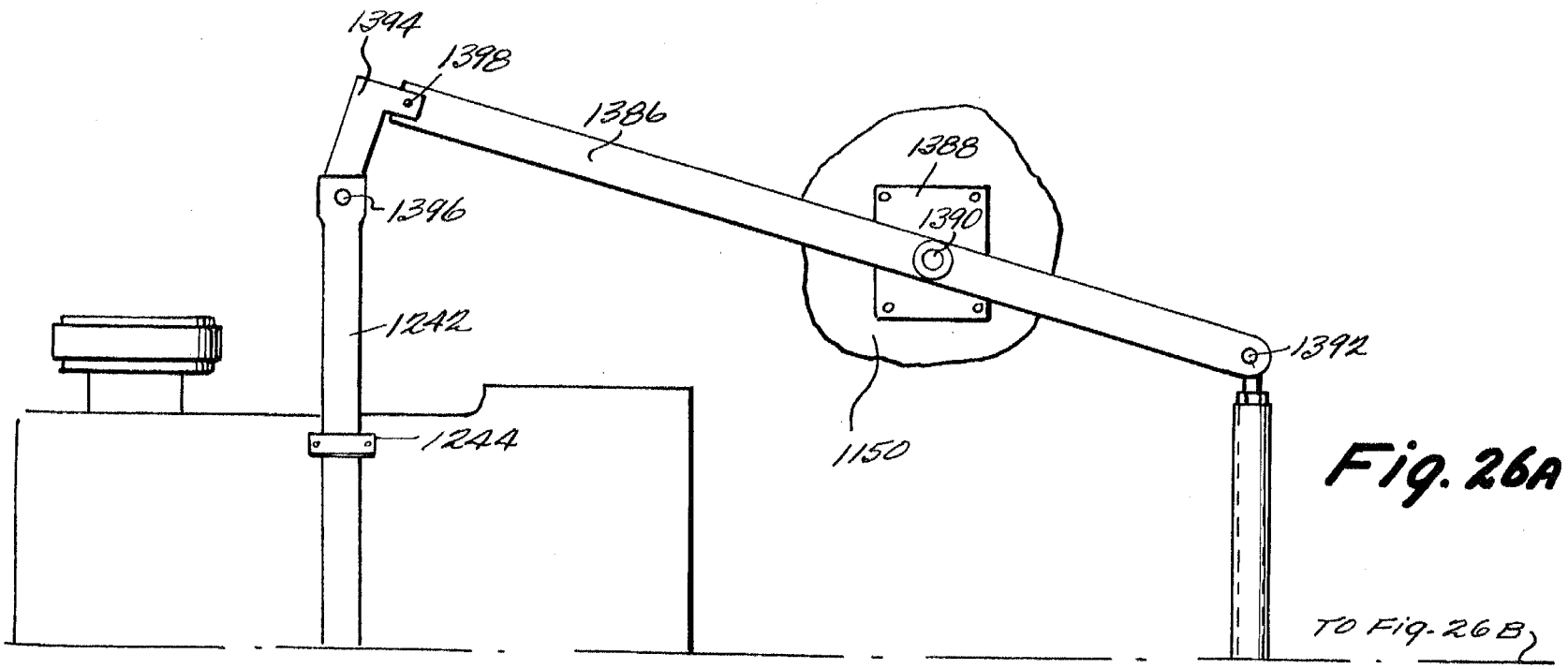
FIGS. 26A, 26B and 26C together are a front elevation of the right pleating station and associated actuating mechanism.
Figure 26B:
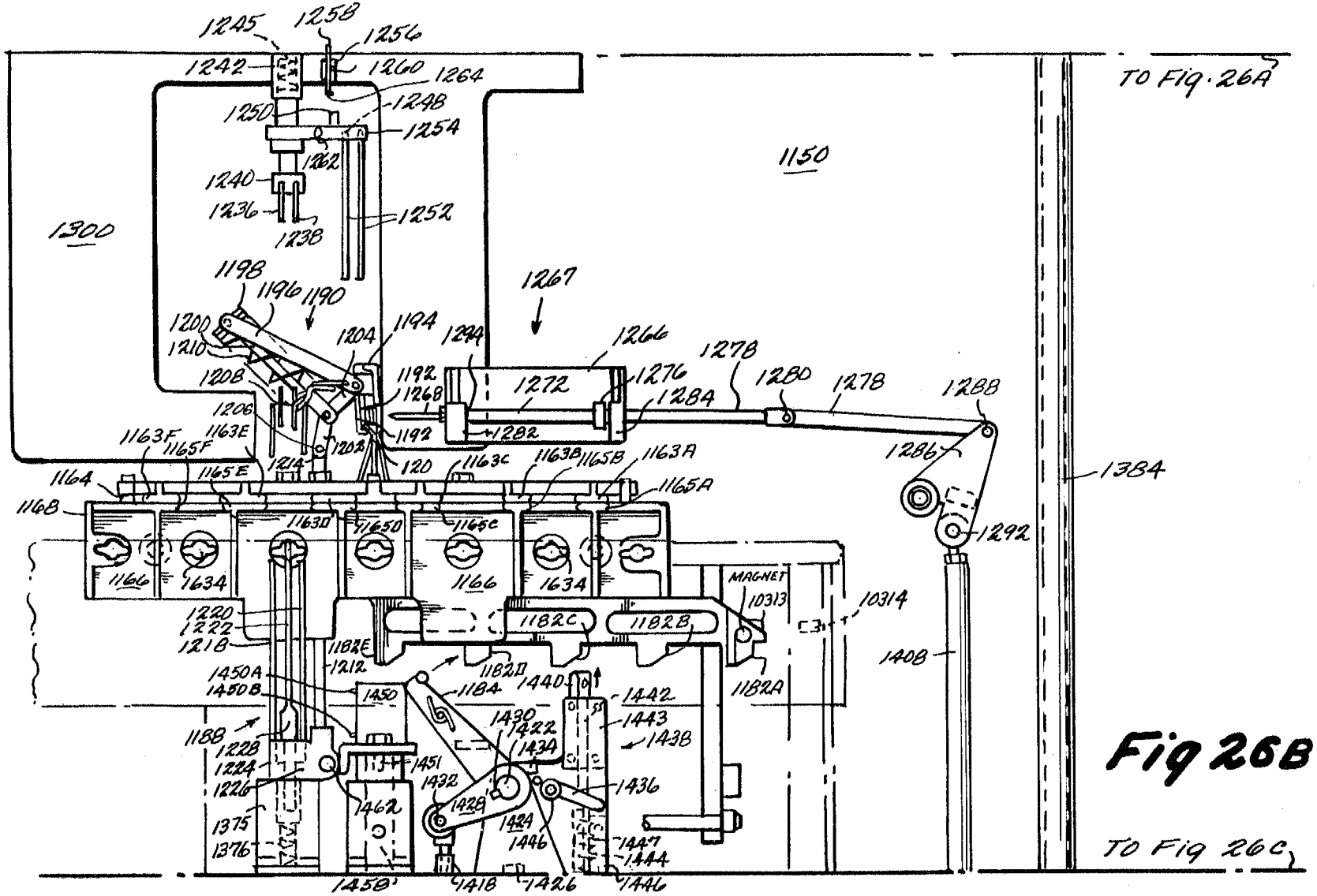
Figure 26C:
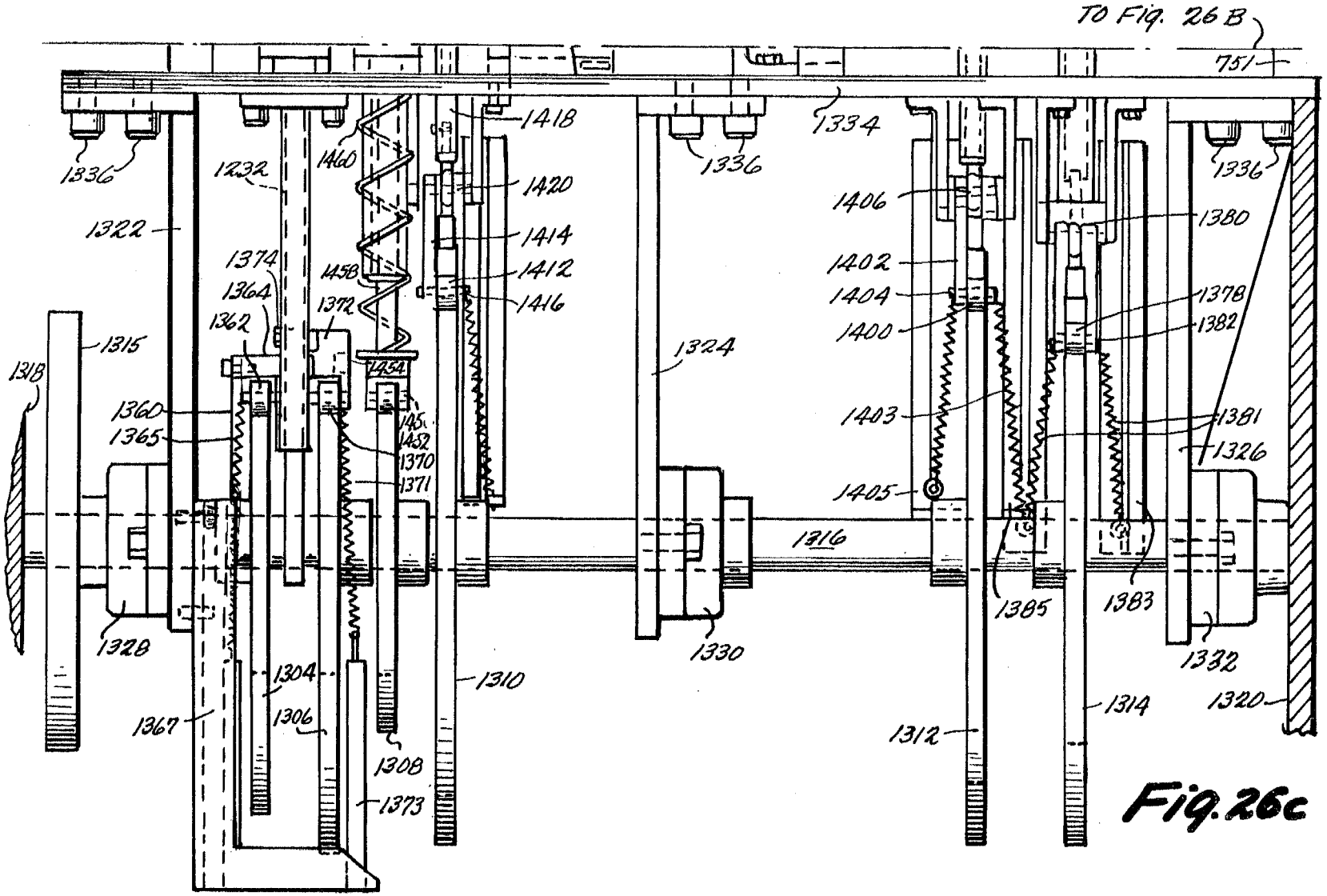

Turning to FIGS. 26A, 26B and 26C, the indexing slide 1166 is moved by means of the depending lugs 1182A-1182E which are engaged by an indexing arm 1184 which is controlled by a cam 1310 in the camming assembly 1156 as will be discussed hereinafter. As the indexing arm 1184 is rotated in a clockwise direction, the upper portion of the indexing arm 1184 will come into contact with one of the indexing lugs 1182 thereby causing the indexing slide 1164 to move from left to right. In addition, the upper and lower header clamp fingers 1163A-1163F and 1165A-1165F, respectively, are spaced apart a distance which is equivalent to the spacing between the indexing lugs 1182A-1182E. When the header portion of the drapery panel is initially clamped by the header clamp assembly 1154, the indexing slide 1164 is moved to a position such that the indexing lug 1182A is positioned in the path of indexing arm 1184. Thus, in the intial position, the first loop in the header portion between fingers 1163A/1163B and 1165A/1165B is in the position shown in FIG. 26B for the fourth loop; thus, also in alignment with the upper and lower pleat blades 1186 and 1188, respectively. Each time the indexing slide is indexed one notch to the right, the next succeeding loop will be aligned with the upper and lower loop blades 1186 and 1188. At the same time, it will be noted in FIG. 26B that while the fourth loop is in alignment with the upper and lower loop blades, the third loop, now in the form of a pleat, is held in the pleat clamp 1190. As will be pointed out hereinafter, the pleat clamp 1190 is itself aligned with the sewing machine needle and thus the pleat held therein will be position to be sewn. Therefore, each indexing cycle will serve not only to align the next loop to be formed into a pleat with the pleat blades, but will also align the previously formed pleat with pleat clamp 1190.

The pleat clamp 1190 is comprised of an L-shaped clamp portion 1192 which is rotatably mounted on a bracket 1194 secured to the index guide plate 1168. Connected to the L-shaped clamp portion 1192, is a connecting link 1196, which in turn is connected to a circular member 1198 which is provided with a central bushing in which a guide rod 1200 is inserted. The lower end of the guide rod 1200 is pivotally connected to the links 1202 and 1204 by means of pin 1206. In addition, a second circular retaining plate 1208 is secured to the guide rod 1200 and serves to retain spring 1210 in between the plates 1198 and 1208. Thus, spring 1210 serves to maintain the pivoted relationship between the guide rod 1200 and the two connecting links 1202, 1204 once the spring is operated. Thus, the spring 1210 will serve to maintain the clamp 1192 in either its open or closed position. The drive rod 1212 for the pleat clamp is secured by means of a pin 1214 to connecting link 1202 and is provided with a drive lug 1216 on its lower end. The drive lug 1216 is provided with a hole 1217 adapted to fit over drive arm 1462. The circular opening 1217 in the drive lug 1216 is adapted to be able to slide on and off the drive arm 1462 which is drivingly connected to the cam 1308 which operates the pleat clamp assembly 1190 as described hereinafter.

The lower pleat forming blades indicated generally at 1188 are comprised of two outer blades 1218 and 1220 and a center blade 1222. Each one of the pleating blades is respectively connected to a pleat holder 1224, 1226 and 1228, respectively, and these in turn are connected to drive rods 1230 1232 and 1234.

Referring to FIGS. 25 and 26B, the upper pleat blade assembly generated indicated at 1186 is comprised of two pleating blades 1236 and 1238 which are retained in a pleat blade holder 1240 which is secured to a driving link 1242 which in turn is slidably retained on the vertical support plate 1150 by brackets 1244. Also attached to the drive link 1242 is a mounting block to which a rotatably mounted plate 1248 is attached. The plate 1248 has an extension arm 1250 attached to the upper surface while four push rods 1252 are attached to the bottom of the plate as by set screws 1254. Attached to the vertical support plate 1150 is a mounting block 1256 in which a vertically adjustable rod 1258 is retained by means of set screw 1260. When the drive rod 1242 is in its down position, a spring 1262 is wrapped around the extension arm 1250 and the mounting block 1246 so as to retain the plate 1248 in a horizontal position so that the push rods are pointing toward the header clamp area. When the drive rod 1242 is moved upwardly, the vertical rod 1258 will come into contact with the extension arm 1250 with the upper surface of the extension arm 1250 acting as a cam surface, indicated at 1264, causing the plate 1248 to rotate so that the push rods are now aimed toward the rear of the machine so as to be out of the path of the loop clamp assembly 846. It should be understood, however, that the push rods 1252 could merely be raised higher and accomplish the same purpose.

A support plate 1266, mounted to the vertical plate 1150, serves to support a pleat pinning mechanism 1267 which retains the pleat in its folded condition between the time the pleat is formed by the upper and lower pleat blade assemblies 1186 and 1188, and the time the formed pleat is securely retained within the pleat clamp 1190. The needles 1268 and 1270 are each mounted on drive rods 1272 and 1274, respectively, which are in turn connected to a drive block 1276 which is connected to a connecting link 1278 by pin 1280. Also connected to the support plate 1266 are rod support bars 1282 and 1284. A drive linkage 1286 is connected to the connecting link 1278 by means of pin 1288 and likewise to a driving link 1290 by means of connecting pin 1292. The drive link is connected to cam 1312 within the camming assembly as will be described hereinafter. The rod support bars 1282 and 1284 are each provided with bearings indicated generally at 1294 through which the rods 1272 and 1274 can slide.

As indicated in FIG. 25, a guide plate 1294 having a plurality of guide fingers 1296 is secured above the header clamp assembly to the sewing machine 1300. The guide fingers 1296 assure that as the header carriage is moved back into the sewing position and subsequent to the forming of the individual pleats the drapery material behind that secured between the body header clamps will move beneath the sewing machine and not become tangled therewith. Likewise, an upper cam cover 1302, shown in FIG. 2, is provided so as to also keep the drapery panel which is hanging down in front of the pleating station during the pleat and sew sequencing cycle away from the internal components of the pleating machine.

Turning now to the camming section 1156 and referring to FIG. 26C, there are six pleating cams which are 1304, 1306, 1308, 1310, 1312, and 1314, respectively, and a pleat cycle cam 1315. Cam 1304 is the lower outside pleat blades cam, cam 1306 is the lower center blade pleat cam, cam 1308 is the pleat clamp actuating cam, cam 1310 is the indexing cam while cams 1312 and 1314 are the pleat pin and top pleat blades actuating cams, respectively.

The cams 1304 through 1315 are mounted on a central drive shaft 1316 which is secured at its ends by vertical support plates 1318 and 1320 and by intermediate support plates 1322, 1324 and 1326. Attached to the support plates 1322, 1324 and 1326 are bearings 1328, 1330 and 1332, which rotatably mount the cam drive shaft 1316. The support brackets 1322, 1324 and 1326 are secured to a top support plate 1334 by means of screws or bolts 1336 and the top plate 1334 is secured to the frame post 754, and to the side support walls 1318 and 1320.

The cam drive shaft 1316 is driven by motor 1338, shown in FIG. 2, which is mounted on a bracket 1340 which is connected to left side support wall 1318. Motor 1338 is connected to shaft 1316 through a clutch/brake mechanism 1342 and a conventional gear reducer 1344. The motor 1338 is a one-third horsepower Dayton motor, the clutch/brake assembly 1342 is a Warner Electric Model EM-50-10-20 while the gear reducer 1344 is manufactured by Boston, a 3000 series model, and has a 40:1 ratio.

Referring first to the cams 1304 and 1306, which operate the lower pleating blade assembly 1188, the cam 1304 operates a cam roller follower 1360, which in turn is connected by means of bolts 1362 to a follower yoke 1364. Extension springs 1365 are connected to yoke 1364 and to frame member 1367 and serve to hold follower 1360 on cam 1304. The follower yoke is connected to drive rods 1230 and 1234. The drive rod 1230 is connected to pleat blade 1218 while the drive rod 1234 is connected to the blade 1220. The two drive rods are joined at the follower yoke 1364 so that each of the blades 1218 and 1220 is controlled by the action of cam 1304.

Cam 1306 controls the actuation of cam roller follower 1370 which in turn is connected to a follower yoke 1372 by bolts or screws 1374. Extension springs 1371 are connected to yoke 1372 and to a rod 1373 which is welded or otherwise attached to frame member 1367. Springs 1371 hold follower 1370 on cam 1306 thereby assuring positive contact between the follower and the cam surface. The follower yoke 1372 is in turn connected to a drive rod 1232 which is connected to the lower center pleat blade holder 1228.

The drive rod 1232 is connected to the lower center pleat blade holder 1228 by means of a slidable coupling 1375 which includes compression spring 1376. The lower center pleat blade 1222 is held in an extended condition but can be moved downwardly within the coupling 1375 against the effect spring 1376.

Figure 34:
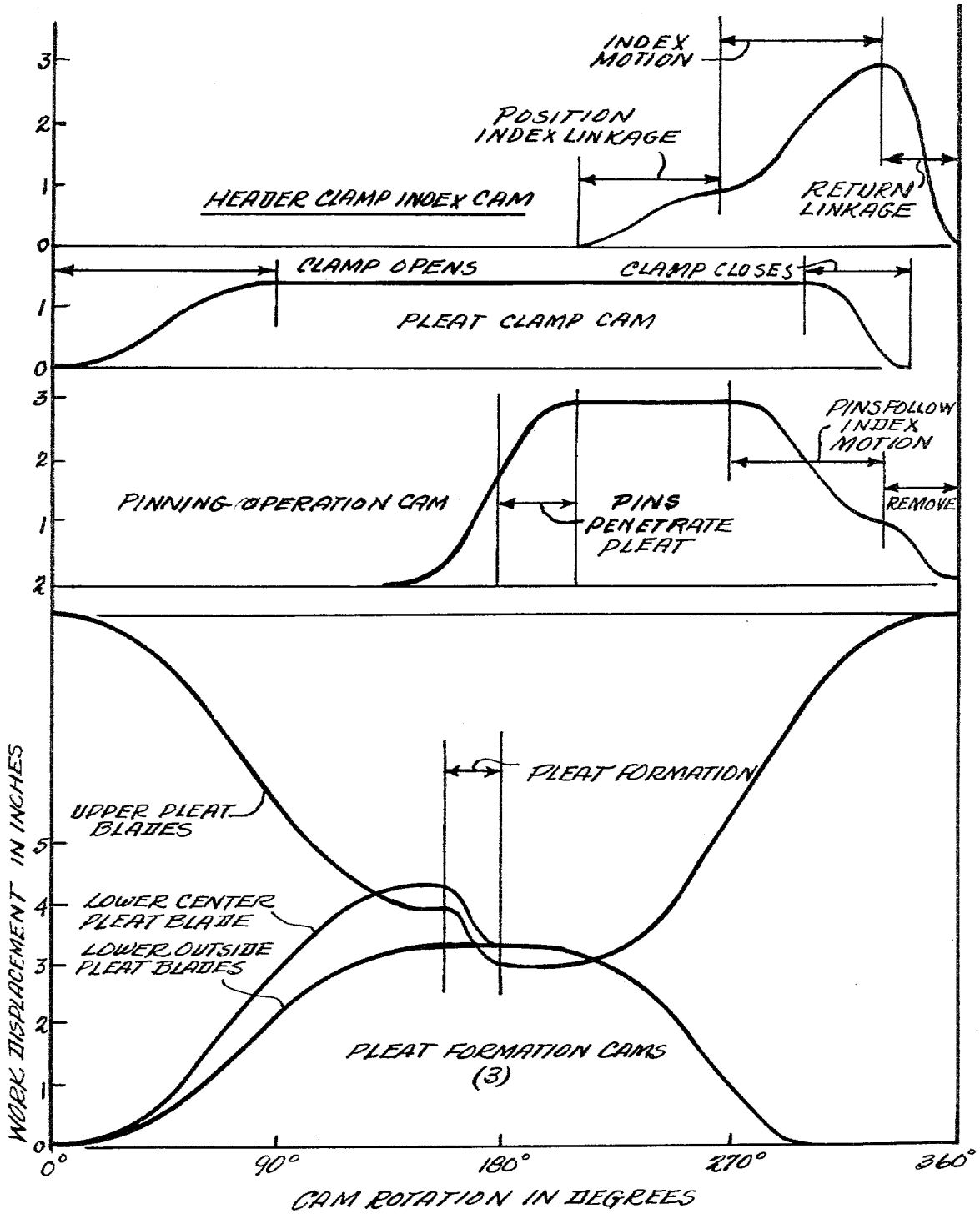
FIG. 34 is a diagram of the cam patterns for the pleat station actuation cams.

Referring to FIG. 34 which shows the cam pattern for each of the cams 1304 through 1314, it will be observed that the cam 1306 causes the center pleat blade 1222 to be raised higher than the outer pleat blades 1218 and 1220 by the outer pleat blade cam 1304. This higher raising of the center pleat blade 1222 causes the loop which is in alignment with the pleating blade assemblies 1286 and 1288 to be centered prior to the pleat formation.

Turning again to FIG. 26C and to cam 1314, which controls the actuation of the top pleat assembly 1186, the cam 1314 is contacted by a cam roller follower 1378 which in turn is connected to a follower yoke 1380 by means of pin 1382. Extension springs 1381 are connected to yoke 1380 and to spring retaining arms 1383 and 1385 which in turn are secured to the top support plate 1334. Here again, springs 1381 serve to hold follower 1378 on cam 1314. The follower yoke 1380 is in turn connected to a drive rod 1384 which controls the actuation of the connecting link 1386. The connecting link 1386 is pivotally mounted by means of a mounting bracket 1388 shown in FIG. 26*a* and pin 1390 to the vertical support plate 1150. Pin 1392 serves to connect the drive rod 1384 to the connecting rod 1386. The drive rod 1242 is connected to the connector link 1386 by means of a drag link 1394 with the drag link 1394 being secured to the rod 1242 by means of a pin 1396 and by means of pin 1398 to the connecting rod 1386. The upper pleat blade holder 1240 is secured to a rod 1341 which is slidingly retained in a slidable coupling 1243 which includes a compression spring 1245. The upper pleat blade holder 1240 is held in an extended condition but can be moved toward the coupling 1243 against the effect of spring 1245.

Referring again to FIGS. 26A and 26C and FIG. 4F, the lower center pleating blade 1222 will reach its raised position prior to contact with the upper pleat blades 1236 and 1238. It will be noted that after the upper pleating blade assembly 1286 meets the lower center blade 1222, the upper blade assembly 1186 continues its downward movement while the lower center blade 1222 is simultaneously retracted, along with the upper blade, to a position comparable to that previously attained by the outer lower blades 1218 and 1220. This is shown at FIG. 4G. Thereafter, the upper pleat blade assembly 1186 continues to move downwrdly so that the upper blades 1236 and 1238 will exend into the two spaces between the lower pleat blades 1218, 1220 and 1222, as at FIG. 4H. This forces the fabric, which comprised the loop, to likewise be forced into those spaces and into the form of a triple pleat. Additionally, the force upon the upper blade assembly 1186 and the lower center pleat blade 1222 is sufficient to overcome the effect of compression springs 1245 and 1376 thereby assuring that there is no excess of fabric within the loop that has not been formed into the pleat. In spacing the loops, the loop assembly 104 will, of necessity, form loops that, while identical within a given panel, may vary in size, or depth, from panel to panel. This is so, since each finished drape will be approximately 25 inches wide. Further, each pleat must be sized so that it will be correctly sewn. Therefore, while there is a minimum pleat size, excess fabric may be present and any such excess is corrected for by the effect of the slidability of the upper blade assembly 1186 and the lower center blade 1222. When the cam 1314 has caused the upper blade assembly 1186 to be fully actuated to its downward position, the pleat will have been formed between the upper and lower pleat blade assemblies.

The pleat pins 1268 and 1270 are controlled by the pleat pin cam 1312. A cam roller follower 1400 is in contact with the cam 1312 and is connected to a follower yoke 1402 by means of pin 1404. Extension springs 1403 are connected to yoke 1402 and to a spring retaining arm 1405 and spring retaining arm 1385. Spring retaining arm 1405 is also secured to top support plate 1334, and springs 1403 hold follower 1400 on cam 1312. The follower yoke 1402 is in turn connected by means of a pin 1406 to a drive shaft 1408 which is in turn connected to the drive link 1286 for the pin assembly by means of pin 1292. When the cam 1312 causes the cam follower 1400 to be raised, the yoke 1402 is likewise raised causing the rod 1408 to be actuated thereby rotating drive linkage 1286. As the drive linkage 1286 is rotated, as will be seen from the cam diagram in FIG. 34 occurs immediately subsequent to the formation of the pleat, the needles 1268 and 1270 will be moved to the left, in the right pleating station, until they have passed through the pleat blades which are provided with needle slots 1410 as seen in FIG. 25 and shown at FIG. 4I.

As indicated previously, the push rods 1252 are mounted to the spring-loaded plate 1248 which, when not in contact with the rod 1258, will be rotated by means of the spring 1262 such that the push rods 1258 are pointed downwardly toward the header clamp assembly. As the upper pleat forming assembly 1186 is moved downwardly, the push rods 1258 will come into contact with the last sewn pleat and will push that last sewn pleat out of the path that needles 1268 and 1270 will take on the way toward piercing the pleat which has just been formed. The needles 1268 and 1270 will pass beneath the support mounting plate 1194 and will pass through the slots 1410 in the pleat blades and thus pass through the pleat. Following the full extension of needles 1268 and 1270, the pleat control cams 1304, 1306 and 1314 will cause the upper and lower loop forming blade assemblies 1186 and 1188 to retract their initial positions, as at FIG. 4J, and the index cam 1310 will have rotated such that the cam roller follower 1412 which is in riding contact with the cam 1310 will be moved in an upward direction.

Still referring to FIGS. 26A–26C, the cam roller follower 1412 is held in a follower yoke 1414 by pin 1416 and the cam follower 1414 is in turn connected to a drive rod 1418 for the indexing arm 1184 by means of a pin 1420. The indexing bar 1184 is connected to a shaft 1422 which is rotatably mounted in a generally U-shaped mounting bracket 1424 which is secured to the top support plate 1334 as by screws 1426. A connecting link 1428 is also connected to shaft 1422 by means of a key 1430 and in turn is connected to the drive rod 1418 by means of a pin 1432.

The projection 1434 as it is being rotated will come into contact with the index stop mechanism 1438. The index stop mechanism 1438 consists of an index stop bumper 1440 connected to the index stop actuator link 1442 which is supported by an index stop bearing 1443 mounted on an indexing bracket 1424. The index stop actuating link 1442 is connected to the drive link 1436 which overcomes the effect of the index stop spring 1444 which tends to keep the index stop bumper 1440 in a lowered position out of the way of the indexing lugs 1182A–1182E. The spring 1444 is retained in place by means of a spring cap 1446 and the index stop bearing cap 1447. Thus, in operation when the shaft 1422 is rotated by means of the drive cam 1310, the projection 1434 contacts the drive link 1436 which causes the effect of the spring 1444 to be overcome which pulls the index stop actuator link 1442 upward so that it comes into contact with the right-hand side edge of the indexing lugs 1182A–1182E. When the indexing bumper comes into contact with the top of bearing block 1442, further indexing of the index slide 1166 is prohibited and thus only the required distance of indexing has been allowed to occur.

Figure 28:
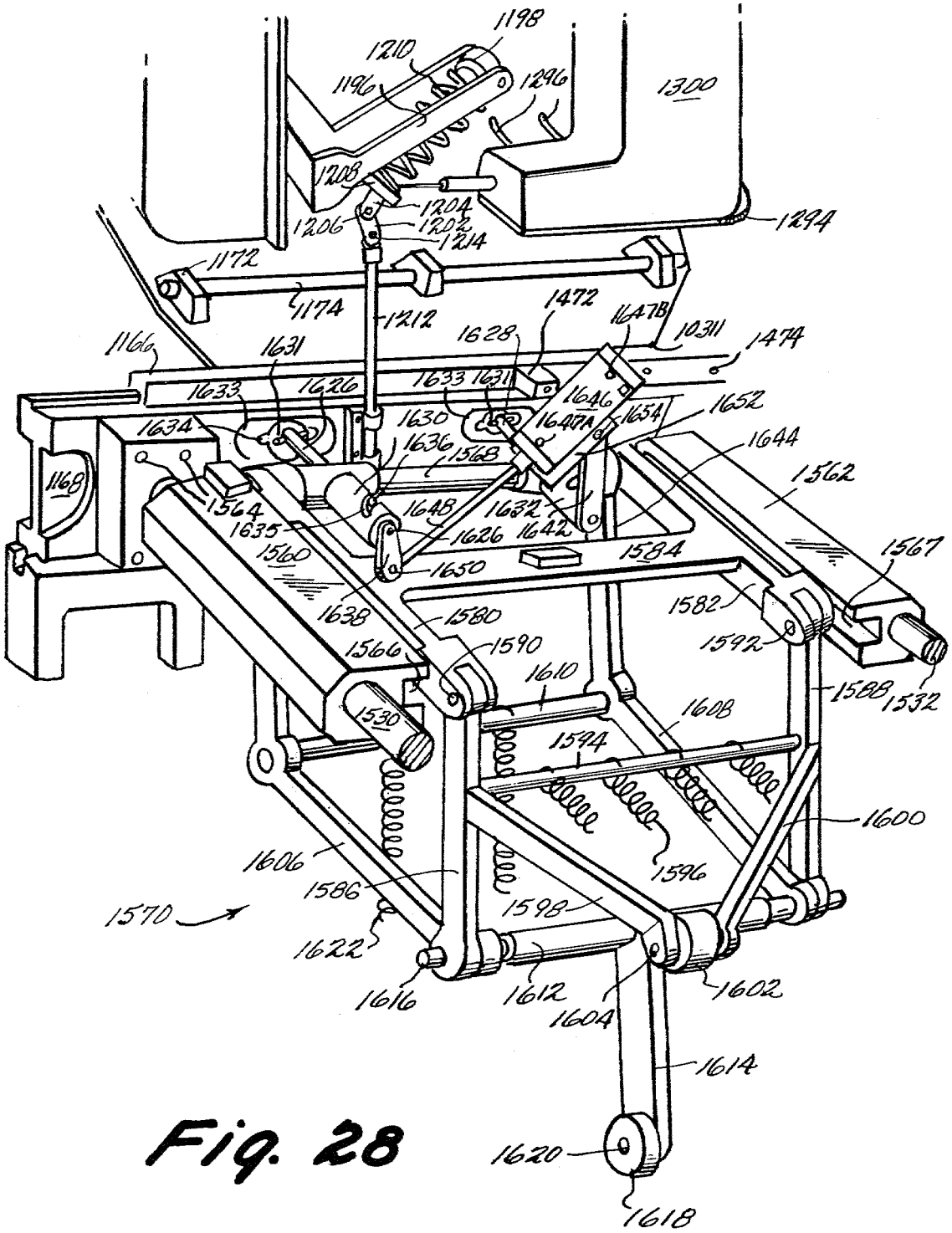
FIG. 28 is a diagrammatic perspective view of the pleat sewing actuating mechanism.

As will be noted, in FIG. 28, the indexing slide 1166 extends above frame 1168 and attached to the frame 1168 is a bracket 1470 on which a spring loaded ball assembly 1472 is mounted. A series of detents 1474 are provided on the indexing slide 1166 which are adapted to cooperate with the spring loaded ball assembly 1472 so as to provide additional means to help align the indexing slide 1166 at the correct point. The detents 1474 are aligned with the correct stopping place for the index slide 1166 and assist in correctly positioning with respect to the pleating blade assemblies and with the pleat clamp 1190. When the indexing cycle has been moved the proper distance, the stop mechanism 1438 and the spring loaded ball assembly 1472 will cooperate to positively position the indexing slide 1166 correctly.

The pleat clamp 1190 is operated both by the pleating cam 1308 during the pleating cycle and also by a cylinder 1450 at the end of the pleat cycle, when the clutch 1342 removes the driving force from the cam drive shaft 1316. A cam roller follower 1452 is in contact with the cam 1308 and is mounted in a follower yoke 1454 by means of pin 1456. The lower end of drive shaft 1458 is secured to the follower yoke 1454 by any convenient means while the upper end of drive shaft 1458 is rigidly secured to the cylinder drive rod 1451 of cylinder 1450 by any convenient means such as by silver solder. In normal operation, the cylinder drive rod 1451 is fully retracted into cylinder 1450 and when drive shaft 1458 is forced up by cam 1308, the drive shaft 1458, cylinder 1450 and drive arm 1462 move together as a unit.

In addition, a compression spring 1460 is secured between the top of the follower yoke 1454 and the base of the top support plate 1334. The spring 1460 serves to hold the pleat clamp 1190 in a normally closed condition and cam 1308 provides the necessary force to overcome the compressive effect of compression spring 1460 to open pleat clamp 1190.

The pleat clamp drive arm 1212 is provided with a drive lug 1216 which is provided with a circular opening 1217. As indicated hereinbefore, the header clamp is indexed back into the pleat sewing area during the pleat sew cycle. As shown in FIG. 25 the solid line for drive arm 1212 and drive lug 1216 shows the location of those parts during the sew cycle while the phantom lines show their position during the pleating cycle. During the pleating cycle, when the pleat clamp 1190 needs to be opened, the drive lug 1216 slides onto a drive arm 1462 which is rigidly attached to the pleat cam air cylinder 1450. When the drive shaft 1458 is moved by cam 1308, the upward movement of air cylinder 1450 likewise raises drive arm 1462 and thus the pleat clamp drive arm 1212 so as to open pleat clamp 1190.

Reference to FIG. 34 and the cam pattern for the pleat clamp cam indicates that the cam 1308 holds the pleat clamp 1190 open during the majority of the pleat cycle, the clamp being closed only at the very beginning and end of the pleat cycle as well as throughout the pleat sewing cycle. Thus, after the fifth pleat has been sewn and the entire pleat cycle for the panel has ended the cam drive shaft 1316 will no longer be rotated. In order to eject the completed panel, therefore, it remains necessary to open the normally closed pleat clamp 1190 and this is accomplished by cylinder 1450.

The cylinder drive rod 1451 is normally fully retracted into cylinder 1450. The drive arm 1462 is fixed to cylinder 1450 and following the sew cycle the header clamp assembly 1154 will be returned to its pleat position so that drive lug 1216 is again engaging drive arm 1462.

Cylinder 1450 is provided with air ports 1450A and 1450B which are suitably connected to the air supply by valve SV-58. When the cylinder 1450 is actuated causing cylinder drive rod 1451 to move to its extended position, the cylinder 1450 and drive arm 1462 will be forced upward which causes a like upward movement of the pleat clamp drive arm 1212, thus opening pleat camp 1190.

An air cylinder 1470 which is secured to the rear portion of the side frame 754, as shown in FIG. 2, is provided with a cylinder driving shaft 1472, a push lug 1474, air ports 1471A and 1471B which are also suitably connected to the air supply by valve SV-58. At the completion of the pleating cycle, the indexing slide 1166 will have been moved from its extreme left initial starting position to its extreme right ending position, and upon being activated, cylinder 1470 will return the indexing slide 1166 to its initial extreme left starting position. The actuation or indexing of the index slide 1166 is accomplished during the pleating and sewing cycle by the indexing cam 1310 but, as was indicated previously, at the completion of the pleat and sew cycle, the clutch 1142 will serve to disconnect the drive shaft 1316 from the motor 1140 so that the cams 1304-1314 will no longer provide a driving function. Thus, the cams will not return the indexing slide 1166 back to its starting position and this return of the indexing slide 1166 is effected by push lug 1474 which is connected to drive arm 1472 of cylinder 1470. When cylinder 1470 is energized by the controller, the lug 1474 will contact the extreme right-hand edge of the indexing slide 1166 and push the indexing slide 1166 back to its initial left-hand position ready to be indexed through the next pleat and sew cycle.

As shown in FIG. 27, the cam shaft 1316 also drives a pleat cycle switch cam 1315 which operates a double contact switch 10307 having contacts 10307A and 10307B. While the pleating cycle is in progress, the switch arm 1317 will be on the surface of cam 1315 and out of the hole 1319 provided in cam 1315. In that position the pleat forming clutch/brake relay 1850 is held in its actuated condition and at the end of the pleat cycle when the switch arm 1317 drops into hole 1319, switch contact 10307B is closed, producing input signal I-10307 to the controller indicating that the pleat forming is complete.

Referring now to the sewing indexing assembly 1160 it provides the stitching motion for the header clamps and each clamped pleat during the pleat sewing cycle and is located in an area behind the pleating station. Support walls 1500 and 1502 mounted to the rear frame 1501 as by welding serve to support a drive shaft 1504 which is in a driving relationship with motor 1480, by means of a gear reducer 1482 which operates through a clutch/brake mechanism generally referred to at 1484. The motor 1480 is a Dayton ¾ h.p. 1725 rpm three phase, 22 DU, 60Hz. The gear reducer 1482 is a REX Perfection American Co. 60:1 ratio, 0.78 h.p. input at 1750 rpm.

Gear reducer 1482 is mounted on a vertical frame member 1478 by any suitable means such as mounting bracket 1479.

Motor 1480, through a pulley 1481 and belt 1486, drives vertical shaft 1483 rotatably mounted on frame member 1478 by brackets 1487 through clutch/brake mechanism 1484 and specifically pulley 1485 and vertical shaft in turn drives the gear reducer 1482 and pulley 1488.

The gear reducer is drivingly engaged with cam shaft 1504 by suitable gearing (not shown) and pulley 1488 drives sewing machine 1300 through belt 1478 and pulley 1301.

The clutch 1490 and brake 1491 are operated by cylinder 1492 which is under the control of controller 1920.

It will be noted in FIG. 27 that a brake collar 1493 is provided with a cam surface 1494 leading into a notch 1495, and that brake show 1496 is provided with an extension lug 1497. When the cylinder 1492 is actuated to disengage the clutch 1490 and brake 1491, the shaft 1483 will continue to coast and continue to rotate until the lug 1497 rides up cam surface 1494 and into notch 1495. When the lug 1497 is so positioned, the sewing machine needle will be positioned at its upper stop position withdrawn from the pleat and ready for the next sew cycle.

Cylinder 1492 is mounted on bracket 1497' and is connected to the clutch/brake mechanism 1484 by a drive shaft 1498 and a connecting link 1499. Cylinder 1492 is also provided with air ports 1492A and 1492B for connection to the air supply. Connected or secured to the drive shaft 1504 are the stitch cams 1510 and 1512 and the pleat sewing thread cutter blades positioning cam 1514. The support walls 1500 and 1502 are connected to the support wall 1320 by means of any suitable means such as bolts 1516 and to portions of the rear frame 1501.

Two support lug extensions 1518 and 1520 extend upwardly from each support wall 1500 and 1502 and serve to support shaft 1522. The shaft 1522 is retained within the extensions 1518 and 1520 by any convenient means such as by washers 1524 and 1526 which are secured to shaft 1522 by means of set screws 1528. Each end of shaft 1522 respectively supports shafts 1530 and 1532 within linear bearings 1534 and 1536 so that the support shafts 1530 and 1532 can slide forwards and backwards through bearings 1534 and 1536 respectively. Connected across the ends of support shafts 1530 and 1532 is a positioning bar 1538 which is secured on the ends of shafts 1530 and 1532 as by screws 1540.

Figure 29:
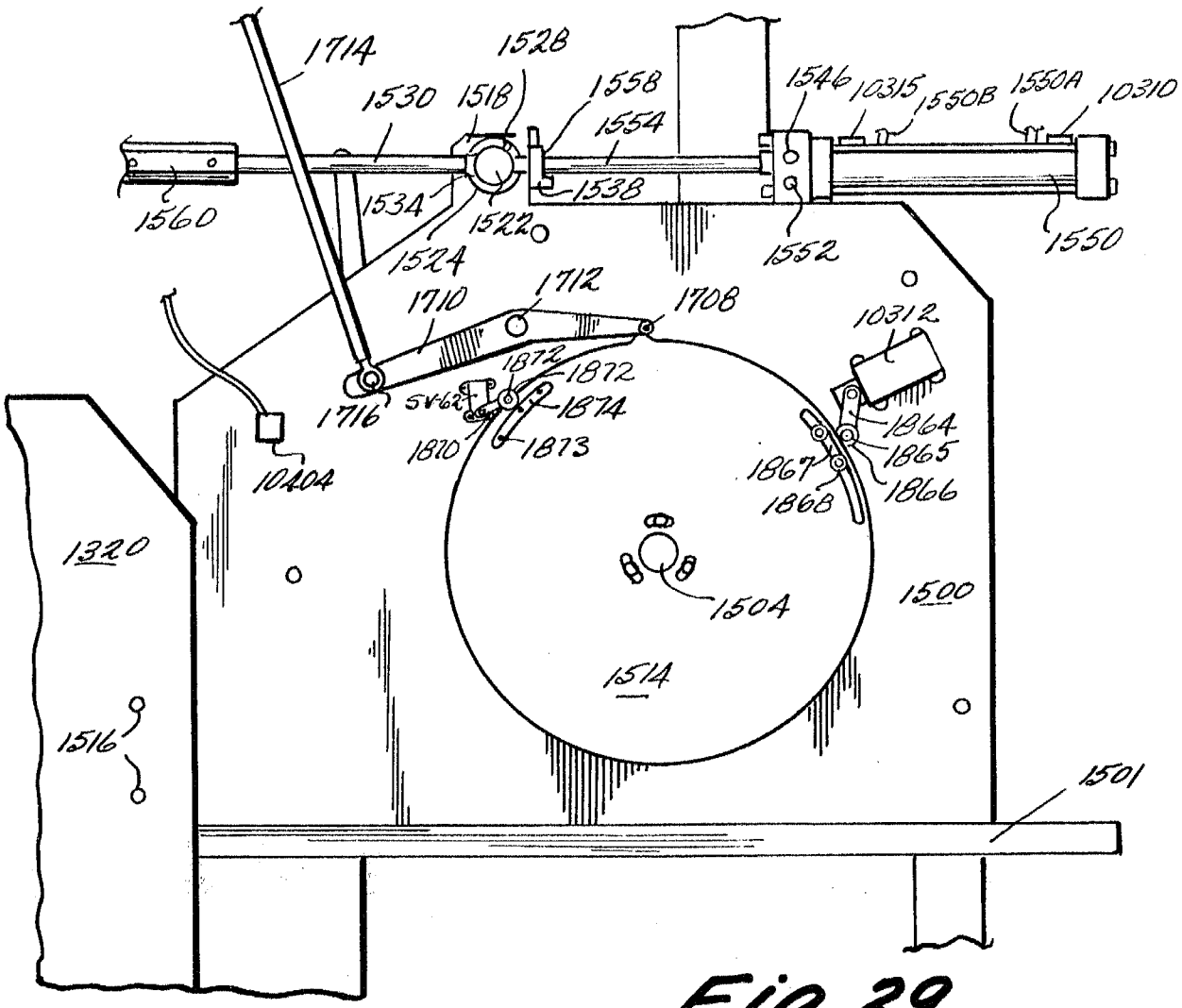
FIG. 29 is a side elevational view taken on line 27—27 of FIG. 2.

A mounting bracket 1546 is secured to support walls 1500 and 1502 by means of bolts 1548 and cylinder 1550 is mounted to the mounting bracket by means of screws 1552 or by any other convenient method shown in FIG. 29. The drive shaft 1554 of cylinder 1550 is provided with a ball-shaped outer end 1556. In addition, a clamping ball socket 1558 provided in the positioning bar 1538 is adapted to receive the ball 1556 on the outer end of drive shaft 1554. The support shafts 1530 and 1532 have mounting brackets 1560 and 1562, respectively, which are fastened to the index guide plate frame 1168 by means of screws 1564. The mounting brackets 1560 and 1562, in addition, have channelled support portions 1566 and 1567. As shown in FIG. 28, the channelled portions are directed inwardly toward each other and serve to contact and be supported by shaft 1568. Shaft 1568 is part of the cam actuated driving assembly 1570 which transmits the correct stitching motion to be transmitted to the header clamp assembly 1154 as supplied by cams 1510 and 1512. The channelled supports 1566, 1567 are always in engagement with shaft 1568 and in addition, the U-shaped channels 1566 and 1567 are provided in their forward position with ball sockets 1572 and 1574. Shaft 1568 is provided with ball-type ends 1576 and 1578, respectively.

Connected to shaft 1568 are rearward extending linkage arms 1580 and 1582 which are connected together by a cross brace 1584. Connecting links 1586 and 1588 depend from linkage arm 1580 and 1582, respectively, and are rotatably attached thereto by pins 1590 and 1592. A cross arm 1594 holds connecting links 1586 and 1588 rigid and serves as a mount for extension springs 1596 which are also secured to the frame member 1597. Drive arms 1598 and 1600 are welded to connecting links 1586 and 1588, respectively, and support a cam roller follower 1602 by pin 1604.

Also connected to and depending from shaft 1568 are L-shaped connecting links 1606 and 1608 which are held rigid by a cross arm 1610. The rear ends of connecting links 1606 and 1608 are in turn welded to a sleeve 1612 and are supported by rod 1616 which extends through sleeve 1612 and the lower ends of connecting links 1586 and 1588. A drive arm 1614 is also welded or otherwise rigidly secured to sleeve 1612 and a cam roller follower 1618 is attached thereto by pin 1620. The cross arm 1610 also serves as a mount for extension springs 1622 which are also secured to frame member 1623.

Thus, the drive linkage under the control of cams 1510 and 1512 comprises essentially a rigid box structure. Referring to FIGS. 27 and 28 and Chart I, the cam 1510 through cam follower. 1602 provides the horizontal movement of the F stitch pattern while cam 1512 through cam follower 1618 provides the vertical portions of the stitch pattern.

CHART I

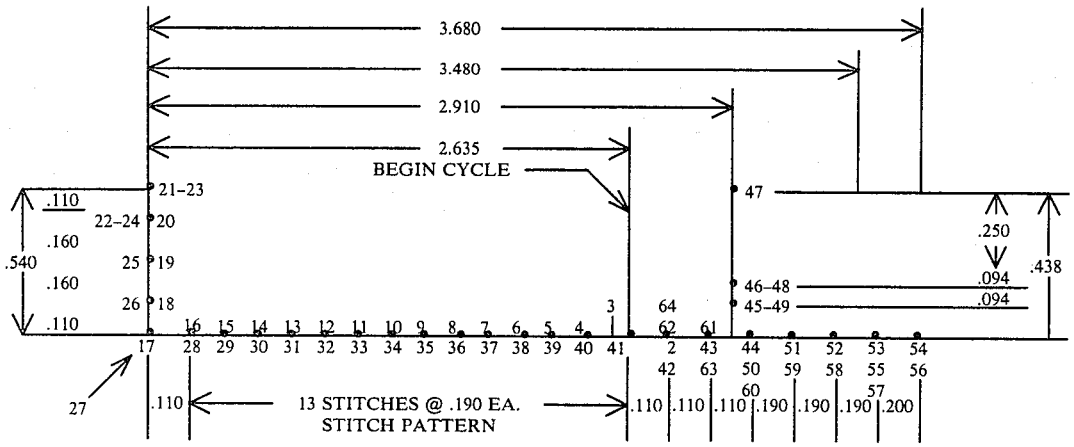

As indicated by Chart I, the stitch pattern is in the form of the letter "F" and is comprised of 64 individual stitches with overlapping stitches at the ends of the vertical rises and at the right-hand end of the pattern. One complete rotation of cams 1510 and 1512 causes the pleat clamp and header carriage assembly to be started and stopped 64 times so as to move the clamped pleat only between each stitch while the sewing machine needle is raised out of the fabric. Further, since movement of the pleat is under positive cam control, the pleat is moved in uniform increments and thus entry of the needle will be precisely placed so that the needle will re-enter the same stitch hole when double stitches are produced. For example, needle holes 5 and 6 are the same as holes 38 and 39. This will produce very uniform stitch patterns that are reproducible from pleat to pleat, thereby aiding in the uniformity of the final drape and in producing attractive stitching.

It is essential that the header carriage assembly 1154, the indexing assembly 1160 and the drive linkages just discussed be held rigidly together during the sew cycle.

To accomplish this, a lock mechanism, generally indicated at 1624 in FIG. 28, is provided. The lock mechanism 1624 is comprised of two locking pins 1626 and 1628 which extend through holes in shaft 1568 and are rotatably supported by sleeves 1630 and 1632 which are welded to shaft 1568. Each pin 1626 and 1628 is provided with a cross pin 1631 in their forward end and the index guide 1168 is provided with cut-out portions 1633 and indexing slide 1166 is provided with keyholes 1634 through which locking pins 1626 and 1628 will pass, as shown in FIG. 28. Sleeves 1630 and 1632 are provided with helical cam slots 1635 in which tightening lugs or guide pins 1636, which are welded to locking pins 1626 and 1628, will move when the locking pins 1626 and 1628 are rotated.

A drive link 1638 is secured to the rear end of locking pin 1626 as by key 1640 and drive link 1642 is secured to the rear end of locking pin 1628 as by key 1644. An air cylinder 1646 having a drive rod 1648 is connected to drive link 1638 through drive rod 1648 and pin 1650 and to drive link 1642 by means of a mounting bracket 1652 secured to the cylinder 1646 by screws (not shown) and pin 1654. Air cylinder 1646 is provided with air ports 1647A and 1647B and when actuated will cause locking pins 1626 and 1628 to rotate within sleeves 1630 and 1632, respectively. The cylinder 1646 is actuated following the rearward indexing of the header clamp assembly 1154 back into the pleat sewing position. Thus, the locking pins 1626 and 1628 will be extending through the index guide 1168 and the indexing slide 1166 and likewise through keyholes 1634. When the locking pins 1626 and 1628 are rotated by air cylinder 1646, the pins 1631 will be rotated in keyholes 1634 so as to establish a locking relationship therewith. At the same time, the guide pins 1636 will be moved within the helical slots 1635 thereby forcing the locking pins 1626 and 1628 to move rearwardly in sleeves 1630 and 1632. Thus, the locking effect is tightened as the locking pins 1626 and 1628 continue to rotate.

After a sew cycle is completed, the cylinder 1550 will be energized by the controller causing the cylinder drive shaft 1534 to connect with the bell socket 1558 in the cross arm positioning bar 1538 and causing the header carriage assembly to move forward to the pleat forming position. After completion of the pleat forming cycle, the cylinder 1550 is reversed in its operation so that the drive shaft 1554 is caused to move to the rear, the positioning bar 1538 will likewise be caused to move rearwardly and will thus move the header clamp assembly rearwardly since the support bars 1530 and 1532 are connected both to the header clamp assembly and to the positioning bar 1538. At the end of its stroke, the cylinder 1550 will be disconnected from ball socket 1558 in positioning bar 1538 and the shafts 1626 and 1628 will extend through the keyholes 1634 in the indexing slide 1166. The cylinder 1646 then will be energized causing the drive linkage to rotate the shafts 1626 and 1628, thus rotating the pins 1631 in the keyholes 1634 which locks together the indexing mechanism comprised of the support shafts 1530 and 1532 and the indexing bar 1538, the sewing drive assembly 1570 and the header clamp assembly 1154. The clutch mechanism 1508 will be actuated which places the motor 1506 into a driving relationship with the stitch cam drive shaft 1504 which causes the stitch cams 1510 and 1512 and the cutter positioner cam 1514 to be rotated. As the stitch cams 1510 and 1512 rotate, the stitch pattern as indicated in Chart I will be produced.

The clutch/brake mechanism 1484 is energized by the controller and the ensuing rotation of the stitch cams 1510 and 1512 will be in a stepped sequence timed with the needle of the sewing machine 1300 so that the clamped pleat is moved with respect to the movement of the needle only when the needle is out of the fabric, thereby preventing bent or broken needles.

The clutch/brake mechanism 1484, shown in FIG. 2, controls this starting and stopping and provides a drive sequence that allows cams 1510 and 1512 to make a single revolution per each pleat sewing cycle at a speed 1/64th that of the sewing needle so that the sixty-four stitches are placed in the pleats over a length of about 3.68 inches. The cams 1510 and 1512 are designed with a cycloidal motion displacement curve which allows for the production of shorter stitch lengths and provides a greater amount of time in which to make the pleat movements.

Figure 31:
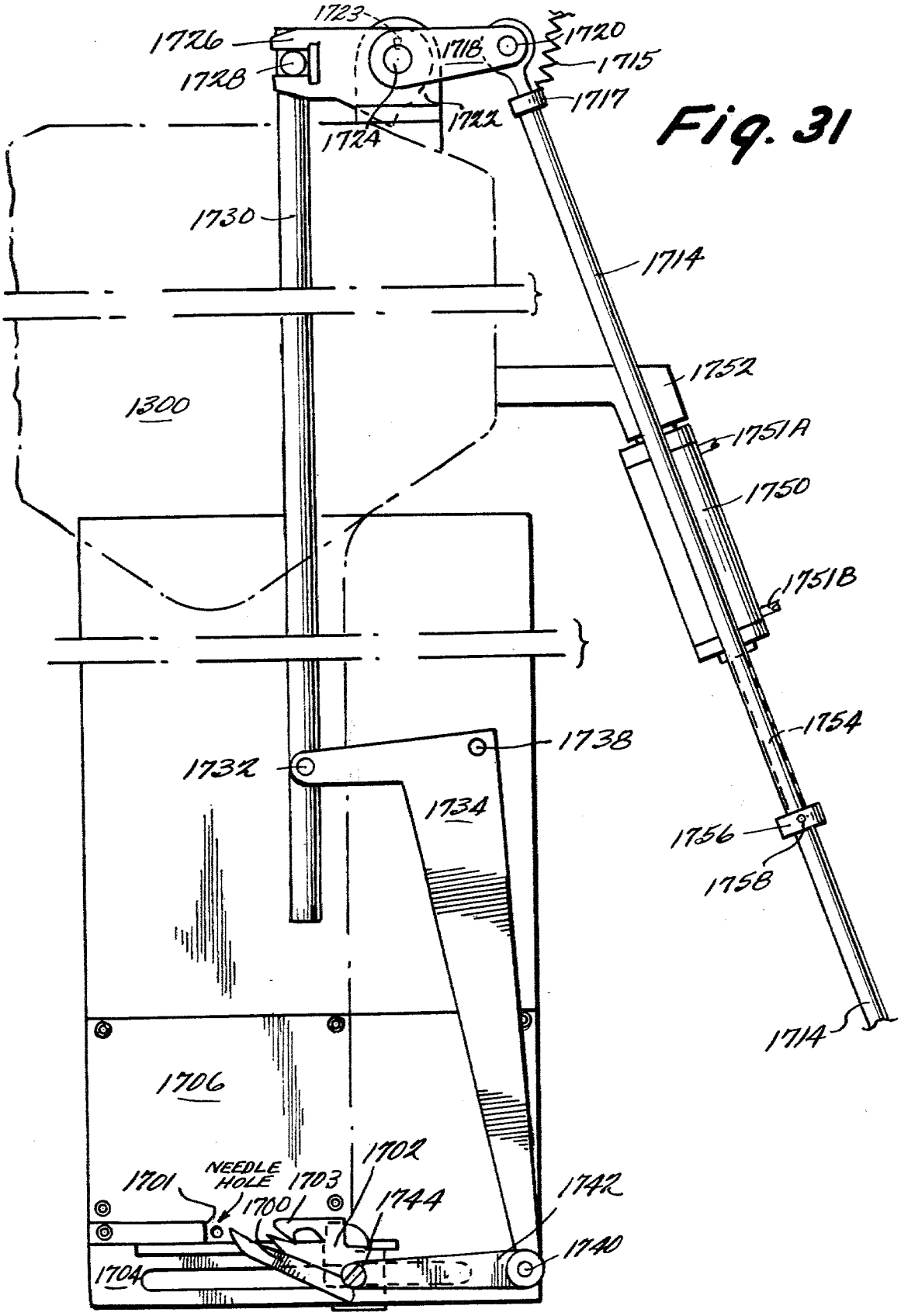
FIG. 31 is a vertical elevational view of the pleat sewing thread cutting device.

The cutting blade positioning cam 1514 has likewise been turned by the drive shaft 1504 and at the end by the time the end of the cycle is reached the cutting blades have been positioned. Referring to FIGS. 29, 31 and the diagram in FIG. 35, the cutting blades 1700 and 1702 which respectively are a bobbin thread cutting blade and a needle thread cutting blade, and a bobbin hook 1703, are slidably mounted in a cutter guide 1704 which is mounted to the throat plate 1706 of sewing machine 1300. A cutting anvil 1701 is also provided for blade 1702. The cutters 1700 and 1702 are operated or connected to the positioning cam 1514 by means of a cam roller follower 1708 which is secured to a follower arm 1710. The follower arm 1710 is pivotally connected to the mounting support wall 1502 by a follower arm pivot lug 1712. Rotatably connected to the opposite end of the following arm 1710 from the roller follower 1708 is connecting rod 1714 held thereon by a pivot screw 1716. The other end of connecting rod 1714 is rotatably connected to a connecting link 1718 by means of a pin 1720 with the connecting link 1718 being secured by a key 1723 to shaft 1724, which is rotatably secured in support bracket 1722 as by snap rings (not shown). The connecting rod 1714 also has an extension spring 1715 secured to the overhead beam 752 and serves to hold cam follower 1708 on cam 1514 and act as the return for the cutting blades 1700 and 1702. A connecting link 1726 is likewise secured to shaft 1724 and by pivot screw 1728 is pivotally connected to a drag link 1730 which in turn is pivotally connected by pin 1732 to drag link 1734. The drag link 1734 is secured to the throat plate of sewing machine 1300 by means of the pivot lug 1738 and is connected by means of pin 1740 to the connecting link 1742 which is connected to the cutters 1700 and 1702 by pin 1744.

The cylinder 1750 is mounted by means of a mounting bracket 1752 to the sewing machine 1300 and the drive shaft 1754 is connected to connecting rod 1714 by a bracket 1756 and pin 1758. The cylinder 1750 is provided with air ports 1751A and 1751B for connection to the air supply and is operated by solenoid valve 54-54 which also actuates cylinder 1646 when the header assembly 1154 is unlocked from the pleat sewing station.

Figure 35:
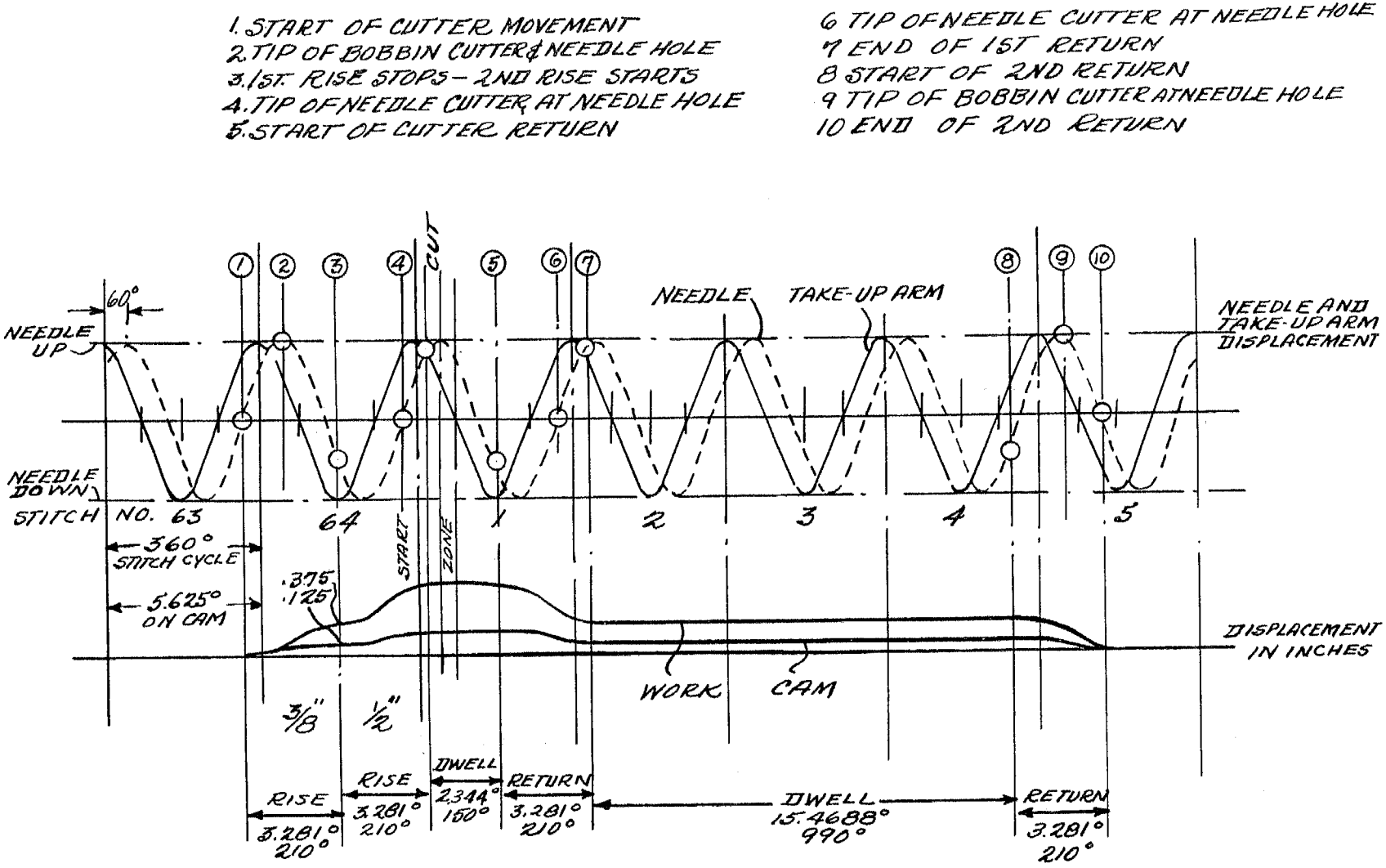
FIG. 35 is a diagram of the cam patterns for the thread cutting cam.

As shown in FIG. 35, the cutting action, which includes the positioning of blades 1700 and 1702 and the actual cutting, occurs between stitch 63 of the present cycle and stitch 1 of the next cycle. The circled numbers correspond to the listed events. At ① the positioning of the cutters is initiated. The bobbin thread cutter is positioned first and picks up the bobbin loop following the 63rd stitch as at ②. Thereafter, the needle thread is picked up by cutter 1702 prior to its being cut. The cutting action at the top of the take-up arm stroke is accomplished by cylinder 1750 at the same time cylinder 1646 unlocks the locking mechanism 1624. The bobbin thread is sliced by blade 1700 while the needle thread is cut between blade 1702 and anvil 1701. Thereafter, the cutting blades 1700 and 1702 will begin their return cycle indicated at ⑤. Thereafter, the thread retainer 1703 which is mounted to cutting blades 1700 and 1702 entraps the bobbin thread tail during the return cycle ⑤ through ⑦. The thread retainer remains in this position for three stitch cycles to ensure initiation of the lock stitch. The cutter assembly moves to its retracted position during the cycle ⑧ through ⑩.

DOFF ARM ASSEMBLY

Turning now to FIGS. 3 and 32, the doff arm 1800 is mounted to the overhead beam 752 by means of a doffing arm mounting bracket 1802. The doff arm 1800 itself is attached to a second mounting bracket 1804 which is rotatably connected to bracket 1802 by doffing arm pivot pin 1806. A cylinder 1808 is secured to bracket 1802 by means of a cylinder mounting bracket 1810 by pin 1812, and driver arm 1814 is rotatably retained in bracket 1804 by pin 1816. Cylinder 1808 is provided with air ports 1809A and 1809B which are connected to the air supply through solenoid valve 54-56.

Connected to the bottom end of the doff arm 1800 is clamp arm 1820 which extends into the pleating station area, as shown diagrammatically in FIG. 3.

As diagrammatically shown in FIG. 32, the clamp arm 1820 is provided with an extension 1822 which serves as a mounting bracket for a movable clamp arm 1824. The movable clamp arm 1824 is mounted to the extension 1822 by pin 1826. An air cylinder 1830 is mounted within the clamp arm 1820 by a bushing 1832 and has a drive shaft 1834 which is connected to the movable clamp arm 1824 through a clevis-type connecting link 1836 and drive link 1838 by pins 1840, 1842 and a lug 1844 welded to the interior of movable clamp arm 1824. The clamp portion 1846 of clamp arm 1820 and the clamp portion 1848 of movable clamp arm 1824 may be provided with a rubber or cork surface to improve the gripping effect of the doff arm.

The cylinder 1830 is provided with air ports 1831A and 1831B and these are connected by T-type connections (not shown) and operated in the same fashion as cylinder 1808.

In operation, the controller will actuate cylinders 1808 and 1830 which will cause the clamp arm 1824 to rotate toward and to mesh with the clamp arm 1820 so as to securely clamp the completed drapery panel therebetween. Cylinder 1808 will cause the doff arm 1800 to pivot in a counterclockwise direction around pin 1806, thereby raising the panel away from the pleat and sew station.

RIGHT PLEAT AND SEW STATION CIRCUIT

Figure 45A:
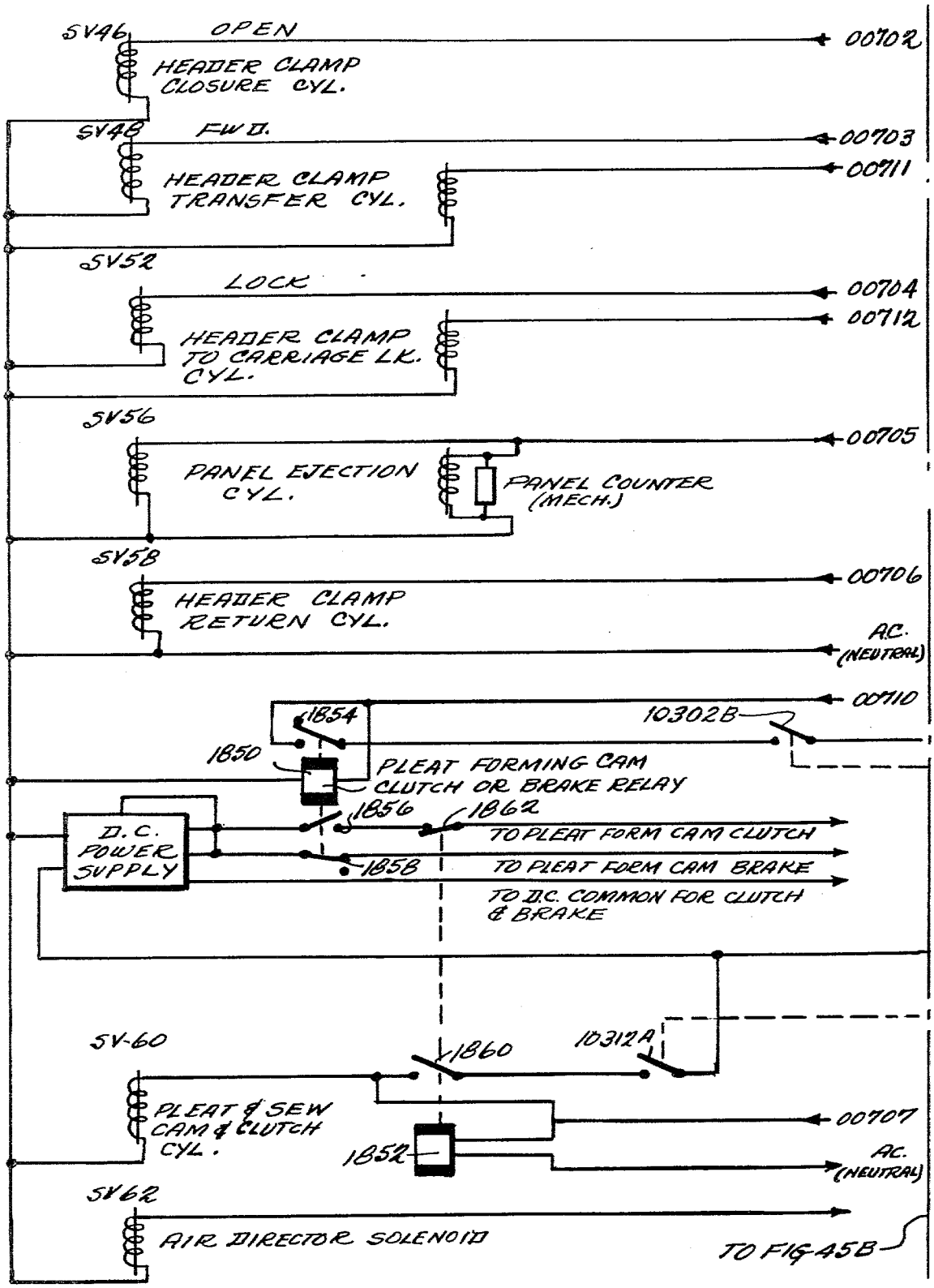
FIGS. 45A and 45B show the right pleat and sew station control circuit.

In FIG. 45A, the upper portion of the circuit shows the actuation method for the header clamp closure cylinder 1176, the cylinder which causes the header clamp to be transferred cylinder 1550, the cylinder 1646 which causes the header clamp to be locked to the carriage, cylinders 1808 and 1830 which are the panel ejection cylinders, and the header index slide return cylinder 1470 which causes the indexing slide 1166 to move back to its initial position.

The header clamp cylinder 1176 is controlled by the solenoid valve SV-46 which, when is actuated by the output signal 00702 from controller 1920, directs air to air port 1176A. The return motion is provided by a spring within cylinder 1176 (not shown) and directs air flow to air port 1176B. The header clamp transfer cylinder 1550 is a double-acting cylinder in that it causes the header clamp assembly 1154 to move both forward and backward. Output signal 00703 causes the cylinder drive rod 1554 to move forward into socket 1558 and output signal 00711 causes the drive rod 1554 to move the header assembly back into the sewing area prior to the beginning of the sew cycle. The forward motion of cylinder 1350 is controlled by solenoid SV-48 and directs air flow to port 1550A. Solenoid SV-50 provides the return motion by controlling the reversal of air flow to cylinder 1550 by connecting port 1550B to the air supply.

The lock cylinder 1646 is also dual acting in that this cylinder serves to both lock and unlock the header clamp assembly 1154 in the sewing area. The locking motion of cylinder 1646 is controlled by solenoid valve SV-52 which is actuated by the controller output signal 00704 and SV-52 switches so as to connect air port 1647A to the 80 psi air supply. This causes drive rod 1648 to retract into cylinder 1646 and rotate locking pin 1626 and 1628. The unlocking or return motion is also controlled by solenoid valve SV-54 and output signal 00712 from controller 1920 switches SV-54 so that air port 1647B is connected to the air supply causing drive rod 1648 to be extended which rotates locking pins 1626 and 1628 to an unlocked position. SV-54 also activates thread cutting cylinder 1750 and serves to also connect air port 1752A to the air supply which extends drive rod 1654 and provides the cutting stroke for the pleat sewing needle and bobbin threads. When output signal 00712 is removed, air ports 1751A and 1751B are opened to the atmosphere and the return motion is supplied by spring 1715.

The panel clamp ejection cylinders 1808 and 1830 are controlled by solenoid valve SV-56 which is actuated by output signal 00705 so that SV-56 connects ports 1809A and 1831A to the air supply. At the same time, output signal 00705 is generated, the mechanical panel counter is tripped by the movement ejection arm and thus serves to provide an indication of how many panels are ejected from the machine. The cylinder return is controlled by an internal spring within valve SV-56 to reverse the air supply to ports 1809B and 1831B.

The header clamp return cylinder 1470 is controlled by solenoid valve SV-58 which is actuated by the output signal 00706 and to actuate cylinder 1470 connects air port 1471A to the air supply. The return motion for drive shaft 1472 is provided by an internal spring within valve SV-58 which shifts the air supply to port 1471B causing drive shaft 1472 to be retracted into cylinder 1470.

The lower half of the circuit shown in FIG. 45A controls the right station pleat forming and pleat stitching motor clutches which are controlled, respectively, by relays 1856, and 1852. Relay 1856 is initially actuated by output signal 00710 which causes the relay contacts to shift from their normal position as shown to their closed position.

Thus, relay contacts 1854, 1856 and 1858 are shifted. Contact 1854 serves to latch relay 1850 in an energized condition by completing the circuit from output signal 00710 to the AC neutral line. Contacts 1856 and 1858 act together when shifted to simultaneously engage the clutch and remove the brake from the pleat forming clutch/brake mechanism 1340 by changing the connection of the power supply from the brake to the clutch. Switch contact 10307A is also in the latching circuit with contact 1854 and is one of the contacts within switch 10307 which is actuated by the pleat switch cam 1315. When the switch arm 1317 of switch 10307 is on the cam surface and cam 1315 is rotating, contact 10307A will be closed and the complementing contact 10307B will be open. A cut-out area 1319 is made in cam 1315 and when the switch arm 1317 drops into that cut-out area 1319 at the conclusion of one revolution of cam 1315 which is at the end of the pleat cycle, contact 10307A is opened, unlatching and thus de-energizing relay 1850 while contact 10307B is closed, thereby producing input signal I-10307 indicating completion of the pleat cycle. De-energization of relay 1850 shifts contact 1854, 1856 and 1858 back to the position shown in FIG. 45A which again energizes the brake in the clutch/-brake mechanism 1340.

Relay 1852 controls the pleat stitching clutch cylinder 1492 by energizing solenoid valve SV-60. Relay 1852 is initially energized by output signal 00707 which causes contacts 1860 and 1862 to shift from the position shown in FIG. 45A. Contact 1860 serves to latch relay 1852 in an energized condition and also to keep valve SV-60 in an actuated condition by maintaining a closed circuit from output signal 00707 to the AC neutral line.

Contact 10312A is also located in the latching circuit with contact 1860 and is one of two contacts of switch 10312. Switch 10312 is mounted on support wall 1502 and is operated by a cam 1867 attached to cam 1514 by bolts 1868. Switch 10312 has a switch arm 1864 and a cam follower 1866 attached thereto by pin 1865 and when cam 1514 is rotating and the follower 1866 is not raised by the cam 1867, contact 10312A is closed while the complementary contact 10312B is open. When the follower 1866 and arm 1864 are raised by cam 1877, contact 10312A is opened which de-energizes relay 1852 and valve SV-60 allowing the clutch to be disengaged and braked. Simultaneously contact 10312B closes and produces input signal I-10312 indicating the pleat sewing cycle is complete.

Contact 1862 is controlled by relay 1852 and is provided to assure that both pleat forming and pleat stitching do not occur simultaneously.

The air director solenoid SV-62 is mounted on support plate 1502 and is controlled by cam 1514 as shown in FIG. 29. Valve SV-64 is comprised of a switch arm 1870 which has a cam follower 1872 attached thereto by pin 1871. A separate cam 1874 is attached to cam 1514 by bolts 1873 and will operate valve SV-62 between stitches 46 and 48 so as to remove or reduce tension on the sewing thread during stitch 47. As will be noticed from chart I, stitch 47 is a long stitch. The tension is created by a conventional spring controlled tension disc. The disc is mounted by means of a shaft and the air supply from valve SV-62 is directed against this shaft so as to move the disc against the spring and away from the thread thereby removing tension on the thread.

Figure 45B:
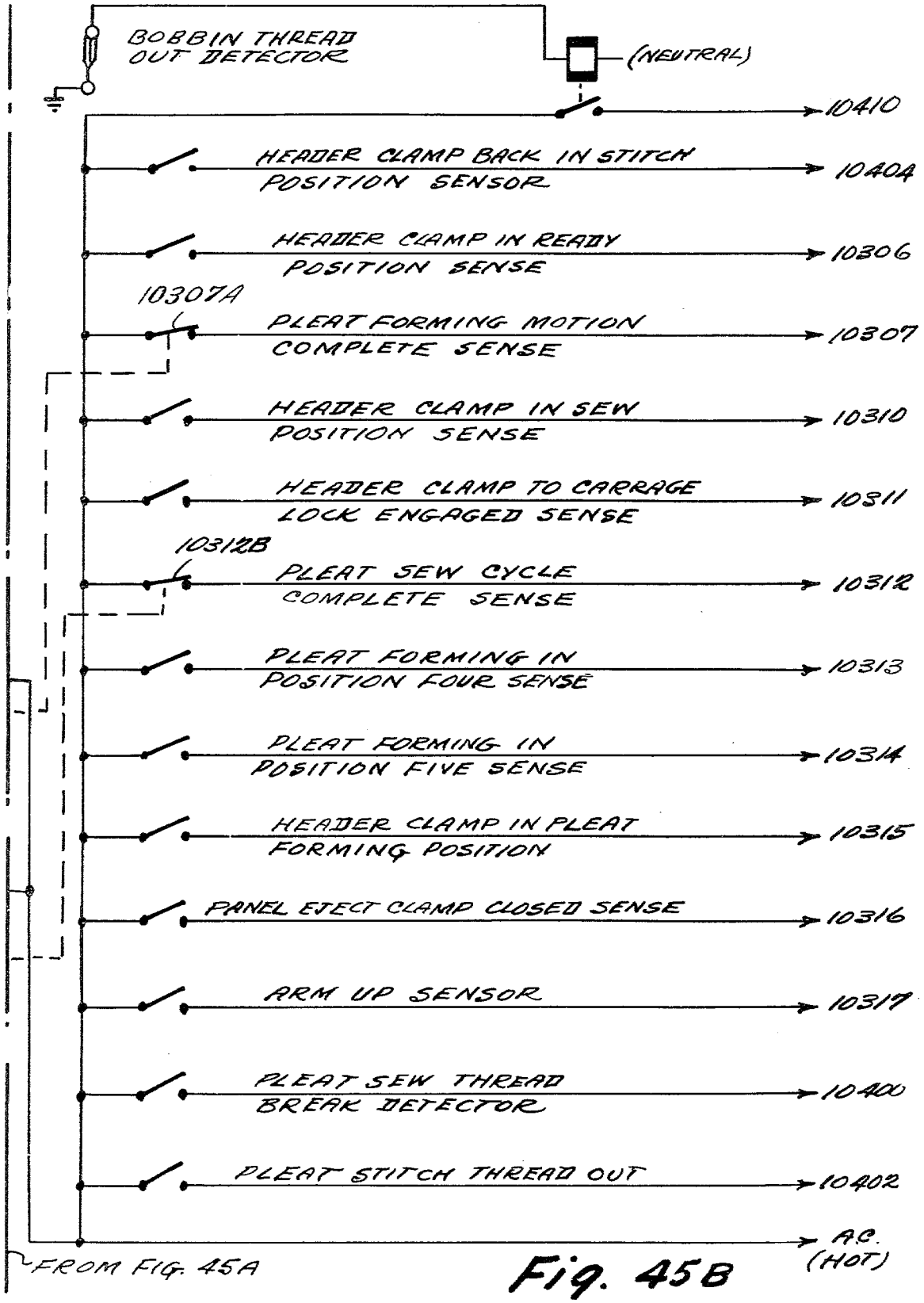
Figure 46A:
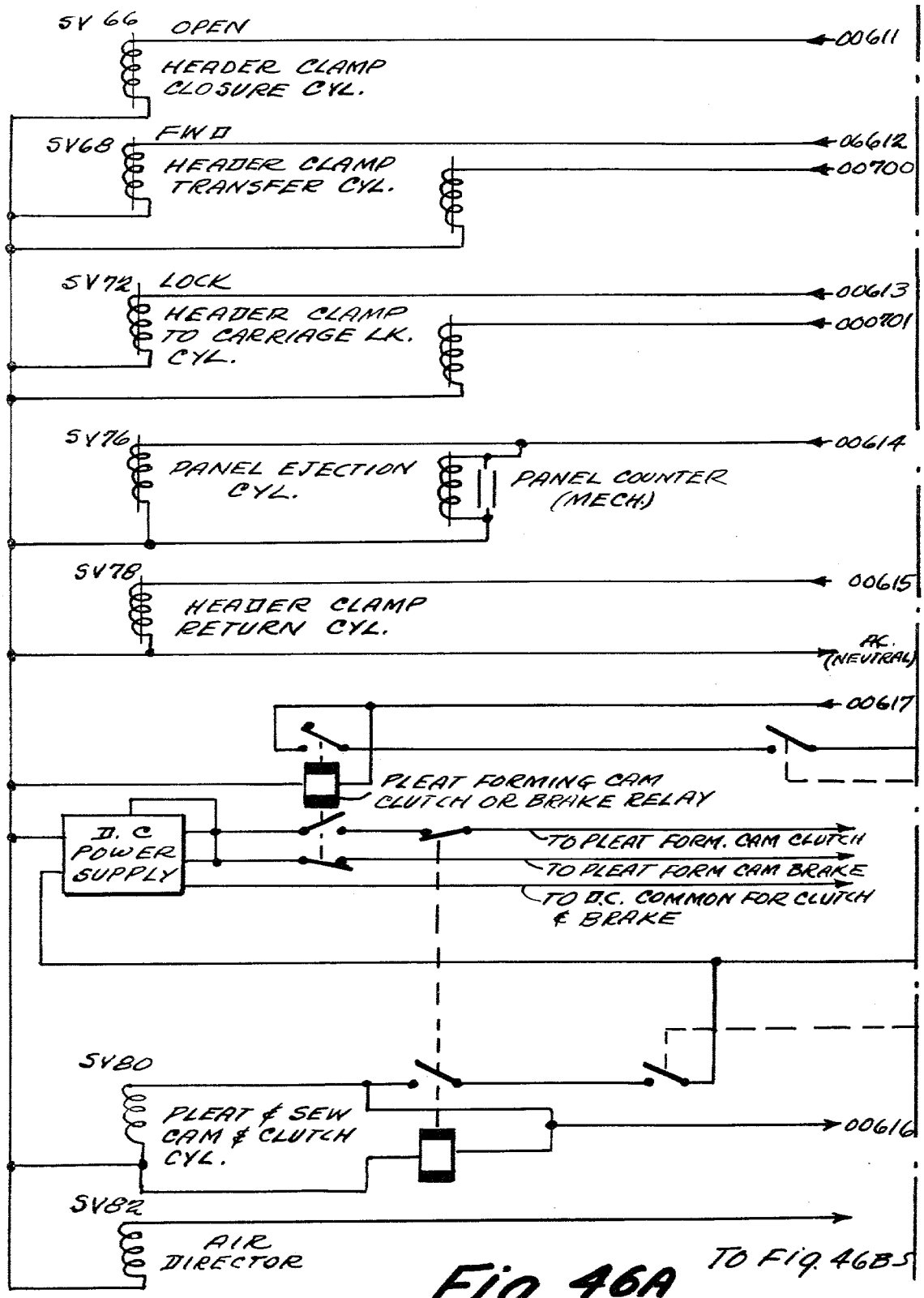
FIGS. 46A and 46B show the left pleat and sew station control circuit.
Figure 46B:
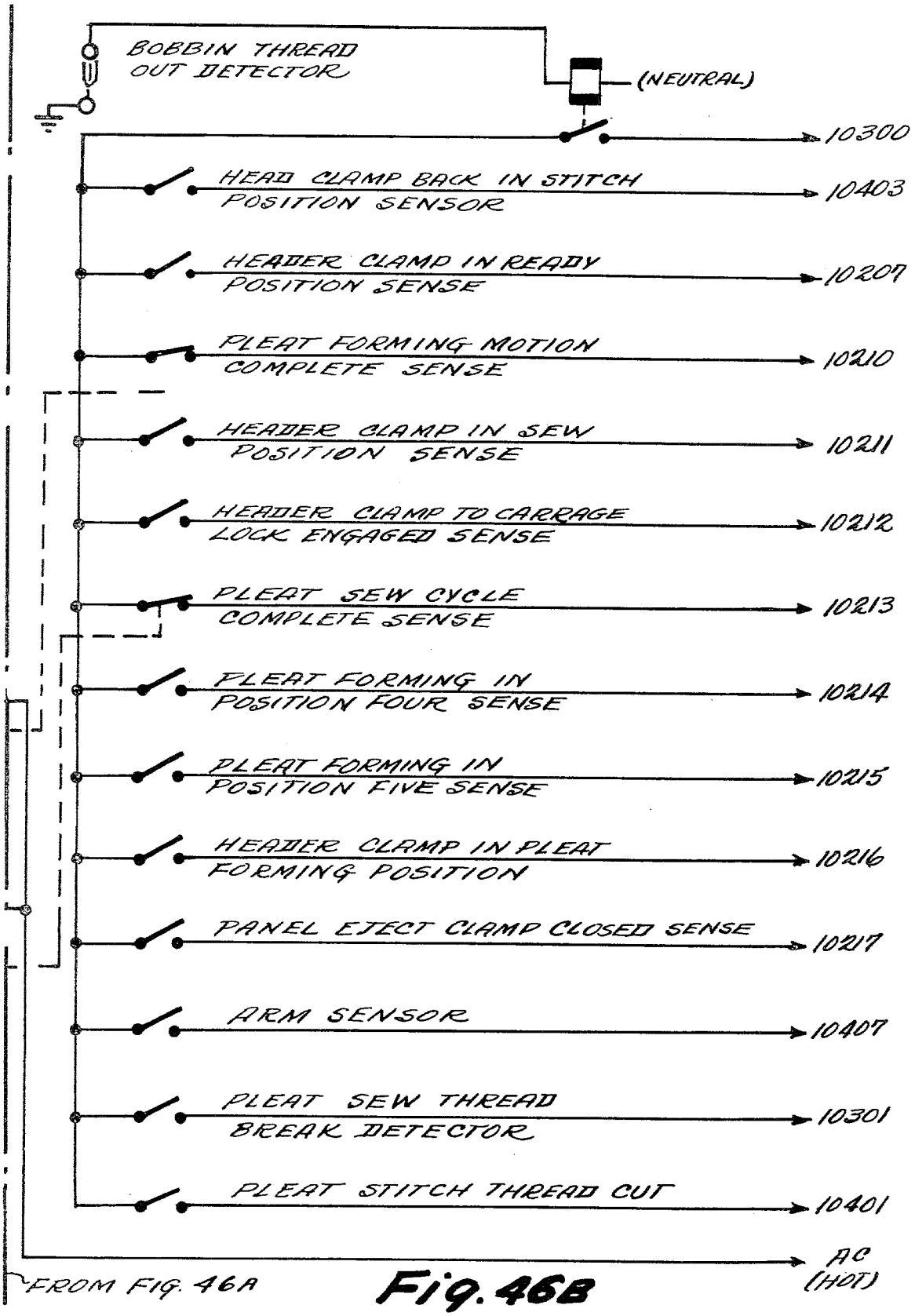

Turning to FIG. 45B, there again are a plurality of microswitches for sensing the relative position of various portions of the pleat and sew apparatus.

The bobbin thread detector, as described in a concurrently filed copending application, U.S. Pat. application Ser. No. 609,918, will produce a signal which in this instance can be directed as an input signal to the controller that the bobbin has run out of thread. In addition, the detector could also be set to indicate when the bobbin was low on thread.

Switch 10404 is a fluidic back pressure switch, shown in FIG. 35. As was indicated hereinabove, the shaft 1568 has ball-shaped ends 1576 and 1578 which fit within ball sockets 1572 and 1574 in the brackets 1560 and 1562. A fluidic sensing port 1880 is provided in bracket 1562 and is connected by an air line 1882 to a fluidic back pressure switch 1884. Switch 1884 has a terminal PS which is connected to the 80 psi air supply which is reduced by a regulator 1886 to 10 ps. Terminal S is connected to air line 1882 and the back pressure through line 1882 will cause the air supply to switch between terminals $O_1$ and $O_2$. When the ball 1578 is fitted in socket 1574, there will be back pressure on line 1882 causing the air supply to pass through terminal $O_1$, line 1888 to pneumatic switch 1890 which, when closed, will produce input signal I-10404 indicating a tight connection between ball 1578 and socket 1574 and that the header clamp assembly 1154 is in the stitch position.

Switch 10306 is located on the forward end of air cylinder 1470 and is actuated by a magnet (not shown) on the drive rod 1472. When cylinder 1470 is actuated by output signal 00706, switch 10306 is actuated when drive rod 1472 is fully extended. The indexing slide 1166 will have been returned to its starting position and input signal I-10306 will have been produced indicating the header clamp is again in a ready position.

Switches 10310 and 10315 are located on the rear and front portions, respectively, of air cylinder 1550. Each is a reed switch and will be tripped by a magnet (not shown) on drive rod 1554. Switch 10315 is actuated when the drive rod 1554 is extended and produces input signal I-10315 indicating that the header clamp assembly 1154 is in its pleat forming position. Switch 10310 is actuated when the drive rod 1554 is retracted into cylinder 1550 and produces input signal I-10310 indicating that the header clamp is in pleat sewing position.

Switch 10311 is a reed surface located on cylinder 1646 and when the drive rod 1648 is retracted into cylinder 1646 a magnet (not shown) thereon trips switch 10311 producing input signal I-10311 indicating the lock mechanism 1624 is engaged.

Reed switches 10313 and 10314 are located on a T-shaped bracket 1892 fixed to support plate 1334, as shown in FIG. 26B. A magnet 1894 is fixed to lug 1182A and when the fourth loop is in position to be pleated, as shown in FIG. 26B, magnet 1894 trips switch 10313 producing input signal I-10313 indicating the fourth loop is in position. When index slide 1166 moves into the fifth pleat position, magnet 1894 trips switch 10314 producing input signal I-10314 indicating that the fifth loop is in pleat position.

Reed switch 10316 is located on cylinder 1176 and is tripped when cylinder 1176 is energized to close the upper header clamp member 1162. Movement of the cylinder drive rod moves a magnet (not shown) which trips switch 10316, thereby producing input signal I-10316 indicating that this clamp is closed.

Reed switch 10317 is located on cylinder 1808 which moves the doffing arm 1800. When the cylinder drive rod 1814 is extended, a magnet (not shown) on drive rod 1814 trips switch 10316 producing input signal I-10317 indicating that the doff cam is raised.

Microswitch 10400 is the same type of switch as thread break detector 1042 and switch 10201 used in the corner sew station. When the thread being monitored breaks switch 10400 is tripped, producing input signal I-10400.

Reed switch 10402 is located on cutting cylinder 1750 and is actuated by a magnet (not shown) on drive rod 1754 and when drive rod 1754 is extended, switch 10402 is tripped producing input signal I-10402 indicating the pleat stitching thread has been cut.

The circuit for the left pleat and sew station is the same as for the right pleating and sewing station. Thus, while solenoids SV-66 through SV-82 are used, they are controlled by different output signals from the controller and control different cylinders. Likewise, the operation of the sensing switches, solenoids and the actuation of the pleat-forming and sewing clutches is the same as just described for the right pleat and sew station.

MAIN CONTROL CIRCUIT

A 230 volt A.C. current, three phase, is applied as the input voltage for the apparatus. Circuit breakers 1900, 1902 and 1904 are provided and thus the power supply for motors M1 through M8 is directly fed to those motors through the various MS contacts. The main power ON/OFF switch S1 is shown in its ON position so that when the momentary ON switch S2 is depressed, the relay coil 1906 will be energized causing the contacts 1908, 1910 and 1912 to be moved from their normally open position to a closed position. Contact 1908 serves as a latching contact for the coil 1906 so that the contacts 1908, 1910 and 1912 will remain closed until the main power switch 10017 is turned off. A transformer 1914, to which the 230 volt input is applied, is an oscillation-type transformer which reduces the 230 volt input to 115 volt output. The lamp 1906 will be energized off of the output side of the transformer 1914 to show that the machine is ON and that the coil 1906 is energized.

The DC output voltage from transformer 1914 is applied to the controller power supply 1918 which in turn powers the controller 1920. The power supply for the controller is a voltage regulator type of power supply and assures that the voltage level for the controller will remain at a steady state regardless of line variations. Thread break detecting microswitches, such as 1042 in FIG. 23, are provided for each sewing machine and are in line with the contact 1910 and the DC output from transformer 1914. As indicated previously, they also provide an input signal to the input side of the controller indicated at 1930. The controller 1920 also has an output segment indicated at 1932 for controlling the various relays and solenoids as indicated previously.

The DC voltage from transformer 1914 is also directly applied to the motor starters for Motors M1 and M7 with a fuse 1934 being in line therewith. Thus, when the ON button 10016 is energized, the panel tail feed motor and the overhead transfer motor are turned on immediately, these motors being M1 and M7, respectively. While power is applied to the other motors, they will only be activated if the appropriate MS switches are turned on by the motor starter circuits which are shown in the right-hand side of FIG. 36C.

Figure 36A:
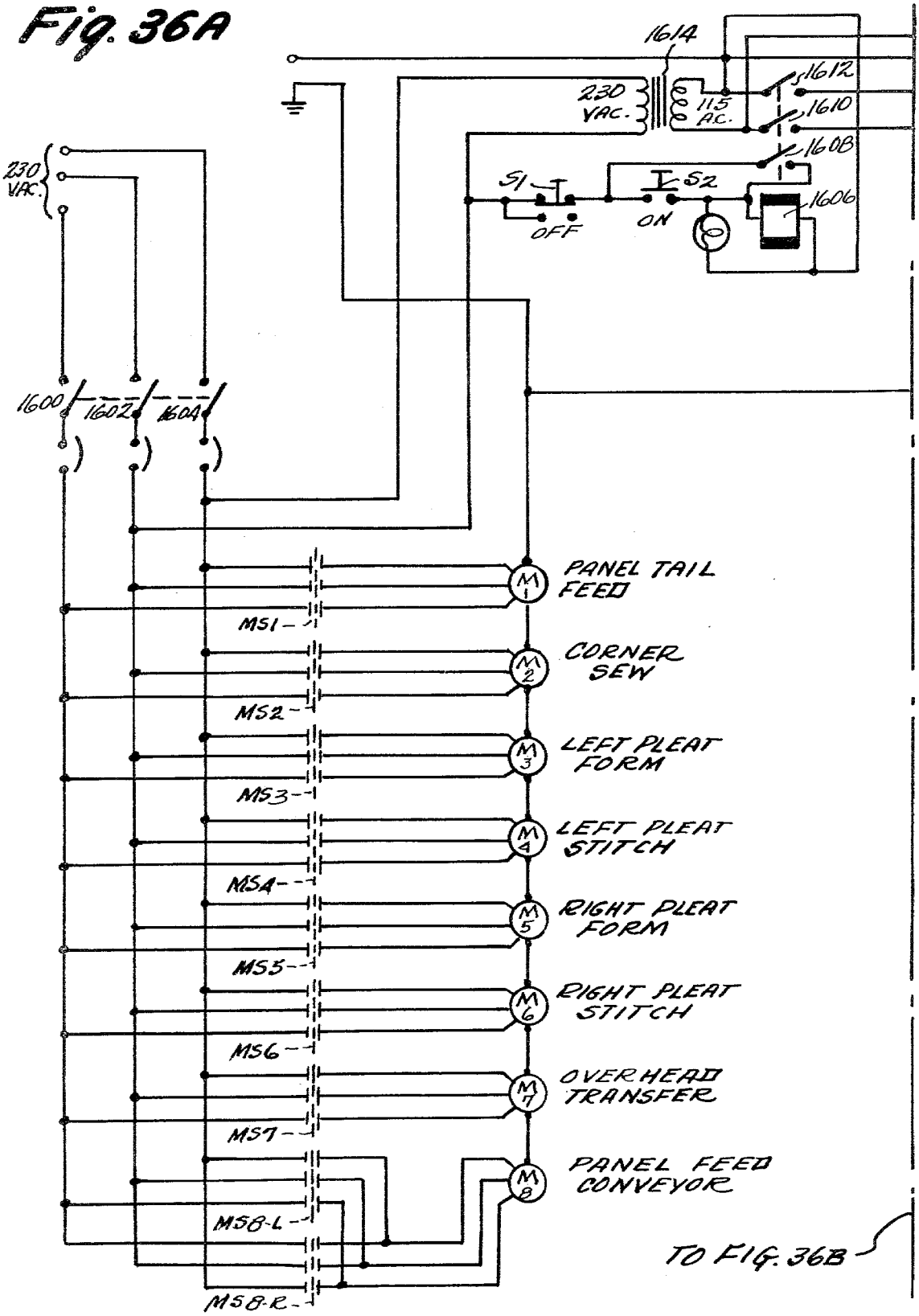
FIGS. 36A, 36B and 36C show the power wiring circuit for the pleating machine.
Figure 36B:
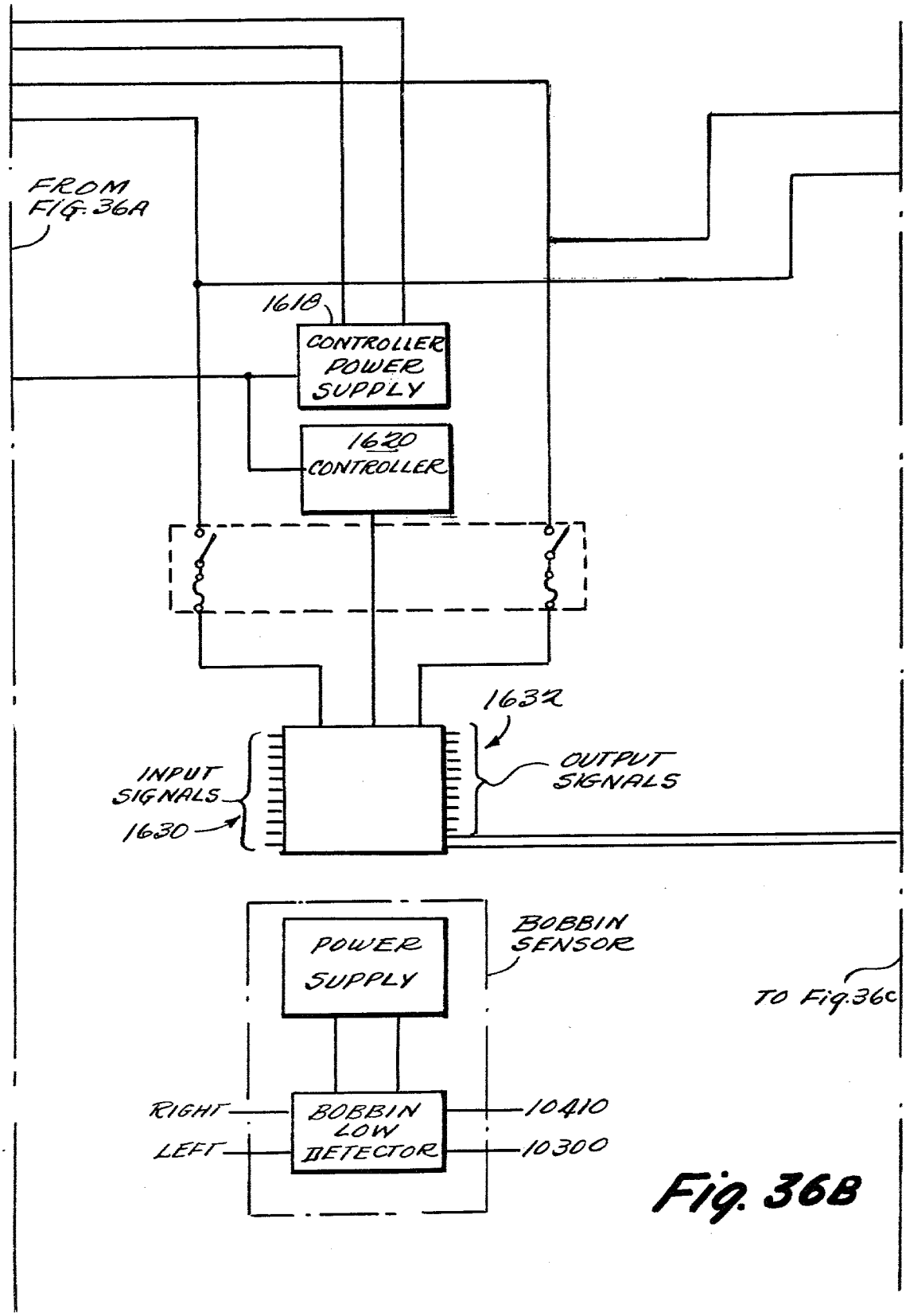
Figure 36C:
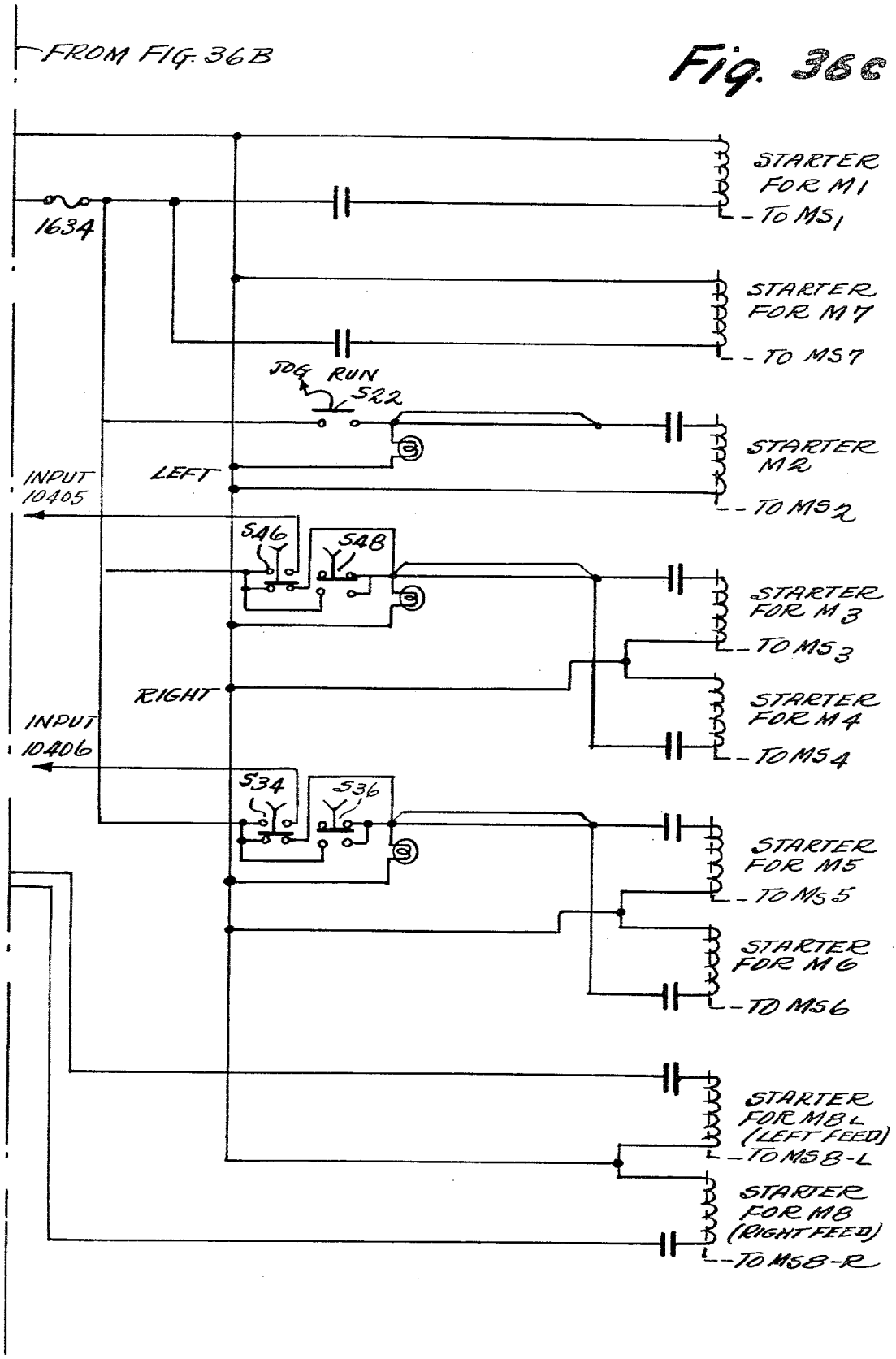

The switches shown in FIG. 36C for controlling the corner sew, the right and left pleat stations, and the conveyor motors are controlled by the corner sew run/jog switch, by the respective right and left pleat station run/jog switches, and by output signals 00713 and 00714 from controller 1920 which determine which way the tail of the panel should be moved. These are the same switches referred to on figures in the circuit diagrams for the corner sew and pleating stations and thus do not require further explanation.

Located below the input-output box is the bobbin low detector. In this regard, reference is made to the copending U.S. Pat. application Ser. No. 609,918 filed concurrently herewith, dealing with a bobbin low detection device and circuit therefor.

Each pleat and sew station is provided with a control panel through which the operator can exercise control or override the controller 1920.

Figure 44:
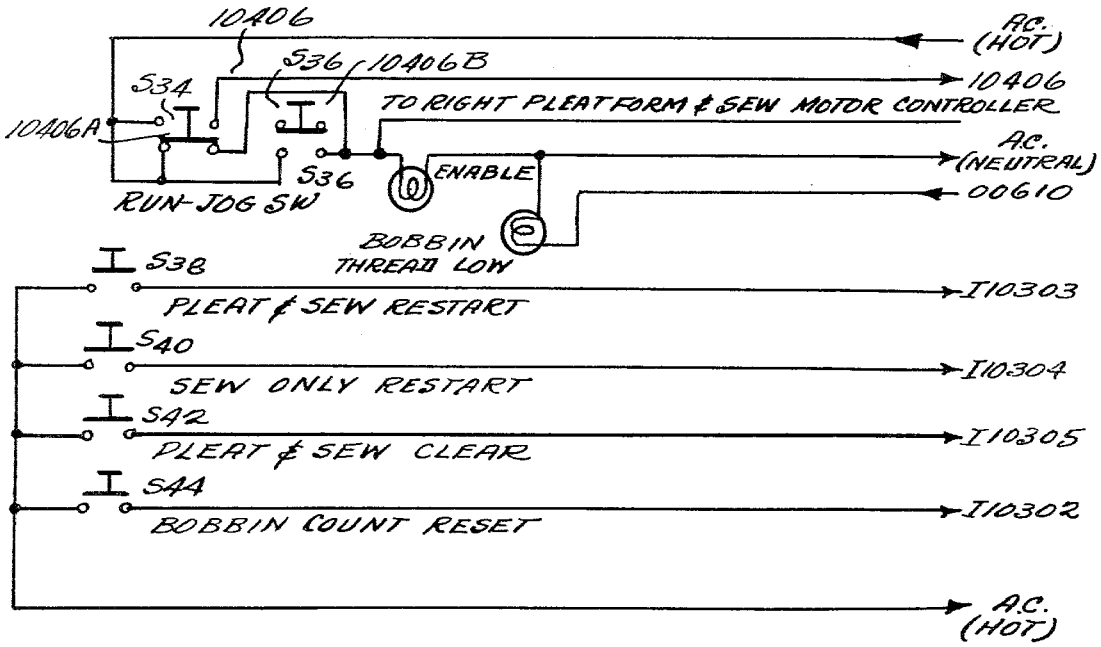
FIG. 44 shows the right pleat forming and sewing station control panel.

In FIG. 44, the control panel switches are set forth and since both the right and left panels are identified except for the designation given to input signals being generated only the right panel will be discussed.

The run/jog switch 10406 is comprised of two contacts 10406A and 10406B. As shown in FIG. 44, the contacts are in their run position. Contact 10406B is open and contact 10406A closes the circuit between the A.C. hot line and the starter coils MS-5 and MS-6 for motors M5 and M6 which are motors 1338 and 1480, respectively. The switch 10406 can be changed to the jog mode which would move contact 10406A to the dotted line position, thereby producing input signal I-10406 indicating that the right pleat and sew station is no longer in the run mode, but rather has been switched into the jog mode. The jog function of switch 10406 is provided by contacts 10406B which are of the momentary pushbutton type. Thus, when contacts 10406B are momentarily moved to the dotted line position, the circuit to motors 1338 and 1480 will be momentarily provided allowing one function to occur. By continually closing contacts 10406B, the station can be jogged, one step at a time, through the station cycle.

The switch 10303, shown in FIG. 44 for the right pleat and sew station panel, provides the operator with the ability to request the controller to re-start the pleat and sew station and when the pushbutton is pressed, will produce input signal I-10303 to the controller.

Figure 43:
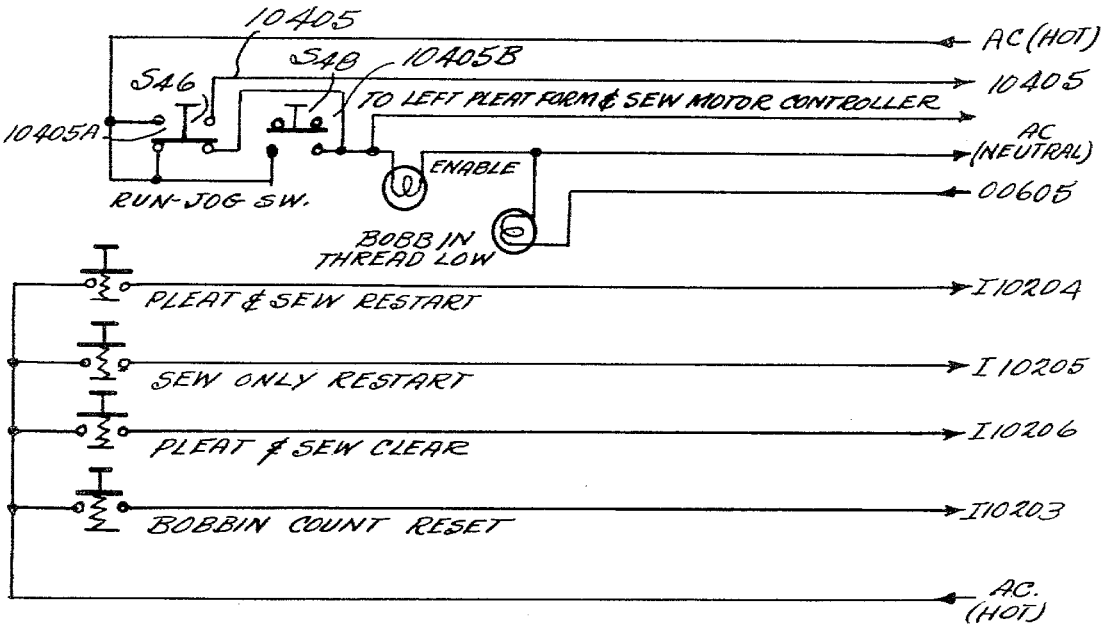
FIG. 43 shows the left pleat forming and sewing station control panel.

The pushbutton switch 10304 provides the operator with the ability to request the controller to re-initiate or re-start the sew cycle and, when pushed, will initiate the input signal I-10304 to the controller. The pushbutton 10305 will clear the pleat and sew station and thus move the various elements back to their initial positions and will produce the input signal I-10305 to the controller indicating that the pleat and sew clear pushbutton has been pushed by the operator. In order to reset the bobbin count after a bobbin has been replaced, the operator is provided with pushbutton 10302 which, when pressed, will produce input signal I-10302 to the controller which will instruct the controller to reset the bobbin counter for the new replaced bobbin. As will be noticed in FIG. 43, which shows the same circuit for the left pleat and sew station panel, the run/jog switch arrangement is exactly the same as that discussed hereinabove with regard to the right station panel and the left station is also provided with pushbuttons which will allow the operator to request the pleat and sew re-start, a sew only re-start, the pleat and sew clear, and the resetting of a bobbin counter, which will respectively produce input signals to the controller of I-10204, I-10205, I-10206 and I-10203.

Figure 37:
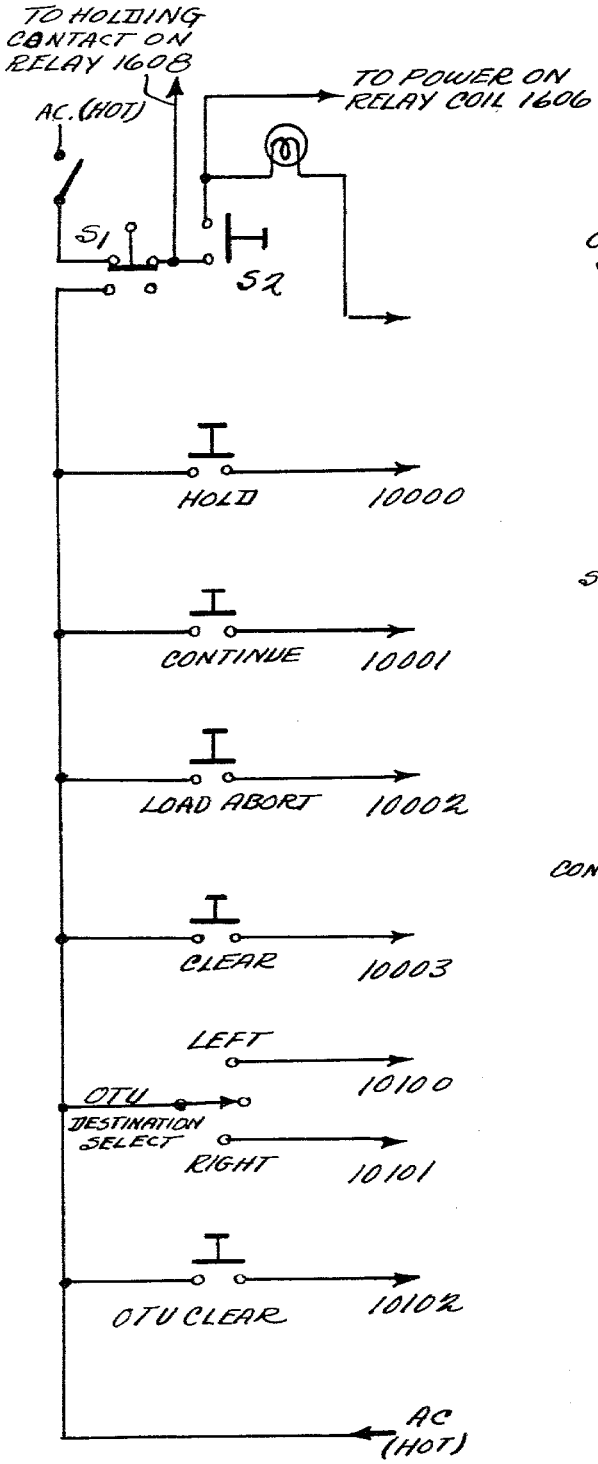
FIG. 37 shows the main control board panel and the overhead transfer unit control panel.

The FIG. 37 shows the pushbuttons which are provided on the main control panel which also includes the panel control for the overhead transfer unit. In addition to showing the main power ON/OFF and the main ON switch S1 and S2, respectively, the main panel has a HOLD switch 10000 which will allow the operator to instruct the controller through the input signal I-10000 to stop the processing sequence and to hold the machine at its last position. The CONTINUE switch 10001 will instruct the controller to again continue with the processing sequence and will result in the production of input signal 10001 to the controller. The LOAD ABORT switch 10002, when pushed, will produce input signal I-10002 to the controller which will cause a termination to the loading process, and return the loading assembly to its initial position, thereby allowing the operator to again initiate the loading sequence with regard to that particular panel.

The CLEAR pushbutton 10003 will allow the operator to instruct the controller through input signal I-10003 to clear the respective assemblies within the pleating machine and return them to their initial positions, this being usually done by the operator at the beginning of a day or shift to make sure that all of the particular assemblies are in their correct initial positions. As discussed within the explanation of the program, this switch is also used during the initialization phase of the controller program.

The right and left DESTINATION SELECT switches 10100 and 10101, respectively, allow the operator to preselect either the left or right station in terms of directing the overhead transfer of panels or the switch can be allowed to remain in its neutral position, as shown in FIG. 37, in which case the selection of the proper overhead transfer unit destination for any given particular panel during the processing sequence of a plurality of panels will be up to the controller which will determine whether the overhead transfer unit should carry the next succeeding panel to either the right or left pleating station. Depending upon the positioning of this switch, the left switch will produce input signal I-10100 while the right switch will produce input signal I-10101.

The overhead transfer unit is also provided with a CLEAR pushbutton 10102 which will allow the operator to return the clear station to its initial position and when this pushbutton is pushed, the input signal I-10102 will be provided to the controller.

Figure 38:
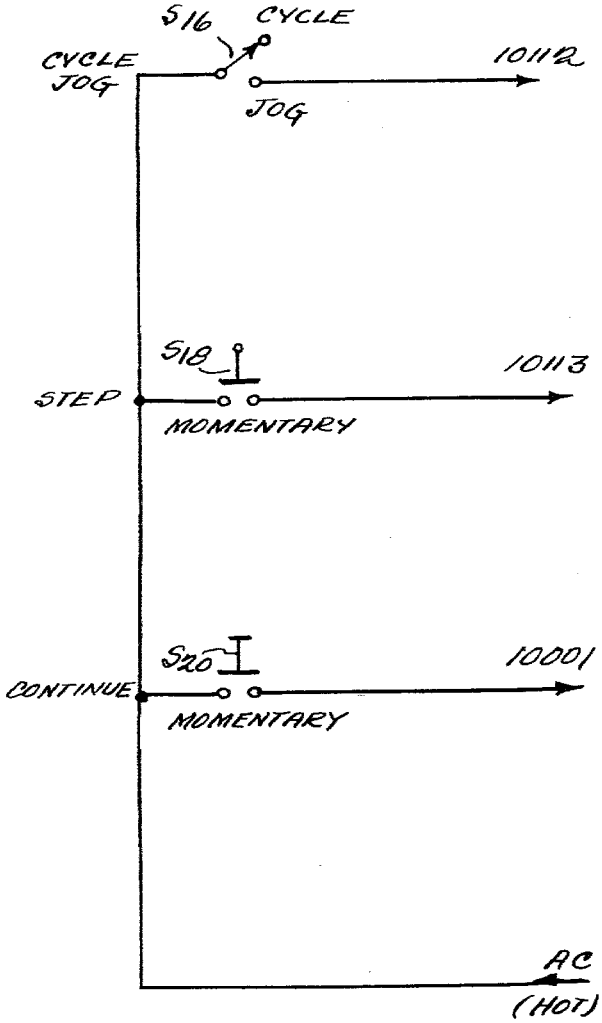
FIG. 38 shows the cycle/jog control switches.

The operator is also provided with a hand-held cycle jog control unit for which the switches are shown in FIG. 38. The switch 10112 is a CYCLE or JOG switch. If this hand-held unit is used to control either the left or right pleat station and it is switched to the JOG position, input signal I-10112 will be provided to the controller in which case the momentary stepping switch 10113 can be used to produce input signals I-10113 which will step the particular station being controlled through its cycle one step at a time. The CONTINUE pushbutton produces the same results as switch 10001 on the main panel and thus will instruct the controller through signal I-10001 to continue with the programmed sequence.

Therefore, the operation of the above-described pleating machine can be described as follows.

The initialization of the machine which initialization process is begun as soon as the machine is turned on, the initialization process assures that the machine has been reset to its normal unloading condition in which the loading bar is back at its normal position, the loading bar has been rotated to the correct loading position so that it is prepared to receive and clamp a drapery panel blank, the panel side clamps are open, and the scissors for forming the loops are open to their minimum width position. In addition the loop clamps themselves are open, the clamps in the corner sew station are in their normally open position, the needles in the corner sew station have been positioned in an up position. In addition the overhead transfer unit is in its normal centralized position and is not in the corner sew position. Likewise the bar tack clamps are not closed. With regard to both the left and right pleat and sew stations, the header clamps are in their pleat-forming position, the right and left header clamps have not been closed and the right and left clamps have not been locked to the carriage assembly. In addition, the initialization will determine whether either the manual right or manual left switch has been energized. The energization of either the right or left manual switch will close out either the left or right pleat and sew station respectively, so that during initialization, only one of the pleat and sew stations will be completely looked at in terms of header clamp position, whether the header clamps have been energized and whether or not the clamps have been locked to the movement carriage. The manual right or left switch would be energized if repair work was being undertaken with regard to one of the pleat/sew stations, or if some other problem existed with one of the stations.

When all of these conditions are met, the machine is ready to receive a panel.

As previously explained, when the machine is turned on, all of the motors are placed in a running condition and will remain running until the machine is turned off. Further, the controller itself is allowed to remain on at all times and in fact, is going through the program every 7 or 8 millisecond. Thus the initialization is merely a period subsequent to the machine turn on in which the controller is checking the position of the switches to determine the location of the elements in the machine to make sure that the machine is in fact ready to be operated by having a drapery blank placed or loaded on the machine.

In order to start the machine as indicated previously, push-buttons S1 and S2 are depressed by the operator.

With the machine now in condition to receive the first panel, the operator will manually fold in the buckram tails of the first panel, producing a square edge, and load a first panel onto the machine. When the start/run button 10017 is pushed, the first panel is clamped by the closing of the loading bar clamps. Following the clamping of the panel, the loading bar 148 is rotated, as shown in FIG. 7, so as to form the header area in the panel blank and the side panel clamps 210 and 212 are thereafter closed.

The loading bar assembly then moves to its forward position, as in FIG. 7, so as to be located adjacent the loop-forming area and the panel blank is ready to be transferred from the loading bar to the loop-forming assembly.

As indicated previously, during the transfer movement of the loading bar from its load position to its forward position adjacent the loop-forming assembly the width of the panel blank is calculated and the loop-forming scissor assembly is adjusted widthwise. The scissors will, therefore, be in position to form uniformly spaced loops for this particular panel being transferred to the loop assembly.

Following the movement of the loading bar assembly to its forward position, the loop clamps are closed around the panel blank while the loading bar clamps and panel side clamps are opened. Following the closing of the loop clamps, the panel is now secured in the loop-forming assembly and the loading bar assembly will return to its loading position. As pointed out above, after the transfer of the header portion of the panel to the loop-forming assembly 104, the body portion of the panel is contacted by the tail roller and by means of the spring-held rollers. The combined actions of the tail roller and the spring-held rollers make sure the main portion of the panel is deposited in the channel provided between the loading assembly 102 and the loop-forming assembly 104 so that when the panel itself is transferred to either the right or left pleat station, the entire panel can move in the proper direction without any impediment. This transfer of the body portion of the panel occurs and the load bar assembly 102 is returned away from the loop-formation assembly 104.

The loop-formation scissors are closed to the position shown in FIG. 15 and the loop blades are raised assuring the full formation of loops between the loop clamps. These loop clamps are shown in FIG. 4E. Also, the loading bar is re-rotated to its normal position.

Following the full formation of the loops, the overhead transfer unit 106 is moved to its forward position and when in its forward position, such that the overhead transfer pick-up clamps are positioned over the loops the pick-up clamps are closed over the previously formed loops. With the closing of the pick-up clamps, the loop-forming blades are lowered to their normal position, and the loop clamps are opened so that complete control and clamping of the panel is now solely under the control of the overhead transfer pick-up clamps.

The overhead transfer assembly 106 is now moved back to its home position from a lateral or an axial direction and during the movement of the overhead transfer assembly back to this position, the operator can begin loading a second panel. As with the loading of the first panel upon hitting the start/run button, the second panel is clamped by the loading bar clamps and the bar is rotated forming the header portion of the second panel.

After the overhead transfer unit arrives at its home (lateral) position, movement of the overhead transfer unit backward to the corner sew station is initiated and when the panel is in position at the corner sew station, the corner clamps at the corner sew station, as shown in FIG. 23, are closed together with the closing of the lock latch clamp. Thereafter corner sewing on both sides of the panel is initiated, preferably simultaneously, but it is to be understood that there could be some reason for sewing one side and then the other. Applicants prefer, however, to have both sides of the panel sewn simultaneously, as this is a more efficient use of machine time.

Following termination of corner sewing, the corner clamp and lock latch are opened and the overhead transfer unit is again moved to its home (lateral or axial) position. During the movement of the overhead transfer unit back to its home (lateral) position the corner sewing thread is cut by thread cutting assembly 816, shown in FIG. 23, thereby assuring that further movement of the panel away from the corner sewing station will not deplete the supply of thread at the corner sew station.

When the overhead transfer unit arrives back at its home (lateral) position from corner sewing, the overhead transfer unit lateral actuator cam 796 is moved which begins the traversing movement of the overhead transfer unit 106 to either the right or left pleating station whichever is not in operation or has been indicated by the controller as being ready to receive a panel. As the overhead transfer assembly is being moved transversely, the scissors assembly is again returned to its minimum position so that they are ready to be set to receive the next panel.

For purposes of this operation description, it is assumed that the first panel will be moved to the right pleating station. When the overhead transfer unit arrives at the right pleating station, the overhead transfer unit is moved rearwardly toward the pleating station while at approximately the same time, the loading bar assembly moves forward to transfer the second panel to the looping assembly.

When the overhead transfer unit holding the first panel is in its most rearward position adjacent the right pleating station, the right pleating station header clamps are closed, the overhead transfer unit pick-up clamps are opened, and transfer of the first panel blank to the right pleating station is thereby completed. At the loop-forming assembly, the loading bar and side panel clamps are opened when the looping clamps are closed, and the loading bar assembly can therefore move back to its load position.

Therefore, at this point in the operation, the first panel is retained in the right pleating station, the overhead transfer assembly is moving back to its home (transverse) position and the second panel has been transferred from the loading bar assembly to the looping assembly.

The formation of pleats is effected through pleating cams, shown in FIG. 26C, which actuate pleating upper and lower pleat blade assemblies 1186 and 1188. The pleating sequence is shown in FIG. 4E–4M.

As indicated previously, the upper set is comprised of two blades while the lower blade set employs three blades with the top set and the middle blade in the bottom group of three being spring loaded. As the bottom group is raised upwardly, the middle blade is moved to a higher position than the two exterior blades and is used to correctly position the center of the pleat and also serves to apply initial tension to the fabric loop, as shown in FIG. 4F. When the lower blade assembly has been raised to its highest degree with the center blade still projecting upwardly beyond the outer blades, the two upper blades will have been lowered down over the center blade and thereby form the center fold in the pleat, as in FIG. 4G. Following that, the two upper blades and the central blade in the lower group are moved down together toward the other two lower blades with the two upper blades being moved into the space formed by each of the outer lower blades with respect to the lower center blade and thereby form the outer folds of the pleat, as in FIG. 4H. Since the upper blade assembly and the lower center blade are spring-loaded, the full closing of the loop blade assemblies will cause these two springs to compress, thereby making sure all available fabric is used. It will be recalled that loop size from panel to panel will vary and these springs compensate for such variations. With the complete forming of the pleat, the clearing pins have been lowered into position, and had there been a pleat which had previously been clamped in the pleat clamp 1190 and sewn, it would be moved out of the path of the transfer pins. The upper and lower blade assemblies are held in pleat forming position while transfer pins 1278 and 1280 are inserted into the pleat, as in FIG. 4I. These pins serve to hold the pleat in its folded condition during transfer to the pleat clamp 1190. The scissor assembly 616 has been adjusted for the width of the second panel and has been closed so as to form equally spaced loops in the second panel previously loaded into the machine.

Following the completion of the pleat formation and the insertion of the holding pins, the pleating blades are withdrawn, as shown in FIG. 4J, and the right header clamp carriage is indexed laterally toward the pleat clamp by cam 1310 and the indexing assembly shown in FIG. 26B and FIG. 4K. The pleat is transferred from the pins to the pleat clamp 1190 as the indexing of the right header clamp carriage is finished, as in FIG. 4E. During the clamping of the first-formed pleat by the pleat clamp 1190, the pins 1278 and 1280 are withdrawn, as in FIG. 4N.

With regard to the first panel, the indexing of the header clamp carriage indexes the entire drapery panel toward the pleat clamp and does not therefore move only the one pleat that has been formed and held by the pins. Following the indexing of the right header clamp carriage and the clamping of the first pleat, the right header clamp assembly 1154 is moved rearwardly toward the sewing area and the right header clamp assembly is locked to the sewing indexing assembly 1158. The ability to index the header clamp carriages at both the right and left pleating stations enables the apparatus to deal with an entire panel at all times rather than dealing in a sequential manner with only one portion of the panel. This serves to maintain the precise control needed to produce uniform pleats and greatly increases efficiency in terms of machine time.

At about the same time the right header clamp carriage is being indexed rearwardly into the sewing area, the overhead transfer unit is again being moved forward from its home (lateral) position to its transfer position over the second panel held in the loop-forming assembly 104 and in which loops have been formed and uniformly spaced along the second panel. When the overhead transfer unit has been moved forward to its full forward position, the overhead transfer pick-up clamps are closed along with the opening of the loop clamps so that the overhead transfer unit now has control of the second looped panel.

When the right header clamp assembly 1154 is fully retracted into the sewing area the sewing machine 1300 is actuated along with the sewing cams 1510 and 1512 and the sewing cycle will form an F-tack pattern.

As the first pleat is being sewn, the overhead transfer unit which now has full control of the loops of the second panel will move back to its home (lateral) position preparatory to moving the second panel into the corner sew station.

Upon completion of sewing of the sewing cycle for the first pleat, the pleat thread is cut and the header clamp assembly 1154 is unlocked from the sewing assembly and indexed forward to its pleating position. While the header clamp assembly 1154 is being indexed forward to its pleating position, the overhead transfer unit 106 is in its home position with the second panel and the operator can now load third panel.

With the right header clamp assembly 1154 back in its pleat-forming position, the previous indexing motion of the right header clamp carriage not only placed the first-formed pleat in position to be clamped by the pleat clamp 1190 for sewing purposes, but likewise positioned the second loop in alignment with the pleat-forming blades so that without further indexing formation of the second pleat can be initiated. Along with the initiation of the second pleat in the first panel, the overhead transfer unit 106 is indexed rearwardly toward the corner sew station and the loading bar 148 is rotated forming the header portion in the third panel. At this point, then, there are three panels within the machine, all being worked on simultaneously without operator assistance for any of the operations.

During the second pleat framing cycle, the following events occur in sequence, as before. The pleat clamp opens, freeing the first pleat, the second pleat is formed and the first pleat is pushed away by the clearing bars so that as the transfer pins are moved they are inserted only into the newly formed second pleat. As soon as the transfer pins have been inserted, the upper and lower pleat blade assemblies are again withdrawn, the right header clamp assembly 1154 is indexed toward the pleat clamp and the pleat is transferred from the pins to the pleat clamp as the indexing of the right header clamp carriage is finished.

While the second pleat is being completed, the overhead transfer unit has been indexed rearwardly into the corner sew station, the corner sew clamps and interlock have closed and the corners of the second panel are being sewn.

It is to be understood that while several panels are being processed at once, if the processing at one station is completed prior to the steps at the next station, those panels are held while other processing steps continue. By way of input signals, the controller 1920 can monitor the status of each panel and coordinate processing accordingly.

In addition, all processing functions are not necessarily dependent on the processing rate of any other panel. Processing steps are stopped only when waiting for a preceding panel to complete a step when that is the next step.

The sewing of the second pleat on the first panel and the sewing of the corners on the second panel are terminated approximately at the same time, and while the corner clamps and latch lock are opened in the corner sew station, the right header clamp assembly 1154 is again indexed forward to its pleat-forming position.

As was the case with the first index motion which served to position the first pleat under the pleat clamp and the second loop under the loop-forming blade assemblies, the second index has positioned the third loop under the loop-forming blades and the pleat-forming cycle is again initiated for the third pleat, which involves closing the pleating blades as previously described.

With the completion of the third pleat in the first panel, the transfer pins secure the third pleat, the pleating blades are withdrawn and the right header clamp assembly is again indexed toward the pleat clamp.

The overhead transfer unit will now have been indexed forward to its home position and the corner sewing thread will have been cut so that the bobbin supply to this corner sewing machine will not be depleted by movement of the panel away from that area and therefore frees the panel from the sewing machines.

While the right header clamp carriage is indexed rearwardly toward the pleat sewing area and locked, the overhead transfer unit is actuated toward the left so that it can transfer the second panel in which loops have been formed and the corners sewn to the left pleating station.

With the completion of the sewing of the third pleat on the first panel, the thread is cut and the right header clamp assembly is unlocked and is again indexed to its forward pleat-forming position. At about this same time, the scissors assembly which were in a closed position are again opened to their minimum position ready to be set to the proper position for the third panel following the full indexing of the overhead transfer unit to the left pleating station, the overhead transfer unit is indexed rearwardly toward the left pleating station, the left header clamp assembly is actuated to securely hold the second panel and the overhead transfer unit pick-up clamps are opened.

At about this same time, the fourth pleat in the first panel is being formed by the same process as was used for the first three pleats the load bar assembly 102 is moved toward the loop-forming assembly, the width of the third panel is used to set the width of the scissor assembly and the third panel is transferred to the loop-forming assembly and uniformly spaced in the fourth panel.

Following the formation of the fourth pleat in the first panel, the transfer pins are again moved into their operative positions, the pleating blades are withdrawn and, while the right header clamp assembly 1154 is again being indexed laterally toward the pleat clamp, the overhead transfer unit will have been indexed back to its home (traversing) position.

When the right header clamp assembly has been fully indexed, the pleat clamp will secure the fourth pleat prior to the sewing operation, the pins will be withdrawn and the pleat sew cycle is initiated.

The formation of the first pleat of the second panel will be initiated by actuating the left pleat-forming upper and lower blade units but the left unit will not be described in detail herein since the right- and left-hand pleat-forming and sewing stations are essentially identical in all respects.

The right header clamp carriage has been indexed to the sewing position and the sewing cycle for the fourth pleat in the first panel has been initiated while at the same time the first pleat in the second panel at the left pleating station has been completed and the left header clamp assembly is indexed laterally, this time to the left toward the left pleat clamp.

Upon the conclusion of the sewing cycle for the fourth pleat in the first panel, at the right pleat/sew station, the right header clamp carriage is again unlocked and indexed back toward its pleating position. The overhead transfer unit can now be indexed forward to pick up the third panel in which loops have now been formed and the first pleat sewing cycle in the left pleat/-sew station is initiated.

The loading bar will now be re-rotated and thus be in position to again receive a drapery panel blank at about the same time the fifth pleat on the first panel is being formed.

In addition, the overhead transfer unit will have arrived at its most forward position, the pick-up clamps of the overhead transfer unit will be closed, the lower loop blades and the looping clamps will be lowered and opened, respectively, with the overhead transfer unit now controlling the third panel.

Upon completion of the fifth pleat in the first panel at the right pleating station, the transfer pins inserted and the pleating blades will be withdrawn. Following that, the right header clamp assembly will again be indexed to the right toward the pleating clamp while simultaneously the sewing cycle at the left pleating station for the first pleat in the second panel will have terminated, the left header clamp assembly and the sewing indexing assembly will have been unlocked, the left header clamp assembly will be indexed to its forward pleating position. At the same time the overhead transfer unit will be moved rearwardly to the corner station to sew the corners on the third panel and the operator can load a fourth panel.

Upon completion of the indexing of the right header clamp assembly so that the pleat clamp is now closed over the fifth pleat, the right header clamp carriage is indexed rearwardly toward the pleat sewing station once again and locked with the sewing indexing assembly. At this same time, the second pleat is being formed in the second panel by the closing of the pleating blades of the left pleating station.

With the right header clamp carriage in the sewing position, the sewing cycle is initiated for the fifth pleat in the first panel, the overhead transfer unit will have been returned to its home (lateral) position from corner sewing and the loading bar will be rotated so as to form the header portion in the fourth panel.

Just prior to the completion of the sew cycle for the fifth pleat in the first assembly, the second pleat will be completed in the second panel, and the transfer pins inserted as was the case with the formation of pleats on the first panel at the right pleating station, and the left header clamp assembly carriage will be indexed to the left so as to position the second formed pleat under the left pleating clamps.

The header having been formed in the fourth panel blank, the side panel clamps are closed and the fourth panel will be held in this position until the third panel moves to a pleating station and the scissors assembly is opened to their minimum position.

On completion of the sew cycle for the fifth pleat, the right header clamp assembly and sewing indexing assembly are unlocked and the right header clamp assembly is moved once again to its pleat-forming position but is now fully indexed to the right.

The doff arm has been in position and upon the completion of the fifth pleat and the opening of the right header and pleat clamps, the drape itself will be deposited into the doff arm clamp and upon rotation of the doff arm 1806 the first panel will be pulled away from the pleating machine. The completed panel will then be in position to be loaded onto a standing truck or in some other way be removed from the system. Thus with the removal of the first panel from the machine, the cycle for the first drape is completed. While the first panel is being removed, the sew cycle for the second pleat in the second panel at the left pleating station will have been completed, and the third panel in the overhead transfer unit is ready to be transferred to the right pleat/sew station.

Thus, the complete cycle for the first panel has been described, and the sequence of these steps will continue automatically as long as the operator continues to load the panel blanks into the pleating machine with the overhead transfer unit under control of controller 1920 serving to place panels following the sewing of their corners to either the right or left pleating station.

The operation of the above-described pleating machine is monitored and controlled by a programmable controller. Specifically, an Allen-Bradley 1774 PROGRAMMABLE LOGIC CONTROLLER has been used for which the Allen-Bradley Company provides manuals explaining how this controller can be programmed, operated, installed and maintained.

As an aid to understanding the control system, the following block diagram illustrates the functions and elements used to control the various sections of the pleating machine and the steps within the pleating process.

CONTROL SYSTEM BLOCK DIAGRAM
AUTOMATIC PLEATING MACHINE
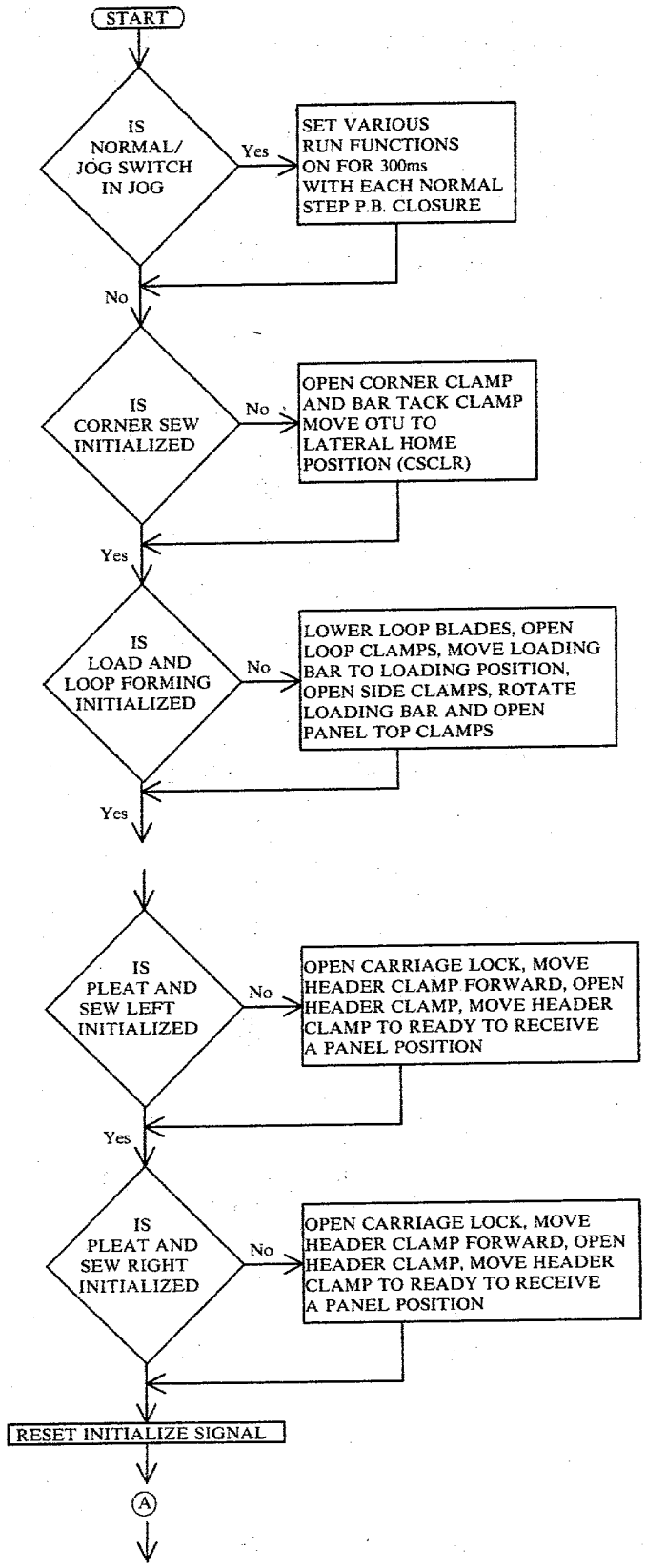

-continued
CONTROL SYSTEM BLOCK DIAGRAM
AUTOMATIC PLEATING MACHINE
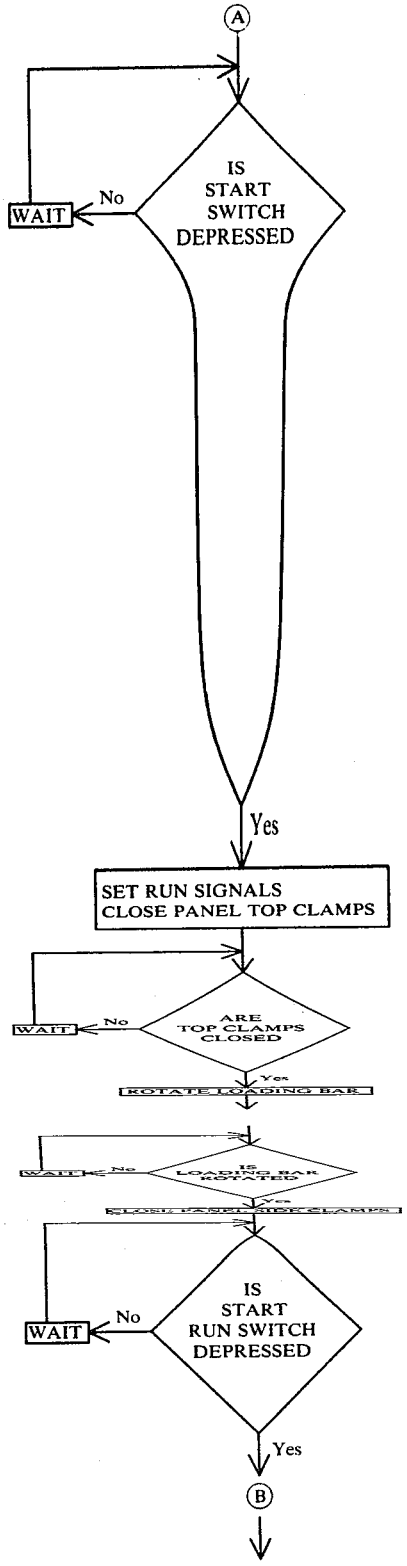

-continued
CONTROL SYSTEM BLOCK DIAGRAM
AUTOMATIC PLEATING MACHINE
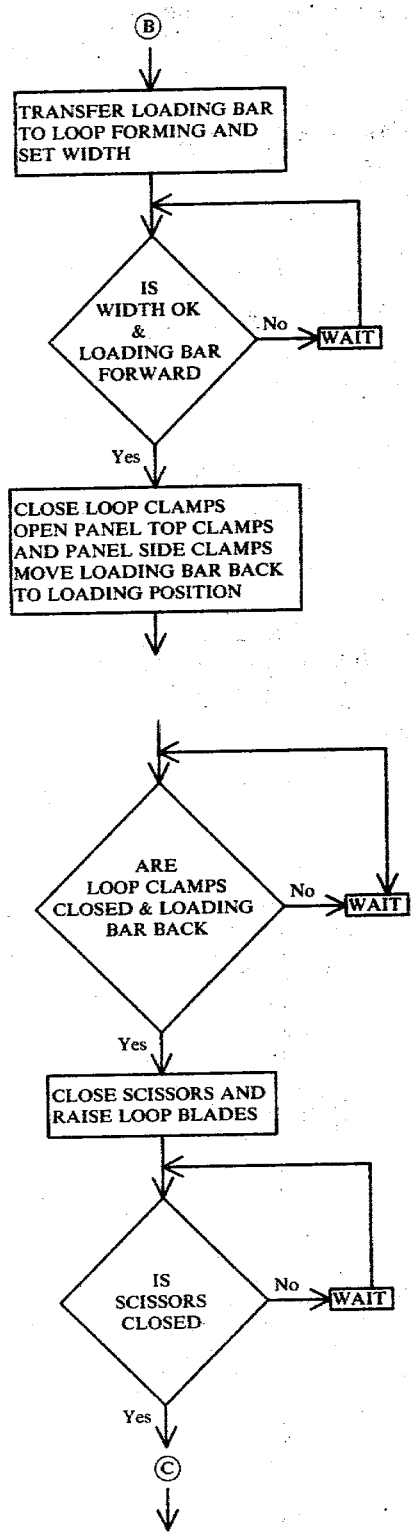

-continued
CONTROL SYSTEM BLOCK DIAGRAM
AUTOMATIC PLEATING MACHINE
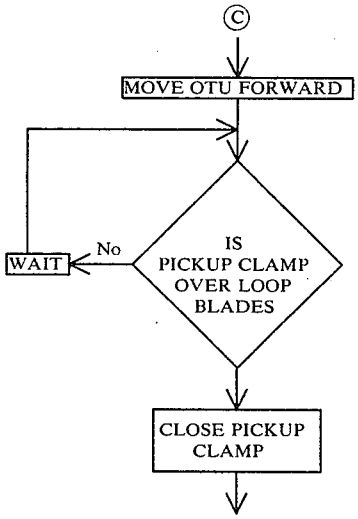
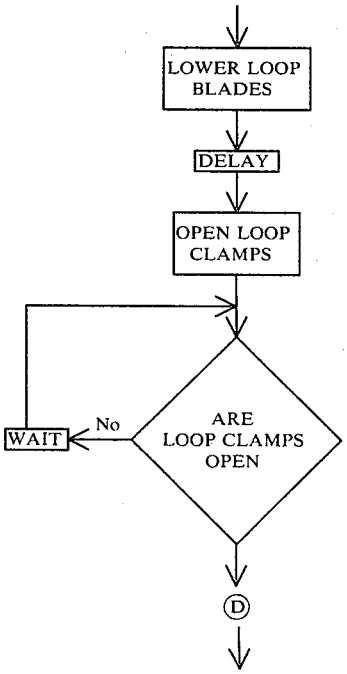

-continued
CONTROL SYSTEM BLOCK DIAGRAM
AUTOMATIC PLEATING MACHINE
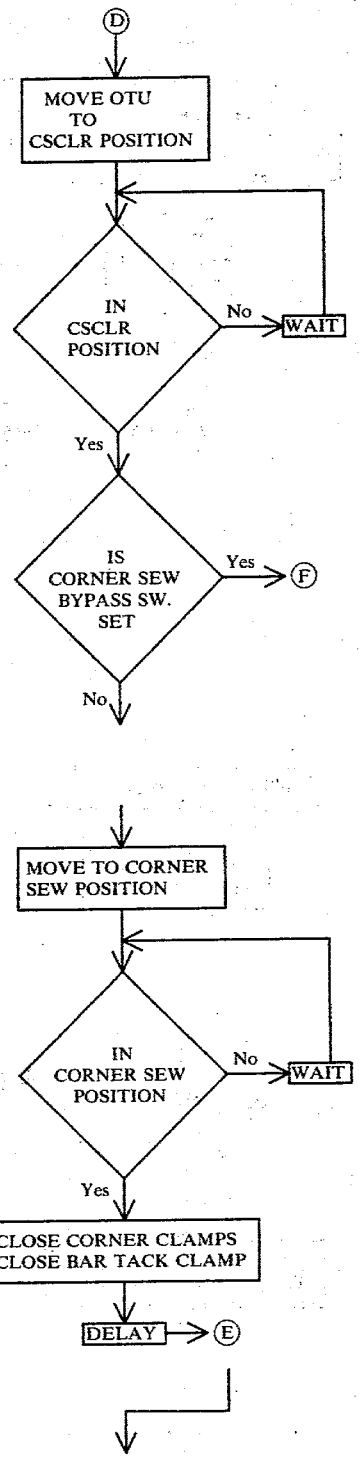

-continued
CONTROL SYSTEM BLOCK DIAGRAM
AUTOMATIC PLEATING MACHINE
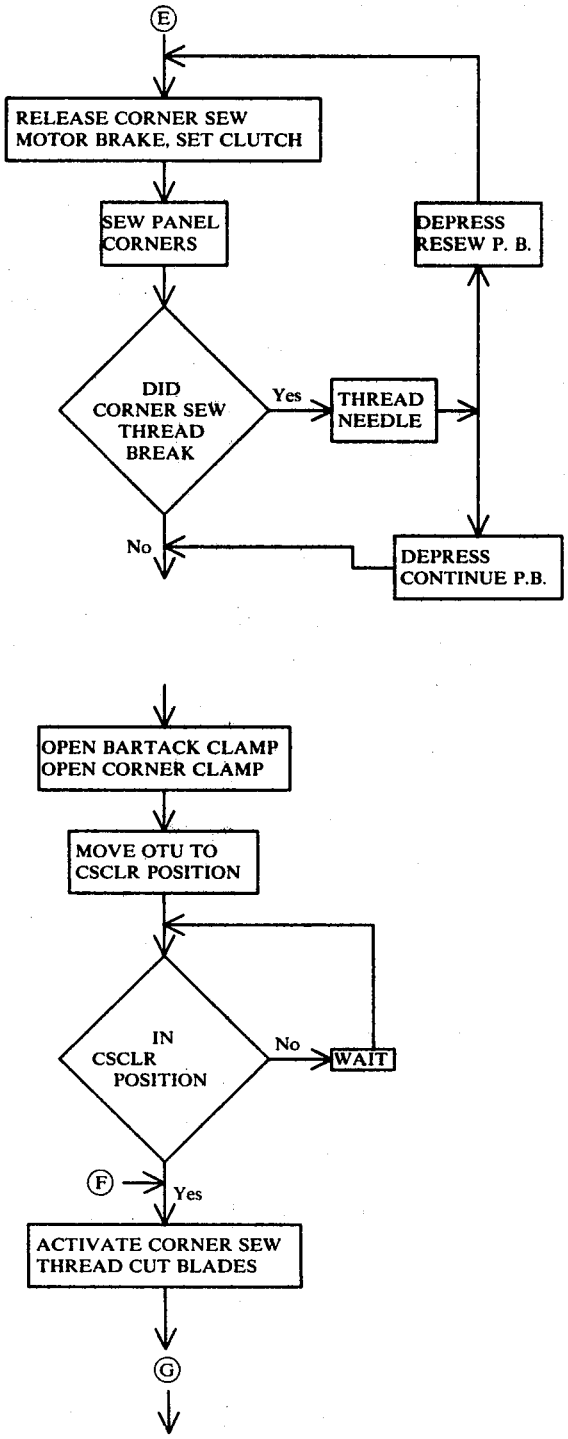

-continued
CONTROL SYSTEM BLOCK DIAGRAM
AUTOMATIC PLEATING MACHINE
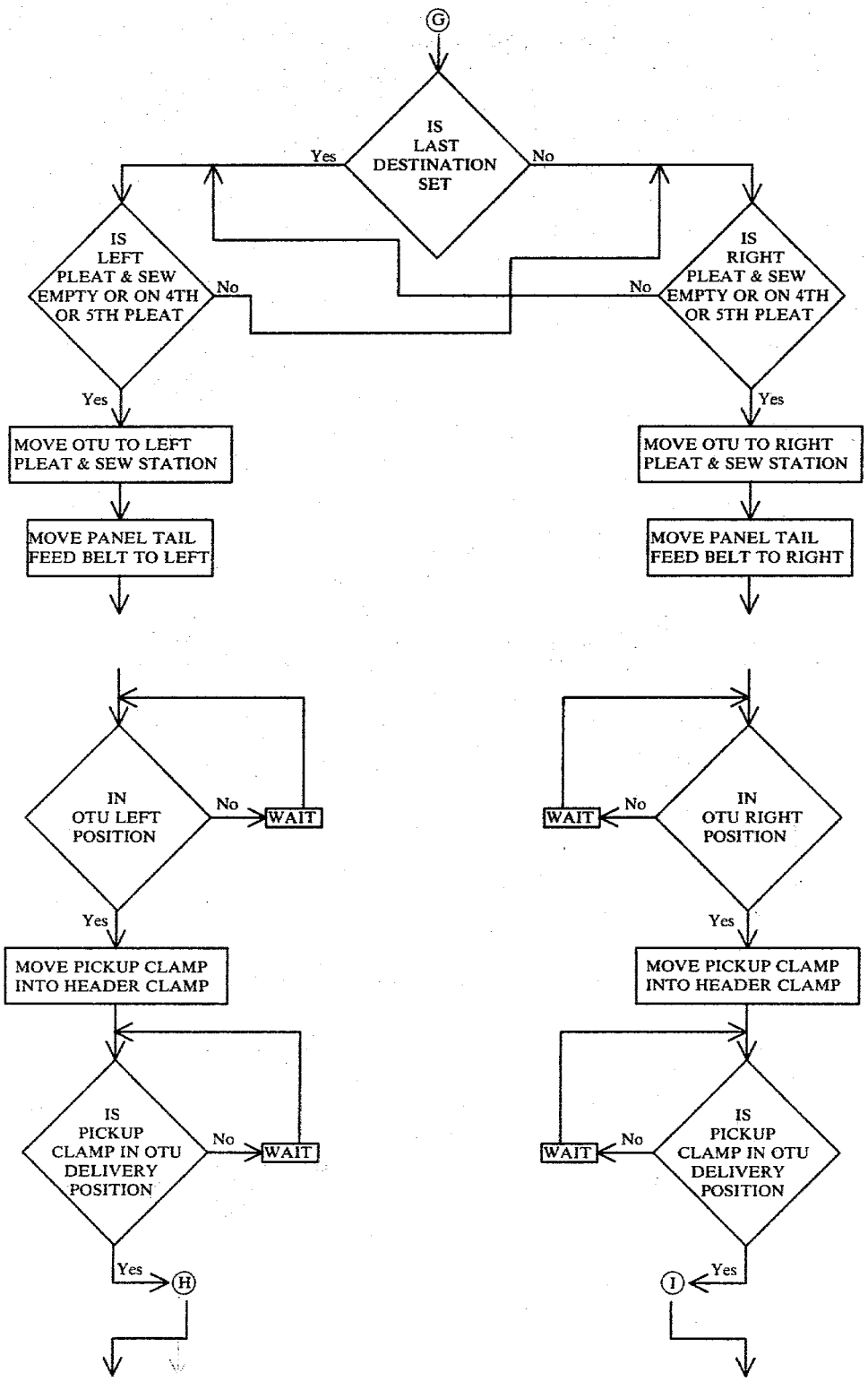

-continued
CONTROL SYSTEM BLOCK DIAGRAM
AUTOMATIC PLEATING MACHINE
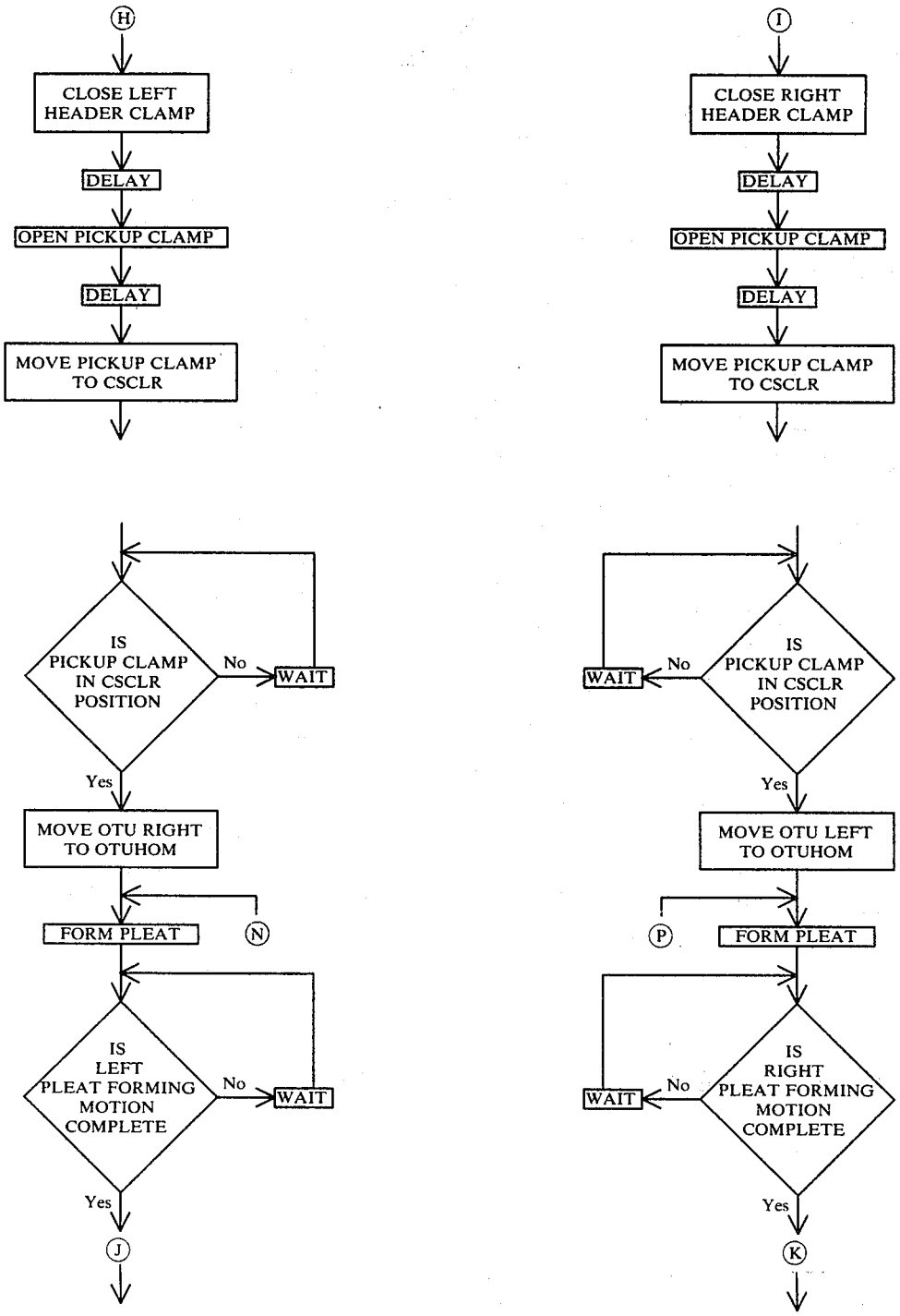

-continued
CONTROL SYSTEM BLOCK DIAGRAM
AUTOMATIC PLEATING MACHINE
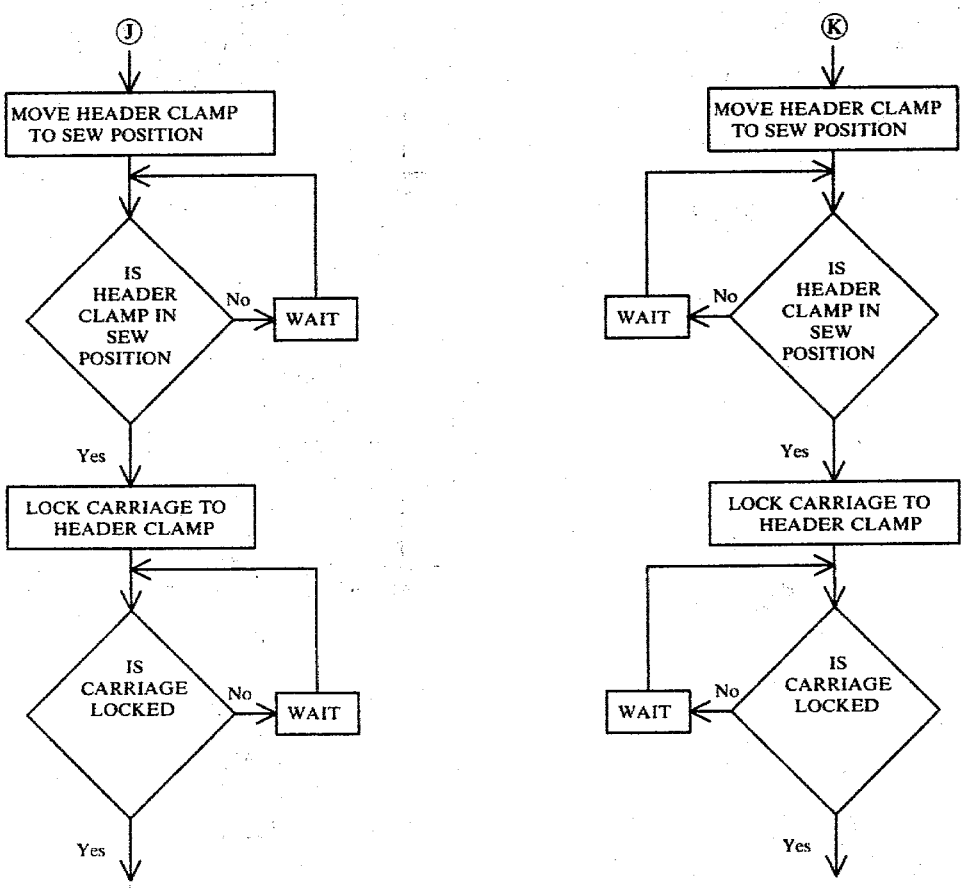

-continued
CONTROL SYSTEM BLOCK DIAGRAM
AUTOMATIC PLEATING MACHINE
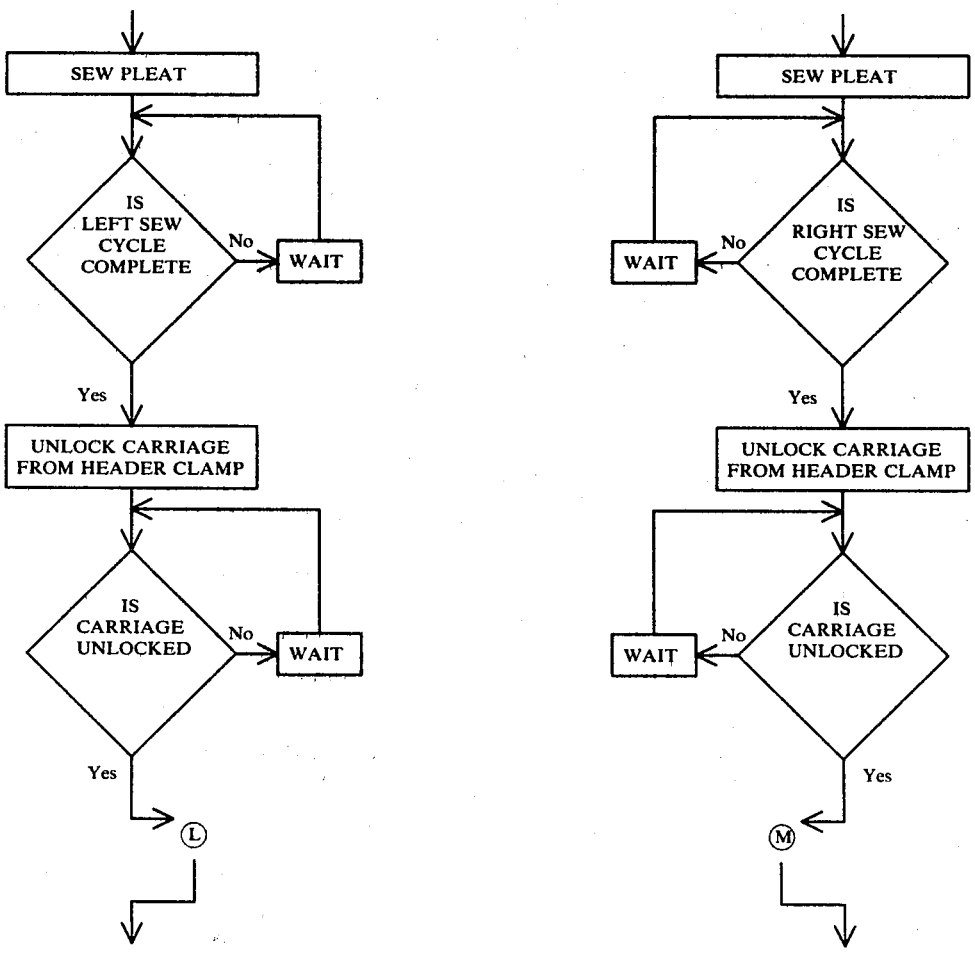

-continued
CONTROL SYSTEM BLOCK DIAGRAM
AUTOMATIC PLEATING MACHINE
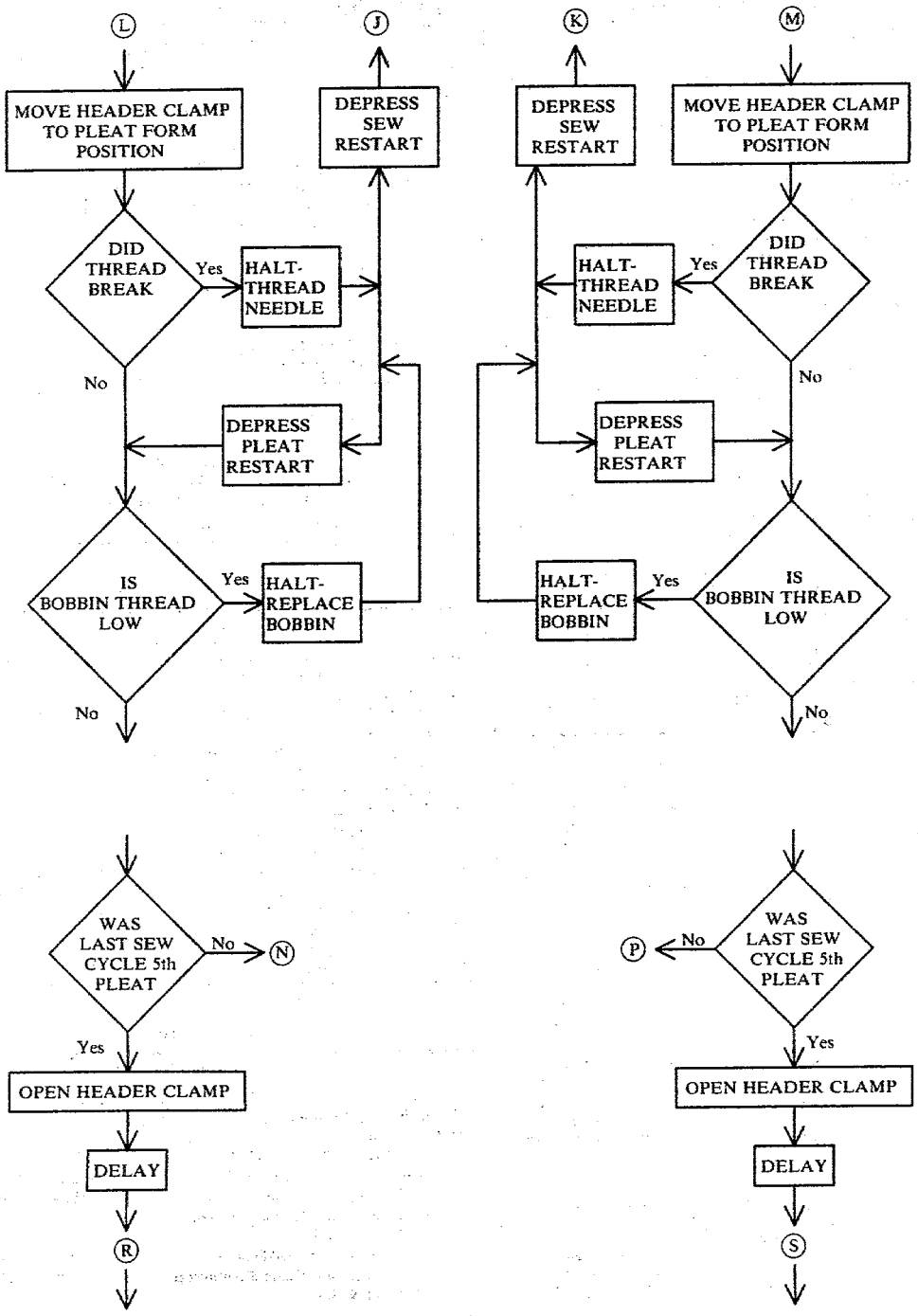

-continued

CONTROL SYSTEM BLOCK DIAGRAM
AUTOMATIC PLEATING MACHINE

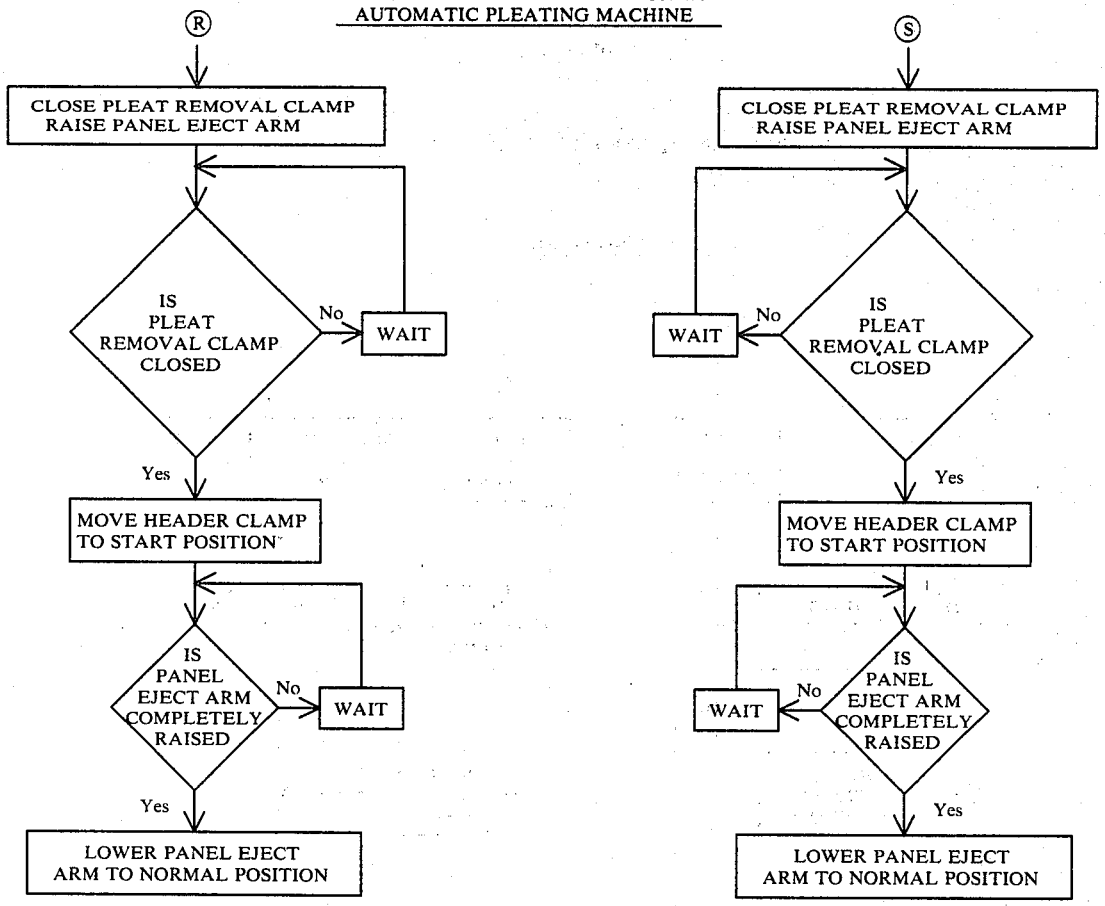

Tables I–XII set forth the description of the various controller inputs, outputs, memory functions and time delays, their octal addresses and symbolic names.

TABLE I

| INPUT ASSIGNMENTS RACK 0, MODULE 0 | | |
|---|---|---|
| 1 Hold Pushbutton | 10000 | HOLD |
| 2 Continue Pushbutton | 10001 | CONT |
| 3 Load Abort Pushbutton | 10002 | LDABT |
| 4 Clear Pushbutton | 10003 | CLEAR |
| 5 Main Power On Pushbutton | 10004 | PWRON |
| 6 Main Power Off Pushbutton | 10005 | PWROF |
| 7 Loading Bar Rotated To Transfer Position Sense | 10006 | LBARR |
| 8 Scissors Open To Minimum Width Panel Position Sense | 10007 | SISOP |
| 9 Loading Bar Transfer Motion Complete Sense | 10010 | LBRUP |
| 10 Scissors Adjustment To Panel Width Complete Sense | 10011 | WIDOK |
| 11 Loading Bar Fully Retracted Sense | 10012 | LBRBK |
| 12 Loop Form Clamps Closed Sense | 10013 | LCPCL |
| 13 Scissors Closed Sense | 10014 | SISCL |
| 14 Loop Form Clamps Open Sense | 10015 | LCPOP |
| 15 Start Run Loop Forming Section | 10016 | STRUN |
| 16 Start Switch | 10017 | START |

TABLE II

| INPUT ASSIGNMENTS RACK 0, MODULE 1 | | |
|---|---|---|
| 1 Left Destination Selection Switch | 10100 | MANLF |
| 2 Right Destination Selection Switch | 10101 | MANRT |

TABLE II-continued

| INPUT ASSIGNMENTS RACK 0, MODULE 1 | | |
|---|---|---|
| 3 OTU Clear Pushbutton | 10102 | OTUCR |
| 4 OTU In Loop Pickup Position Sense | 10103 | OTULP |
| 5 OTU In Corner Sew Position Sense | 10104 | OTUCS |
| 6 OTU In Home Position In Lateral Direction Sense | 10105 | CSCLR |
| 7 OTU In Left Ready Position Sense | 10106 | OTULR |
| 8 OTU In Right Ready Position Sense | 10107 | OTURR |
| 9 OTU In Home Position In Transverse Direction Sense | 10110 | OTUHM |
| 10 OTU In Panel Delivery Position Sense | 10111 | OTUDL |
| 11 Normal Switch In Jog Position | 10112 | NORJG |
| 12 Normal Step Pushbutton | 10113 | NORST |
| 13 Bypass Corner Sew Switch | 10114 | BYPCS |
| 14 Corner Sew Resew Pushbutton | 10115 | RESEW |
| 15 Corner Sew Bobbin Low Reset | 10116 | CSBLR |
| 16 Corner Sew Clear Pushbutton | 10117 | CSCLE |

TABLE III

| INPUT ASSIGNMENTS RACK 0, MODULE 2 | | |
|---|---|---|
| 1 Bar Tack Motion Clamp Engaged Sensor | 10200 | BTCLE |
| 2 Corner Sew Thread Break Detector (Left & Right) | 10201 | CSTBK |
| 3 Corner Sew Cam Rotation Sense | 10202 | CAMRT |
| 4 Left Bobbin Low Reset Pushbutton | 10203 | BRSTL |
| 5 Left Pleat & Sew Restart Pushbutton | 10204 | PSRTL |
| 6 Left Pleat & Sew Sew Only Restart Pushbutton | 10205 | SWRSL |
| 7 Left Pleat & Sew Clear Pushbutton | 10206 | PSCLL |
| 8 Left Pleat & Sew | | |

TABLE III-continued

| INPUT ASSIGNMENTS RACK 0, MODULE 2 | | |
|---|---|---|
| Ready To Receive A Panel Sense | 10207 | HCREL |
| 9 Left Pleat & Sew Pleat Forming Motion Complete Sense | 10210 | PFCPL |
| 10 Left Pleat & Sew Header Clamp In Stitch Position Sense | 10211 | HCSWL |
| 11 Left Pleat & Sew Header Clamp To Carriage Lock Engaged | 10212 | HLOCL |
| 12 Left Pleat & Sew Pleat Stitch Cycle Complete Sense | 10213 | PSCYL |
| 13 Left Pleat & Sew Header Clamp In Position Four | 10214 | PP4LF |
| 14 Left Pleat & Sew Header Clamp In Position Five | 10215 | PP5LF |
| 15 Left Pleat & Sew Header Clamp In Pleat Forming Position | 10216 | HCPPL |
| 16 Left Pleat & Sew Ejected Sense | 10217 | PNLEL |

TABLE IV

| INPUT ASSIGNMENTS RACK 0, MODULE 3 | | |
|---|---|---|
| 1 Left Pleat & Sew Bobbin Low On Thread | 10300 | BLOWL |
| 2 Left Pleat & Sew Pleat Stitch Thread Break Detector | 10301 | PTBKL |
| 3 Right Bobbin Low Reset Pushbutton | 10302 | BRSTR |
| 4 Right Pleat & Sew Pushbutton | 10303 | PSRTR |
| 5 Right Pleat & Sew Sew Only Restart Pushbutton | 10304 | SWRSR |
| 6 Right Pleat & Sew Clear Pushbutton | 10305 | PSCLR |
| 7 Right Pleat & Sew Header Clamp In Ready Position | 10306 | HCRER |
| 8 Right Pleat & Sew Pleat Forming Motion Complete Sense | 10307 | PFCPR |
| 9 Right Pleat & Sew Header Clamp In Stitch Position Sense | 10310 | HCSWR |
| 10 Right Pleat & Sew Header Clamp To Carriage Lock Engage | 10311 | HLOCR |
| 11 Right Pleat & Sew Pleat Stitch Cycle Complete Sense | 10312 | PSCYR |
| 12 Right Pleat & Sew Header Clamp In Position Four | 10313 | PP4RT |
| 13 Right Pleat & Sew Header Clamp In Position Five | 10314 | PP5RT |
| 14 Right Pleat & Sew Header Clamp In Pleat Form Position | 10315 | HCPPR |
| 15 Right Pleat & Sew Panel Ejected Sense | 10316 | PNLER |
| 16 Right Pleat & Sew Panel Eject Art Up Sensor | 10317 | ARMUR |

TABLE V

| INPUT ASSIGNMENTS RACK 0, MODULE 4 | | |
|---|---|---|
| 1 Right Pleat & Sew Pleat Stitch Thread Break Detector | 10400 | PTBKR |
| 2 Left Pleat & Sew Thread Cut Sensor | 10401 | TCUTL |
| 3 Right Pleat & Sew Thread Cut Sensor | 10402 | TCUTR |
| 4 Left Pleat & Sew (Fluidic) Header Clamp Back In Stitch Position | 10403 | HCBCL |
| 5 Right Pleat & Sew (Fluidic) Header Clamp Back In Stitch Position | 10404 | HCBCR |
| 6 Left Pleat & Sew Motor Run/Jog Switch | 10405 | PSJGL |
| 7 Right Pleat & Sew motor Run/Jog Switch | 10406 | PSJGR |
| 8 Left Pleat & Sew Panel Eject Artm UP Sensor | 10407 | ARMUL |
| 9 Right Pleat & Sew Bobbin Low On Thread | 10410 | BLOWR |
| 10 Spare | 10411 | |
| 11 Spare | 10412 | |
| 12 Spare | 10413 | |
| 13 Spare | 10414 | |
| 14 Spare | 10415 | |
| 15 Spare | 10416 | |
| 16 Spare | 10417 | |

TABLE VI

| OUTPUT ASSIGNMENTS | | |
|---|---|---|
| 1 Thread Break-Left Pleat & Sew Station | 00000 | THBKL |
| 2 Thread Break - Corner Sew | 00001 | TBKCS |
| 3 Corner Sew Bobbin Low | 00002 | CSBLO |
| 4 Destination (OTU Left or Right Move) | 00003 | DESTN |
| 5 OTU-Empty Or Clear | 00004 | OTUTY |
| 6 Thread Break - Right Pleat & Sew Station | 00005 | THBKR |
| 7 Additional Display Capability | 00100 | YSTOR |
| 8 Additional Display Capability | 00101 | STORA |
| 9 Additional Display Capability | 00102 | STORB |
| 10 Additional Display Capability | 00103 | STORC |
| 11 Additional Display Capability | 00104 | STORD |
| 12 Additional Display Capability | 00105 | STORE |
| 13 Additional Display Capability | 00106 | STORF |
| 14 Additional Display Capability | 00107 | STORG |
| 15 Additional Display Capability | 00110 | STORH |
| 16 Additional Display Capability | 00111 | STORJ |

TABLE VII

| OUTPUT ASSIGNMENTS | | |
|---|---|---|
| 1 Pleat & Sew Clear Left Station | 00200 | PSCLL |
| 2 Run Pleat & Sew Left Station | 00201 | RUNPL |
| 3 Pleat & Sew Clear Right Station | 00202 | PSCLR |
| 4 Run Pleat & Sew Right Station | 00203 | RNPSR |
| 5 RUN - OTU | 00204 | RNOTU |
| 6 OTU - Hold | 00205 | OTUHD |
| 7 Run - Corner Sew | 00206 | RUNCS |
| 8 Corner Sew Empty | 00207 | CSETY |
| 9 Jog Step Function Switch | 00210 | JGSTH |
| 10 Jog Function | 00211 | JOG |
| 11 Single Function | 00212 | SINGL |
| 12 Run - Load/Loop Sections | 00213 | RUN |
| 13 Load Clear | 00214 | LDCLR |
| 14 Home (Transverse) OTU | 00215 | HOME |
| 15 Pleat & Sew O.K. Left Station | 00216 | PSOKL |
| 16 Initial Function | 00217 | INALZ |

TABLE VIII

| OUTPUT ASSIGNMENTS | | |
|---|---|---|
| 1 Pleat & Sew Loaded - Right Station | 00300 | PSLDR |
| 2 Sew Complete - Right Station | 00301 | SCOMR |
| 3 Pleat Complete - Left Station | 00302 | PCOML |
| 4 Position 5 - Left Station | 00303 | POS5L |
| 5 Pleat & Sew Cycle - Left Station | 00304 | PSCYL |
| 6 Pleat & Sew Load - Left Station | 00305 | PSLDL |
| 7 Sew Complete - Left Station Load Loop Forming | 00306 | SCOML |
| 8 O.K. Function | 00307 | LODOK |
| 9 Corner Sew O.K. Function | 00310 | CSWOK |
| 10 Pleat & Sew O.K. Right Station | 00311 | PSOKR |
| 11 Pick-up Clamps | 00400 | RET16 |
| 12 Corner Clamps | 00401 | RET25 |
| 13 Control Relay 1 - Corner Sew Circuit | 00404 | CR1 |
| 14 Control Relay 2 - For Clutch p.0017 | 00405 | CR2 |
| 15 OTU - Last R or Left Destination | 00406 | LSTDT |
| 16 Loaded (See p.0013) OTU | 00407 | LOADD |
| 17 Corner Sew Done (Sewing Function Only) | 00410 | CSDON |
| 18 Empty Right Station-(Pleat & Sew) | 00411 | EMTYR |
| 19 Partial Right | 00412 | PRTLR |
| 20 Empty - Left Station (Pleat & Sew) | 00413 | EMTYL |

TABLE IX

OUTPUT ASSIGNMENTS

Module #5

| | | |
|---|---|---|
| 1 Panel Top Clamp Cylinder | 00500 | PNLTP |
| 2 Loading Bar Rotation Cylinder | 00501 | LBRRT |
| 3 Panel Side Clamp Cylinder | 00502 | PNLSD |
| 4 Loading Bar Transfer Cylinder | 00503 | LBRTN |
| 5 Scissors Cylinder | 00504 | SISCY |
| 6 Vertical Loop Blades Cylinder | 00505 | LPBLD |
| 7 Loop Former Clamp Cylinder | 00506 | LPCLP |
| 8 Complement Loading Bar Rotation | 00507 | CMY1 |

TABLE IX-continued

OUTPUT ASSIGNMENTS

Module #5

| | | | |
|---|---|---|---|
| 9 | Complement Loading Bar Transfer | 00510 | CMY3 |
| 10 | Complement Scissors Cylinder | 00511 | CMY4 |
| 11 | Complement Vertical Loop Blade | 00512 | CMY5 |
| 12 | Complement Loop Former Clamp | 00513 | CMY6 |
| 13 | Scissors Stop Sol | 00514 | SISTP |
| 14 | Picup Cylinder | 00515 | PICKUP |
| 15 | OTU Transverse Motion Actuator (Left) | 00516 | OTULF |
| 16 | OTU Transverse Motion Actuator (Right) | 00517 | OTURT |

TABLE X

OUTPUT ASSIGNMENTS

Module #6

| | | | |
|---|---|---|---|
| 17 | OTU Lateral Motion Actuator (Forward) | 00600 | OTUFW |
| 18 | OTU Lateral Motion Actuator (Backward) | 00601 | OTUBK |
| 19 | Complement OTU Lateral Actuator (Forward | 00602 | CMY21 |
| 20 | OTU Lateral Motion Actuator (OTUBK to CSCLR) | 00603 | OTUIN |
| 21 | Corner and Bar Track Clamp Cylinder | 00604 | CRCLP |
| 22 | Left Bobbin Thread Low Indicator Lamp | 00605 | BOBLL |
| 23 | Corner Sew Motor Clutch | 00606 | LSCLC |
| 24 | Corner Sew Thread Cut Cylinder | 00607 | CSTCT |
| 25 | Right Bobbin Thread Indicator Lamp | 00610 | BOBLR |
| 26 | Left Header Clamp Cylinder | 00611 | HCLPL |
| 27 | Left Header Clamp Transfer Cylinder | 00612 | HCTRL |
| 28 | Left Header Clamp to Carriage Lock Cylinder | 00613 | HCCLL |
| 29 | Left Panel Eject & Arm Raise Cylinder | 00614 | PNEJL |
| 30 | Left Header Clamp Return Cylinder | 00615 | HCLRL |
| 31 | Left Pleat Stitch Motor Clutch Relay | 00616 | PSCML |
| 32 | Left Pleat Forming Motor Clutch Relay | 00617 | PFCML |

TABLE XI

OUTPUT ASSIGNMENTS

Module #7

| | | | |
|---|---|---|---|
| 33 | Complement Left Header Clamp Transfer | 00700 | CMY33 |
| 34 | Complement Left Header Clamp To Carriage Lock | 00701 | CMY34 |
| 35 | Right Header Clamp Cylinder | 00702 | HCLPR |
| 36 | Right Header Clamp Transfer Cylinder | 00703 | HCTRR |
| 37 | Right Header Clamp to Carriage Lock | 00704 | HCRLR |
| 38 | Right Panel Ejector Cylinder | 00705 | PNEJR |
| 39 | Right Header Clamp Return Cylinder | 00706 | HCLCR |
| 40 | Right Pleat Stitch Motor Clutch Relay | 00707 | PSCMR |
| 41 | Right Pleat Forming Motor Clutch Relay | 00710 | PFCMR |

TABLE XI-continued

OUTPUT ASSIGNMENTS

Module #7

| | | | |
|---|---|---|---|
| 42 | Complement Right Header Clamp Transfer | 00711 | CMY44 |
| 43 | Complement Right Header Clamp To Carriage Lock | 00712 | CMY45 |
| 44 | Left Panel Tail Feed Motor Starter | 00713 | PFEDL |
| 45 | Right Panel Tail Feed Motor Starter | 00714 | PFEDR |
| 46 | Corner Sew Bobbin Thread Low Lamp | 00715 | CSBLO |
| 47 | Spare | 00716 | |
| 48 | Spare | 00717 | |

TABLE XII

TIMERS/COUNTERS

| | | | |
|---|---|---|---|
| 1 | Timer | 200-- | TIMEO |
| 2 | Timer | 201-- | TIME1 |
| 3 | Timer | 20215 | TIME2 |
| 4 | Timer | 20315 | TIME3 |
| 5 | Timer | 20415 | TIME4 |
| 6 | Timer | 20515 | TIME5 |
| 7 | Timer | 20615 | TIME6 |
| 8 | Timer | 207-- | TIME7 |
| 9 | Timer | 210-- | TIM10 |
| 10 | Timer | 211-- | TIM11 |
| 11 | Timer | 212-- | TIM12 |
| 12 | Timer | 21315 | TIM13 |
| 13 | Timer | 214-- | TIM14 |
| 14 | Timer | 215-- | TIM15 |
| 15 | Timer | 216-- | TIM16 |
| 16 | Timer | 21715 | TIM17 |
| 17 | Timer | 220-- | TIM20 |
| 18 | Timer | 221-- | TIM21 |
| 19 | Timer | 222-- | TIM22 |
| 20 | Timer | 22315 | TIM23 |
| 21 | Timer | 224-- | TIM24 |
| 22 | Timer | 225-- | TIM25 |
| 23 | Timer | 226-- | TIM26 |
| 24 | Timer | 227-- | TIM27 |
| 25 | Timer | 23015 | TIM30 |
| 26 | Timer | 24215 | TIM42 |
| 27 | Counter | 231-- | CTR1 |
| 28 | Counter | 232-- | CTR2 |
| 29 | Counter | 233-- | CTR3 |
| 30 | Counter | 234-- | CTR4 |
| 31 | Counter | 235-- | CTR5 |
| 32 | Counter | 236-- | CTR6 |
| 33 | Counter | 237-- | CTR7 |
| 34 | Counter | 240-- | CTR8 |
| 35 | Counter | 241-- | CTR9 |

The following is the program for use with the controller 1920 referred to hereinabove.

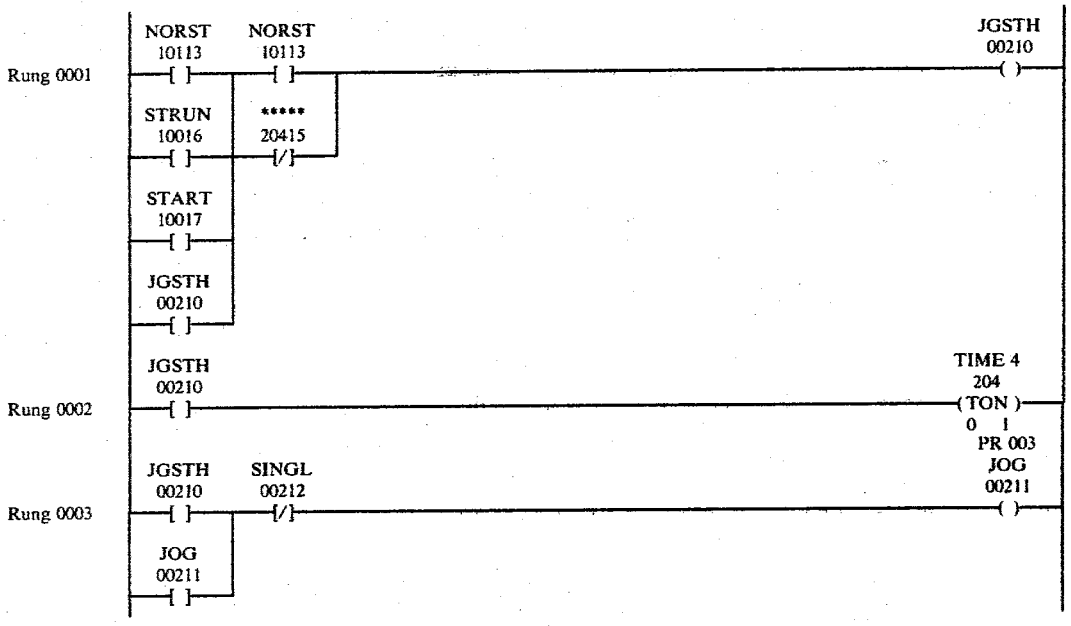
Rung 0001
NORST 10113
NORST 10113
JGSTH 00210
STRUN 10016
***** 20415
START 10017
JGSTH 00210
Rung 0002
JGSTH 00210
TIME 4 204
TON
0 1
PR 003
Rung 0003
JGSTH 00210
SINGL 00212
JOG 00211
JOG 00211
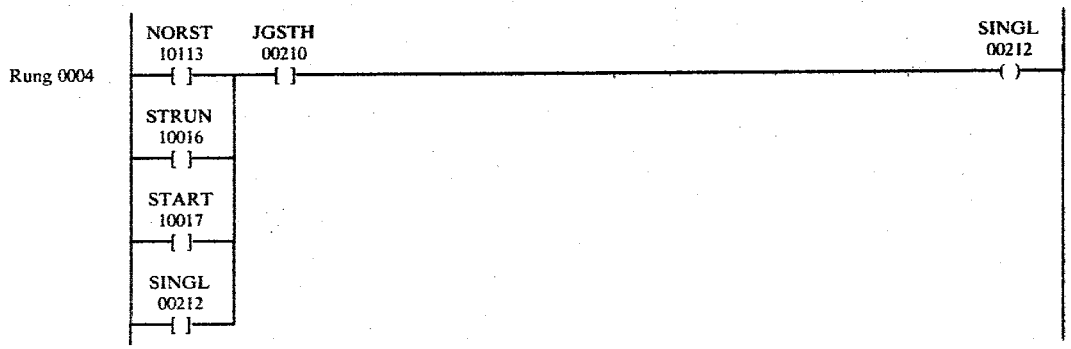
Rung 0004
NORST 10113
JGSTH 00210
SINGL 00212
STRUN 10016
START 10017
SINGL 00212
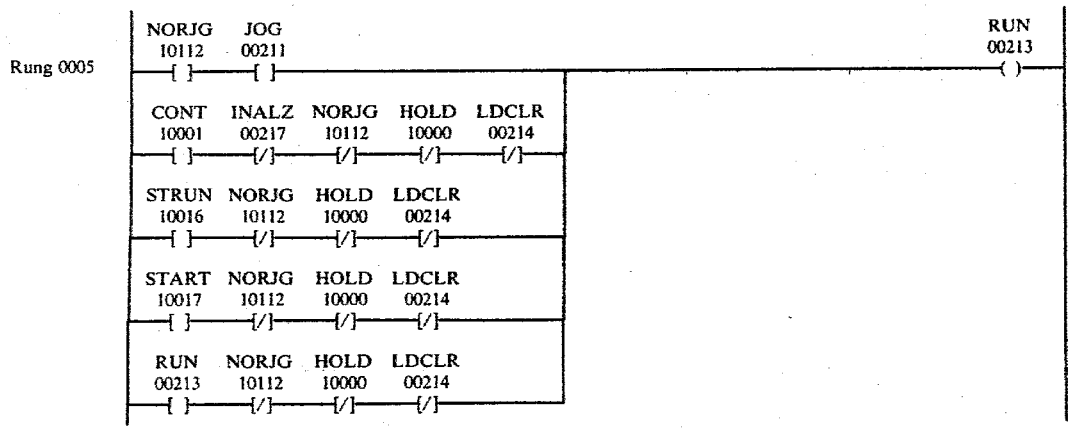
Rung 0005
NORJG 10112
JOG 00211
RUN 00213
CONT 10001
INALZ 00217
NORJG 10112
HOLD 10000
LDCLR 00214
STRUN 10016
NORJG 10112
HOLD 10000
LDCLR 00214
START 10017
NORJG 10112
HOLD 10000
LDCLR 00214
RUN 00213
NORJG 10112
HOLD 10000
LDCLR 00214

-continued
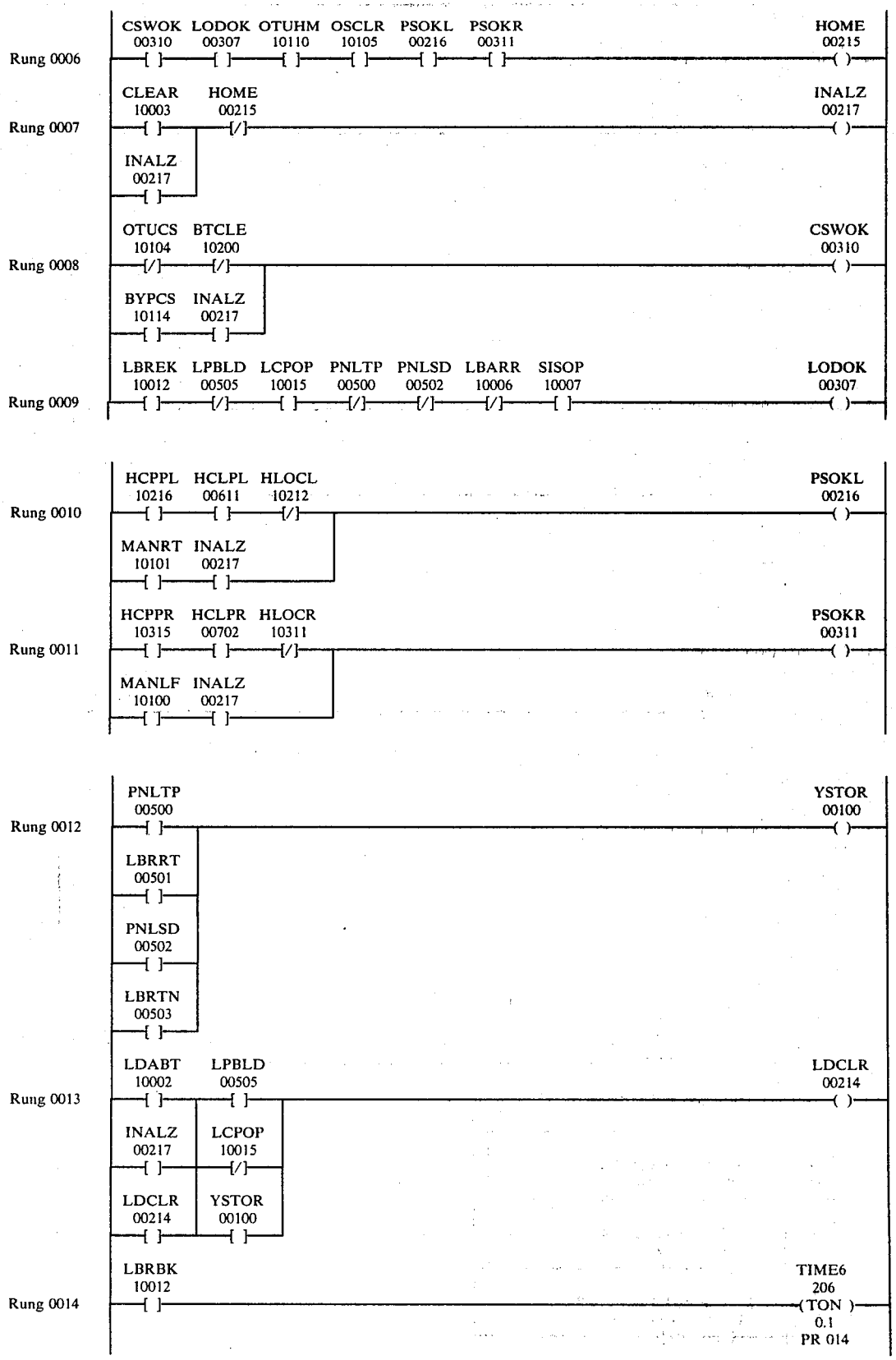

-continued
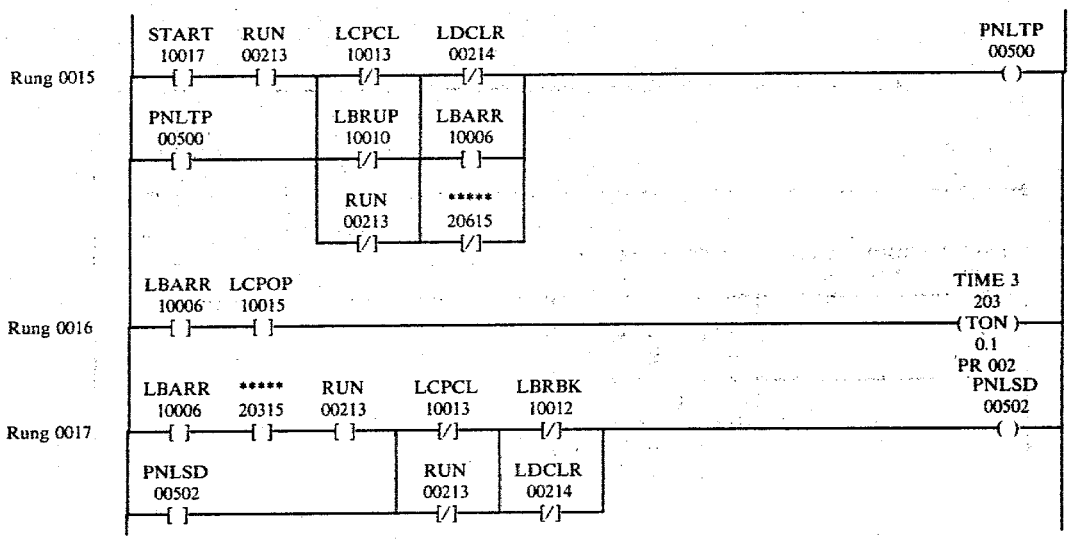
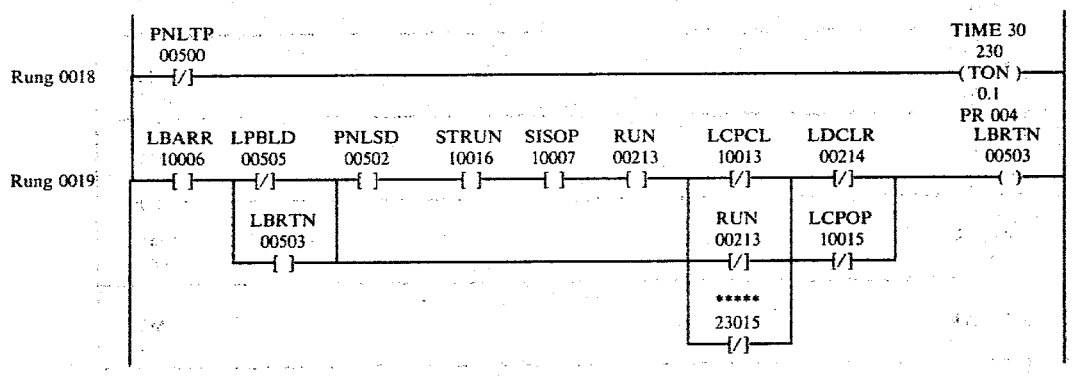
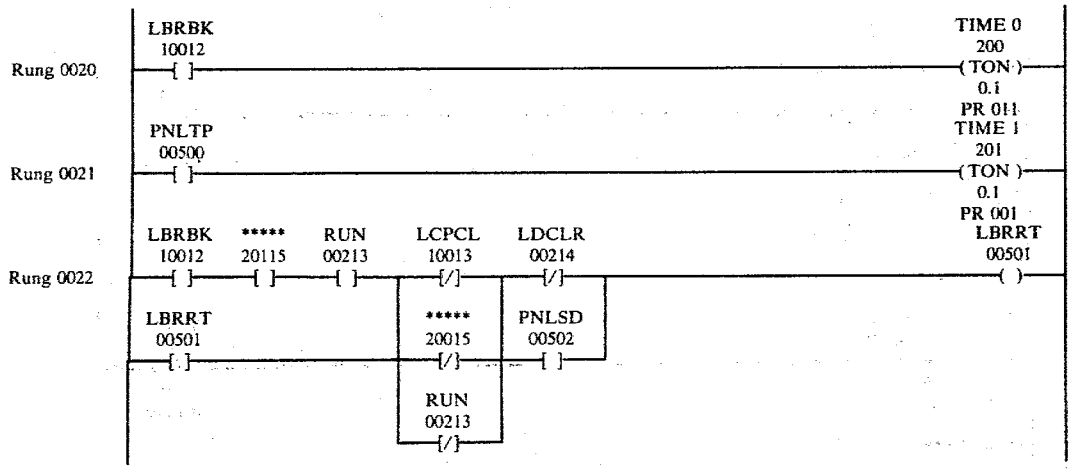

-continued
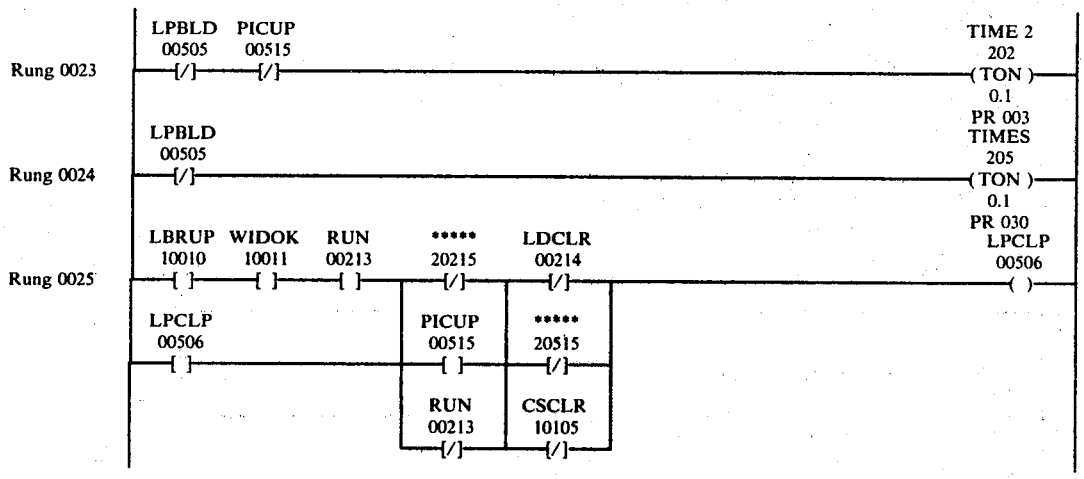
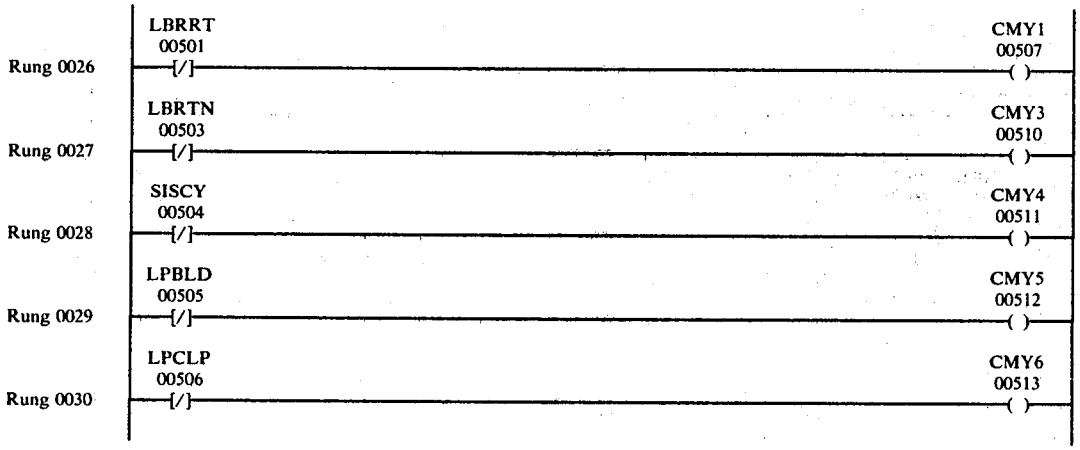
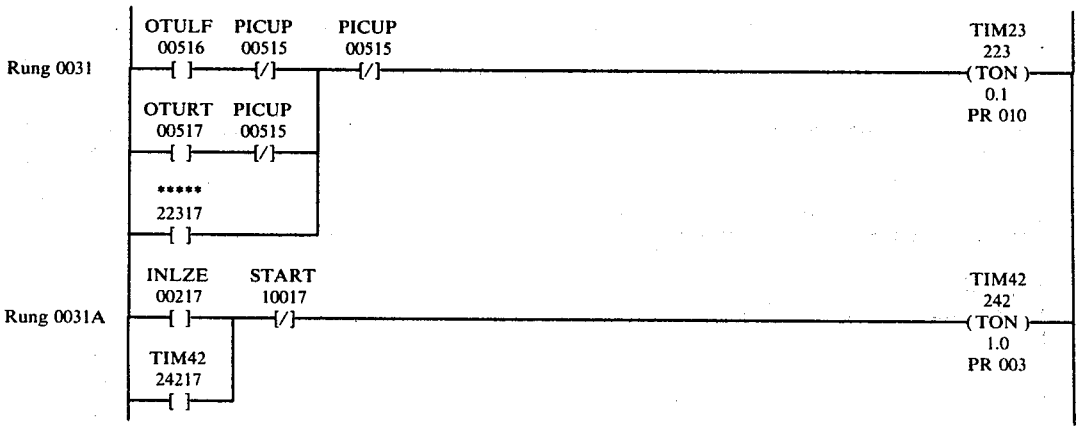

-continued
Rung 0032
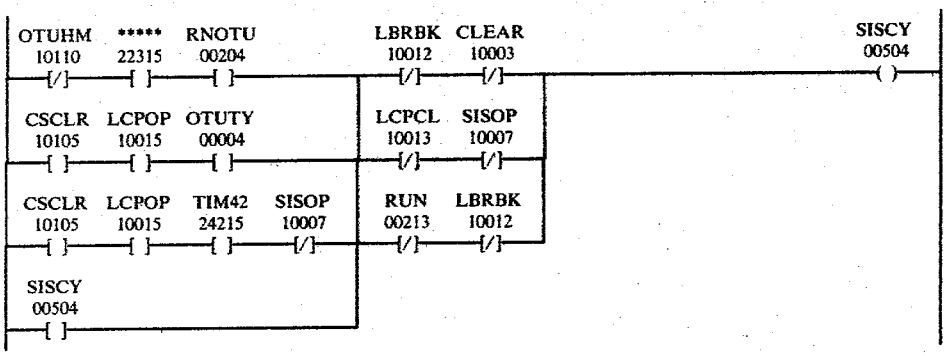
Rung 0033
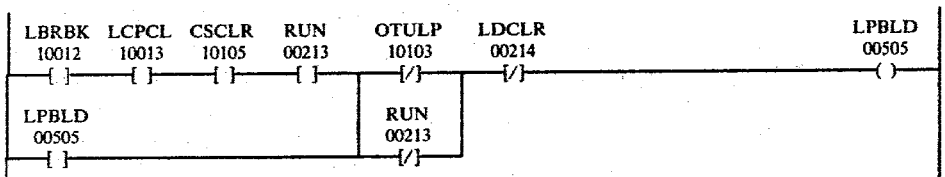
Rung 0034
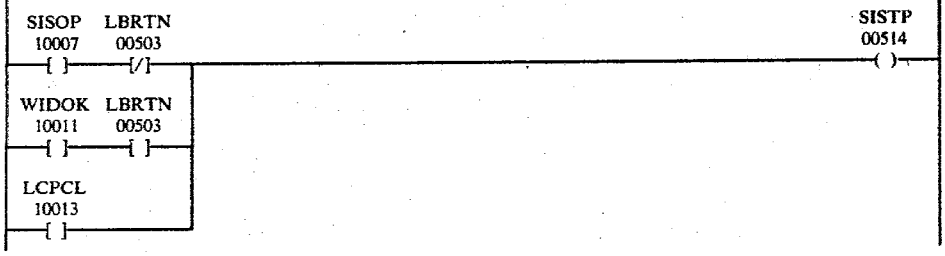
Rung 0035
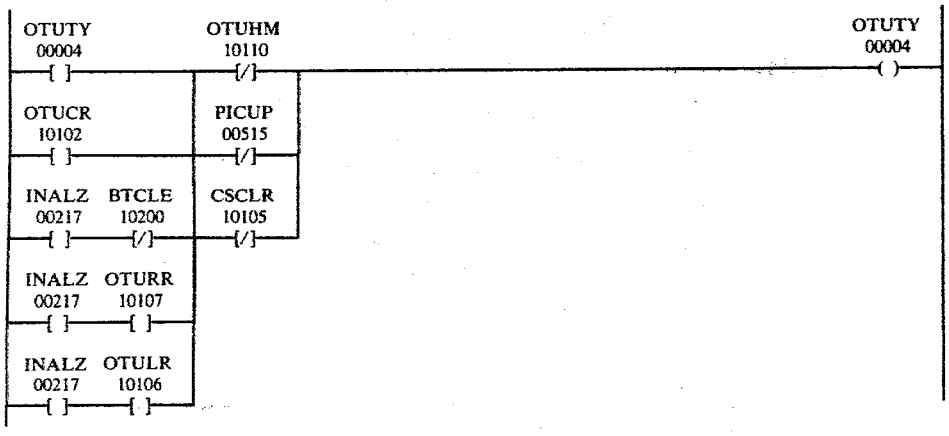

-continued
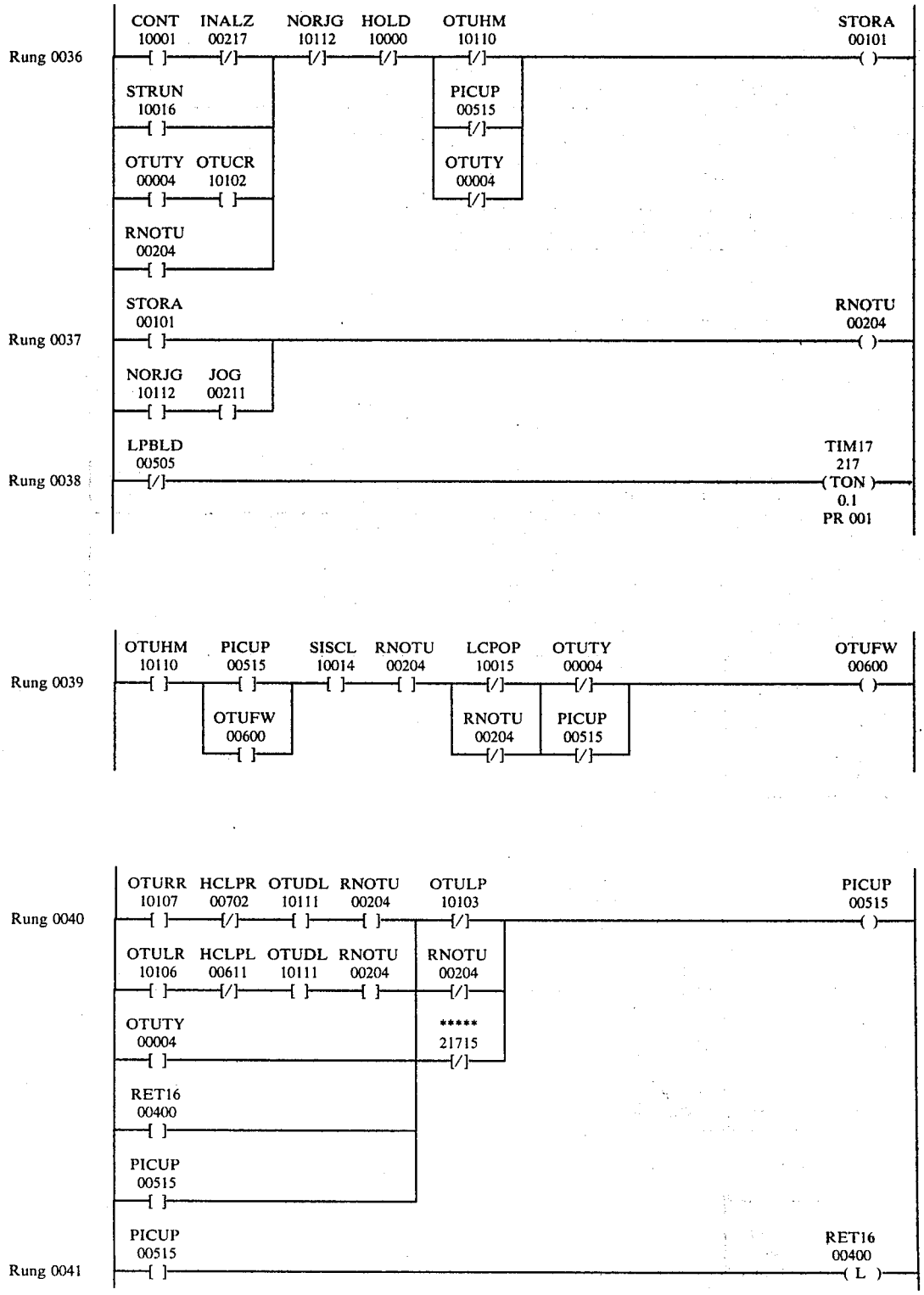

-continued
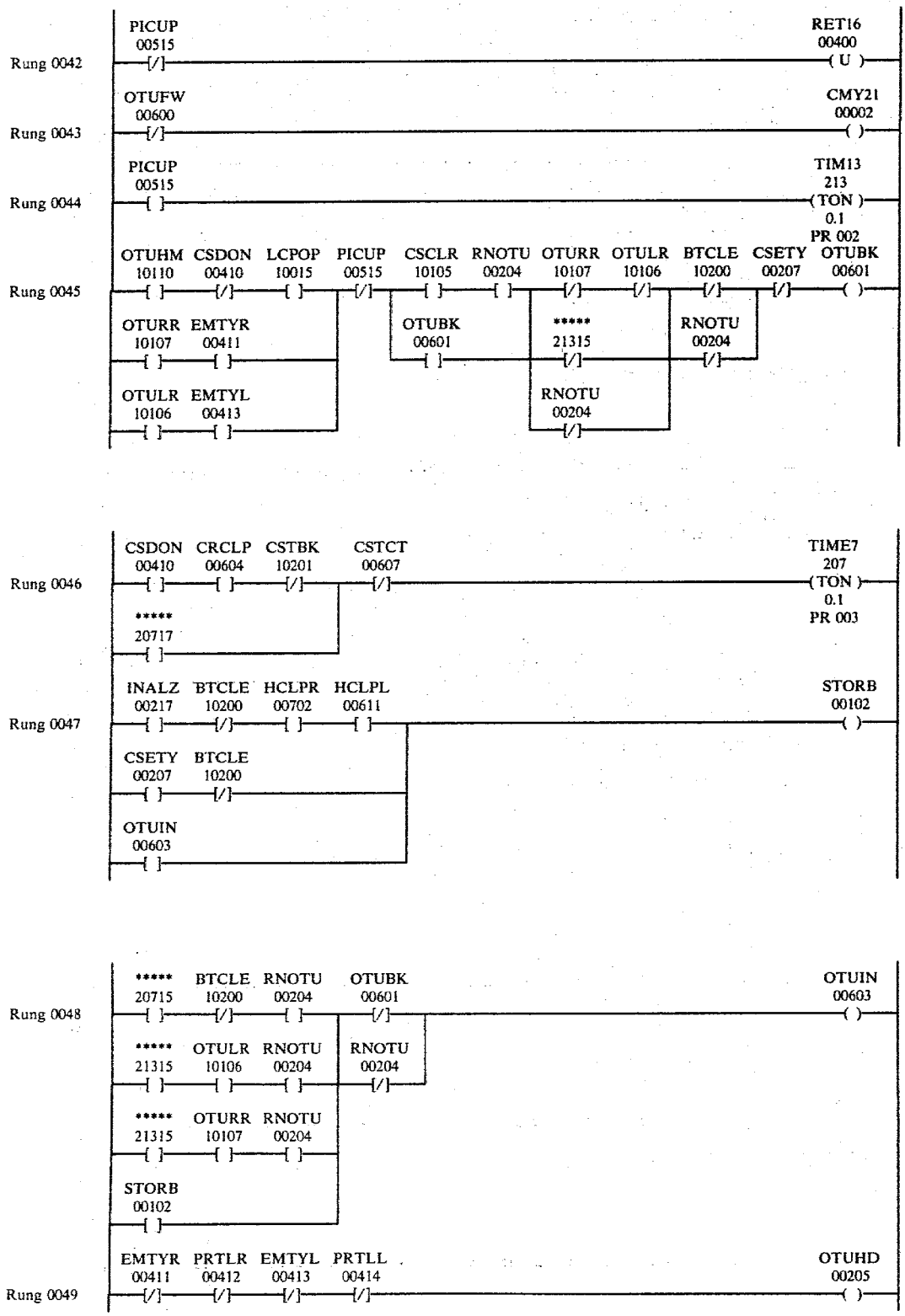

-continued
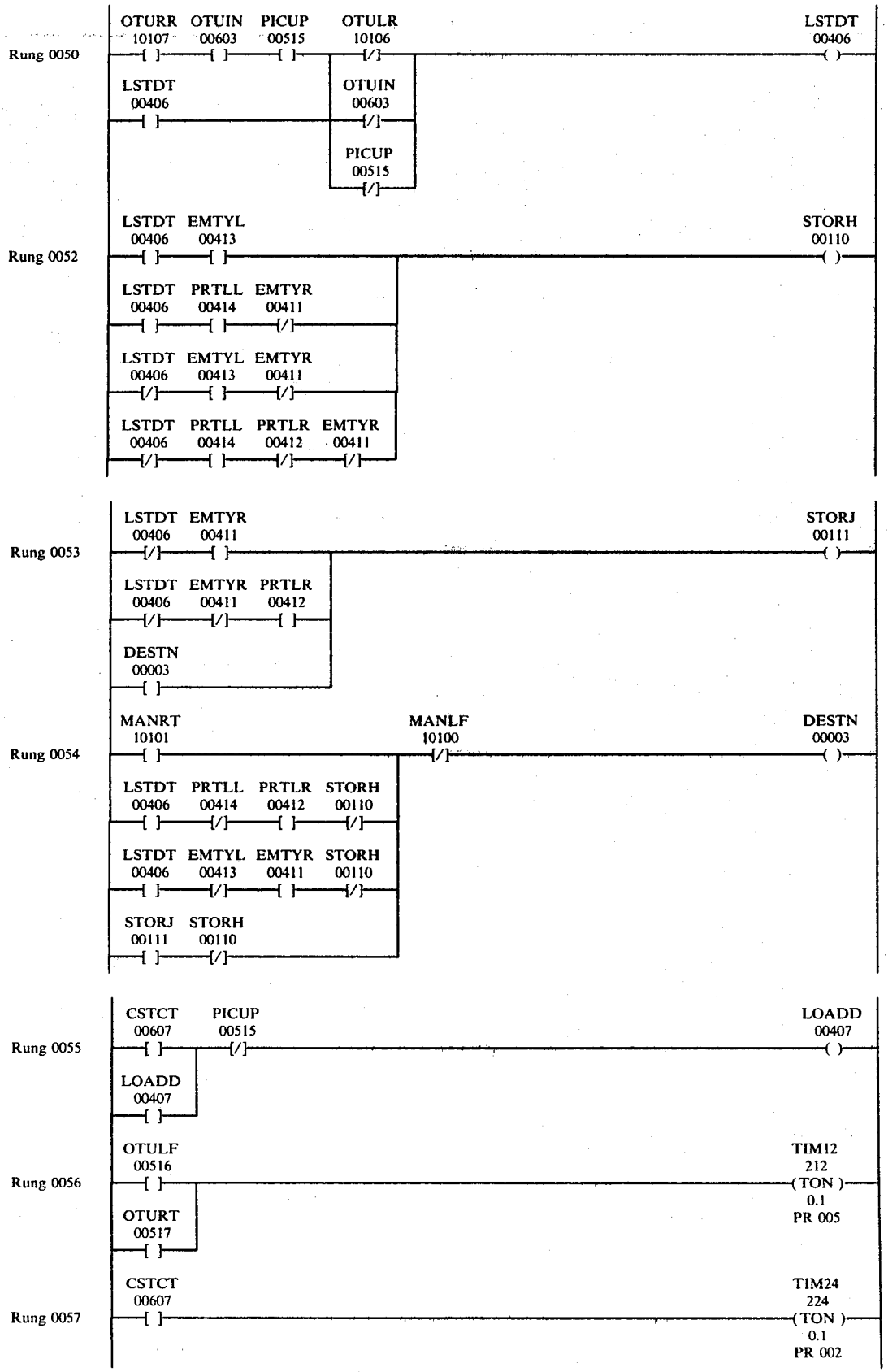

-continued
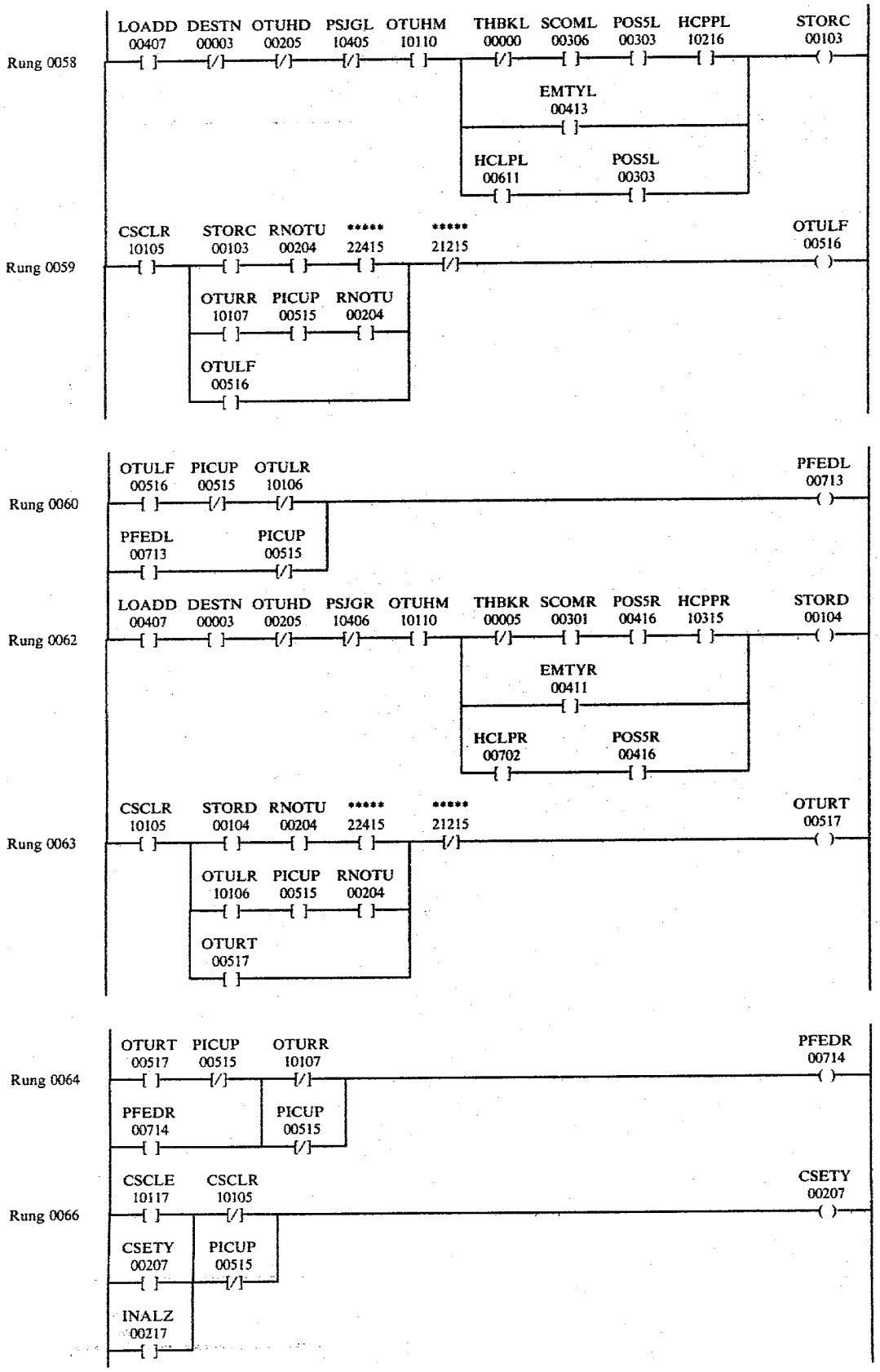

-continued
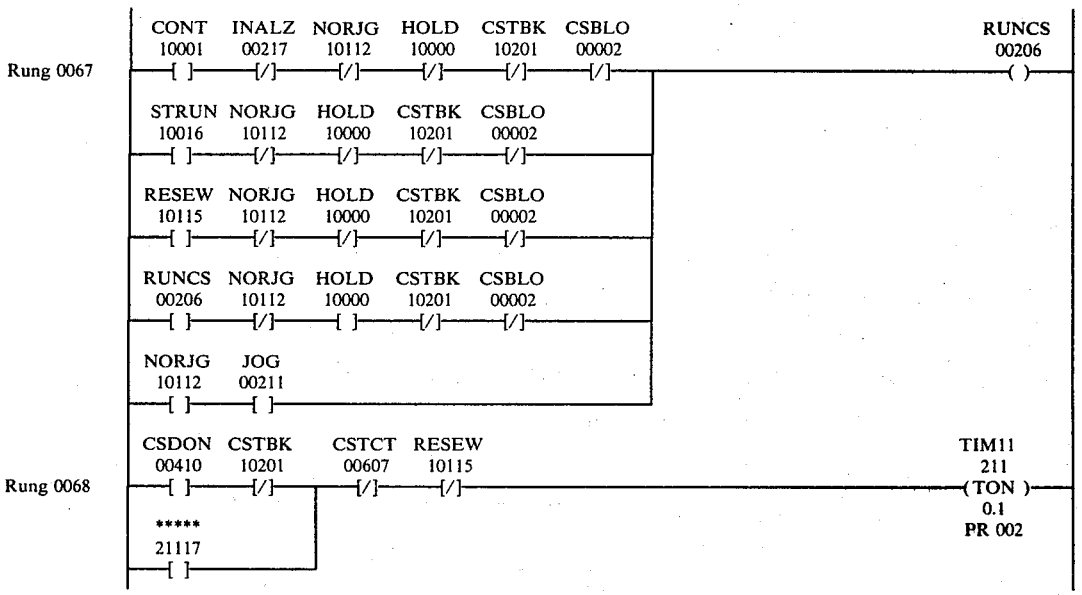
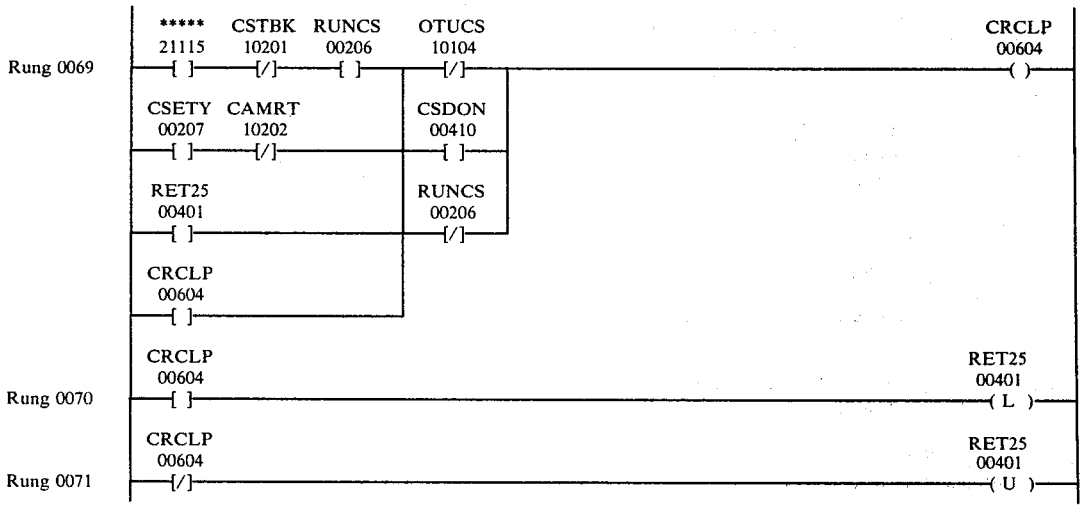

-continued
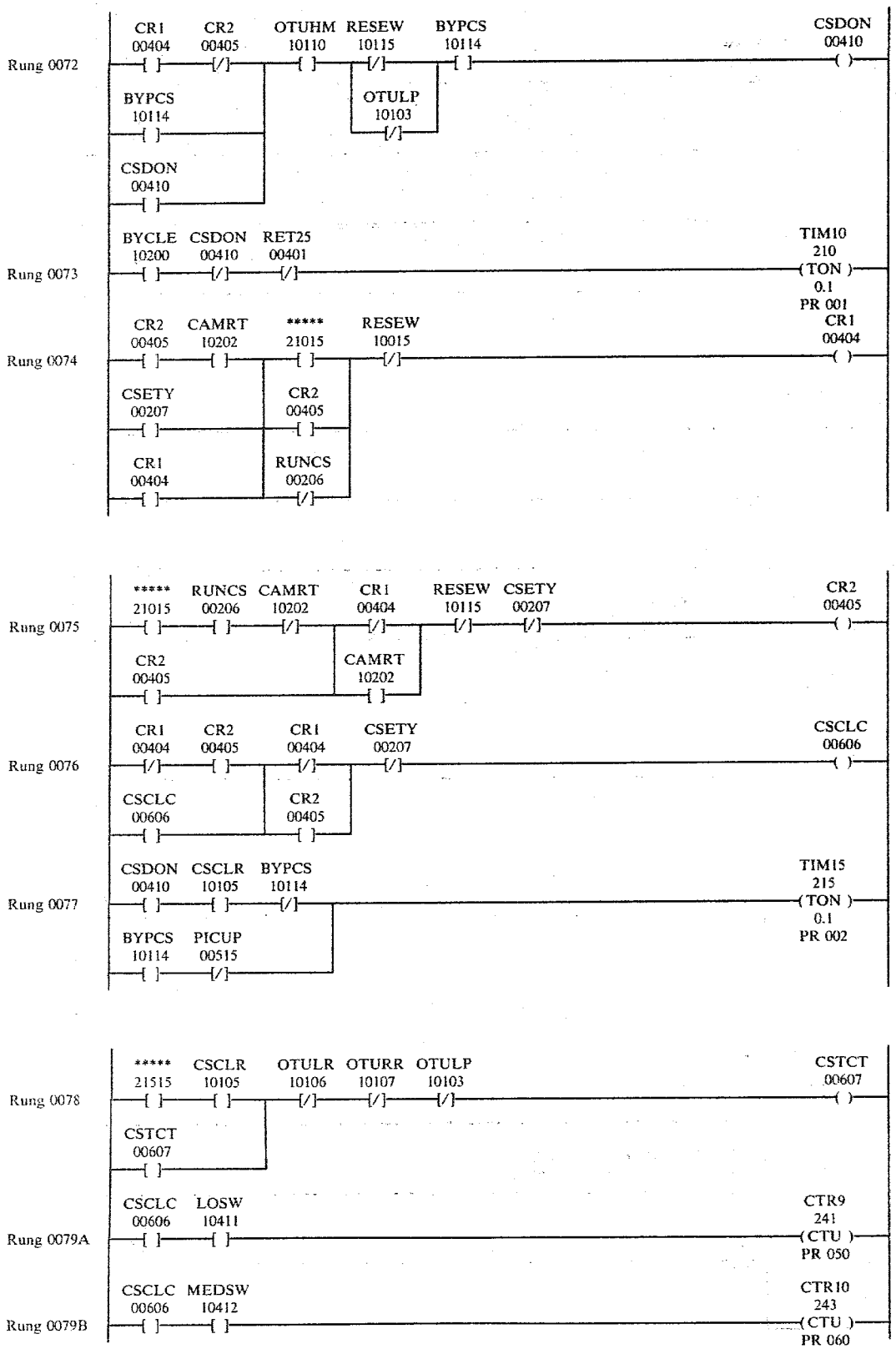

-continued
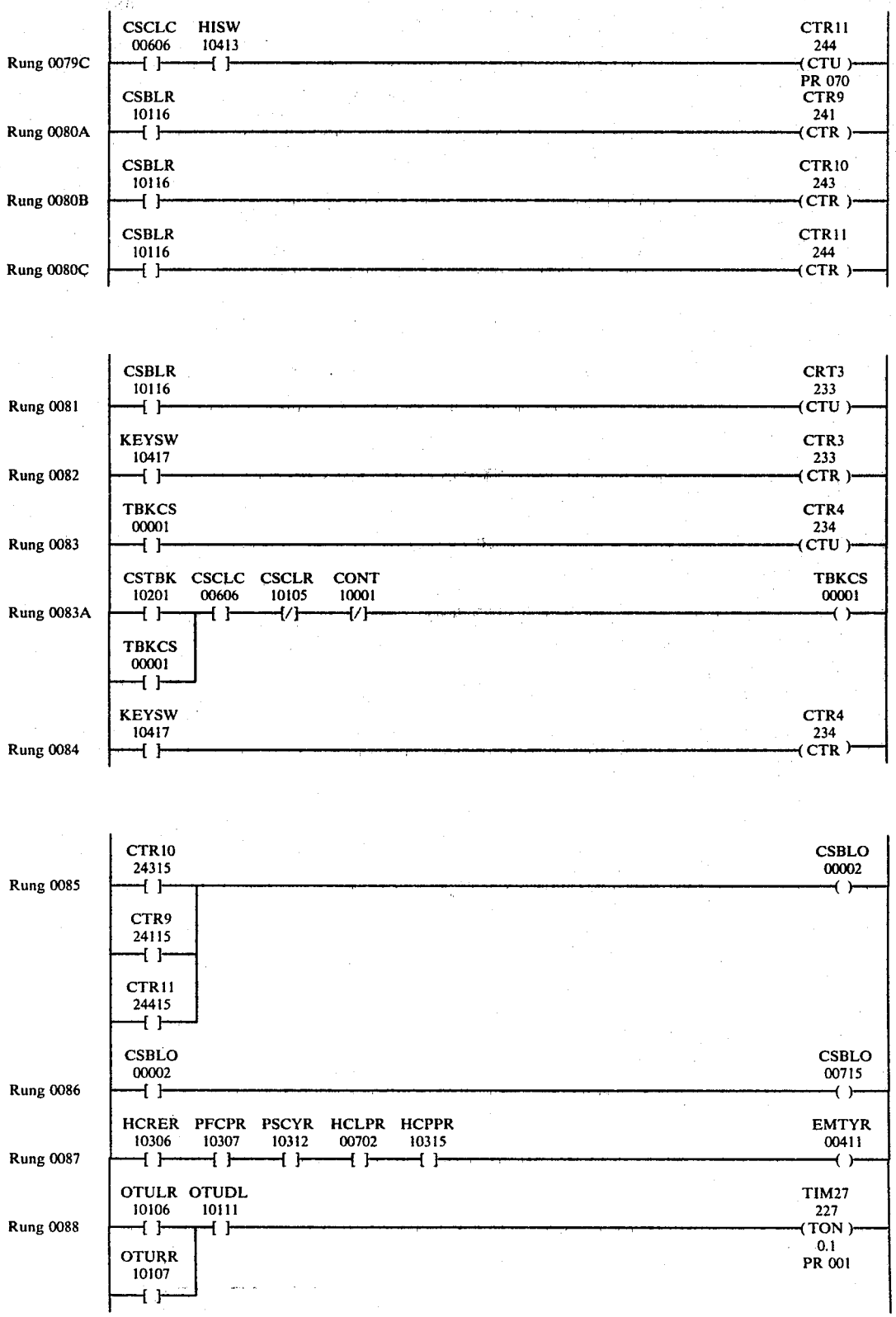

-continued
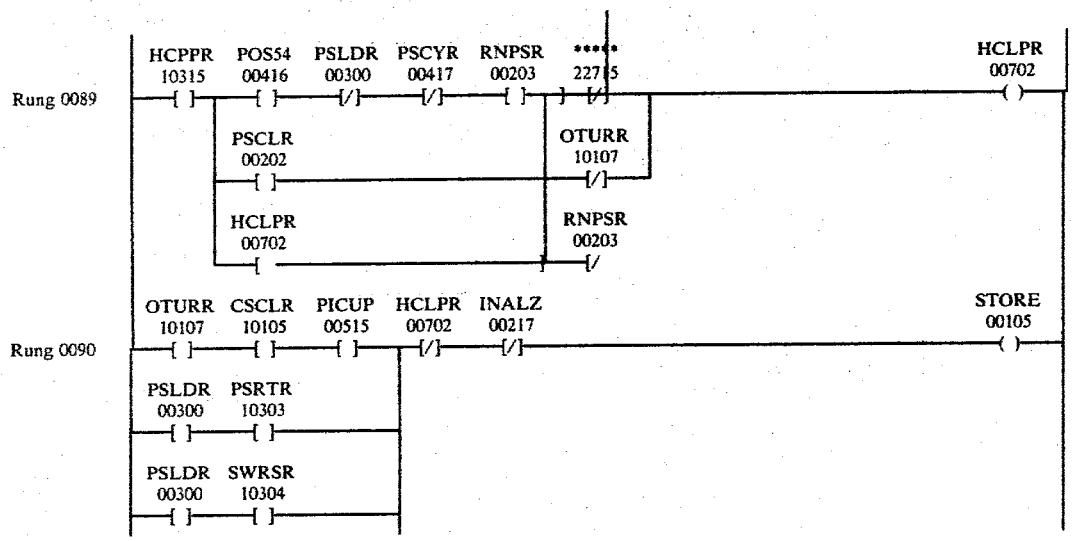
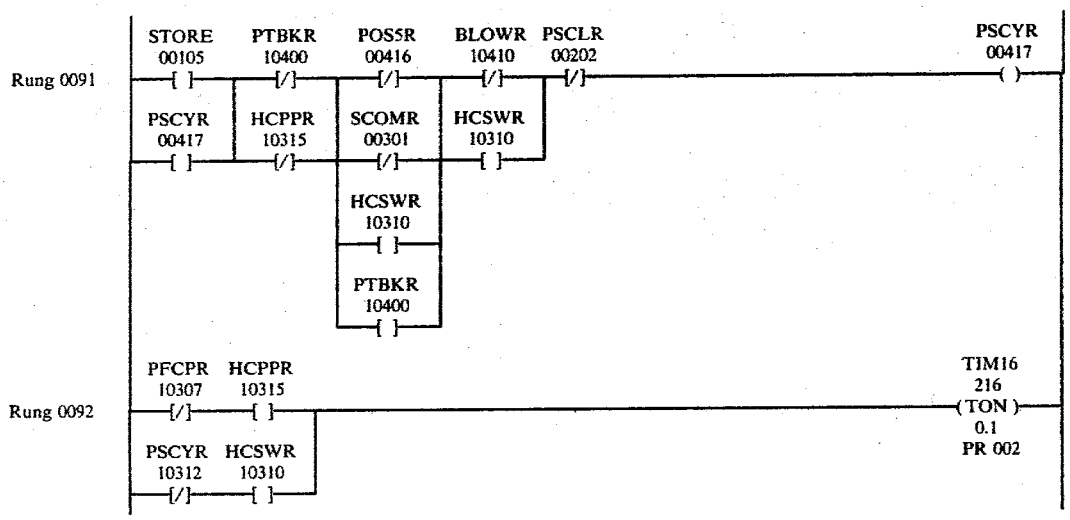
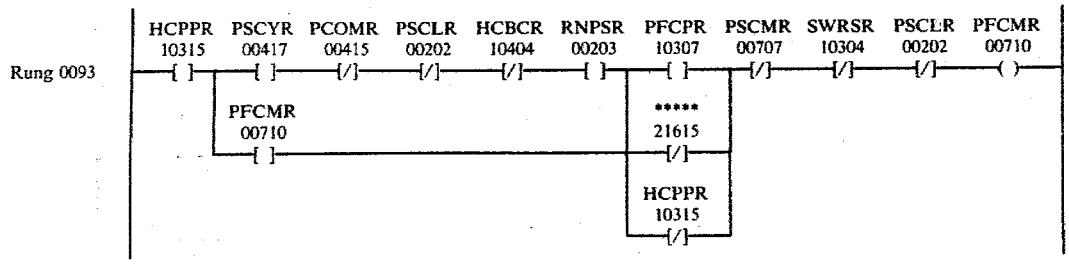

-continued
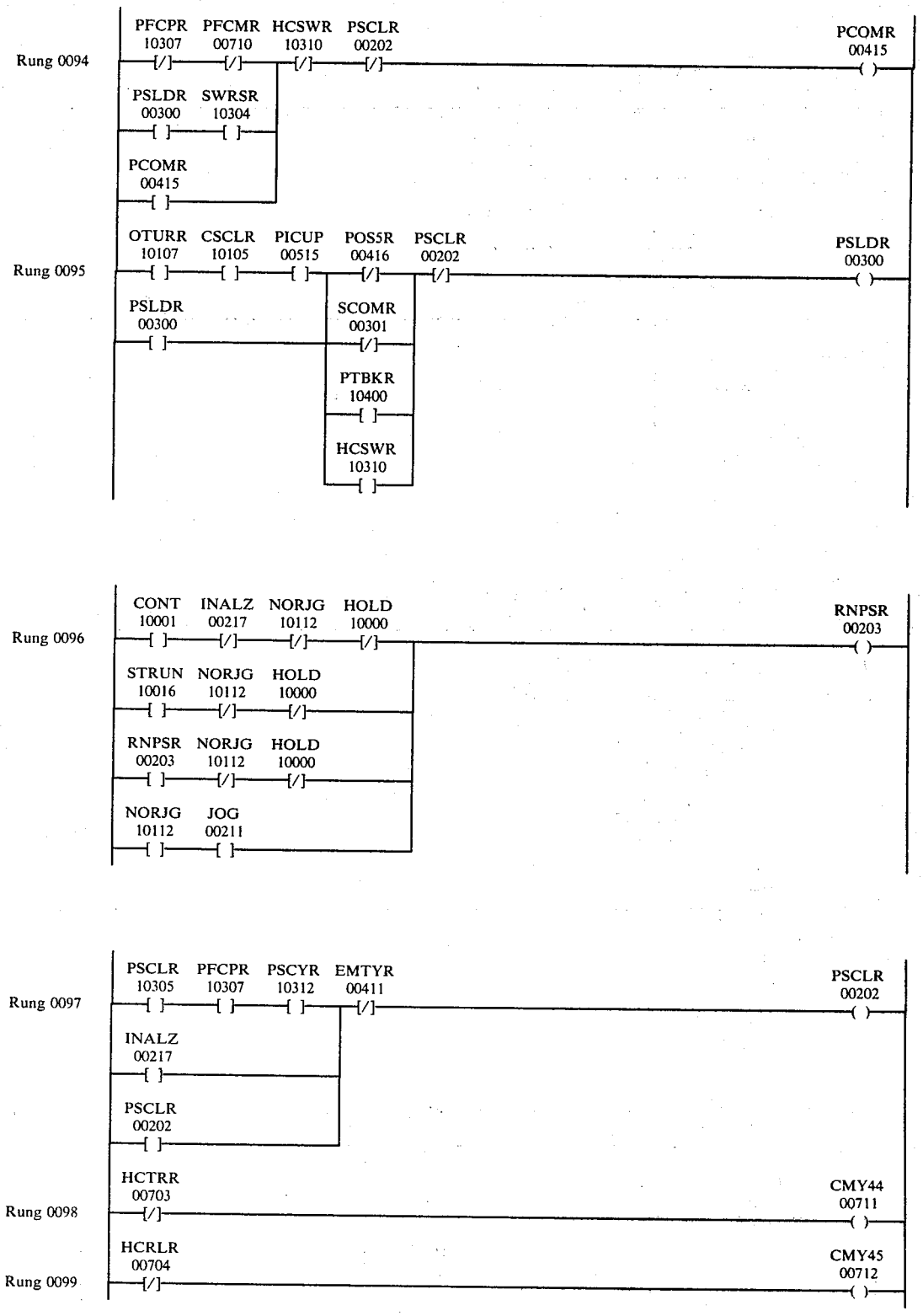

-continued
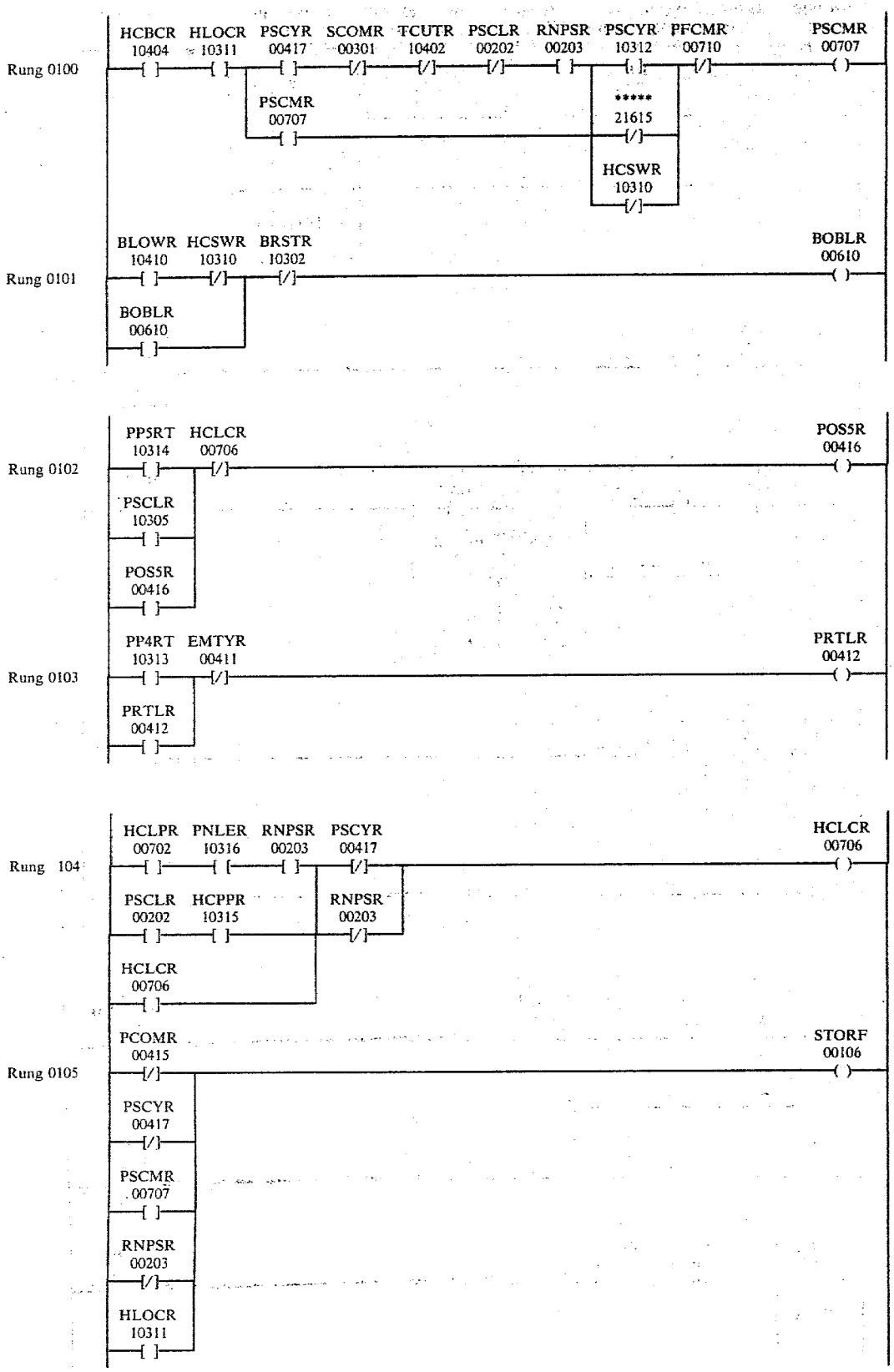

-continued
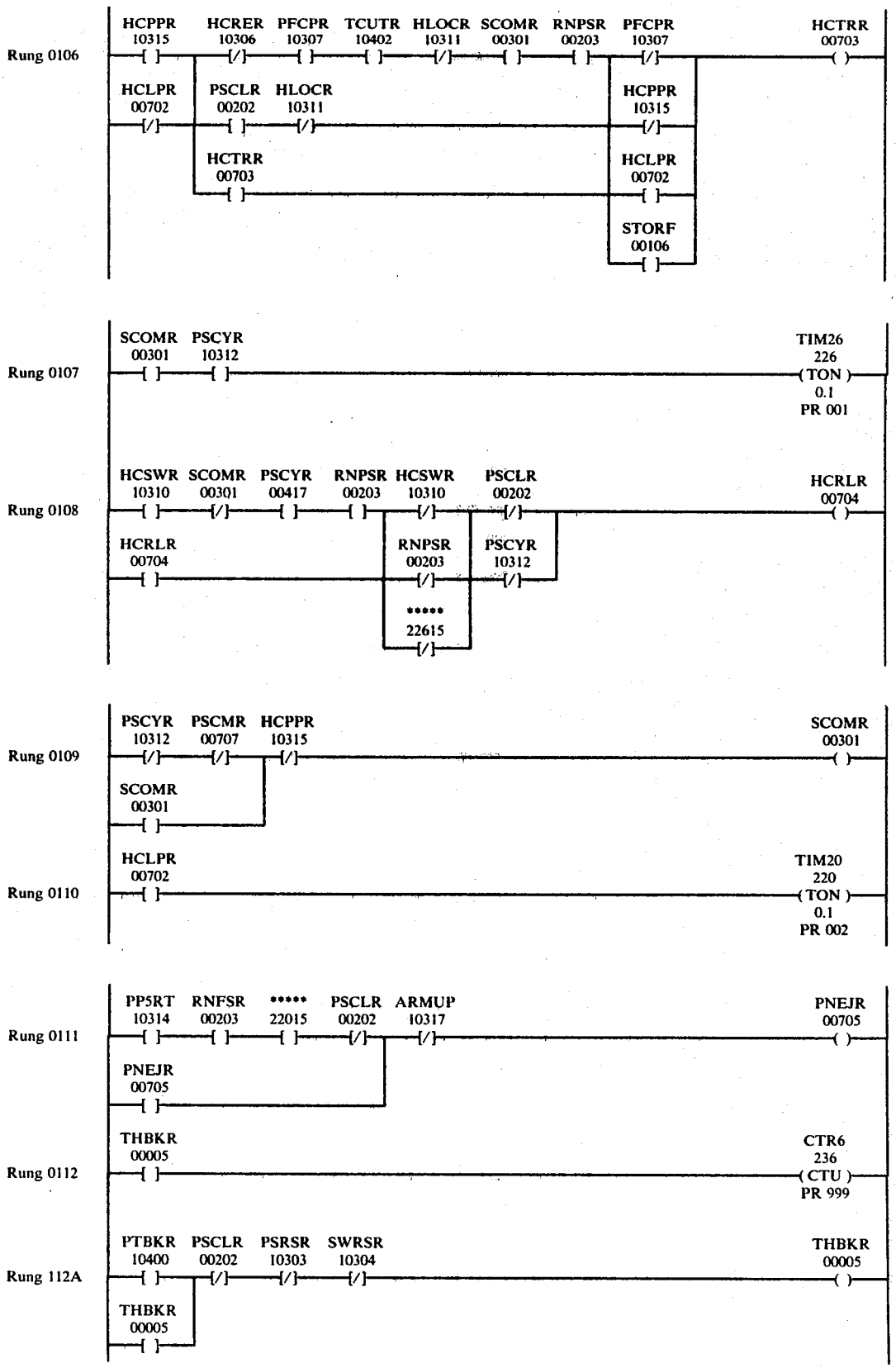

-continued
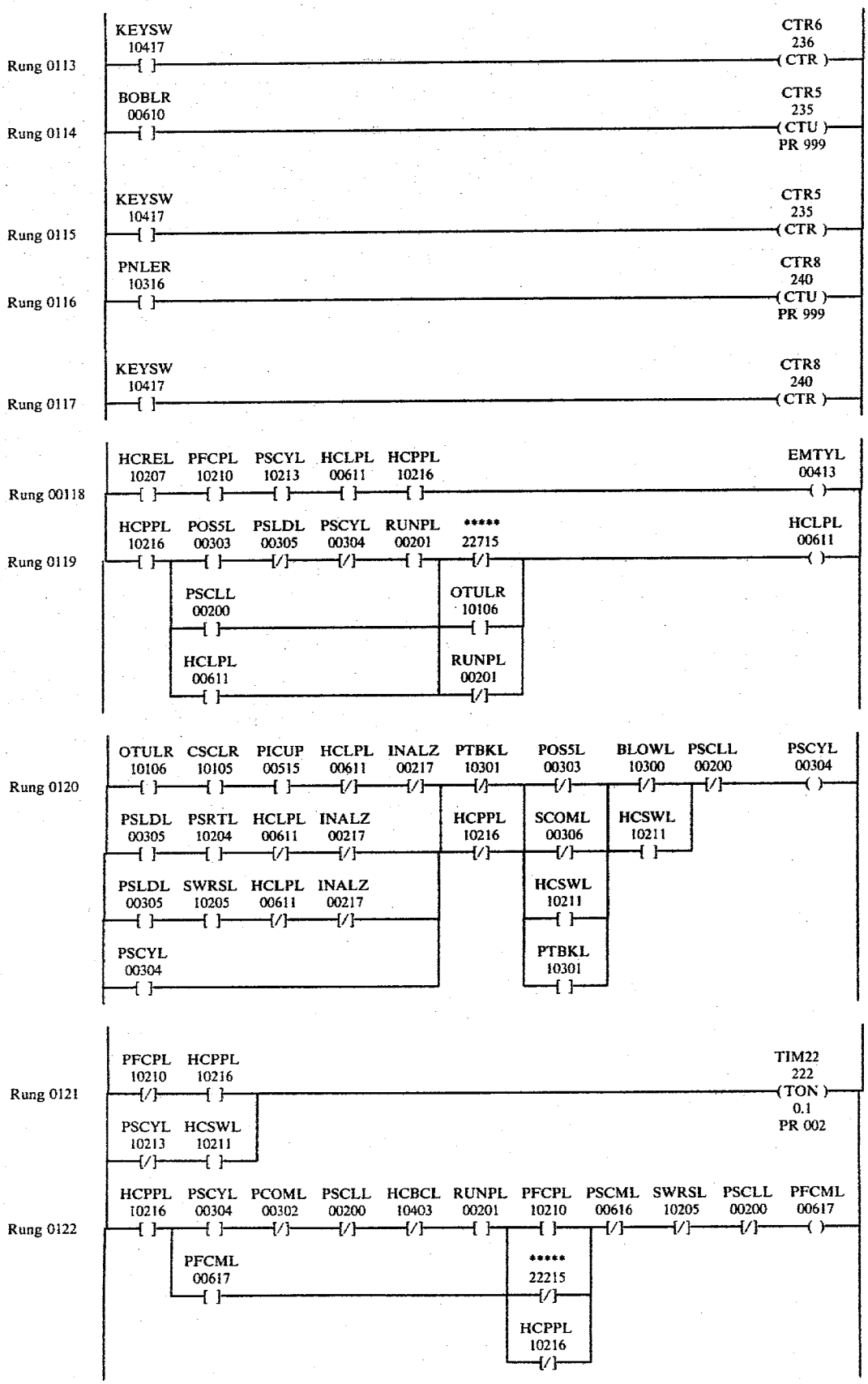

-continued
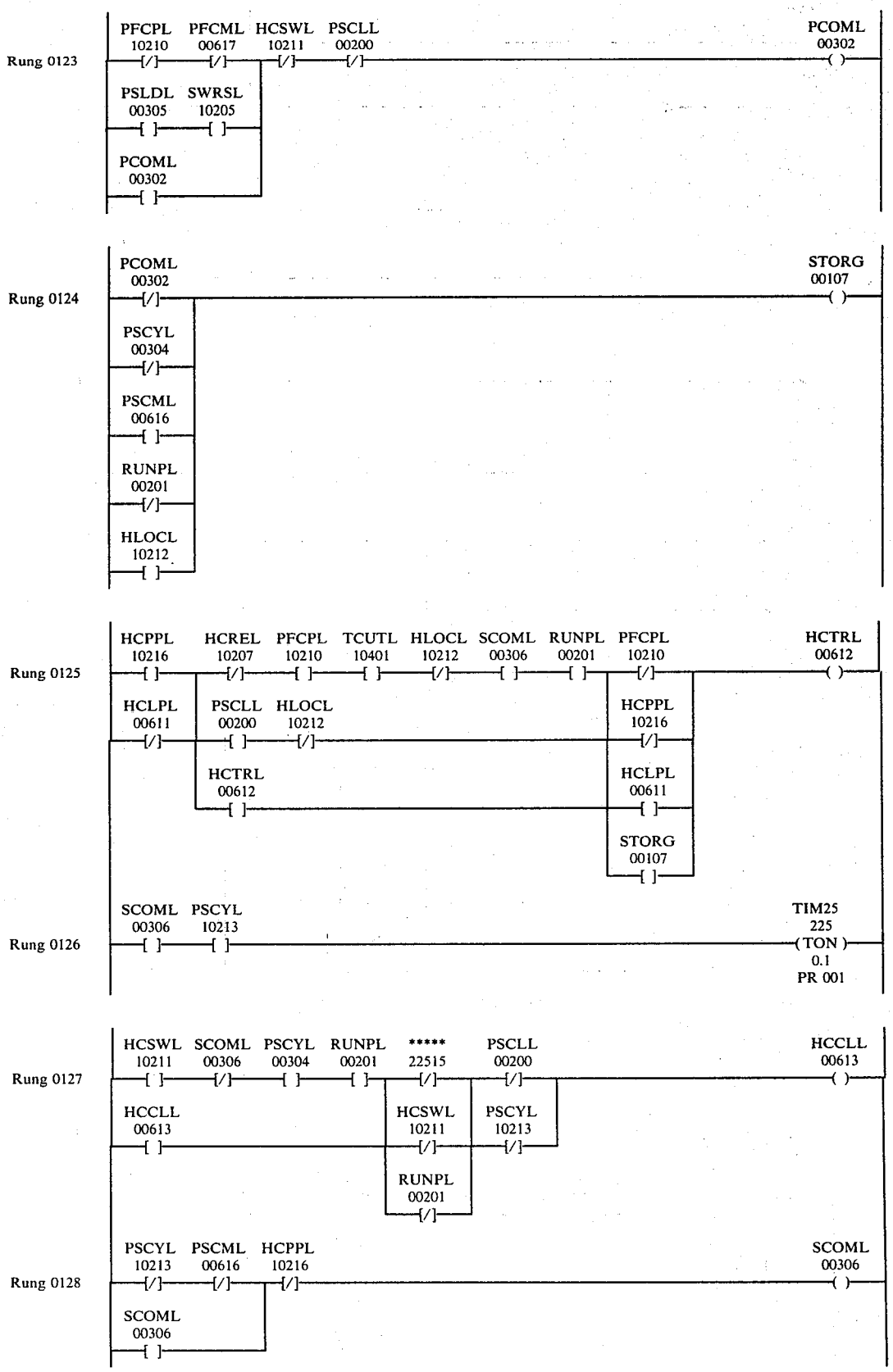

-continued
Rung 0129
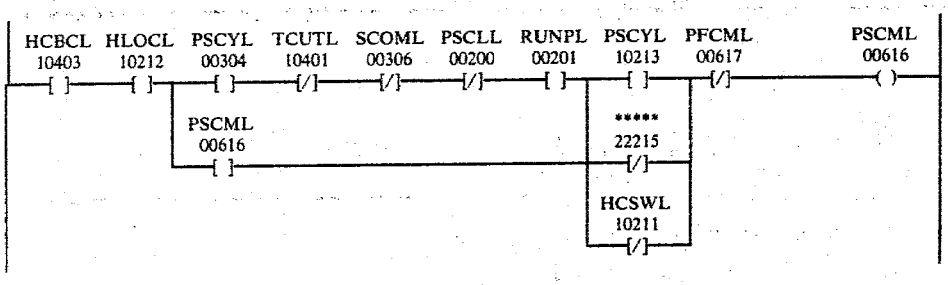
Rung 0130
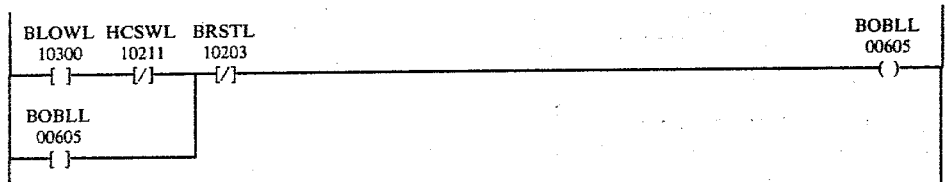
Rung 0131
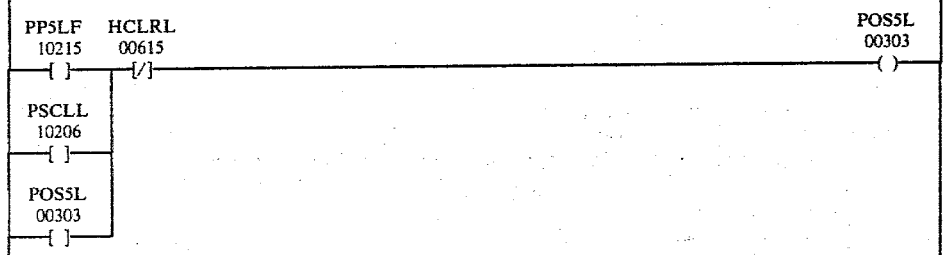
Rung 0132
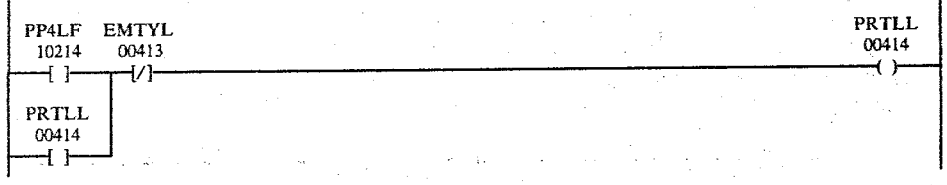
Rung 0133
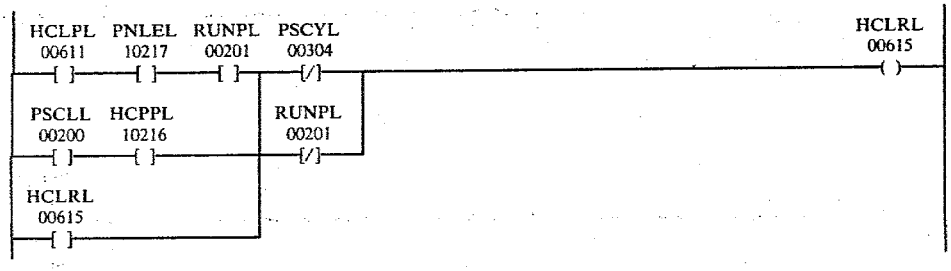
Rung 0134
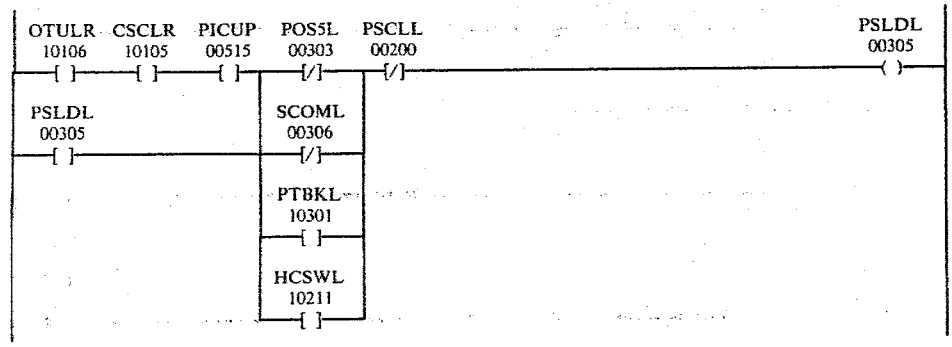

-continued
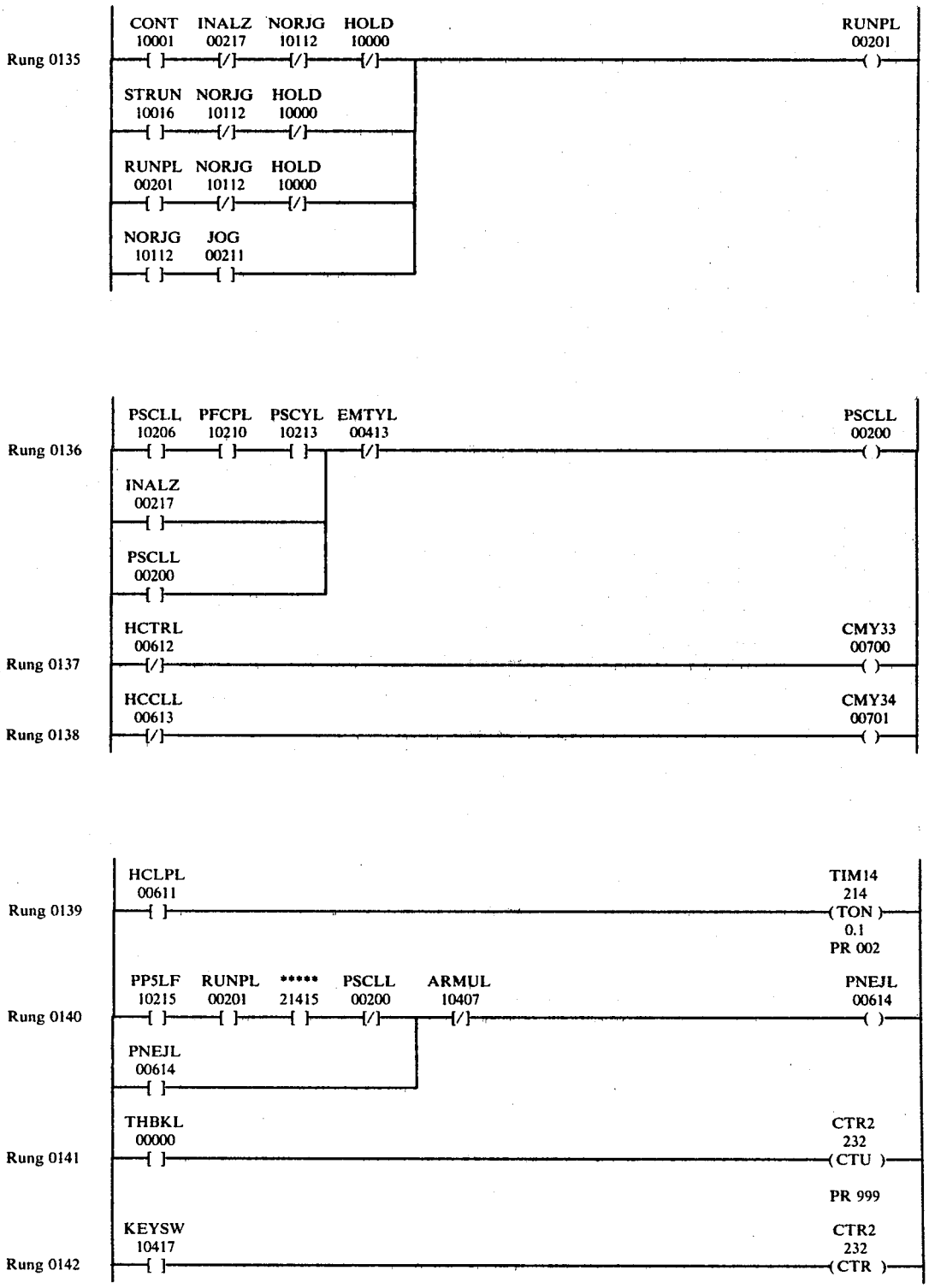

-continued
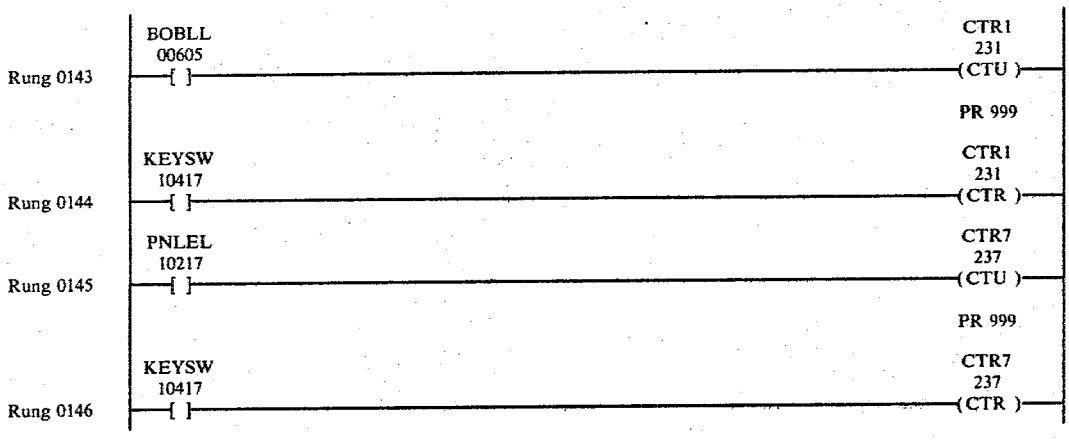
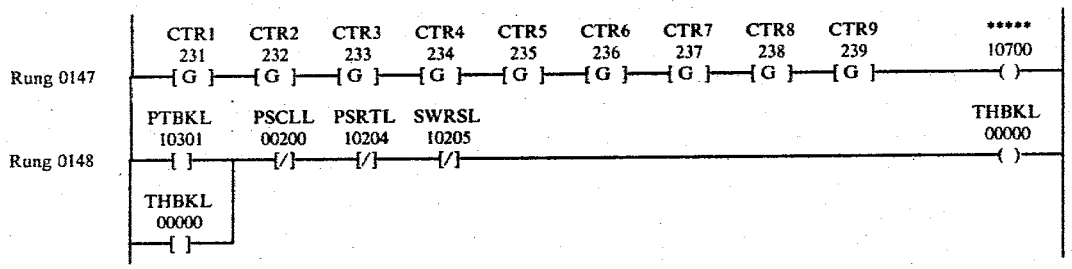
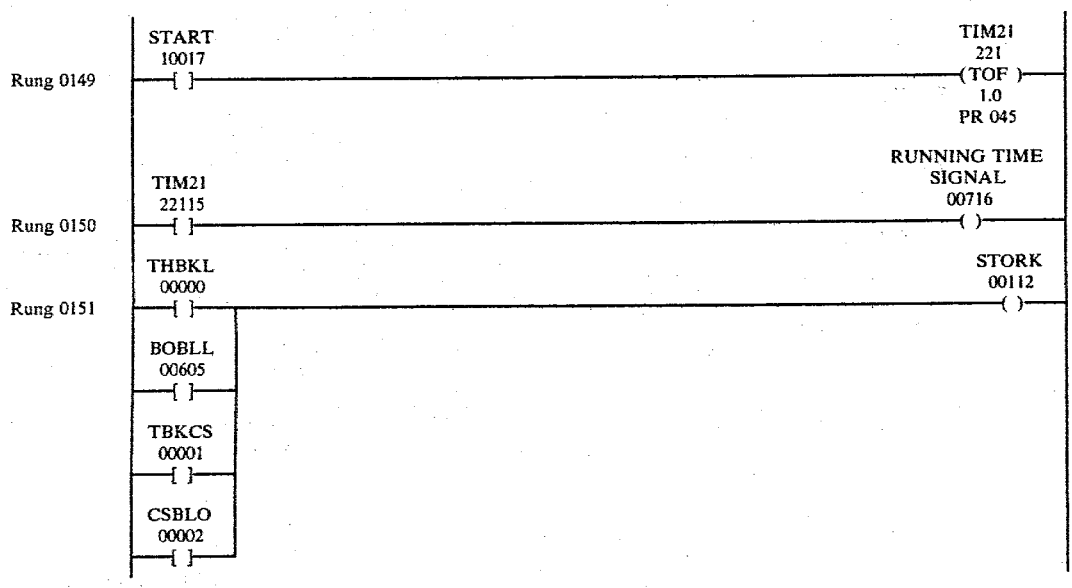

-continued

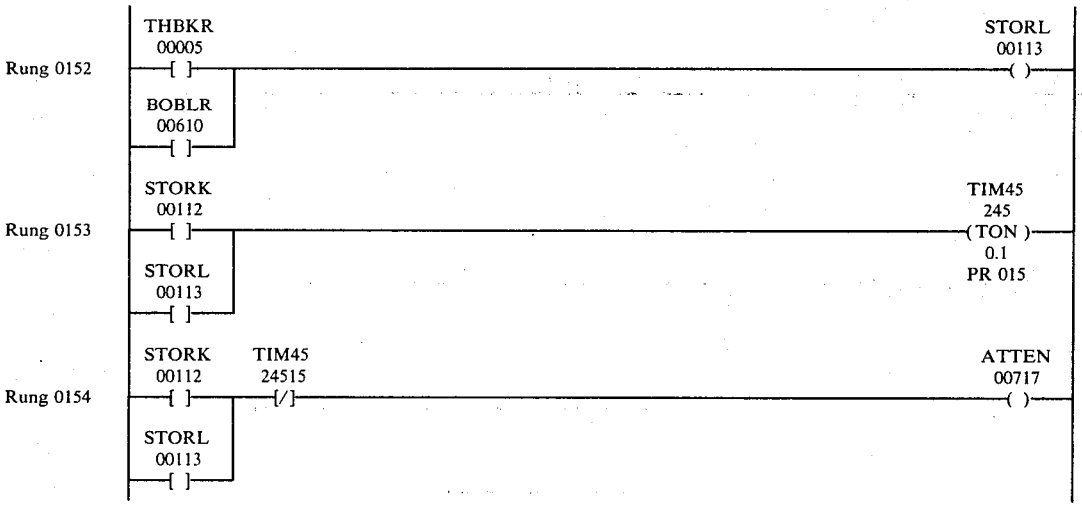

As can be noted, the program is divided up into a series of steps which are referred to as rungs with the rung numbers ranging between 1 and 152.

In order to fully explain the operational program, the specific steps or rungs will be explained individually and will, together with the discussion referring to the sequential operation of the pleating machine serve to fully explain the operation and control of the just described pleating machine.

The program is set forth in terms of ladder circuits which can be broken down into four separate areas.

mode. It will be noted that each one of the condition boxes, beneath the function description, has a slash line through it indicating that that function is in a NOT condition and for the equation to be true, the loop clamps would not be sensed as being in a closed condition, the loading bar transfer motion would not be complete and the load and loop sections of the machine would not be in a run condition. If all of those conditions became false, the PNLTO (00500) function or a signal to the solenoid for closing the panel top clamps by activating the panel top clamp cylinder would be

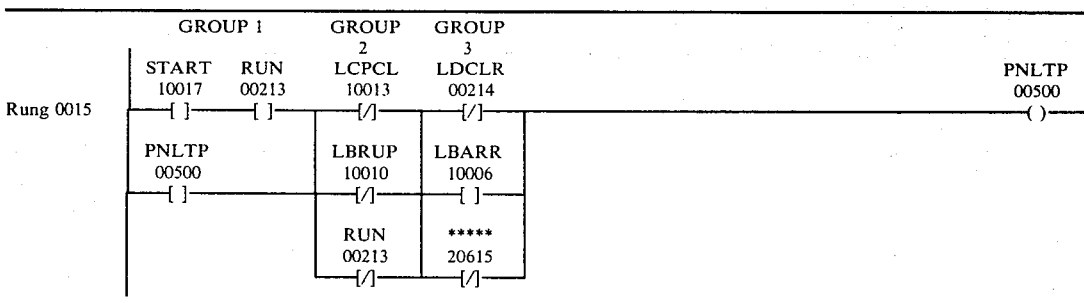

Taking rung 15 as an example, there are three groups of vertical conditions set forth on the left-hand side of the ladder circuit and the resulting function being generated or turned on is PNLTP (00500) is set forth on the right-hand side. The first group on the left-hand side is comprised of two horizontal lines, the first line including the START and RUN functions, the start button (10017) function referring to the start push while the run function (00213) is a memory generated function. The second line includes the PNLTP (00500) function which refers to a controller output signal to the panel top clamp cylinder and serves as a latch for the generated function. It is a machine function actuated by the controller upon the occurrence of the closure of the start switch and when the load and loop assemblies are in a run mode.

Group 2 consists of LCPCL (10013) NOT which refers to the loop-forming clamps close sense, LBRUP (10013) NOT which refers to the loading bar transfer motion complete sense and the RUN (00213) NOT turned off.

The third group when true would serve to allow the initial completion of the circuit and if they remain true will not turn off energization of the panel top clamp cylinder which is latched, once activated, by the PNLTP condition in the first group in the second tier of the first group. The third group consists of LDCLR (00214) NOT which is a memory generated function indicating the load abort push button is not pushed, LBARR (1006) which refers to the sensing of loading bar being rotated to the transfer position and time delay 20615 NOT which indicates the time delay has not run. The 20615 designation for this time delay can be broken down in terms of the first three numbers 206 which refer back to the time interval in rung 14, the last two numerals 15 referred to the contacts that become closed once the time period has run. All time delay functions in terms of the numbers being applied-to the condition will start with the number 2 and can be broken down in the manner just described, Therefore, when these three conditions become false or if the load abort push button is depressed, if the loading bar was not again rotated to a transfer position and if the time delay had run, the controller would be told to clear the signal which would serve to open the panel top clamps. Thus, in order to turn any one of these ladder circuits on, all the conditions in one of the horizontal lines of Group 1 must be true. Thereafter, as long as any one of the conditions in Group 2 and Group 3 are true, a circuit path will be completed. As indicated, to turn the circuit off, all the Group 2 functions would have to be flase or to clear the signal all Group 3 functions would need to be false.

The numbered conditions which begin with the numeral 1 are inputs to the controller and in most instances are generated by switches on the pleating machine which will allow the controller to sense whether or not particular pieces of equipment have been actuated or are in some particular mode.

The functions beginning with numbers 0 though 400 are memory-generated outputs from the computer while those having numbers from 500 to 700 are machine functions and timing functions beginning with the numeral 2.

In addition, there are instances where complementary functions are shown and will be listed as CMY and usually involve a double-acting air cylinder or a double-acting solenoid.

An explanation of the coding for the input and output assignments and for the timer counter functions are set forth in Tables I through XII and can be referred to so as to understand the symbols used in the program.

EXPLANATION OF PROGRAM

Beginning with rung 1, the function associated with rung 1 is the jog step function numbered 210. Assuming one of the functions in Group 2 is true, the signal to turn that function on will be generated if the normal step switch (10113) of the start run switch for the loop-forming section (10016) or the start switch (10017) is actuated. The jog switch indication in that first group will serve to latch the jog run step function once one of the above switches is activated. The second group in rung 1 will serve to turn the signal off when all are false or when the normal switch (10013) is deenergized and the time delay (204) has run.

At rung 2, the jog step function upon being energized will initiate the time delay (204) which, as indicated, will be for a period of a tenth of a second for three intervals or for a total time delay of three tenths of a second.

Rung 3, upon energization of the jog function (00210), the jog function (00211) will be turned on and the jog function in the first group at rung 3 will serve to latch that function in an on condition. The SINGL NOT condition or single function NOT would serve to turn off the jog function once it was energized.

Rung 4 indicates that the single function indicated at SINGL (00212) will be turned on when the normal step switch (10113), when the start/run switch for the loop forming section (10016) or when the general start switch (10017) is actuated and jog step function is present.

Turning now to rung 5, the machine run function will be energized when any one of the left-hand equations are true with the left-hand equations being as follows. With the normal jog switch in its jog position NORJG (10112) and the jog function energized, JOG (00211), RUN (00213) will be turned on. Looking now at the second row of the Group 1 equations, if the continue push button has been energized, CONT (10001), if the machine has completed initialization and (INALZ) is off, INALZ (00217) NOT, the normal jog switch is not in its jog position NORJG (10112) NOT, the hold switch has not been energized HOLD (10000) NOT and the load clear function has not been sensed LDCLR (00214) NOT, the machine will likewise be placed in the RUN mode (00213). Looking now at the third line of equations, if the loop forming start/run switch STRUN (10016) has been energized but the normal jog switch, the hold and the load clear functions are in their NOT condition, the RUN mode will likewise be energized. The fourth line which would energize the RUN function would require that the START switch (10017) would have to be depressed, the normal switch would not be in a jog position NORJG (10112) NOT, there would be no hold HOLD (10000) NOT and the load clear function would not have been sensed LDCLR (00214) NOT. Looking at the last line of functions, the run mode would be self-latching so long as the normal jog swich was not in its jog position, there was no hold and there was no sensed load clear function.

Turning now to rung 6 which relates to the home function HOME (00215) which as a function is utilized by the controller to determine when the initialization process discussed previously has been completed;

The home function HOME (00215) would be turned "on" or in an "on" mode when each of the conditions set forth in the left-hand side of rung 6, or Group 1, is true. Looking at those functions, the corner-sew function O.K. function CSWOK (00310) would have to have been energized with the corner-sew O.K. function being controlled at run 8, where the corner-sew switch OTUCS (10104) and the bar tack clamp engaged switch BTCLE (10200) are reviewed by the computer controller.

The second function looked at by the controller prior to actuating the home function is the load O.K. function LODOK (00307) which will be discussed at rung 9. The overhead transfer traverse home switch OTUHM (10110) and the corner-sew clear switch CSCLR (10105) would both have to be in their "on" position and the left and right pleat and sew O.K. functions PSOKL (00216) and PSOKR (00311), controlled by equations at rung 10 and run 11, would have to be in their "on" mode. As soon as the home function HOME (00215) is "on", assuming the clear push button has been depressed CLEAR (10003) as shown in rung 7, the initialization function INALZ (00217) will be turned "off", since home function HOME (00215) NOT, now in the turn off portion of the circuit, would be false since that function would be "on".

While the equation at rung 7 has been partially discussed, the initialized function INALZ (00217) in the first group on the left-hand side of the equation will serve to latch the initialization function in an "on" condition until the home function previously just discussed at rung 6 is turned on.

Turning now to the equation at rung 8, when the overhead transfer unit is not in the corner-sew position OTUCS (10104) NOT and when the bar tack clamps are not engaged BTCLE (10200) NOT, the corner-sew O.K. CSWOK (00310) indicates that the corner-sew station is capable of receiving a panel and is thus in condition to be operated. If either the overhead transfer was in the corner-sew position so that switch (10104) was energized or if the bar tack clamps remained engaged as would be indicated by switch (10200), then the corner-sew O.K. function would not be energized indicating that there was a problem at that sation. Corner-sew O.K. (00310) can also be energized by turning by-pass corner-sew switch BYPCS (00114) to by-pass position and initialize INALZ (00217) being on. Thus the by-pass switch would cause the controller to consider that for the next program sequence, the corner-sew station would be by-passed and thus during the initialization program there would be nothing to look at in terms of the corner-sew function.

Turning now to rung 9, the load O.K. function when energized, will indicate that the machine is in condition to be loaded. In determining whether or not the load O.K. function is to be energized, the following functions will be looked at by the controller. The load bar back switch LBRBK (10012) would need to be energized indicating that the loading bar was back in position to be loaded, the loop blade output LPBLD (00505) NOT would indicate that there was not an output from the controller to energize the loop blades, the loop clamps open switch LCPOP (10015) would need to be energized indicating that the loop clamps were open, the panel top clamp output NOT PNLTP (00500) would have to be true meaning that there was not an output from the controller energizing the solenoid to close the panel top clamps so that the clamps would be in their open position. Further, the panel side clamp out NOT condition would have to be true, indicated at PNLSD (00502) and would mean that there was no output from the controller to energize the air cylinder that would close the panels side clamps. Thus to be true, the panel side clamps would have to be open, the loading bar rotated switch NOT condition would have to be true, indicated at LBARR (10006), meaning that the loading bar would not be in its rotated from but rather would be unrotated, and finally that the scissors open switch SISOP (10007) would have to be energized to indicate that the scissors were opened to the minimum condition. When all of these conditions are true, the load O.K. function would be energized by the machine indicating that the loading bar was back in its load position, it was not rotated, the scissors were open to their minimum condition, the panel top and side clamps were open and the loop blades were not energized in an up position. Thus, both the loading and loop-forming assemblies are in condition from an apparatus standpoint to have a panel blank inserted and clamped in the loading assembly and transferred to the loop forming assembly and have the loops formed therein.

When the corner-sew O.K. function and the load O.K. function are both energized, that would form two portions of the equation previously discussed at rung 6 and would be part of the equation necessary to have the home function energized.

Turning now to rung 10, we see that the pleat and sew left O.K. function indicated at PSOKL (00216) will be energized when the switch (10216) is closed, with switch HCPPL (10216) being the left-header clamp in pleat formation position switch indicating that the left header clamp is in the pleat formation position, when there is output (00611) generated for the left header clamp indicated at HCLPL. There will be an output in this condition since the header clamps, as indicated previously are held in a normally open position by springs within the clamp closing air cylinder and thus there would need to be an output to hold the clamps in a closed condition. Further, the switch (10212) would be in an off mode, switch (10212) relating to the header clamp locked to carriage switch indicated as HLOCL. As soon as these three conditions are true, the controller will energize the pleat and sew left O.K. function. Likewise, the pleat and sew O.K. function would be energized if the controller were in the initialization process and if the manual right switch indicated at MANRT (10101) had been energized. These are in the second tier of rung 10 and as indicated would likewise serve to produce the turning on of the pleat and sew left O.K. function. The manual right switch would serve to close down the left pleat and sew station and would be energized if the left pleat and sew station were jammed, out of thread, or under repair or for some other reason not operable.

Turning now to rung 11, the function we are turning on and are concerned with at this rung is the right pleat and sew O.K. function which, as referred to above, is a portion of the equation which must be satisfied prior to turning on the home function signal. The equation necessary to be filled at rung 11 is similar to that as discussed for rung 10 but is now switched around to be compatible with the right pleat and sew station. The right header clamp and pleat form position switch would need to be opened, the right header clamp output would need to be generated to open the header clamps since as will be recalled, both the right and left header clamps are held normally closed by means of springs and thus an output is required for the right header clamp cylinder in order to have the right header clamps open. Further, the switch indicating that the header clamp is locked to the carriage would need to be turned off indicating that there was not locked condition. As soon as these statements are true, the pleat and sew right O.K. function PSOKR (00311)will be energized. Further, as was true with rung 10 and the left pleat and sew station, there is a manual left switch MANLF (10100) which, together with the energization of the initialization function, would likewise serve to isolate the right header clamp area and the right pleat and sew O.K. function PSOKR (00311) would be generated since the manual left switch MANLF (10100) would serve to close down the right station and no look at the elements of that station would be required.

Turning now to rung 12, we note that the function being generated is a Y storage function YSTOR (00100). The Y storage functions are provided within this program so as to provide extra storage capability for display purposes since the screen on the display screen of the controller can only show five vertical functions without extra storage. It will be observed that the Y storage function YSTOR (00100) forms a portion of the second vertical grouping of functions of rung 13 which second group would turn off the load clear function as soon as all the conditions is that second vertical grouping were not true. The second vertical grouping in rung 13, when the Y storage from run 12 was added, would be the loop blade output indicated at LPBLD (00505), the loop formed clamp open sensing switch LCPOP (10015), the panel top clamp cylinder output PNLTP (00500), the loading bar rotate output LBRRT (00501), the panel side clamp cylinder output PNLSD (00502)and the loading bar transfer output LBRTN (00503).

The first vertical group in rung 13 comprises the load abort switch LDABT (10002), the initialization function INALZ (00217) and the load clear latching function LDCLR (00215). As soon as the controller is in the initialization phase or as soon a the load abort switch is energized, the load clear function will be switched on and will not be switched off until all of the functions in the second vertical group are not true. Thus, the load clear function would be turned off when the loop blade output did not exist, when the loop forming clamps were sensed in an open condition, when the panel top clamp cylinder was not provided with an output, when there was no output to rotate the loading bar, when there was no output to energize the panel side clamp cylinder, and when there was no output to transfer the loading bar.

Turning now to rung 14, we see that time delay (206), which is of an interval time delay of a tenth of a second times fourteen periods for one and four-tenths seconds, is turned on when the loading bar back switch LBRBK (10012) is energized.

The time delay (206) forms part of the third vertical series in rung 15 and will now allow the panel top clamp cylinders to be de-energized or cleared for at least one and four-tenths seconds.

Rung 15 will turn on the signal to the solenoid which closes the panel top clamps PNLTP (00500) and that output signal will be initiated as soon as the start button START (10017) is depressed and the controller is in a run condition indicated at RUN (00213). The PNLTP (00500) indication in the second line of the first vertical group in rung 15 will, as previously described, serve to latch this function in an "on" condition.

The second vertical series of functions which would serve to turn off the signal to the panel top clamp cylinder comprise the loop forming clamp closed sensse switch indicated at LCPCL (10013), the loading bar transfer motion complete sense LDRUP (10010), and run condition RUN (00213). As soon as each of these requirements were not true, or as soon as the loop clamps were sensed as being closed, as soon as the loading bar transfer motion was sensed as being complete and the machine was in a run mode, the panel top clamp cylinder signal would be removed.

Further, in order to clear the signal without having the turn off conditions fulfilled, time delay (20615) would have had to run out, the loading bar rotation to a transfer position sensed indicated at LBARR (10006) would no longer be sensed, and the load clear as discussed at rung 13 would be turned on.

Turning now to rung 16, we are concerned with time delay (203) which operates at an interval of a tenth of a second for two periods or a total elapse time of two-tenths of a second. Time delay (203) would be turned on as a function when the loading bar was sensed in its rotated to transfer position LBARR (10006) and when there was a sensing that the loop-forming clamps were opened, this being indicated at LCPOP (10015).

Turning now to rung 17, the loading bar must be sensed as being in its rotated to transfer position by switch LBARR (10006), the time delay of two-tenths of a second (20315) will have run, and the machine must be in a run mode in order to turn on the output signal for the panel side clamp cylinder indicated as PNLSD (00502). As will be noted, this signal will be latched by the PNLSD (00502) function indicator in the first vertical group for rung 17. As long as the conditions as indicated in groups 2 and 3 at rung 17 are true, the output signal for the side panel side clamp cylinder will not be turned off or cleared. However, when the loop forming clamps close sense not condition is not true such that the loop-forming clamps are sensed to be closed, this function being indicated at LCPCL (10013) and when the run not condition is not true such that the machine is in a run mode, the panel side clamp cylinder output signal will be turned off. This is true since if this machine is running and the loop-forming clamps have closed, the panel is ready to be transferred to the loop-forming assembly, the loop forming clamps have the panel secured and there is no longer a need to clamp the panel with the side clamps. This is similar to the situation discussed at rung 15 wherein the sensing of the loop clamps being closed, a completion of the loadig bar transfer motion and the machine being in a run mode would serve to turn off the output signal to the panel top clamp cylinders so that the panel top clamps would be allowed to open releasing the panel to the control of the loop-forming clamps.

Again looking at rung 17, specifically the third vertical group of functions, the panel side clamp cylinder output signal would be cleared when the load bar fully retracted sense in NOT condition, LBRBK (10012) was not true or when the loading bar was sensed as being fully retracted and when the load clear NOT LDCLR (00214) was not true or when the load clear function was on.

Turning now to rung 18, time (230) with a time interval of a tenth of a second for four intervals or a total time delay of four-tenths of a second would be energized when the output signal for the panel top clamp cylinder was turned off indicating that the panel top clamp cylinder output NOT condition was fulfilled or true.

Turning now to rung 19, we are concerned with an equation for actuating the loading bar transfer cylinder output signal which would cause the loading bar to be moved from the load position to its transfer position adjacent the loop forming assembly.

In order to obtain this loading bar transfer output signal, the loading bar would have to be rotated to its transfer position as required by LBARR (10006), the vertical loop blade cylinder output NOT condition would have to be true indicated at LPBLD (00505) meaning that the loop blades would not yet be energized. Further, the panel side clamps output would have to be on indicating that the panel side clamps are closed, with this function indicated at PNLSD (00502), the start/run switch (10016) would have to be energized, the scissors would have to be opened to their minimum width as required by the function SISOP (10007) and the machine would need to be in the RUN mode as required by function RUN (00213).

It will be noted that the loading bar transfer cylinder output signal in terms of being latched, is latched to the vertical loop blade NOT condition and loading bar rotated condition so that when the vertical loop blade cylinder output is energized or the loading bar is not rotated, the loading bar transfer cylinder output signal will be unlatched.

The loading bar transfer output signal will be energized so long as the statements in the second and third vertical portions of rung 19 are true. The second portion will serve to turn off the output signal when those functions become false and likewise the third vertical portion would serve to clear the output signal when all those conditions become false.

Thus, the loading bar transfer signal output would be turned off when the loop clamp was sensed as being closed, when the machine was in a RUN condition, and the delay time interval (23015) of four-tenths of a second had run. This would be true since at this point in time, the loop clamps would have closed securing the panel, the time interval would have been actuated due to the turning off of the panel top clamp cylinder indicating that the panel top clamps are open with the time interval allowing the panel side clamps to be opened, thus completely removing the loading bar assembly from its clamped relationship with the panel.

The third vertical group in run 19 serving to clear the output signal would clear that output signal when the load clear function was energized and when the loop-forming clamps were sensed in an open condition.

Turning now to rung 20, when the loading bar fully retracted switch is sensed, indicated at LBRBK (10012), time delay (200) is initiated which operates for 1.1 of a second intervals thus having a total time delay of 1.1 second In run 21, the time interval 201 for 0.10 of a second will be activated when the panel top clamp cylinder PNLTP (00500) is energized.

Turning now to rung 22 in the program, we have the equation which energizes the output signal for the loading bar rotation cylinder. As with the other ladder circuits in this program, there are three vertical portions on the left-hand side of the circuit, the first portion turning on the output signal when all of the different functions within the equation are true, the second vertical group tending to turn off the output signal when all the conditions as shown therein are not true and the third vertical grouping clearing the output signal when all the conditions are not true.

Thus, when the loading bar has been sensed by switch (10012) as being fully retracted when time delay 201 of 0.1 of a second has run and when the machine is in a RUN mode, the loading bar rotation cylinder will have an output signal applied to it thus rotating the loading bar when it is in its returned or fully retracted position.

The output signal to the loading bar rotation cylinder would be turned off when the loop-clamp closed sens NOT condition was untrue or when the loop clamps were sensed as being closed when the time interval 200 of 1.1 seconds had run and when the machine was in a RUN mode. Further, the signal would be cleared when the load clear NOT condition was untrue or when there was a load clear function and when there was no output to the panel side clamps.

The time interval 202 is generated at rung 23 and employs three periods of a tenth of a second each for a total elapsed time of 0.3 when the vertical loop blade cylinder output NOT condition expressed as LPBLD (00505) is true and when the pick-up cylinder output NOT condition expressed as PICUP (00515) is true. In other words, when there is no output to the vertical loop blade cylinder and no output to the pickup cylinder, time interval 202 is generated.

Turning now to rung 24, the time interval 205, which employs thirty 0.1-second intervals for a total elapse time of 3 seconds, is generated when the vertical loop blade cylinder output NOT condition expressed as LPBLD (00505) is true. In other words, when there is no vertical loop blade cylinder output, time interval 205 will be generated.

Rung 25 controls the turning on of the loop former clamp cylinder ouput signal LPCLP (00506). When the loading bar transfer motion is sensed as being complete indicated at LBRUP (10010), when the scissors are sensed as being adjusted to the correct panel width, indicated by WIDOK (10011) and when the controller is in a RUN mode, the function is ready to be turned "ON" assuming that at least one of the fuction conditions in each of the Group 2 and Group 3 portions of the equation is true. Thus, if any one of the conditions in Group 2 and any one of the conditions in Group 3 were true, such as the time interval has not run, the pick-up clamp were open, or the machine was not running, or in Group 3 there had not been a load clear indication, the time interval 205 had not run or there was no indication that the overhead transfer unit was in its home position in terms of a lateral (axial) direction, the circuit path could be completed through any one of the conditions in Group 2 and thereafter through any one of the conditions in Group 3.

The loop-former clamp cylinder output signal would be turned off when the time interval had run, if the pick-up clamps were not open and the machine was in a RUN condition. Likewise, the loop-former clamp cylinder output signal would be cleared if there was a load clear indication, if the time interval 205 had run and if the overhead transfer unit was sensed in its lateral (axial) home position.

Rungs 26, 27, 28, 29 and 30 relate to the turning on of the complementary functions for the listed output conditions so that the complement will cause the reverse effect from the effect caused by the initial output condition. Thus, when the loading bar rotate cylinder output NOT condition is true, LBRRT (00501) as shown in rung 26, the complement to the loading bar rotation output or CMY1 (00507) output will cause the loading bar to re-rotate.

Turning now to rung 31, we are provided with an equation which serves to energize the time delay function 223 which operates at an interval of a tenth of a second for ten intervals making the total elapsed time one second. This time interval will be generated by one of two roots, since there are two horizontal levels to the first vertical group either of the horizontal levels being capable of turning the time 223 function on. The first or upper horizontal level is comprised of the overhead transfer unit transverse motion actuator left function indicated at OTULF (00516) and the pick-up cylinder output NOT condition indicated at PICUP (00515). The second level would be the overhead transfer unit transfer motion actuator right condition indicated at OTURT (00517) and again the pick-up cylinder output NOT condition. The pick-up clamps are one of the two groups which are held in an open condition when the actuating cylinder or actuating means is actuated by means of receiving an output and under normal conditions, the pick-up clamps would be held closed by means of a spring. Thus, when the pick-up cylinder NOT condition is true, the cylinder no longer tends to hold the clamps open and the clamps will be held in a closed condition by means of the spring or other suitable holding device. Therefore, when the pick-up clamps have engaged the loops and the overhead transfer unit has been actuated to move in a transverse direction either to the left or to the right, time delay 223 will be energized. The signal will be turned off when the pick-up clamp cylinder output NOT is untrue, meaning that when the pick-up clamp cylinder output did exist, this time delay would be turned off. The indication of the time delay (22317) on the left-hand side of the first vertical group will tend to latch time delay (223) once that function is energized.

Rung 31A shows the equation which when the elements are true, produces time delay 24215 for 3 seconds. When initialization is begun which is function INLZE (00217) and the START pushbutton has not been depressed, function START (10017) the time delay 242 will be generated. Also, the function TIM42 (24215) will latch the equation.

At rung 32 the equation will cause the scissors to open from their closed position or a closed position less than the minimum width position. At rung 28 the complement function CMY4 (00511) for rung 32 is generated causing the scissors to close.

Looking at the equation, there are three horizontal portions in the first part of the equation through which this function could be turned or if a path could be found through the other two portions. The first horizontal line would require the overhead transfer unit not be sensed in the home transverse position OTUHM (10110) NOT, the running of time delay 22315, and that the overhead transfer unit be in a RUN condition RNOTU (00204). The second line would require the overhead transfer unit be sensed in its home lateral position CSCLR (10105), that the loop forming clamps be open LCPOP (10015) and that the overhead empty signal be generated OTUTY (00004). The third line required the overhead transfer unit be in its home lateral position CSCLR (10105), that the loop forming clamps be open LCPOP (10015), that time delay at rung 31A be on TIM42 (24215) and that the scissors not be open to their minimum position SISOP (10007) NOT.

The second portion sets the following conditions: that the loading bar not be sensed to be fully retracted LBRBK (10012)NOT, that the loop forming clamps not be sensed as being closed LCPCL (10013) NOT and that the load and loop assemblies not be in a run mode RUN (00213) NOT. If any one of these conditions were true, a path would exist to turn on SISCY (00504). On the other hand, if all were false SISCY (00504) would be turned off.

The third portion of the equation at rung 32 calls for the clear push button not to be depressed CLEAR (10003) NOT for the scissors not to be at the minimum position SISOP (10007) NOT, and for the loading bar not to be sensed as fully retracte LBRBK (10012) NOT. Likewise, if any of these functions were true, a path would exist through the equation to turn SISCY (00504) on. Also, if all became false, SISCY (00504) would be cleared.

As will be noted at rung 34, the opening of the scissors will be terminated when the minimum condition SISOP (10007) is sensed.

At rung 33, we are provided with the circuit which serves to provide the output for the vertical loop-blade cylinder and that output signal will be turned on when the load bar is sensed as being fully retracted with that sensing being indicated at LBRBK (10012), when the loop forming clamps are sensed as being closed, LCPCL (10013), when the overhead transfer unit is in its home position in a lateral (axial) direction indicated at CSCLR (10105) and when the machine is in a RUN mode, indicated at RUN (00213). The indication LPBLD (00505) in the second horizontal line is the function serving to latch the vertical loop-blade cylinder output in an ON mode.

The second vertical group consisting of the two functions indicated as OTULP (10103) and RUN (00213) which refer to the overhead transfer unit being in the loop pick-up position NOT and the machine being in a run mode NOT, respectively, will cause the vertical loop blade cylinder output to turn off when these two conditions are not true or when the machine is in a run mode and when the overhead transfer unit is in the pick-up position. This would be true since with the overhead transfer unit in the pick-up position, the closing of the loop pick-up clamps would want to contact only the loops that are formed and not the vertical loop blades.

In order to clear this signal, the load clear NOT condition would have to be untrue and so when there was a load clear output signal, that signal would clear the output generated at rung 33.

Turning now to rung 34, the equation for turning on the scissors stop solenoid, indicated at SISTP (00514) consists of the scissors open to their minimum width sensing switch SISOP (10007) and the loading bar transfer cylinder output NOT function LBRTN (00503). The scissors stop solenoid output would also be generated by the second horizontal row comprising the scissors adjustment to a width O.K. function WIDOK (10011) and the loading bar transfer cylinder output signal sense LBRTN (00503). Or in a third manner, when the loop-forming clamps are sensed as being closed indicated as LCPCL (10013) in the third horizontal portion of rung 33.

Thus, the scissors stop solenoid would be energized when the scissors were sensed as being opened to their minimum width and there was no output to the loading bar transfer cylinder. Alternatively, the scissors stop solenoid output would be generated when the scissors were sensed as being adjusted to the width that matched the panel width and the loading bar transfer cylinder was energized or further when the loop form clamps were sensed as being closed.

Turning now to rung 35, the ladder circuit here causes a memory generated output indicating that the overhead transfer unit is empty for four different methods indicated by the four horizontal lines in the first vertical group. Going down this first vertical group and beginning with the top horizontal line, the function OTUTY (00004) provides the latching capability for this circuit and is shown here at the top of the equation instead of at the bottom. The second horizontal line refers to the overhead transfer unit clear push button OTUCR (10102) and when this is depressed, the overhead transfer empty output will be generated. The third horizontal line would require that the initialization process be in operation INALZ (00217) and that the bar tack motion clamp engage sensor NOT condition be fulfilled BTCLE (10200) NOT. The fourth horizontal line would again require that the machine or controller be in the initialization phase INALZ (00217) and that the overhead transfer unit would be sensed in its right ready position OTURR (10107). The fifth way the overhead transfer unit empty memory generated output would be produced, would be again to have the controller in its initialization phase INALZ (00217) and to have the overhead transfer unit sensed in its left ready position OTULR (10106).

Turning now to the second vertical group, the overhead transfer empty function would be turned off when the conditions in the second vertical group as indicated are untrue. Thus, the overhead transfer unit would have to be sensed in its home position in a transverse direction, there would have to be an output to the pick-up clamp cylinder indicating that the pick-up clamps are open and the overhead transfer unit would likewise have to be sensed in its home position from a lateral (axial) direction.

Rung 36 will generate a signal that will result in the function STORA (00101) which forms a part of the output from rung 37 which serves to initiate the turning on of the overhead transfer unit RUN function. The output from rung 37 can be initiated either by having the signal from storage A initiated or by having the normal switch in its jog position indicated at NORJG (10112) and having the jog function energized indicated at JOG (00211).

Turning now to rung 36 and the creation of the storage A signal, this signal can be energized by three different approaches with the RNOTU (00204) function in the bottom of the first vertical group serving to latch the run function energized at rung 37 in an "on" mode.

The first means of producing the storage A function would be to have the continuous push button CONT (10001) depressed and to have the machine not in its initialization mode. Likewise, the storage A function will be turned on when the start/run switch STRUN (10016) is depressed. Further, the storage A function will be turned on when the overhead transfer unit is sensed as being empty indicated at OTUTY (00004) and by having the overhead transfer unit clear push button depressed indicated at OTUCR (10102).

STORA (00101) will be turned off if normal/jog switch is switched to jog position or hold push button is depressed. STORA being turned off turns RNOTU off. The third vertical section also will turn STORA off and thus RNOTU. If the overhead transfer unit is home (OTUHM), pick-up clamps open (PICUP), and CTUTY empty memory signal has been generated it will turn STORA off.

At rung 38, the equation indicates that as soon as we lose the output energizing the vertical loop blade cylinder, we initiate time interval 217 which operates for a tenth of a second interval for one interval, making the total time delay one tenth of a second.

At rung 39, we have the equation which serves to generate the output signal causing the machine function OTUFW (00600), referring to the overhead transfer unit moved to its forward pick-up position, when the overhead transfer unit is sensed at its home position in a transverse direction, when the pick-up clamp cylinder output signal is generated thus assuring that the pick-up clamps with the overhead transfer unit are open, when the scissors clamps are sensed as being closed and when the overhead transfer unit is in its run mode, each of these functions being indicated at rung 39 in the first vertical group of functions.

The lower horizontal line in the first vertical group at rung 39 serves as a latching function for the overhead transfer unit in its forward motion and it will be noted that the latching circuit does not come back to the far left-hand line but rather is latched to the horizontal line between the overhead transfer unit home function OTUHM (10110) and the pick-up clamps open output signal PICUP (00515). Having the overhead transfer unit forward output latched at this point, assures that the signal will become unlatched and turn off when the overhead transfer unit moves away from its home position.

The portions of the equation in the second and third vertical groups would cause the signal to be turned off or cleared, respectively. Thus, in analyzing the second and third vertical groups, if the conditions as set forth were fulfilled or if the loop clamps were sensed open and the machined was in a run condition, the overhead transfer unit to a forward position signal would be turned off. Likewise, the signal causing the overhead unit to move to its forward pick-up position would be cleared if the overhead transfer empthy function were true and if the pick-up cylinder clamp output condition were true. Thus, if the overhead unit was indicated as not being empty and if the pick-up clamps were not open, there would be no reason for having the overhead transfer unit moved to its pick-up position since it would not be able to pick up the panel in which loops had been formed.

As soon as the conditions in the second or third vertical groups in rung 39 became false, the signal to move the overhead transfer unit forward would be turned off or cleared, respectively.

With reference to the position of the latching of the overhead forward signal, it is latched to the overhead transfer home position instead of being latched to the far left line since the only time the overhead transfer unit is to go forward is when it is in its home position from a transverse standpoint. This assures that the overhead transfer unit will never move forward when it is in a position other than its home transverse position and thus provides a guarantee that the overhead transfer unit will not attempt to move when it is out of its axial alignment with the loop assembly.

The equation at rung 40 serves to generate the pick-up clamp cylinder output signal which causes the pick-up clamps to open since the action of the cylinder in this instance will overcome a spring which normally holds the pick-up clamps closed.

In order to generate this pick-up signal indicated as PICUP (00515) there are four equations in the first vertical group, any one of which can serve to turn on this output signal. Looking at the first horizontal line in this first vertical group of the equation shown at rung 40, we see that the overhead transfer unit will have to be sensed in its right ready position as required by OTURR (10107), the right header clamp cylinder output NOT condition will have to be true indicating that the right header clamp cylinder has not been energized and thus the right header clamps remain closed due to a spring that holds the header clamps normally closed, the overhead transfer unit must be sensed in its panel delivery position as required by OTUDL (10111) and the overhead transfer unit must be in the RUN mode as required by RNOTU (00204).

The second horizontal line in the first vertical equation which will turn on the pick-up clamp cylinder output signal would require that the overhead transfer unit be in its left ready position as required by OTULR (10106), that the left header clamp cylinder output NOT condition be true indicating that the left header clamp would be closed, that the overhead transfer unit be in its panel delivery position as required by OTUDL (10111) and that again the overhead transfer unit would have to be in its RUN mode as required by RNOTU (00204).

The next horizontal line in the equation would cause the pick-up clamp cylinder output signal to be generated if the overhead tranfer unit empty function were operative indicated as OTUTY (00004).

RET16 is a retentive memory function that will remain in whatever state it was in when power is lost and comes back on. At rung 41, pick-up clamp signal is on (pick-up clamp open) and this activates RET16(L). If power is lost and comes back on RET16(L) will be turned on by memory as the power comes up holding pick-up clamp in an open state.

At rung 42, pick-up clamp is off (pick-up clamp closed) and this actuates RET16(U). If power is lost and comes back on RET16(U) will be turned on by memory as the power comes up, holding the pick-up clamp in a closed state.

The last horizontal line would serve to latch the pick-up clamp cylinder output signal in its "on" mode.

The second vertical group would tend to turn the pick-up clamp cylinder output signal off when the NOT condition became untrue. Thus, when the overhead transfer unit is in the look-pick-up position, when the overhead transfer unit is in its RUN mode and when the time delay 217 has run, the pick-up clamp cylinder output signal would be turned off allowing the pick-up clamps to be closed by the normal closing due to the effects of the spring which holds the pick-up clamps in a normally closed condition.

At rung 43, the complement function to rung 39 is formed indicated as CMY21 (00602) and thus when the overhead transfer unit forward signal is turned off, the complement function will be energized causing the overhead transfer unit's forward motion to be reversed thereby moving the overhead transfer unit back to its home position from a lateral (or axial) direction.

At rung 44, we see that time delay 213 is energized and consists of a tenth of a second interval for two intervals making a total time delay of 0.2 of a second. This function is energized when the pick-up clamp cylinder output PICUP (00515) is energized.

In rung 45 the overhead transfer unit signal which moves the overhead transfer unit laterally (axially) from its home position into either the corner-sew station or the right or left pleater sew station is generated. Unlike the turn on portion of the equations that have been discussed heretofore, the turn on portion of this equation is composed of two segments, the first segment comprising the first three functions in the first horizontal line or in the alternative, the portions of the equation directly underneath those first three functions, with the second portion comprising the fourth, fifth and sixth functions in the first horizontal line. The turn off portion of the equation lies between the two vertical lines following the sixth function, the sixth function being RNOTU (00204) and the second turn off portion of the function comprising the third vertical group, consisting of BTCLE (10200) NOT and RNOTU (00204) NOT. The clear portion is the signal corner sew empty CSETY (00207) which is set by depressing corner-sew clear push button.

In explaining the equation, the OTUBK (00601) function will be energized as follows. Looking first at the second portion of the turn on part of this equation, OTUBK (00601) will be turned on if the pick-up clamp cylinder output is not being generated, if the overhead transfer unit is in its home position from a lateral direction and if the overhead transfer unit is in a RUN mode. Assuming that these three conditions are met, OTUBK (00601) will be turned on if anyone of the following three sets of conditions will exist: (a) the overhead transfer unit is in its home position from a transverse direction indicated at OTUHM (10110), if there is no sensing that the corner-sew sewing function is done indicated at CSDON (00410) and if the loop forming clamps are sensed as being open; (b) if the overhead transfer unit right ready signal is generated and if the right pleat and sew station is indicated as being empty at EMTYR (00410), indicating that the overhead transfer unit is in the proper position to move back into the right pleat and sew station and that the right pleat and sew station is empty; (c) that the left ready signal has been generated for the overhead transfer unit indicated at OTULR (10106) and that the left pleat and sew station is indicated as being empty indicated at EMTYL (00413) which together indicate that the overhead transfer unit is in the proper position to move back into the left pleat and sew station and that the left pleat and sew station is empty and capable of receiving a panel.

Thus, if any one of the three conditions is true in the first portion of the turn on segment of this equation and if the second portion of functions are met, the OTUBK (00601) function will be energized.

It is important to point out at this portion of the discussion that the overhead transfer unit is moved axially by two different cylinders. One cylinder is energized by the overhead transfer unit forward signal indicated as OTUFW (00600) with its complement CMY21 (00602) with this function controlling the movement of the overhead transfer unit toward and away from the loop forming assembly. A second cylinder which is energized by the function OTUBK (00601) and its complement OTUIN (00603) serves to move the overhead transfer unit toward and away from the corner sew station. When the overhead transfer unit is in the corner-sew station, further movement of the panel during the sewing operation is not affected by the cylinder controlled by OTUBK (00601) nor the companion function OTUIN (00603) but rather is moved by means of the sewing machine as previously indicated. Therefore, it is important to de-energize the air cylinder controlled by OTUBK (00601) and OTUIN (00603) during the period of time that the overhead transfer unit remains in the corner-sew position. Therefore, OTUBK (00601) will be cleared when the bar tack motion clamp engage sensor senses that the bar tack is engaged and when the overhead transfer unit is in a RUN mode or when the two functions in the clear segment of this equation are untrue.

Turning now to the turn off portion of the equation shown at rung 45, as long as the conditions between the turn on segment and the clear segment of this equation are true OTUBK (00601) will not be turned off. However, when the conditions in the second vertical series of equations become untrue, the signal will be turned off.

Thus, when the overhead transfer unit right ready NOT function indicated at OTURR (10107) or when the overhead transfer unit left ready signal NOT condition is untrue or when the left ready signal is sensed indicated at OTULR (10106) when the time delay (21315) has timed out or completed its cycle, and when the overhead transfer unit is in a RUN mode, the function generated by rung 45 serving to energize the overhead transfer unit backward actuator will be turned off.

It should also be noted that the function OTUBK (00601) is latched between the pick-up NOT function and the RNOTU home function so as to assure that as soon as the pick-up NOT condition is untrue or false, the overhead transfer unit will not be moved back beyond the home position in a lateral (axial) direction.

Rung 46 is concerned with time delay 207 which is for one-tenth of a second intervals, and three intervals, making a total time delay of three-tenths of one second.

This time delay will be energized when the corner sewing assembly is done with a sewing operation indicated at CSDON (00410), when the corner and bar tack clamp cylinder outputs have been generated CRCLP (00604) and when there has been no indication that there has been a thread break in the corner-sew assembly indicated at CSTBX (10201). Further, latching is accomplished by time function (20717) in the second line of Group 1.

The time delay will be turned off once the corner sew thread cut cylinder output NOT condition becomes untrue or when there is an output which causes the corner-sew cutting cylinder to cut the thread following the completion of the corner-sewing sew cycle.

Rung 47 produces a store G function STORB (00102) which is used to supplement the turn on portion of rung 48 which causes the energization of the overhead transfer unit lateral movement function which is a companion function to OTUBK (00601). OTUIN (00603), generated at rung 48, will cause the overhead transfer unit to move from the corner-sew assembly back to its home position and likewise to cause the overhead transfer unit to move back out of the right or left corner pleat and sew station following the transfer of control of the pleat panel from the overhead transfer unit to the right or left pleat or sew station.

Thus, when the storage B function is inserted in the equation of rung 48 there are five different ways that the companion function for OTUBK (00601) or OTUIN (00603) can be energized.

Looking, therefore, at rung 48, the first horizontal line in the first vertical series of functions, we see that OTUIN (00603) will be energized when the time delay (20715) has run, when the bar tack motion clamp engage sensor indicates that the bar tack motion clamp is not engaged indicated at BTCLE (10200) and when the run signal is present indicated by RNOTU (00204).

The second horizontal line would turn on the OTUIN (00603) function when time delay (21315) has run, when the overhead transfer unit left ready switch is "on" indicating that the overhead transfer unit is presently in the left pleat and sew delivery position OTULR (10106) and when the overhead transfer unit is in its RUN condition.

Likewise, the OTUIN (00603) output will be turned on when time delay (21315) has run, when the overhead transfer right ready signal is energized OTURR (10107) and when the overhead transfer unit is in a RUN mode.

The next horizontal line refers to storage B and looking back at rung 47, the first horizontal line of storage B would indicate that the OTUIN (00603) function will be turned on when the machine is initialized indicated at INALZ (00217), when the bar tack motion clamp engage sensor NOT condition is true BTCLE (10200) or when there is no sensing that the bar tack motion clamp is engaged, when the right header clamp cylinder has been energized HCLPR (00702) and when the left header clamp cylinder has been energized, HCLPL (00611).

Turning to the next horizontal line, we see that OTUIN (00603) output function will be energized, when the corner-sew empty condition is true indicated at CSETY (00207) and again when there is no sensing that the bar tack motion clamp is engaged BTCLE (10200). The OTUIN (00603) function in the last horizontal line of rung 47 would serve to latch the OTUIN (00603) output "on" whenever it is turned "on".

The first and second horizontal lines of rung 47 are used to clear the overhead transfer unit from corner-sew or right and left pleat and sew delivery positions. The first horizontal line moves the OTU to home in an axial direction during initialization and the second horizontal line clears the OTU from corner sew at any time CSETY (00207) is set by depressing corner sew clear pushbutton.

Going back to rung 48, the OTUIN (00603) output function will be turned off when the overhead transfer unit backward function OTUBK (00601) is energized and when the overhead transfer unit is in its run mode RNOTU (00204), thus making the two conditions false in the second vertical segment of the equation shown at rung 48.

Turning now to rung 49, we see that the overhead transfer HOLD signal OTUHD (00205) is a memory signal generate when neither the right nor left pleat and sew station is indicated as being empty or when both pleat and sew stations are busy which signals are indicated at EMTYR (00411) and EMTYL (00413) and further when there is no indication that either the right or left pleat and sew station has progressed to the fourth pleat, indicated by PRTLR (00212) and PRTLL (00414), respectively. If either the right or left pleat and sew station has reached the fourth pleat position or either station is empty EMTYL (00413) or EMTYR (00411), this signal will not be generated. The partial left and partial right signals will be generated when the right or left header carriage is moved to the fourth position indicating that the fourth pleat at either the right or left pleat and sew station is about to be formed. This circuit assures that the movement of the overhead transfer unit will be initiated soon enough, i.e., at the beginning of the forth pleat. If it were found, however, that sufficient time would be alloted simply to sense when a completed panel from either the right or left pleat and sew station was being ejected, and then move the overhead transfer unit, the overheat transfer unit HOLD function could be de-energized when the empty signal for the right or left pleat and sew station was initiated.

At rung 50, we have the last right or left destination function being generated indicated as LSTDT (00406) and again the equation has a turn ON and turn OFF portion.

Looking at the turn ON portion, the function LSTDT (00406) will be energized, when the overhead transfer right ready signal OTURR (10107) is energized, when the lateral motion actuator signal OTUIN (00603) has been energized to move the overhead transfer unit from the right panel delivery position back to its home position in an axial direction, and when the pick-up clamps have been energized PICUP (00515). The LSTDT (00406) function in the second vertical line of the turn ON segment of the equation at rung 50 will serve to latch the function on.

Thus, when the pick-up clamp output is energized, it serves to open the pick-up clamps, when the overhead transfer unit motion actuator function for moving the overhead transfer unit from the right pleat and sew station back to its axial home position is energized and when the overhead transfer unit right ready condition is energized, the LSDDT (00406) function will be energized. The last destination (LSTDT) ON indicates the last panel delivered was to the right pleat and sew station.

The turn OFF functions as shown are OTULR (10106) or left ready NOT, and QTUIN (00603) NOT or lateral motion actuator output NOT and pick-up clamp output NOT, PICUP (00515). When these conditions are untrue or when there is a left overhead ready, and when the lateral motion actuator output is energized and when the pick-up clamps are energized, the LSTDT function will turn off indicating that the last panel delivered was to the left pleat and sew station.

Both rungs 52 and 53 produce storage outputs, storage H, STORH (00110) and storage J, STORJ (00111), respectively. These storage functions are used to enlarge the turn ON ability for the destination signal output DESTN (00003) as is accomplished by rung 54 where storage J and storage H are combined in the last horizontal line in the turn on portion of rung 54 to energize the destination function signal. Therefore, we will initially consider rung 54.

The destination function DESTN (00003) is the output signal which is used to help decide whether the overhead transfer unit moves to the right or to the left. Thus, looking at the first horizontal line of the turn ON portion of rung 54, we see that energization of the manual right switch MANRT (10101) will turn on destination 3 and cause the overhead transfer unit to move right at the proper time. Likewise, the manual left switch when turned on MANLF (10100) would turn off destination 3 and cause the overhead transfer unit to move left at the proper time.

Looking at the second horizontal line in the turn on segment of rung 54, the last destination function or function right LSTDT (00406) would have to be on, the partial left would have to be OFF thereby fulfilling partial left NOT PRTLL (00414) partial right would have to be energized PRTLR (00412) and storage H STORH (00110) would have to be not energized.

The third horizontal line which would serve to turn on destination 3 would require that the last destination LSTDT (00406) be energized, that the left pleat and sew station not be sensed as empty EMPYL (00413) NOT, that the right pleat and sew station would be sensed as being empty EMTYR (00411) and that the storage H function would not be energized.

The final horizontal line in the turn on segment or rung 54 would require that the storage J function be energized and that storage H not be energized.

Turning back to rung 52, we see that there are four conditions which could serve to turn on the storage H function. The first would be the initiation of the last destination signal LSTDT (00406) and an indication that the left pleat and sew station was empty EMTYL (00413). .

The second would be that the last destination function were energized, that the partial left function were energized indicating that the panel in the left pleat and sew station was on the fourth pleat PRTLL (00414) and that the right pleat and sew station was not sensed as being empty EMTYR (00411).

The third would be that the last destination function was not energized, that the left pleat and sew station was indicated as being empty and that the right was indicated as not being empty. These functions being, respectively, LSTDT (00406), NOT, METYL (00413) and EMTYR (00411) NOT.

The last group of functions which would serve to initialize or turn on storage H would be to have the last destination function NOT energized, to have the indication that the left panel was on its fourth pleat, that the right panel was not on its fourth pleat and that the right station was not empty, which functions respectively are LSTDT (00406) NOT, PRTLL (00414), PRTLR (00412) NOT, EMTYR (00411) NOT. Thus, if any of those conditions in those four sequences were met, the storage H function would be turned ON and would serve to keep destination 3 from being turned on in any instance except if the manual or right switch itself were energized.

Turning now to rung 53, we see that the storage J function would be energized initially if the last destination were not energized and if the right pleat and sew station were indicated as being empty which functions, respectively, are LSTDT (00406) NOT and EMTYR (00411). Alternatively, the storage J function would be energized if the last destination were not energized, if the right station were not indicated as being empty, but the right station had a partial indication indicating that the right station itself had begun the fourth pleat on the panel that was at the right pleat and sew station which functions, respectively, are LSTDT (00403) NOT, EMTYR (00411) NOT and PRTLR (00412) which are in the second horizontal line of rung 53. Likewise, we see in storage J that there is a latching function for destination 3 which would operate as part of the rung 54 equation and serve to latch destination 3 until the manual left switch was energized or STORH was turned ON which would thereby turn off destination 3 output.

Turning now to rung 55, we see that the load signal LOADD (00407) is energized, indicating that the overhead transfer unit is loaded, as long as the pick-up clamps are sensed as being closed or pick-up clamp NOT is true PICUP (00515), which is the turn off portion of rung 55, and when the corner-sew thread cut output function is energized CSTCT (00607). LOADD (00407) latches the output until the pick-up clamp is opened.

Time delay 212 is energized at rung 56 as soon as the overhead transfer motion left actuator is energized OTULF (00516) or the overhead transfer unit right motion actuator is energized OTURT (00517) with time delay 212 being for five 0.1-second intervals for a total time delay of five-tenths of a second.

Time delay 224 for two 0.1-second intervals or two-tenths of a second is energized when the corner-sew thread cut is energized CSTCT (00607), as shown in rung 57.

Turning now to rung 58, the storage C functional output STORC (00103) is energized when the load function is energized, when destination 3 is not energized, when the overhead transfer unit is not being held, when the left pleat and sew motor run/jog switch is not in the jog position, when overhead transfer unit is in home position in a transverse direction, and when any one of the three parallel circuits anded with the above conditions is true. Parallel circuit one has thread break left NOT THBKL (00000) NOT, and sew complete left SCOML (00306), and position five left POS5L (00303), and header clamp left in pleat forming position HCPPL (10216). Parallel circuit two has the signal that says the left pleat and sew station is empty and ready to receive a panel EMTYL (00413). Parallel circuit three has header clamp output signal energized HCLPL (00611) and pleat and sew operation is now working on the fifth pleat. These functions are indicated respectively at rung 58 as LOADD (00407), and DESTIN (00003) NOT, and OTUHD (00205)NOT, and PSJGL (10405) NOT, and OTUHM (10110), and the three following parallel circuits, EMTYL (00413) or HCLPL (00611) and POS5L (00303), or THBKL (00000) and SCOML (00306) and POS5L (00303) and HCPPL (10216).

Turning now to rung 59, we have the equation which will generate the output for the overhead transfer mechanism assembly and specifically the left actuator which will move the assembly to the left. The overhead transfer assembly must be detected in the home position from a lateral standpoint since it is not desirable to attempt to move the overhead transfer assembly transversely if it has not returned completely to the home position from being in the corner-sew assembly or if it has not returned from or if it has moved a slight distance toward the loop forming assembly. As indicated above, the storage C function is now used as part of the turn "on" for the overhead transfer lateral motion actuator and the overhead transfer unit must be in a RUN condition and time delay 224 must have timed out.

The overhead transfer unit left actuator function is latched up to the first horizontal line in the turn on segment of rung 59 and will remain latched after the signal is turned "on" as long as the overhead unit has been detected in its home position OTUHM (10110). The storage C, and RUN overhead transfer unit, and time delay 224 RUNOUT functions will serve to turn on the OTULF (00516) signal after the overhead transfer unit home lateral position has been detected, and the second horizontal line comprised of the functions OTURR (10107) which is the overhead transfer unit right ready signal, the PICUP (00515) or pick-up clamps energized signal, and the RNOTU (00204) indicating that the overhead transfer unit is in a RUN mode, would also tend to turn "on" the overhead transfer assembly left actuator. The timing delay (21215) for five-tenths of a second would, however, turn off the overhead transfer unit's left actuator signal, thus assuring that the left actuator motion is only of a short duration.

At rung 60 is the function PFEDL (00713) which pertains to the left panel tail feed motion starter. This signal is generated once the overhead transfer assembly left actuator signal is generated, and when the pick-up clamp cylinder output signal NOT condition is true. Turn "on" causes it to latch itself on until turn "off" conditions are met. This left pane tail feed motion starter signal will energize the endless belt moving toward the left pleat and sew station which, as explained previously, will serve to carry the portion of the pan which will be hanging between the loop-forming assembly and the remaining portions of the machine. The left panel tail feed motion starter will be turned off when the overhead transfer unit reaches the left pleat and sew station and activates the left ready switch OTULR (10106) and the pick-up clamp PICUP (00515) opens after delivering the panel to the header clamp.

Turning now to rung 62, the storage D functional output STORD (00104) is energized when the load D function is energized, when destination 3 is energized, when the overhead transfer unit is not being held, when the right pleat and sew motor run/jog switch is not in the jog position, when overheat transfer unit is in home position in a transverse direction, and when any one of the three parallel circuits anded with the above conditions is true, parallel circuit one has thread break right NOT, and sew complete right, and position five right, and header clamp in pleat forming position right. Parallel circuit two has the signal that says the right pleat and sew station is empty and ready to receive a panel. Parallel circuit three has header clamp output signal energized and pleat and sew operation is now working on the fifth pleat. These functions are indicated, respectively, at rung 62 as LOADD (00407), and DESTN (00003), and OTUHD (00205) NOT, and PSJGR (10406) NOT, and OTUHM (10110), and the three following parallel circuits are anded with the functions just listed and they are EMTYR (00411), or HCLPR (00702) and POS5R (00416), or THBKR (00005) and SCOMR (00301) and POS5R (00416) and HCPPR (10315).

Looking at rung 63, we see that this is similar to rung 59 except that the overhead transfer transverse motion actuator right indicated at OTURT (00517) is generated. As was the case with rung 59, the overhead transfer unit must be sensed in a home position OTUHM (10110) from a transverse star point and again there are two ways to turn on OTURT (00517) once the overhead transfer unit has been sensed in its home lateral position. The first way is to make use of the storage D function and to have the overhead transfer unit in a RUN mode and time 224 must time out. The second would be to have the overhead unit left ready signal generated indicated at OTULR (10106) in the second horizontal line in the turn "on" segment of the equation at rung 63, to have the pick-up clamp sensed as being opened since this output to the pick-up clamp cylinder is generated, this being indicated at PICUP (00515) and again to have the overhead transfer unit in a RUN mode indicated at RNOTU (00204). As also was the case with rung 59, the right actuator transverse motion signal will be generated only for a period of five-tenths of a second since the completion of the time delay (21215) will turn off OTURT (00517).

As was indicated previously, the right panel tail feed motor starter output signal indicated at PFEDR (00714) is generated at rung 64 when the overhead transfer unit right actuator signal is generated, when the pick-up clamps are closed, PFEDR turns on and latches. The right panel tail feed motor starter output signal is turned off when the overhead transfer unit is sensed as being in the right ready position and the pick-up clamp opens after delivering the panel to the right header clamp. This is caused by OTURR (10107) NOT, and PICUP (00515) NOT both becoming false.

At rung 66, the signal CSETY (00207) is generated and used to clear the corner-sew assembly. This signal will be generated when the corner-sew clear push button is energized as indicated at CSCLE (10117) or by initialize INALZ (00217) being generated. It will be latched by the CSETY (00207) function shown in the first vertical group of functions.

The corner-sew empty function will be turned off once the turn "off" functions become untrue or when the overhead transfer unit home lateral NOT condition is untrue indicating that the overhead transfer unit is at its home position from the lateral direction and when the pick-up NOT condition is untrue or when the pick-up cylinder output signal is generated indicating that the pick-up clamps are open.

Turning now to rung 67, we have the equation which will generate the run corner-sew signal indicated at RUNCS (00206).

As is evident, there are five ways the run corner-sew signal can be generated indicated by the five horizontal lines on the left-hand side of this equation. In each of the first four equations, the normal jog switch cannot be in its jog position, the hold switch button cannot have been energized, there cannot have been a sensing of a thread break in the corner-sew assembly, and there must not be an indication of low thread on the sewing machine bobbins. In the first horizontal equation, the pushing of the continuation push button will place the corner-sew assembly in run condition. In the second horizontal equation, the pushing of the start/run push button will likewise turn on the corner-sew run function. In the third horizontal equation, the pushing of the corner-sew resew button will turn on the corner-sew run condition, and in the fourth horizontal portion of the equation, the corner-sew run function will be latched as long as the normal jog hold corner-sew thread break and corner sew bobbin low signal are all in the NOT conditions.

If the normal jog switch has been energized such that it is in its jog position and the jog function (00211) is on, the corner-sew RUN signal will also be set but only for the short duration that the jog function stays on. This is set by the time delay 204 (20415) and is for three-tenths of a second.

At rung 68, time delay (00211) for two-tenths of a second will be energized, when the corner-sew assembly is done its sewing cycle, and when there has not been an indication that there is a thread break in the corner-sew assembly. It is latched by the indicated signal (21117). Time 211 is turned "off" by corner-sew thread cut output being energized or depressing the resew push button. These functions are indicated at CSDON (00410), CSTBK (10201), CSTCT (00607) and RESEW (10115), respectively.

Rung 69 causes the corner and bar tack clamp cylinder output signal to be generated. If the time delay (21115) has run, and there has not been a sensing of a thread break in the corner-sew assembly and the corner-sew is in its RUN mode, with these functions indicated in the first horizontal line or the turn-on portion, the corner and bar tack clamp cylinder output signal will be turned on. It should be pointed out that when the corner and bar-tack clamp cylinder output signal is turned on, the clamps will be open and when the signal is turned off, the clamps will be closed.

Looking at the second horizontal circuit and the turn-on portion of rung 69, if the corner-sew empty signal has been generated CSETY (00207), and there is no sensing that the corner-sew cam is rotated, the corner and bar-tack clamp cylinder output signal will also be generated.

The third horizontal circuit will also turn on the output signal corner clamps CRCLP (00604). If RET25 (00401) is on, then CRCLP (00604) will be actuated. An explanation of this signal RET 25 is given in the discussions of rungs 70 and 71.

The corner and bar-tack clamp cylinder output signal will be turned off, thus allowing the clamps to close if the overhead transfer unit in corner-sew position sensed NOT condition is untrue indicating that the overhead transfer unit is in the corner-sew position, if the corner-sew done signal is not being generated, indicating that the corner-sew is not done, and if the run corner-sew NOT condition is untrue indicating that the corner-sew run signal is present. Thus, while the overhead transfer unit is in the corner-sew position, with the corner-sew RUN signal present and it does not have a corner sew done signal, the bar and corner-tack clamps signal will be turned off, thus closing the clamps.

Looking at rung 70, we find that when the output signal CRCLP (00604) is present, the retentive memory signal RET25 (00401) will be activated. The L in parenthesis under RET25 as shown for rung 70 indicates that this is a retentive memory signal and is latched. If RET25 is on and power is lost to the programmable controller, when power is restored RET25 (L) will still be on and used in rung 69 to hold the corner clamps open.

Looking at rung 71, we see that when the output signal CRCLP (00604) is turned off by normal means, RET25 (U) is turned on. The U in parenthesis indicates RET25 is in its unlatched state. If power is lost when RET25 is unlatched, then when power is restored RET25 (U) will still be on and will not cause the corner clamps to open.

This retentive function is necessary in the corner clamp output (rung 69) because the normal desired power-up state is to have the clamps open and without RET25 (L) on there would be no way to turn CRCLP (00604) on. CRCLP on opens the corner clamps.

All outputs are off on the power-up and require a true turn on condition to be activated.

Turning now to rung 72, we have the equation that will generate the corner-sew done signal, output signal CSDON (00410). Corner-sew done is generated by control relay one CR1(00404) being on and control relay two CR2 (00405) being off or in the NOT state. If corner-sew by-pass switch is switched to the by-pass position, it will also turn on CSDON (00410). Once it is turned on, it will latch. The normal turn off condition for CSDON (0041) is for the overhead transfer unit to leave the home position in a transverse direction. Then the OTUHM (10110) position sense switch opens, making OTUHM go from a true to a false condition which turns CSDON (00410) off. After a corner-sew cycle is completed, the control relays 1 and 2 will have caused CSDON (0041) to be set. If a thread break or low bobbin was sensed, it will be necessary to resew the corners after correcting the problem. It then becomes necessary to turn CSDON (00410) off and this is accomplished by depressing the resew push button.

The last vertical set turns CSDON (00410) off after the machine has run for some period of time in the by-pass corner-sew mode and it is then switched to normal. Usually when the mode is changed to normal operation CSDON remains set for the first panel. When the overhead transfer unit moves forward to OTULP (10103) and the by-pass switch is off CSDON is reset and the first panel after the switch change will go on into corner sew.

At rung 73, we have the equation for providing the time delay (21015) for a total of one-tenth of a second and this time delay will be energized when the bar motion clamp engaged sensor indicates that the bar-tack clamp is engaged, when there is no indication that the corner-sew is not done and when the corner clamps are not set.

At rung 74 is the equation for energizing the control relay No. 1 for the corner-sew circuit. This control relay will be energized either when the control relay two controlling the clutch is energized and when the corner-sew cam is sensed as rotating or when the corner-sew empty signal is sensed. The output signal to the control relay one will be turned off once the time delay 21015 of one-tenth of a second has timed out and been reset, if the control relay two is not energized and when the corner-sew is in a run mode. Likewise, if the resew button RESEW (10115) has been pressed, the output signal to the control relay one will be turned off.

At rung 75 is the circuit which will turn on control relay No. 2 for the corner-sew clutch. This will be energized when time delay 21015 of one-tenth of a second has run, when the corner-sew assembly is in its run mode indicated at RUNCS (00206) and when there has been no sensing that the corner-sew cam has been rotated as indicated at CAMRT (10202) NOT. As is in the case previously, the CRT2 (00205) function in the second horizontal line in the first vertical segment of the equation at rung 75 will serve to latch the output signal to a control relay 2 ON.

The second vertical series will serve to turn the signal off and the series as shown requires that the control relay 1 not to be energized and that there be sensing of the cam having rotated back to the starting point. Thus, if there was no sensing of the cam rotating and the control relay 1 was energized, the output signal to control relay 2 would be turned off.

Further, the third vertical group or portion of rung 75 will serve to clear the signal and as shown, the resew button is in its NOT condition meaning that the resew button has not been pressed and the corner-sew empty is in a NOT condition indicating that the corner-sew clear push button has not been depressed. Thus, when the resew button has been pressed or the corner-sew clear pushbutton has been depressed, the output signal to control relay 2 will be turned off.

At rung 76, we have the equation necessary to turn on the corner-sew clutch output signal CSCLC (00606) which will cause the sewing machine to run and which also removes the brake and engages the clutch. This will be energized when the output signal control relay 2 CR2 (00405) is on and when the control relay 1 output signal CR1 (00404) is not energized. This output signal to the corner-sew clutch motor is latched as shown in the second horizontal line of the first vertical segment of rung 76.

The turn-off portion for rung 76 is comprised of CR1 (00404) NOT and CR2 (00405). Thus when that segment becomes untrue, or when the output signal to control relay 1 is on, and when the signal to control relay 2 is off, the corner-sew clutch output signal will be turned off.

The clear portion of rung 76 comprised of CSETY (00207) indicates that the corner-sew clear push button has not been depressed and is in its NOT mode and thus the signal to the corner-sew clutch motor will be cleared when there is a sensing that the corner-sew clear push button has been depressed.

At rung 77 we have the equation for energizing the time delay function 215 which operates at one-tenth of a second intervals for two intervals making a total lapse time of 0.2 second. The signal will be turned on if the corner-sew signal CSDON (00410) is energized and if the controller sees that the overhead transfer unit is in its home position from a lateral direction indicated as CSCLR (10105) and if there has not been a switching of the corner-sew by-pass switch BYPCS (10114) NOT.

In addition, this time delay 215 can be energized if the by-pass corner-sew switch has been energized and if the pick-up clamps are not provided with an output signal indicated in the second horizontal line of the first separate run segment of rung 77.

The output for the corner-sew thread cut cylinder which will cause the thread between the sewing machine needle in the corner-sew assembly and the panel to be cut, will be energized following the running of time delay 21515 and when the overhead transfer unit is again sensed to be in its home position from a lateral (axial) standpoint. The CSTCT (00607) function in the left-hand side of this equation will serve to latch the corner-sew thread cut cylinder output signal on.

The output signal to the corner-sew thread cut cylinder will be turned off once any one of the remainder of the equation at rung 78 becomes untrue or when there is a sensing that the overhead transfer unit is in its left-ready position, or when the overhead transfer is in its right ready position or when the overhead transfer unit is sensed in the loop pick-up position.

Rung 79 is a counter that totals the number of times the corner-sew clutch output signal CSCLC (00606) is energized and this is a count of how many corners have been sewn. Rung 79 is shown as 79A, 79B, and 79C with each going to a different counter through a different switch but each has the corner-sew clutch output signal as an input. The three switch positions—low switch (LOSW-10411), medium switch (MEDSW 10412) and high switch (HISW-10413) are all contacts on one rotary switch. The switch is set by the pleating machine operator according to the type of fabric being sewn, i.e., thin fabric — HISW, heavy fabric — LOSW. Thin fabric does not use as much thread from the bobbin as heavy fabric so the counter is set to a higher PR count before it turns a light on telling the operator to change the corner-sew sewing machines bobbins.

Rung 79A will cause counter CTR9 (241) to count up (CTU) to a preset count of 50 if the low switch LOSW (10411) is selected and the corner-sew clutch is pulled in 50 times. Contact 24115 is turned on when a count of 50 is reached. Rung 79B counts to a preset count of 60 if the medium switch MEDSW (10412) is selected. Rung 79C counts to a preset count of 70 if high switch HISW (10413) is selected.

Rungs 80A, 80B and 80C are counter resets (CTR) for each of the three counters. By depressing corner-sew bobbin low reset CSBLR (10116) all three counters will be set back to zero count.

Rung 81 is a counter that totals the number of bobbins replaced during an eight hour shift and is passed on to management each day. Each time the corner-sew bobbin low reset push button is depressed, it is counted by counter 3, CTR3 (233).

Rung 82 is the reset for counter 3. Key switch KEYSW (10417) is the input used to reset all counters that contain management information. The switch is one in which a key must be inserted and turned to activate the contacts to clear the counter and the key is in the possession of the pleating machine shift supervisor.

Rung 83A is an output that is set when a corner-sew thread break TBKCS (00001) is sensed. Corner-sew thread break CSTBK (10201) senses the thread break and turns on TBKCS (00001) and it latches. The output signal TBKCS (00001) can be reset if any one of three conditions becomes false, that is, the corner-sew clutch output signal CSCLC (00606) is set, or continue push button CONT (10001) is depressed or if the overhead transfer unit is moved out of the corner-sew position and home in a lateral direction switch CSCLR (10105) is activated. Rung 83A is latched to keep from giving false counts to rung 83 counter 4 CTR4 (234) as the thread break is repaired. TBKCS (00001) is the input to counter 4 which totals the number of thread breaks on the corner-sew machines during an eight hour shift and is information for management.

Rung 84 has key switch — KEYSW (10417) as its input and when it is turned on, counter 4 CTR4 (234) is reset to zero count.

At rung 85, an output from any one of the three counters described at rungs 79A, 79B and 79C will generate corner-sew bobbin low signal CSBLO (00002). This signal is turned off by depressing the corner-sew bobbin low reset push button.

Looking at rung 86, the corner-sew bobbin low lamp output signal will be energized, thus lighting the corner-sew bobbin low lamp when the corner-sew bobbin low output CSBLO (00002) energized at rung 85 is on.

The empty right signal EMTYR (00411) for the right pleat and sew station will be energized when that station is in fact empty, which will be indicated when the right header clamp is sensed as being in its ready position, when the right pleat and sew station pleat-forming motion is sensed as being complete, when the right pleat and sew stitch cycle is sensed as being complete, when the right header clamp cylinder output is on thus opening the clamp, the right header cylinder clamps and when the right pleat and sew header is in the pleat forming position. Thus, when these conditions are all true, the right pleat and sew station will be indicated to the controller as being empty and in position to receive a looped panel following its corners being sewn by the corner-sewing assembly.

Rung 88 controls the turn on of time delay 227 for one-tenth of a second, which will occur when the overhead transfer unit is in its right or left ready position and in the OTU delivery position and will be turned off when the overhead transfer unit leaves the delivery position.

Turning now to rung 89, we have the equation which will energize the output signal HCLPR (00702) for the right header clamp cylinder. The output signal will be energized through one of two circuits, the first being the first horizontal line over through the function RNPSR (00203), the second comprising PSCLR (00202). Both of these equations require, however, that the right pleat and sew station header clamp be in the pleat-forming position indicated at HGPPR (10315). Also, the output signal for the right header cylinder is latched back to the first horizontal line just pass the right pleat and sew station header clamp pleating formation signal so that when that signal is lost indicating that the right pleat and sew station header clamp is not in its pleat-forming position, the right header clamp cylinder will be de-energized and thus allowed to be closed due to the action of the spring which will maintain the header clamp, both right and left header clamps, closed.

The second portion of the first equation which will serve to turn on the signal requires that the panel be in the fifth position at the right pleat and sew station indicated at POS5R (00416), that there be no indication that the pleat and sew station is loaded, nor that the pleat and sew cycle at the right pleat and sew station be energized but that the right pleat and sew station be in its RUN mode. The second equation that would turn on the right header clamp cylinder output signal would be when the right pleat and sew station was cleared as at PSCLR (00202).

The output signal to right header clamp cylinder will be turned off when the equations in the second vertical section of rung 89 are untrue, those functions being, respectively, time delay 22715 of one-tenth of a second NOT, OTURR (10107) NOT and right pleat and sew station in a RUN mode NOT, RNPSR (00203). When these not conditions become untrue such as time delay 22715 having run, in the overhead transfer unit being in its right ready position and when the right pleat and sew station is in its RUN mode, the right header clamp cylinder would be turned off and the header clamps will be allowed to close.

Rung 90 energizes a storage E function indicated a STORE (00105) which is used as part of the equation shown at rung 91, serving to turn on the output signal for the pleat sew cycle PSCYR (00417) for the right station.

The storage E function will be energized when the overhead transfer unit is in its right ready position, when the overhead transfer unit is in its home position from the lateral direction and when the pick-up clamp cylinder output signal is energized. Alternately, the storage E function will be energized when the right pleat and sew station is sensed as being loaded and when the right pleat and sew restart button has been pressed. A further way the storage E function can be energized would be when the right pleat and sew station was indicated as being loaded and when the sew only restart button SWRSR (10304) has been energized. If any one of these three conditions is fulfilled, the storage E function will be energized and that output will be used in equation 91 as part of the signal necessary for the controller to turn on the right pleat and sew cycle.

The storage E function will be turned off when the portions of the rung 90 equation in the second vertical group which are respectively, HCLPR (00702) NOT which refers to the right header clamp output signal NOT and when we have an initialization NOT INALZ (00217). When either of these two conditions become untrue such as when we do have an output signal for the right header clamps cylinder or we are in initialization, the storage E function will not be turned on.

Turning now to rung 91, if the storage E function is on, the right pleat and sew cycle will be initiated, indicated at PSCYR (00417). This function is also shown as being latched between the left-hand vertical line and the storage E function.

Throughout the program thus far, there has been only one vertical portion or segment of each equation which is designated as the turn-off portion of the function being energized by that equation. In this instance, however, at rung 91, there are essentially four ways that the right pleat and sew cycle can be terminated, one being the normal turn off after five pleats have been formed and sewn, one being a tread break sensed, one being bobbin low on thread sensed, and the last a clear signal being generated.

The first vertical group is the vertical group following the storage E function and comprises PTBKR (10400) and HCPPR (10315). Both of these are NOT conditions, the PTBKR indicates a pleat and sew thread break NOT condition or that there is no thread break in the pleat and sew area, during the pleat and sew cycle, and that the header clamps be in their pleat-forming position NOT such that when these conditions were untrue in that the header clam was in a pleat-forming position and there was a thread break indication, the pleat and sew cycle would be terminated.

Moving to the second turn off series of functions, we have the following equations: POS5R (00416), SCOMR (00301), HCSWR (10310) and PTBKR (10400). The first two are NOT conditions, the second two are true conditions and when we have the pleat and sew in its fifth position, the sewing is indicated as being completed, the header clamp is not in a sew position and there is no pleat and sew thread break, the pleat and sew cycle will also be terminated.

The next portion of segment of rung 91 which would serve to turn off the pleat and sew cycle output signal would be BLOWR (10410) NOT indicating that we did not have a bobbin low indication and HCSWR (10310) or indicating that the header clamps were sensed in a stitched position. Thus when these conditions run false, or when there is a bobbin low and the header clamps are not in a stitch forming position, the output signal to the pleat and sew cycle would be terminated.

The pleat and sew clear NOT condition when untrue would likewise terminate or clear the right pleat and sew cycle output signal.

The time delay 216 of one-tenth of a second intervals with three intervals making a total time delay of three-tenths of a second is generated at rung 92 when the right pleat and sew pleat forming motion complete sense has not been sensed by the controller indicated at PRCPR (10307) NOT and when the right pleat and sew header clamp is sensed in its pleat forming position as indicated at HCPPR (10315). Time delay 216 can also be generated when the pleat and sew stitch cycle complete sense NOT condition is true and when the right pleat and sew header clamp is sensed in its pleat stitch position indicated at HCSWR (10310). In either one of these instances, neither the pleat forming nor the stitch cycle would be complete and the right pleat and sew header clamp would either be in its pleat or stitch-forming position.

Turning now to rung 93, and the equation for producing the output signal to the right pleat-forming motor clutch relay indicated at PFCMR (00710). This output signal will be generated when the right pleat and sew header clamp is sensed to be in its pleat-forming position, when the right pleat and sew station is in its fifth pleat and sew cycle indicated at PSCYR (00417), there is not an indication that the pleat forming cycle is completed indicated at PCOMR (00415) NOT, there is no pleat and sew clear signal indicated at PSCLR (00202), the header clamp is not back in its stitch-forming position, HCBCR (10404) NOT and the right pleat and sew station is in its RUN mode indicated at RNPSR (00203).

The right pleat forming motor clutch relay signal will be turned off when the right pleat and sew pleat forming motion complete sense PRCPR (10307), time delay 21615 NOT and the header clap in a pleat forming position NOT, HCPPR (10315) NOT are untrue, or when the right pleat and sew pleat-forming motion is not complete, the time delay has run and when the header clamp is in a pleat forming position.

The right pleat forming motor clutch relay signal will be cleared when the right pleat stitch motor clutch relay is energized or when PSCMR (00707) NOT is false, or when the sew only restart push button is depressed indicated as SWRSR (10304) or when pleat and sew clear PSCLR (00202) NOT is false.

It sould also be noted that the latching function is latched over in the left-hand side of the equation where the function PFCMR (00710) latches between function HCPPR (10315) and PSCYR (00417). Thus, as long as the right pleat and sew header clamp is in its pleat-forming position, the right pleat-forming motor clutch relay will be energized.

The pleat complete at the right station indicated at PCOMR (00415) and shown at rung 94 is turned on by one of two methods, the first involving PFCPR (10307) NOT which requires the pleat-forming motion complete sense to be not complete and the function PFCMR (00710) NOT standing for the pleat-forming clutch motor right output signal NOT. Thus, if the pleat-forming motion is not complete, and there is no output signal to the pleat-forming clutch motor, the pleat complete signal PCOMR (00415) will be generated.

Likewise, if the right pleat and sew station is loaded as required in the second horizontal line of the turn-on segment of rung 94 and indicated at PSLDR (00300) and if the sew reset button is pushed SWRSR (10304), the pleat complete output signal will also be generated.

PCOMR (00415) at the third horizontal line is a latch for the pleat complete.

The functions HCSWR (10310) and PSCLR (00202), respectively, stand for the header clamp being in the stitch position sense NOT and the pleat and sew clear push button NOT. When either one of the two conditions is false, or when the header clamp is sensed to be in the stitch position or the pleat and sew clear push button has been energized, the pleat complete signal will be turned off.

Turning to rung 95, we have the equation which causes the pleat and sew loaded output signal to be generated and indicated at PSLDR (00300).

In order to turn this signal on, the overhead transfer unit must be in its right ready position, the overhead transfer unit must also be sensed to be in its home lateral position, and the pick-up clamp cylinder output signal must be generated, these three signals being found in the first horizontal line of the turn-on portion of rung 95.

In order to turn the pleat loaded signal off, the turn-off portion of the equation comprises the functions POS5R (00416) NOT, SCOMR (00301) NOT, PTBKR (10400) and HCSWR (10310). The first two conditions are in the NOT state. Thus when these conditions are untrue, the right pleat assembly will be in the fifth position, the sew complete signal will have been generated, there will not have been a right thread break in the pleat area, and the header clamp will not be sensed in the stitch position.

To clear the pleat and sew loaded signal, the pleat and sew clear NOT condition would have to be untrue. The function PSCLR (00202) which refers to pleat and sew clear right, is a memory signal which is generated by depressing the pleat and sew clear push button PSCLR (10305). In addition, the pleat and sew loaded output signal is latched over on the left-hand side of the equation by means of the function PSLDR (00300).

At rung 96, we have the equation presented which turns on the signal which causes the right pleat and sew station to be in a RUN mode and there are four different ways that this RUN mode can be established. The first is to have the machine in a continuation state by means of pushing the continue push button indicated at CONT (10001), we cannot be in the initialization phase, the normal jog switch cannot be in the jog position, and likewise the HOLD push button has not been depressed.

If the start/run push button STRUN (10016) has been energized, but the normal jog switch is not in the jog position and the hold push button has not been energized, the right pleat and sew station will also be placed in a RUN mode. The third method for turning on the run pleat and sew right signal would be to have the normal jog switch in the jog postion and to have the jog function generated by depressing the normal step push button NORST (10113). The fourth is essentially the latching circuit and is comprised of RNPSR (00203), normal jog function NORJG (10112) NOT and the hold function HOLD (10000) NOT which means that the normal jog switch is not in its jog position and if the hold push button is not depressed so as to energize that function, the output signal for the right pleat and sew RUN mode will be latched.

Turning now to rung 97, the equation for turning on the right pleat and sew clear function indicated at PSCLR (00202) is shown and this is latched by means of the bottom horizontal line and the turn-on segment of the equation shown at rung 97 at PSCLR (00202).

If the pleat and sew clear push button has been energized, the pleat and sew forming motion has been sensed as being completed, and the pleat and sew stitch cycle is complete, the right pleat and sew clear signal will be energized. Likewise, if we are in the initialization function, the right pleat and sew clear condition will be produced. To turn off the right pleat and sew clear indication, the empty right NOT condition would have to be untrue and thus if the right pleat and sew station were sensed as being empty, the pleat and sew clear signal would be turned off.

At rung 98, we have a complementary function for the right header clamp transfer indicated at HCTRR (00703) and thus when the right header clamp transfer cylinder does not have an output applied to it, the function CMY44 (00711) will be energized, causing the header clamp to move in the opposite direction or to the pleat stitch position.

Rung 99 likewise allows the formation of a complementary function, this time CMY45 (00712) which is a complementary function of HCRLR (00704) NOT which stands for the right header clamp to carriage lock NOT. Thus when the signal causing the right header clamp and carriage to be locked together is not being generated to be complementary function CMY45 (00712) causes the right header clamp and carriage to unlock.

The equation shown at rung 100 causes an output signal to be applied to the right pleat stitch motor clutch relay indicated as PSCMR (00707).

The output signal for the right pleat stitch motor clutch relay is latched as indicated in the second horizontal line in the equation, and the turn-on portion at PSCMR (00707) with this function being latched just beyond the function HLOCR (10311) which is an input signal to the controller indicating that the right pleat and sew header clamp to carriage lock is engaged. Since this latter function follows the function indicated at HCBCR (10404) which indicates an input signal indicating that the right pleat and sew header clamp is back in the stitch position, the output signal to the right pleat stitch motor clutch relay will only remain latched as long as the header clamp is back in the stitch position and the header clamp is sensed as being locked to the carriage. This assures that the right pleat stitch motor will be activated via the clutch which in turn is activated by the clutch relay only when the header clamp is back in its stitch position and is locked to the carriage which will move it throughout the stitch cycle.

The right pleat stitch motor clutch relay output signal then will be energized when the header clamp is back in the stitch position, and when the header clamp is sensed as being locked to the carriage as indicated above, and also when the right pleat and sew station is in the five pleat and sew cycle indicated at PSCYR (00417), when there is not input to the controller indicating that the sew cycle is complete, or when SCOMR (00301) NOT is true, when there has been no sensing that there has been a thread cut in the right pleat and sew station, thus making the function TCUTR (10402) NOT true and when the right pleat and sew station is in a run mode, as indicated at RNPSR (00203) and when there has not been a pleat and sew clear right signal generated.

The output signal to the right pleat stitch motor clutch relay will be turned off according to the second vertical segment of the equation shown at rung 100 when the conditions as shown there are untrue. The conditions as shown are as follows: PSCYR (10312) which stands for the right pleat and sew pleat stitch cycle complete sense, time delay 21615 NOT and HCSWR (10310) NOT which means that the right pleat and sew header clamp is not sensed as being in a stitch position. Thus, the output signal PSCMR (00707) will be turned off when there is no sensing of a completion of the stitch cycle after the time period 21615 of three tenths of a second has run out and while the header clamp is still sensed as being in the stitch position.

The output signal PSCMR (00707) will be cleared if the function PFCMR (00710) which stands for the right pleat forming motor clutch relay NOT condition was untrue, or when there was an output signal applied to the right pleat forming motor clutch relay. Thus, this would assure that the motors for both the pleat-forming clutch and the pleat-stitching clutch would not be operated simultaneously since the header clamp can only be in one of the positions at a time.

At rung 101, we have the equation which will serve to provide an output signal to the right bobbin thread low indicator lamp indicated at BOBLR (00610). This function is also latched as indicated in the second horizontal line in the left-hand side of the equation shown at rung 101 and the signal will be turned on when the bobbin low input signal is applied as indicated at BLOWR (10410) and when the right pleat and sew header clamp is not sensed in its sew position as indicated at HCSWR (10310) NOT.

The right bobbin thread low indicator lamp output signal will be turned off when the right bobbin low reset button is set or when the function BRSTR (10302) NOT is untrue. This assures that when the right bobbin low reset push button is pushed, the right bobbin thread low indicator lamp will be turned off.

At rung 102, we have the equation which will generate the signal POS5R (00416) indicating that the right station is in its fifth position or at the point of producing the fifth pleat. This function is latched as shown in the third horizontal line in the left-hand portion of the turn on portion of the equation shown at rung 102. This signal is generated either when the output signal PP5RT (10314) indicates that the right pleat and sew header clamp is in its fifth position or when the right pleat and sew clear push button is depressed as indicated at PSCLR (10305) in the second horizontal line in the turn on portion of this equation.

The signal POS5R (00416) will be turned off when the function HCLCR (00706) NOT becomes untrue or when the right header clamp or output signal to the right header clamp return cylinder is on.

At rung 103 is the equation for producing the partial right function indicated at PRTLR (00412) which refers to the sensing of the initial forming of the fourth pleat.

This function is also latched and is turned on when the controller receives an input signal PP4RT (10313) which indicates that the right pleat and sew header clamp is in position four. This signal will be turned off when the empty right NOT condition is untrue, indicated at EMTYR (00411) NOT or when the right station is indicated as being empty.

At rung 104, is the equation for producing the output signal for the right header clamp return cylinder indicated at HCLCR (00706).

This function is also latched as shown in the third horizontal line in the turn-on segment of the equation shown at rung 104. This output signal can be generated in one of two fashions, the first comprising the first horizontal line in the turn on portion of the equation shown at rung 104, the second comprising the second horizontal line in that portion of this equation. The first horizontal line is composed of the functions HCLPR (00702), PNLER (10316) and RNPSR (00203). These stand, respectively, for the right header clamp cylinder output signal, the input signal from the right pleat and sew panel ejected sensor and the indication that the right pleat and sew station is in a RUN mode. Thus, if there is an output signal to the right header clamp cylinder, there is a sensing that the right panel is ejected and that the right pleat and sew station is in a RUN mode, the output signal for the right header clamp return cylinder will be generated.

The second way of energizing the output signal for the right header clamp return cylinder is when there is an indication that the right pleat and sew station clear signal has been generated as indicated at PSCLR (00202) and when the header clamp is sensed as being in the pleat-forming position indicated at HCPPR (10315).

The output signal to the right header clamp return cylinder HCLCR (00706) will be turned off when the two NOT conditions in the second vertical segment of the equation shown at rung 104 become untrue or when the right pleat station is in its fifth pleat and sew cycle and the right pleat and sew station is in a RUN mode.

Rung 105 causes the generation of the storage F function, STORF (00106) which is used as a portion of the turn off segment of the equation shown at rung 106 and is used to turn off the output signal for the right header clamp transfer cylinder.

Therefore, turning first to rung 106, we see that the output signal for the right header clamp transfer cylinder will be generated in one of two ways since there are two horizontal lines in the turn-on segment of the equation shown at rung 106 with the output signal being latched to each of those turn-on portions. Looking at the latch aspect of the equation at 106 first, we see that the signal will be latched to the function HCLPR (00702) NOT or when the right header clamp cylinder does not have an output signal applied to it, or also when the header clamp is sensed as being in its pleat-forming position, as indicated in the first horizontal line at HCPPR (10315). Thus, once the output signal is generated, as long as the right header clamp signal does not have an output signal applied to it or the header clamp is in a pleat-forming position, the output signal for the right header clamp transfer cylinder will remain on.

The first method of turning on the output signal for HCTRR (00703) will be when the header clamp is in its pleat-forming position as indicated before at HCPPR (10315) or when the header clamp is closed indicated by HCLPR (00702) NOT, and when the header clamp is not sensed as being in its ready position indicated at HCRER (10306) NOT, when the pleat-forming motion complete sense is true or when the pleat-forming motion is sensed as being complete indicated at PFCPR (10307), when there is an indication to the controller that the thread of the right pleat and sew station has been cut, when the right pleat and sew header clamp is not locked to the carriage, when the sewing cycle is complete and when the right pleat and sew station is in a RUN mode. Turning HCTRR (00703) on moves the header clamp from the sew position forward to the pleat-forming position.

The second method of generating the output signal for HCTRR (00703) is when the right header clamp cylinder does not have an output signal applied to it as shown in the second horizontal line in the turn on portion of the equation shown at rung 106 at HCLPR (00702) NOT, or when the header clamp is in the pleat-forming position HCPPR (10313), when the right pleat and sew station clear signal is set as at PACLR (00202) and when there is no indication that the right pleat and sew header clamp is locked or engaged with the carriage as indicated at HLOCR (10311) NOT.

The output signal to the right header clamp transfer cylinder will be turned off when the functions in the turn off segment of the equation at rung 106 are untrue with the equation shown at rung 105 being part of the turn off segment of the equation at rung 106. The equations, the functions of the turn off segment are as follows: PFCPR (10307) NOT standing for the pleat forming motion complete sense NOT, HCPPR (10315) NOT standing for the right header clamp being sensed in the pleat-forming position NOT, HCLPR (00702) calling for an output signal to be applied to the right header clamp cylinder, and the functions in storage F at rung 105 or a pleat complete NOT indicated at PCOMR (00415) NOT, fifth pleat and sew cycle NOT PSCYR (00417) NOT, the right pleat stitch motor clutch relay output signal PSCMR (00707), the right run pleat and sew station NOT RNPSR (00203) NOT and the indication that the right pleat and sew header clamp is engaged with the carriage or locked thereto HLOCR (10311). Thus, when these conditions are not true, the pleat forming will be sensed as being complete, the right header clamp will be in the pleat forming position, there will be no output sign 1 to the right header clamp cylinder, the pleat will be complete, the fifth pleat and sew cycle will be on, there will be no output to the right pleat stitch motor clutch relay, the right pleat and sew station will be in the RUN mode and the right pleat and sew header clamp will not be locked to the carriage. If these latter conditions are met, the output signal to the right header clamp transfer cylinder will be turned off.

At rung 107, we have a signal which will generate the time delay 226 for one-tenth of a second, and this time delay will be turned on when the right sew cycle is indicated as being complete, the function being SCOMR (00301) and when the right pleat stitch cycle is sensed as being complete, that function being PSCYR (10312).

At rung 108, we have the equation for providing the output signal to the right header clamp to carriage lock which is latched to the left-hand side of the equation in the second horizontal line of the turn on portion of the equation at rung 108.

This output signal is turned on when the header clamp is sensed as being in the stitch position at HCSWR (10310), when the sewing cycle is not indicated as being complete, SCOMR (00301), when the right pleat and sew station is in its fifth pleat and sew cycle PSCYR (00417), and when the right pleat and sew station is in the RUN mode RNPSR (00203).

This output signal for the right header clamp to carriage lock will be turned off when the time delay 22615 for one-tenth of a second has run or when the condition as shown is untrue, when the right pleat and sew station is in its RUN mode and when the right header clamp is sensed as being in the stitch position. Further, the output signal for the right header clamp to carriage lock will be cleared when the right pleat and sew clear signal is produced by depressing the clear push button as indicated by PSCLR (00202), and when there is an indication or sensing that the right pleat and sew stitch cycle is not complete or when the function PSCYR (10312) NOT is untrue.

The right station sew complete output signal will be generated, this being indicated at RUN 109 as SCOMR (00301), when there is no sensing that the right pleat and sew pleat stitch cycle is complete, or when PSCYR (10312) NOT is true and when there is no output signal applied to the right pleat stitch motor clutch relay, thus when PSCMR (00707) NOT is true.

The turning off of function SCOMR (00301) will occur when the function HCPPR (10315) NOT becomes untrue or when the right header clamp is in its pleat-forming position. The function SCOMR (00301) is also latched in the normal sense, this being indicated in the second horizontal line of the turn on portion of the equation shown at rung 109.

At rung 110 the time delay 220 for two-tenths of a second will be energized when the right header clamp cylinder output signal is on or when the function HCLPR (00702) is true.

At rung 111 the output signal for the right panel ejector cylinder indicated at PNEJR (00705) will be energized when the right header clamp is sensed as being in the fifth position, that function being PP5RT (10314), when the right pleat and sew station is in its run mode indicated at RNPSR (00203), when the time delay 22015 is energized and when there is no indication that the right pleat and sew station clear signal is on, or when the function PSCLR (00202) NOT is true.

The output signal for the right panel ejector cylinder is latched again in the usual sense by the function PNEJR (00705) in the second horizontal line of the equation shown at rung 111. The output signal for the right panel ejector cylinder will be turned off when the function ARMUP (10317) NOT becomes untrue or when the right panel ejector arm is sensed as being up.

At rung 112 we see that when the right pleat and sew stitch thread break memory signal is energized as at THBKR (00005), the counter CTR6 (236) counts one time. This counts the number of thread breaks during an eight hour shift and is used as management information.

Rung 112A has been added to provide a memory generated signal thread break right THRKR (00005). This signal is then used as an input to counter 6 CTR6 (236). The turn on portion comprised of the thread break sensor PTBKR (10400). When it is activated by a thread break, memory output THBKR (00005) is turned on and latches.

The turn off section is comprised of three signals any one of which can turn THBKR (00005) off by becoming false. The three signals are PSCLR (00202) NOT, PSRSR (10303) NOT, and SWRSR (10304) NOT. If right pleat-forming restart push button is depressed PSRSR (10303) or sew only restart push button is depressed SWRSR (10304), the memory output THBKR (00005) is reset. Also, if the right pleat and sew clear push button is depressed, memory signal pleat and sew clear right PSCLR (00202) will be generated and this will reset THBKR (00005).

At rung 113 the function CTR6 (236) is reset by key switch KEYSW (10417) being actuated by the shift supervisor at the end of the shift. Key switch is actuated only after the count is recorded.

At rung 114, when the right pleat and sew bobbin low output signal is on, indicated at BOBLR (00610), the counter CTR5 (235) counts one time. This counter totalizes the number of bobbins used during an eight hour shift.

When the key switch has been energized, indicated at KEYSW (10417) counter 5 CTR5 (235) is reset to zero count. Again this information is recorded before the counter is reset.

At rung 116, when the panel ejected input signal is received by the computer (controller) indicated at PNLER (10316), counter 8 CTR8 (240) totalizes the number of panels run through the right pleat and sew station during an eight hour shift.

At rung 117, the function KEYSW is energized when the shift supervisor inserts a key in key switch KEYSW (10417) and turns it after recording the information contained in counter 8. This function KEYSW (10417) being turned on resets CTR8 to zero count.

At rung 118, we see the equation which will cause an output signal indicating that the left pleat and sew station is empty, that function being indicated as EMTYL (00413).

This function will be energized when the left pleat and sew station is sensed as being ready to receive a panel, that function indicated as HCREL (10207), when the left pleat forming motion is sensed as being complete indicated at PFCPL (10210), when there is a sensing that the left pleat stitch cycle has been completed, indicated at PSCYL (10213), when there is an output signal applied to the left header clamp cylinder indicated at HCLPL (00611), and when the left header is sensed as being in the pleat forming position, this function indicated at HCPPL (10216).

The output signal to the left header clamp cylinder indicated at HCLPL (00611) is generated by the equation at rung 119. Looking first at the bottom horizontal line in the left-hand turn on segment of the equation at rung 119, we see that the function HCLPL (00611) will latch up to the function HCPPL (10216) which is a signal indicating that the left header clamp is in fact in the pleat forming position. Thus, as long as the left header clamp is sensed as being in the pleat forming position, and once the output signal to the left header clamp cylinder is generated, that output signal will remain latched until the left header clamp leaves the pleat forming position or the turn off section causes the output to deenergize.

Once the left header clamp is sensed as being in a pleat forming position, the left header clamp cylinder output signal will be generated in one of two ways, the first comprising the functions POS5L (00303), PSLDL (00305), PSCYL (00304) and RUNPL (00201). These functions respectively stand for an output that the left pleat and sew assembly is in position 5, that the left pleat and sew assembly is not loaded, that the left pleat and sew assembly is not in the pleat and sew cycle, but that the left pleat and sew assembly is in the run mode. The second way of turning on HCLPL (00611) would be if the left header clamp was again in pleat forming position and the left pleat and sew clear output PSCLL (00200) was generated.

The output signal to the left header clamp cylinder will be turned off when the time period 22715 has run, when the overhead transfer unit is sensed as being in its left ready condition, and when the left pleat and sew assembly is in its run mode or when the conditions shown in the second vertical segment of the equation of rung 11 are untrue.

The output signal generating the left station five pleat and sew cycle indicated at PSCYL (00304) is generated by the equation at rung 120. The equation at 120 has a turn on segment which comprises the first vertical group of horizontal lines with the last horizontal line being a latch function and being PSCYL (00304). The following four vertical segments of the equation at rung 120 comprise essentially four ways to turn off the output signal to the left station five pleat and sew cycle function with the last being the clear function and comprising the function PSCLL (00200) NOT or when the pleat and sew left clear input is received the output signal which will generate the left station pleat and sew cycle will be turned off.

Turning now to the three equations that will turn on the output signal generating the left station fifth pleat and sew cycle, the first horizontal line comprises the functions OTULR (10106), CSCLR (10105), PICUP (00515), HCLPL (00611), and INALZ (00217). These relate respectively to an indication that the overhead transfer unit is sensed to be in the left ready position, the overhead transfer unit is in its home position in a lateral or axial direction, an output signal is turned on which opens the pickup clamp, there is no output signal to the left header clamp cylinder and the controller is not in its initialization phase.

The second horizontal line provides the second means for generating an output signal at rung 120 and comprises the functions PSLDL (00305) PSRTL (10204), HCLPL (00611) and INALZ (00217) which, respectively, relate to the left pleat and sew load output signal, an indication that the left pleat and sew restart push button has been depressed, that there is no output signal to the left header clamp cylinder, and that the controller is not in its initialization phase.

The third horizontal line represents the third method of turning on the output signal at rung 120 and is comprised of the functions PSLDL (00305), SWRSL (10205), HCLPL (00611) and INALZ (00217). Thus, the output signal which will generate the left station fifth pleat and sew cycle will be generated when there is an output regarding the pleat and sew load function, when the sew only restart push button has been depressed, when there is no output signal to the left header clamp cylinder, and when the controller is not in its initialization function.

The output signal to the left station fifth pleat and sew cycle will be turned off when the conditions in any one of the following three vertical segments of the equation at rung 120 become all untrue. Looking at the first vertical turn off segment which is comprised of the functions PTBKL (10301) NOT and HCPPL (10216) NOT. Thus when these two conditions are untrue there is a sensing that there is a pleat stitch thread break and the header clamps are sensed as being in the pleat-forming position.

The second vertical segment in the turn off portion of rung 120 equation is comprised of the function POS5L (00303) NOT, SCOML (00306) NOT, HCSWL (10211), and PTBKL (10301). Thus when these conditions are untrue, the left pleat and sew station will be in position 5 in terms of the pleat formation, the left sewing cycle will be complete, the left header clamp will not be in the stitch position and there has been no indication that there has been a pleat stitch thread break.

The output signal at rung 120 is also turned off when the functions in the third vertical turn off segment are untrue, the third vertical segment comprising the functions BLOWL (10300) NOT, and HCSWL (10211). Thus the output signal will be turned off when there is an indication that there is a bobbin thread low condition existing at the left pleat and sew station and when the header clamp is not in the stitch position.

Also the signal which allows five pleat and sew operations PSCYL (00304) will be turned off if the left pleat and sew clear signal PSCLL (00200) is generated by depressing the left pleat and sew clear push button.

Time delay 222 which operates at intervals of a tenth of a second for three intervals making a total time delay of 0.3 of a second is generated at rung 121, when the pleat forming is not sensed as being complete as indicated at PFCPL (10210) NOT and when the left pleat and sew header clamps are in their pleat-forming position as indicated at HCPPL (10216). Alternatively, time delay 222 can be generated when there is no sensing that the pleat stitch cycle has been completed as indicated at PSCYL (10213) NOT, when the left header clamp is in the stitch position.

Turning to rung 122, we have the equation which will cause the formation of the output signal to the left pleat-forming motor clutch relay, indicated at PFCML (00617). When this relay is turned on by the output signal, the pleat-forming process will be allowed to proceed at the left pleating station.

The output signal is latched as indicated in the second horizontal line in the turn on segment of the equation shown at rung 122 by the function PFCML (00617) and is latched behind function HCPPL (10216) which stands for the signal indicating that the left header clamps are in their pleat-forming position. Obviously, the output signal which would cause the pleat-forming motor clutch to be energized which would connect the pleat-forming motor to the pleating assembly would not want to be turned on unless the header clamps were in their pleat-forming position. The signal will be turned on, therefore, when the left pleating station has the signal generated which allows five pleat and sew cycles as indicated by the function PSCYL (00304), when there is no indication that the pleating function is complete as required by the function PCOML (00302) NOT and likewise the left pleat and sew assembly cannot have the clear signal present, this function being PSCLL (00200) NOT. In addition, the header clamps cannot be back in their stitch position, thus the function HCBCL (10403) NOT would be true in order to turn on the output signal and, in addition, the left pleat assembly would have to be in a run mode as required by RUNPL (00201).

The output signal to the left pleat forming motor clutch relay would be turned off when the functions in the turn off segment of the equation at rung 122 become not true, those functions being PFCPL (10210), time delay TIM23 (22215) NOT and HCPPL (10216) NOT. Thus, when the header clamps were in the pleat-forming position, and time delay TIM23 (22215) had run out and there was no sensing of a completion of the pleating formation, the output signal to the left pleat-forming motor clutch relay would be turned off.

The output signal to the left pleat-forming motor clutch relay would be cleared when the functions within the second and third clearing portion of this equation become untrue, those functions being PSCML (00616) NOT and SWRSL (10205) NOT. Thus, if there was an output signal to the left pleat stitch motor clutch, or if the sew only restart button was pushed, the left pleat-forming motor clutch relay output signal would be cleared. Also, PSCML (00616) will be cleared by the left pleat and sew clear signal PSCLL (00200) if it is present.

A rung 123 is the equation which causes the function PCOML (00302) to be turned on, thus indicating that the left pleat station pleat is complete. This function is latched again at the bottom horizontal line in the turn on segment of the equation at rung 123 through the function PCOML (00302).

This left station pleat complete function is turned on when the left pleat-forming motion is sensed as not being complete and when there is no output signal provided to initiate the leat-forming motor clutch, these being indicated as functions PFCPL (10210) NOT and PFCML (00617) NOT, respectively. The switch which activates the pleat-forming motor is controlled by a cam and is turned on during the cycle and off when the cycle is complete. Thus, when no signal is sensed, the cycle will be complete.

Alternatively, the output signal to the left station pleat complete function is turned on when there is an output to the left station pleat and sew load function indicated at PSLDL (00305) and when the sew only restart push button has been depressed as indicated at function SWRSL (10205).

The output signal to the left station pleat complete function PCOML (00302) is turned off when the functions HCSWL (10211) NOT or PSCLL (00200) NOT become untrue or when the header clamp is sensed as being in the stitch position and when the left pleat and sew station is cleared.

The storage G STORG (00107) function is generated by the equation shown at rung 124 and is used in the equation shown at rung 125, specifically that portion of the equation which turns off the signal generated by the equation at rung 125.

The equation shown at rung 125 produces the output signal to the left header clamp transfer cylinder indicated as function HCTRL (00612). This function is latched to two functions, the latching function being shown in the third horizontal line in the turn on segment of the equation shown at rung 125 as HCTRL (00612). The output signal is latched both to the function HCLPL (00611) NOT or the function indicating that the left header clamp cylinder output signal is not being generated and HCPPL (10216) indicating that the header clamp is in pleat-forming position. Thus, as long as there is no output signal to the left header clamp cylinder or the left header clamp is in the pleat-forming position, the output signal to the left header clamp transfer cylinder will remain on once it is generated.

The turning on of the output signal at rung 125 is accomplished by one of two methods, the first involving the top horizontal line in the turn on segment of rung 125, the second involving the second horizontal line.

Discussing the first horizontal line, the header clamp must be in the pleat-forming position as indicated at HCPPL (10216) or the left header clamp must be closed as indicated by HCLPL (00611) NOT, there cannot be any sensing that the left pleat and sew station is ready to receive a panel, the pleat-forming motion must be sensed as being complete as required by the function PFCPL (10210), the left thread-cut sensor must be energized, that function being TCUTL (10401), the left pleat and sew header clamp cannot be sensed as being locked or engaged to the carriage, this function being HLOCL (10212) NOT, the sew must be completed, indicated at SCOML (00306) and the left pleat and sew station must be in the run mode as required by the function RUNPL (00201).

The second method by which the output signal can be turned on at rung 125 is if the left header clamp output signal is not being generated, that function being HCLPL (00611) NOT, or the header clamp must be in the pleat-forming position as indicated by input HCPPL (10216), the left pleat and sew clear push button must have been depressed or the station is being initialized as required by the function PSCLL (00200) and again the left pleat and sew station header clamp cannot be sensed as being engaged or locked to the carriage, that function being HLOCL (10212) NOT.

The output signal at rung 125 will be turned off when the conditions shown in the second vertical group are untrue, those conditions being PFCPL (10210) NOT, HCPPL (10216) NOT, HCLPL (00611), and STORG (00107), this latter function being the function controlled by the equation shown at rung 124.

Therefore, when the pleat-forming motion is sensed as being complete, when the left header clamps are in pleat-forming position, the left header clamp cylinder output signal should be off, the left station pleat complete output signal must be generated, as required by the function in rung 124 as PCOML (00302) NOT, the left station five pleat and sew cycle must be on or PSCYL (00304) NOT the output signal to the left pleat stitch motor clutch relay must be off or PSCML (00616), the left pleat and sew station must be a run mode indicated at RUNPL (00201) NOT, and the left pleat and sew header clamp will not be sensed as being engaged or locked to the carriage, this being indicated at HLOCL (10212). As long as all of these functions are true, the output signal for the left header clamp transfer signal as controlled by the equation at rung 124 will be turned on and when these conditions are untrue as discussed above, the output signal at rung 124 will be turned off.

Turning now to rung 126, the time delay function TIm25 (22515) or one-tenth of a second is turned on when the sew complete output signal is generated, indicated at SCOML (00306) and when left pleat and sew pleat cycle is sensed as being complete indicated as PSCYL (10213).

Rung 127 causes the output signal to be applied to the left header clamp to carriage lock cylinder indicated as function HCCLL (00613). This function is latched on by the function HCCLL (00613) in the left-hand side of the equation and in the second horizontal line of the turn on segment of the equation at rung 127.

The output signal to the left header clamp to carriage lock cylinder is turned on when the left header clamp is sensed as being in the stitch position, when there is no indication that the sewing is complete, when the left pleat and sew assembly is in its five pleat and sew cycle and when the left pleat and sew station is in a run mode, these functions being indicated by or at HSCWL (10211), SCOML (00306) NOT, PSCYL (00304) and RUNPL (00201), respectively.

The output signal generated at rung 127 is turned off when the following functions are untrue. Time delay TIM25 (22515) NOT, HCSWL (10211) NOT, and RUNPL (00201) NOT. Thus, when time delay TIM25 (22515) has run, when the header clamp is in the stitch position, and when the left pleat and sew station is in its run mode, the output signal at rung 127 will be turned off.

The output signal at rung 127 to the left header to the carriage lock cylinder will also be cleared when the functions PSCLL (00200) NOT and PSCYL (10213) NOT are untrue, or when the left pleat and sew station clear signal is present, and when there is a sensing that the pleat stitch cycle is complete.

The output signal for the left station sew complete function indicated at SCOML (00306) is generated at rung 128 and this function is again latched in the usual sense by the function SCOML (00306) in the second horizontal line in the turn on segment of the equation at rung 128.

The output signal at rung 128 is turned on when the functions PSCYL (10213) NOT and PSCML (00616) NOT are true or when there is no sensing that the pleat stitch cycle is complete and there is no output signal to the left pleat stitch motor clutch relay.

The left station sew complete function will be turned off when the function HCPPL (10216) NOT is not true, or when the header clamp is sensed as being in the pleat-forming position.

The output signal generated at rung 129 for the left pleat stitch motor clutch relay indicated at PSCML (00616) will be generated as follows. The left pleat and sew header clamp will be back in the stitch position, the header clamp carriage lock will be sensed as being engaged, the left station will be in the five pleat and sew cycle, there will be no sensing that there is a thread cut in the left station, there will be no indication that the sewing cycle is complete, the left pleat and sew clear signal will not be present, and the left pleat and sew station will be in the run mode. These functions are set forth in the first horizontal line of the turn on segment of the equation at rung 129 and are indicated as follows: HCBCL (10403), HLOCL (10212), PSCYL (00304), TCUTL (10401) NOT, SCOML (00306) NOT, PSCLL (00200) NOT, and RUNPL (00201).

The output signal for the left pleat stitch motor clutch relay will be turned off when the functions PSCYL (10213), time delay TIM22 (22215) NOT and HCSWL (10211) NOT are untrue, or when there is no sensing that the pleat stitch cycle is complete when the time delay TIM22 (2215) of 0.1 of a second has run out, and when the left header clamp is sensed as being in the stitch position.

Further, the output signal to the left pleat stitch motor clutch relay will be cleared when the function PFCML (00617) NOT is untrue, or when there is an output signal applied to the left pleat-forming motor clutch relay. The output signal to the left pleat stitch motor clutch relay would have to be turned off or cleared if the motor and clutch operating the pleat-forming assembly were turned on, and thus this clearing function assures that the motors respectively operating the pleating and stitching assemblies will not be simultaneously engaged.

Rung 130 serves to generate the output signal for the left bobbin thread low indicator lamp indicated at BOBLL (00605). This output signal is also latched by the functions BOBLL (00605) shown in the left-hand side of the equation at rung 130. This output signal will be generated when there is an indication that the bobbin is low of thread in the left station, this function indicated as BLOWL (10300) and when the header clamp is not sensed as being in the stich position indicated at HCSWL (10211) NOT.

The output signal to the left bobbin thread low indicator lamp will be turned off when the function BRSTL (10203) NOT is not true or when the bobbin low reset push button is pushed. Thus, the indicator lamp would be turned off when the bobbin low reset push button was depressed.

At rung 131 we have the equation which will turn on the function POS5L (00303) indicating that the left station is at the position 5 or at the fifth pleat position. This function is latched again in the left-hand portion of the equation at the third horizontal line by the function POS5L (00303). The function at rung 131 is turned on either when the left pleat and sew header clamp is sensed as being in position 5 or when the left pleat and sew clear push button is depressed, these functions being PP5LF (10215) and PSCLL (10206), respectively.

The function POS5L (00303) will be turned off when the function HCLRL (00615) NOT is untrue or when the left header clamp return cylinder output signal is on.

The function PRTLL (00414) is turned on at the equation at rung 132 and is latched again in the normal sense by the function PRTLL (00414) shown in the left-hand side of the equation and specifically in the second horizontal line in the turn on portion. The function PRTLL (00414) is turned on when the header clamp is sensed as being in the fourth position and specifically when the fourth pleat is being initially formed, this function indicated as PP4FL (10214).

When the left pleat and sew station is indicated as being empty or when the function EMTYL (00413) NOT is untrue, the function generated at rung 132 will be turned off.

Turning now to rung 133, the output signal to the left header clamp return cylinder indicated at HCLRL (00615) is generated in one of two methods, the first comprising the functions HCLPL (00611), PNLEL (10217) and RUNPL (00201), the second comprising PSCLL (00200) and HCPPL (10216) which respectively appear in the first and second horizontal lines in the turn on segment of the equation shown at rung 133. The output cylinder again is latched by the function HCLRL (00615) shown in the third horizontal line in that turn on segment. Thus, referring again to the first horizontal line, the output signal at rung 133 will be turned on, when the left header clamp output signal is on, when the ejection of the panel at the left pleat and sew station is sensed and when the pleat and sew left station is in a run mode. Alternatively, the second way the output signal to the left header clamp return cylinder can be generated, is when the left pleat and sew clear signal has been generated and when the header clamps are sensed as being in the pleat-forming position.

The output signal for the left header clamp return cylinder is turned off when the functions PSCYL (00304) NOT and RUNPL (00201) NOT are untrue or when the left station is in the five pleat and sew cycle and the left pleat and sew station is in a run mode.

At rung 134, the output signal for the left station pleat and sew load function indicated at PSLDL (00305) is generated and is latched by the function PSLDL (00305) which is in the second horizontal line of the turn on segment of the equation shown at rung 134.

This output signal is turned on when the overhead transfer unit is indicated as being in its left ready position, OTULR (10106), when the overhead transfer unit is at its home position in a lateral direction indicated at CSCLR (10105) and when the output signal is applied to the pick-up clamps indicated at PICUP (00515). Thus, the left pleat and sew station will be indicated as being in a load condition when the overhead transfer unit is in the left ready position and also in a home position from a lateral or axial standpoint so that it is not either in motion toward or away from either the loop or corner sewing assemblies and the pick-up clamp cylinder is energized.

The output signal for the left pleat and sew load function will be turned off when the functions POS5L (00303) NOT, SCOML (00306) NOT, PTBKL (10301) and HCSWL (10211) are untrue or when the left station is indicated as being at the fifth position, the sewing cycle is complete, there is no indication that there is a thread break and the left header clamps are not in a stitch position.

Further, the output sgnal generated at run 134 will be cleared when the function PSCLL (00200) NOT is untrue or when the left pleat and sew clear signal is generated by the pleat and sew left clear push button being depressed or the station is being initialized.

At rung 135, we have the equation that will cause the function RUNPL (00201) referring to the run mode for the left pleat and sew station to be turned on. There are four different ways that this can occur, the first involving the function CONT (10001) indicating that the continue push button is depressed, INALZ (00217) NOT indicating that the controller is not in the initialization phase, NORJG (10112) NOT indicating that the normal switch is not in its jog position and HOLSD (10000) NOT indicating that the hold push button is not depressed.

The second involves the functions STRUN (10016) indicating that the start/run push button is depressed and again that the normal switch is not in its jog position and that the hold push button is not depressed indicated by the functions NORJG (10112) NOT and HOLD (10000) NOT, respectively.

The third method of turning on the function at rung 135 involves the functions RUNPL (00201), indicating that the left pleat and sew station is in its run mode, and where the normal switch is not in its jog position and there is no holding indication as would result from the actuation from the hold push button as was the case with the first two methods.

The run pleat and sew mode would also be energized in a stepped sequence function as would occur when the controller was in its jog function condition, and thus the fourth method of turning on this function would involve the placing of the normal switch in its jog position and having the jog function arrive at this point, these functions being indicated respectively in the fourth horizontal line as NORJG (10112) and JOG (00211).

At rung 136, we have the equation which will turn on the function PSCLL (00200) indicating that the left pleat and sew clear function, used to take the station to an initialized condition, has been generated.

This function is latched by the function PSCLL (00200) in the third horizontal line of the turn on segment of the equation shown at rung 136. This function is turned on when the pleat and sew clear push button is depressed indicated at PSCLL (10206), when the pleat-forming motion is sensed as being complete indicated at PFCPL (10210), and when the pleat stitch cycle is sensed as being complete indicated at PSCYL (10213). Likewise, this function can be turned on when the controller is in its initialization phase indicated in the second horizontal line in the turn on segment as function INALZ (00217).

This function will be turned off when the left pleat and sew station is indicated as being empty or when the function EMTYL (00413) NOT is untrue.

At rung 137, the complement left header clamp transfer output signal is energized when the left header clamp transfer cylinder is in its NOT condition as required by the functon HCTRL (00612).

Rung 138 causes the complement of the left header clap to carriage lock output signal being created indicated at CMY34 (00701) and this function is caused to turn on when the function HCCLL (00613) NOT is true, indicating that the left header clamp is not locked to the carriage.

At rung 139, time delay TIM14 (21415) for two 0.1-second intervals or a total elapsed time of two-tenths of a second is energized when the left header clamp cylinder output signal is energized indicated by the function HCLPL (00611).

At rung 140, we have the equation which will cause the left panel eject arm raise cylinder output signal to be generated indicated at PNEJL (00614). This output signal is also latched as indicated by the function PNEJL (00614) as shown in the second horizontal line of the turn on segment of this equation.

This output signal at rung 140 is turned on when the left pleat and sew header clamp is indicated as being in position 5, that function being PP5LF (10215), when the left pleat and sew station is in a run mode indicated at RUNPl (00201), when time delay TIM14 (21415) has timed out and when there is no indication that the left pleat and sew clear signal is present, that function being PSCLL (00200) NOT.

The output signal at rung is turned off when the function ARMUL (10407) NOT is untrue or when the left pleat and sew panel is sensed as having the ejection arm in an up mode.

Rung 141 has counter 2 CTR2 (232) that totalizes the number of thread breaks that occur during an eight-hour shift. It has as its input THBKL (00000) from rung 148.

Rung 142 is the reset for counter 2 CTR2 (232) when KEYSW (10417) is energized by the shift supervisor. Counter 2 CTR2 (232) is reset to zero.

Rung 143 has counter 1 CTR1 (231) that totalizes the number of bobbins replaced in the left pleat and sew sewing machine during an eight-hour shift. The input to this counter is bobbin low left output signal. Every time it is energized, counter 1 CTR1 (231) counts once.

Rung 144 is the reset for counter 1 CTR1 (231). When KEYSW (10417) is activated by the shift supervisor, counter 1 CTR1 (231) is reset to zero.

Rung 145 has counter 7 CTR7 (237) for its output. The input signal is panel eject left PNLEL (10217) which causes the counter to record the number of panels sewn on the left pleat and sew station.

Rung 146 is the reset for counter 7 CTR7 (237). After reading and recording the total panels sewn on the left pleat and sew station, the shift supervisor inserts a key in the key switch and turns it to activate KEYSW (10417) and reset counter 7 CTR7 (237) to zero.

Rung 147 is the counter output display. The circuit is called up by the shift supervisor on the screen of the counter and from it he can record vital management information. Counter 1 CTR1 (231) tells the number of bobbins replaced on the left pleat and sew station, counter 2 CTR2 (232) tells the number of thread breaks on the left pleat and sew station, counter 3 CTR3 (233) gives the number of bobbins replaced, and counter 4 CTR4 (234) gives the number of thread breaks on the corner sew station. Counter 5 CTR5 (235) gives the number of bobbins replaced and counter 6 CTR6 (236) gives the number of thread breaks on the right pleat and sew station. Counter 7 CTR7 (237) gives the number of panels sewn on the left pleat and sew station, and counter 8 CTR8 (240) gives the number of panels sewn on the right pleat and sew station. Counter 9 CTR9 (241) totals the number of times the corner sew machines are operated. This information is used to determine when to replace the corner sew bobbins.

At rung 148 we have the equation for the output thread break left THBKL (00000). The turn on portion has the thread break sensor for an input PTBKL (10301) and the latch THBKL (00000) is across the input. The output will be turned off if any one of three signals becomes false. The three signals are pleat form restart PSRTL (10204) NOT, sew only restart SWRSL (10205) NOT, and left pleat and sew clear PSCLL (00200) NOT. Thus, if left pleat form restart PSRTL (10204) push button or left sew only restart SWRSL (10205) push button is depressed, latch THBKL (00000) will be turned off or if the left pleat and sew clear signal is generated by depressing the left pleat and sew clear push button, latch THBKL will be turned off.

Rung 149 has timer TIM21 (221) as an output. This timer is different from any other timer used on the pleating machine. When it is started by the start switch START (10017), its output 22115 is high until a preset time has expired and then its output 22115 goes low. It is preset to 45 seconds. If, after it has been started, start push button is depressed, its time count will go to zero and it will again go for 45 seconds.

Rung 150 has as its output running time signal and timer TIM21 (221) as its input. As long as the start switch is activated continuously and with less than 45 seconds elapsing between starts, running time output stays on and drives a running time meter. This provides an indication of how much time is actually machine running time.

Rung 151 has as its outpt store K STORK (00112) and as its inputs four signals in parallel. The inputs are thread break left pleat and sew THBKL (00000), bobbin low left pleat and sew BOBLL (00605), thread break corner sew TBKCS (00001), and bobbin low corner sew CSBLO (00002). If any one of these signals becomes true, STORK (00112) will be turned on.

Rung 152 has store L STORL (00113) as its output and as it inputs two signals in parallel. The inputs are thread break right pleat and sew THBKR (00005) and bobbin low right pleat and sew BOBLR (00610). If either one of the inputs goes on, STORL (00113) will be turned on.

Rung 153 uses the outputs from rungs 151 and 152 as inputs to a timer TIM45 (245). It is preset for time delay contacts to close after 1.5 seconds. If either STORK (00112) or STORL (00113) come on, TIM45 (245) will be energized.

Rung 154 also has STORK (00112) and STORL (00113) as parallel inputs to turn on output attention ATTEN (00717). ATTEN (00717) provides 115 VAC to a bell that rings to let the machine operators know that there has been a thread break or bobbin run-out on one station of the machine. The turn off for ATTEN (00717) is when TIM45 (245) times out 1.5 seconds later and causes TIM45 (245) not to become false.

While the foregoing illustrates and describes what is now contemplated to be the best mode of carrying out the invention, the same is, of course, subject to modification without departing from the spirit and scope of the invention.

What is claimed is:

1. A method of making finished drapes from blank drapery panels in a pleating machine of a type having a loading assembly, a loop forming assembly, an overhead transfer assembly, a corner sewing station and at least one pleat forming and pleat sewing station wherein the loading assembly, loop forming assembly, overhead transfer assembly and pleating/sewing station each have clamping portions comprised of a plurality of spaced apart clamps, said method comprising the steps of:

loading the drapery panel in the loading assembly of the pleating machine;

forming a header portion in said drapery panel;

sensing the width of the drapery panel to determine pleat spacing;

transferring said drapery panel to a loop forming assembly;

forming loops in the header portion of the drapery panel, said loops being uniformly spaced across said drapery panel according to the sensed drapery panel width;

advancing said drapery panel to the corner sewing station and sewing the corners of the header portion;

thereafter advancing said drapery panel to a pleating station;

successively forming pleats in each of said loops and after each pleat is formed advancing that formed pleat and said drapery panel into a pleat sewing station and sewing that formed pleat, and ejecting said drapery panel after the pleat in the last loop is formed and sewn.

2. The process as claimed in claim 1 wherein the drapery panel is clamped along its full width by a clamping portion of the loading assembly and the header is formed by rotating the clamping portion of the loading assembly.

3. The process as claimed in claim 2 wherein the clamping portion of the loading assembly is rotated 180°.

4. The process as claimed in claim 3, including the further step of clamping each side of the header portion and thereafter moving the side clamps apart so as to stretch the header portion to its full width.

5. The process as claimed in claim 1 wherein the transferring of the drapery panel to the loop form assembly includes the steps of advancing the loading assembly toward the loop forming assembly until the header portion is positioned directly over the loop forming assembly, moving loop clamps to a clamping position, said loop clamps clamping position being determined by said sensed drapery panel width, clamping the header portion of said drapery panel with said loop clamps, releasing the loading clamps and returning the loading assembly to its initial position.

6. The process as claimed in claim 5 including the further step of raising a roller into position beneath the body portion of the drapery panel as the loading assembly is returned to its initial position and rotating said roller in order to move the body portion of the drapery panel between the loading assembly and loop forming assembly.

7. A process as claimed in claim 1 wherein the loop forming includes the steps of contracting the loop clamps in which the drapery panel is retained to a central position on the loop forming assembly so as to cause the header portion held between loop clamps to be compressed and raising loop blades from an initial position beneath the header portion at each location where the header portion is being compressed to a fully extended position so as to assist in forming each part of the header portion being compressed between loop clamps into upright loops.

8. The process as claimed in claim 7 wherein each of the upright loops is formed as a single loop.

9. The process as claimed in claim 1 wherein the transferring of the drapery panel to the corner sewing station includes the steps of: advancing the overhead pick-up assembly from an initial position forwardly toward the loop forming assembly until the clamping portion of the overhead transfer assembly is positioned directly over the previously formed loops, closing the overhead transfer clamps, releasing the loop clamps and lowering the loop blades to their initial position so that the drapery panel and the loops are retained by the overhead transfer clamps, moving the overhead transfer assembly rearwardly through said initial position toward the corner sewing station until the overhead transfer assembly is positioned in a corner sewing position.

10. The process as claimed in claim 9 wherein the transfer of the drapery panel to the corner sewing station includes the further step of guiding each outer corner of the header portion as the overhead transfer assembly moves into the corner sewing position so that each corner portion of the header hangs in a vertical position and extends below the bottom of the overhead transfer clamps.

11. The process as claimed in claim 10 wherein the sewing of the corners of the header portion includes the steps of locking the overhead transfer assembly in the corner sewing position, clamping each outer corner with corner sew clamps and sewing each outer corner by passing each header corner back and forth through a sewing machine so as to form a line of stitches along each corner of the header portion.

12. The process as claimed in claim 11 wherein a sewing machine is provided for each corner being sewn and wherein the line of stitches is formed by moving the overhead transfer assembly with respect to the sewing machines.

13. The process as claimed in claim 12 where the overhead transfer assembly is moved in a slow fast slow pattern.

14. The process as claimed in claim 12 wherein each corner is simultaneously sewn.

15. The process as claimed in claim 12 including the further step of positioning the sewing machine needles at the end of the sewing cycle so that the needles have been withdrawn out of the drapery panel.

16. The process as claimed in claim 15 including the further steps of cutting the thread following the completion of the sewing cycle, opening the corner sew clamps, unlocking the overhead transfer assembly and returning the overhead transfer assembly to its initial position.

17. The process as claimed in claim 1 wherein the advancing of the drapery panel to a pleating station includes the steps of sensing that a pleating station is empty and ready to receive a looped drapery panel, moving the overhead transfer assembly to the empty pleating station in response to the sensing of the empty pleating station and transferring control of the looped drapery panel from the overhead transfer assembly to the pleating station.

18. The process as claimed in claim 17 wherein the transferring of control of the looped drapery panel includes the further steps of stopping the overhead transfer assembly so that the overhead transfer assembly is axially aligned with the pleating station, advancing the overhead transfer assembly toward the pleating station until the overhead transfer assembly is positioned directly over the pleating station clamping portion, closing the pleating station clamps and opening the overhead transfer clamps so that the looped drapery panel is retained by the pleating station clamps with each loop being positioned between two of said pleating station clamps and returning the overhead transfer assembly to its initial position.

19. The process as claimed in claim 1 wherein the forming of pleats includes the steps of moving a lower pleat forming assembly from an initial retracted position below the pleating station clamps upwardly between two of said pleating station clamps into a first loop positioned between first and second clamps of said pleating station clamps, moving an upper pleat forming assembly from an initial retracted position above said loops downwardly until said upper and lower pleat forming assemblies meet so as to form a pleat within said first loop, securing said pleat in its formed condition, retracting said upper and lower pleat forming assemblies to their initial positions, indexing the carriage on which the pleating station clamps are slidably mounted while maintaining the pleat in a secured condition so that the pleat is positioned under a pleat clamp also mounted on the carriage and so that said upper and lower pleat forming assemblies are aligned with the next loop and clamping the pleat with said pleat clamp.

20. The process as claimed in claim 19 wherein the securing of the pleat includes the steps of moving holding pins from an initial retracted position past said pleat clamp until the holding pins become inserted into the formed pleat.

21. The process as claimed in claim 20 wherein the forming of the pleats includes the further steps of indexing the holding pins in along with said pleating station clamps and withdrawing the holding pins from the pleat to their initial position after the pleat has been clamped.

22. The process as claimed in claim 21 further including the step of clearing previously formed pleats from the path in which said holding pins are moved.

23. The process as claimed in claim 19 wherein the sewing of the pleat includes the steps of moving the carriages from their initial pleat forming position rearwardly until the clamped pleat is in a pleat sewing position, locking the pleating station clamps and the pleat clamp in the pleat sewing position and sewing the clamped pleat by passing the clamped pleat back and forth through a sewing machine so as to form a predetermined line of stitches along the length of the clamped pleat.

24. The process as claimed in claim 23 wherein the clamped pleat is moved through the sewing machine by moving the pleating station clamps and the pleat clamp with respect to the sewing machine.

25. The process as claimed in claim 24 wherein the pleating station clamp and pleat clamp is moved so as to form a line of stitches in the shape of an F.

26. The process as claimed in claim 25 wherein the pleating station clamp and pleat clamp are moved to a cycloidal motion so as to effect a smooth acceleration and deceleration without excessive vibration whereby the line of stitches are uniformly made.

27. The process as claimed in claim 25 further including the steps of unlocking the pleating station clamps and the pleat clamp from the pleat sewing position and retracting the pleating station clamps together with the pleat clamp to their initial pleat forming position.

28. The process as claimed in claim 27 including the further steps of pleating and sewing successive loops until all loops within the drapery panel have been pleated and sewn.

29. The process as claimed in claim 23 wherein the passing of the clamped pleat back and forth through a sewing machine is accomplished by moving the carriage back and forth past the sewing machine needle.

30. The process as claimed in claim 29 wherein the movement of the carriage is stopped for every stitch and is in motion only while the sewing machine needle is withdrawn from the pleat being sewn.

31. The process as claimed in claim 30 wherein the moving of the carriage includes the steps of rotating a cam against a driver located on the carriage wherein the cam is rotated at a speed one sixty-fourth the speed of the sewing machine needle so that a single revolution of the carriage cam will allow the placement of sixty-four individual stitches in the pleat being sewn.

32. The process as claimed in claim 23 wherein the passing of the clamped pleat back and forth through a sewing machine is accomplished by moving the carriage in discrete increments past the sewing machine needle and stopping the movement of the header just prior to the entry of the needle into the clamped pleat being sewn.

33. The process as claimed in claim 33 wherein the sewing of the pleat includes the additional steps of placing the thread used to form the line of stitches in the clamped pleat being sewn in a thread cutter assembly and cutting the thread after the needle has been withdrawn from the pleat and the stitch cycle is complete.

34. The process as claimed in claim 33 wherein the step of cutting the pleat sewing thread involves the additional steps of moving the thread cutter toward the bobbin thread between the sewing of the next to the last and last stitch in the sew cycle, stopping movement of the cutter just prior to the forming of the last stitch in the sew cycle, continuing movement of the cutter following completion of the last stitch in the sew cycle until the cutter completely engages the thread, cutting the thread and returning the cutter to its initial position.

35. The process as claimed in claim 1 wherein the ejecting of the drapery panel after the last pleat in the drapery panel is sewn includes the steps of placing the drapery panel as the pleats are formed and sewn in a large open clamp positioned adjacent the pleat and sew station, closing the large ejection clamp at the conclusion of the pleat and sew cycle, opening the pleating station clamps so that the panel is retained in the large ejection clamp and moving the large ejection clamp away from the machine to a predetermined panel pick-up position.

36. A method of forming a completed drape from a blank drapery panel blank in a pleating machine comprising the steps of:

loading the drapery panel blank in the pleating machine;

forming a header portion in said panel blank;

sensing the width of the drapery panel blank and forming loops in the header portion, said loops being spaced uniformly across the width of the drapery panel blank;

sewing the corners of the header portion;

successively making and sewing pleats in each of the previously formed loops, and ejecting the drapery panel as a completed drape after the pleat formed in the last loop is sewn.

37. A method of handling a drapery panel in a pleating machine during the formation of regularly spaced pleats in said panel comprising the steps of:

securing the top edge of the drapery panel at a loading station, forming a header portion in said panel, advancing said panel from said loading station to a loop forming station and securing the panel in said loop forming station, forming a plurality of regularly spaced loops along the length of the header portion of said panel, retaining said panel in its looped condition in transfer means and advancing said panel to a corner sewing station, sewing both corners of said header portion, thereafter advancing said panel still in its looped condition to a pleating station and securing said panel in said pleating station successively forming and sewing pleats within each of said loops and ejecting said panel after the last desired pleat is sewn.

38. A method of continuously forming finished drapes from blank drapery panels in a pleating machine of a type having a loading assembly, a loop forming assembly, an overhead transfer assembly, a corner sewing station and a plurality of pleat forming and pleat sewing stations, said method comprising the steps of:

loading a first drapery panel in the loading assembly of the pleating machine, forming a header portion in said first drapery panel, sensing the width of the first drapery panel to determine the pleat spacing for the first drapery panel, transferring said first drapery panel to the loop forming assembly, forming loops in the header portion of the first drapery panel, said loops being uniformly spaced across the first drapery panel according to the sensed width of said first drapery panel, loading a second drapery panel into the loading assembly of the pleating machine and while forming the header portion on said second drapery panel and sensing the width of said second drapery panel advancing said first drapery panel to the corner sewing station and sewing the corners of the header portion of the first drapery panel while advancing said first drapery panel to one of said pleating stations transferring said second drapery panel to the loop forming assembly and forming loops in the header portion of the second drapery panel so that such loops are being uniformly spaced across the second drapery panel according to the sensed width of said second drapery panel, while successively forming pleats in each of said loops of said first panel and after each loop is formed advancing that formed pleat in said first drapery panel into the pleat sewing station and sewing that formed pleat, loading a third drapery panel in the loading assembly of the pleating machine, and while forming a header portion in the third drapery panel and sensing the width of the third drapery panel advancing the second drapery panel to a corner sewing station and sewing the corners of the header portion of the second drapery panel, while advancing said second drapery panel to another pleating station forming loops in the header portion of the third drapery panel such loops being uniformly spaced across said third drapery panel according to the sensed width of said third drapery panel, ejecting said first drapery panel after the pleat in the last loop is formed and sewn and thereafter while advancing said third drapery panel to a pleating station loading a fourth drapery panel in the loading assembly of the pleating machine, and continuously repeating these sequential steps while blank drapery panels are being loaded into the pleating machine.

39. A method for successively making pleated drapes from drapery panels which are placed in a pleating machine in a sequential fashion wherein the pleating machine is of a type having a loading station, a loop forming station, a transfer assembly, a corner sew station, a pleat forming station, a pleat sewing station and an ejection assembly, said method comprising the steps of:

securing a first drapery panel at a loading station;

sensing the width of said first panel to determine the spacing of pleats to be formed therein;

forming a header portion along the top edge of said first panel;

transferring said first panel from the loading station to the loop forming station and securing said first panel in said loop forming station;

simultaneously forming a plurality of loops along the length of the just formed header portion, said loops being uniformly spaced along said header portion according to the sensed width;

transferring said first panel from said loop forming station to the overhead transfer assembly so that said first panel is retained in said overhead transfer assembly;

advancing said overhead transfer means to a first sewing station and sewing the corners of said header portion in said first panel;

securing a second drapery panel in said loading station and sensing the width of said second panel to determine the spacing of pleats to be formed therein;

forming a header portion along the top edge of said second panel;

advancing said overhead transfer assembly to a first pleating station and transferring said first panel from the overhead transfer assembly to said first pleating station and securing said first panel in said first pleating station;

returning the overhead transfer assembly to its initial position and begin pleat;

transferring said second panel from said loading station to the loop forming station and securing said second panel in said loop forming station and simultaneously forming a plurality of loops along the length of the just formed header portion, said loops being uniformly spaced along said header portion according to the sensed width of the second panel;

successively forming pleats in each of the loops previously formed in said first panel and after each loop is formed advancing that formed pleat and said first panel into a first pleat sewing station and sewing that formed pleat;

advancing the overhead transfer assembly forward so that it is positioned over the loop forming station, and transferring said second panel from said loop forming station to said overhead transfer assembly so that said second panel is retained in said overhead transfer assembly;

advancing said overhead transfer means to said first sewing station and sewing the corners of said header portion in said second panel;

securing a third drapery panel in said loading station;

sensing the width of said third panel to determine the spacing of pleats to be formed therein;

forming a header portion along the top edge of said third panel;

advancing said overhead transfer assembly to a second pleating station and transferring said second panel from the overhead transfer assembly to said second pleating station and securing said second panel in said second pleating station;

returning the overhead transfer assembly to its initial position and begin pleat;

transferring said third panel from said loading station to said loop forming station and securing said third panel in said loop forming station and simultaneously forming a plurality of loops along the length of the just formed header portion, said loops being uniformly spaced along said header portion according to the sensed width of the third panel;

successively forming pleats in each of the loops previously formed in said second panel and after each loop is formed advancing that formed pleat and said second panel into a second pleat sewing station and sewing that formed pleat;

advancing the overhead transfer assembly forward so that it is positioned over the loop forming station and transferring said third panel from said loop forming means to said overhead transfer assembly so that said third panel is retained in the overhead transfer assembly; advancing said overhead transfer assembly to said first sewing station and sewing the corners of said header portion in said third panel, moving said overhead transfer assembly to its initial position while retaining said third panel and holding said overhead transfer assembly in the initial position until a pleating station is ready to receive a looped drapery panel;

securing a fourth drapery panel in said loading station;

sensing the width of said fourth panel to determine the spacing of pleats to be formed therein;

forming a header portion along the top edge of said fourth panel;

ejecting said first panel after the last pleat has been sewn from said first pleating station;

thereafter, advancing said overhead transfer assembly to said first pleating station and transferring said third panel from the overhead transfer assembly to said first pleating station and securing said third panel in said first pleating station;

returning the overhead transfer assembly to its initial position and begin pleat;

transferring said fourth panel from said loading station to said loop forming station and securing said fourth panel in said loop forming station and simultaneously forming a plurality of loops along the length of the just formed header portion, said loops being uniformly spaced along said header portion according to the sensed width of the fourth pleat;

successively forming pleats in each of the loops previously formed in said third panel and after each loop is formed advancing that formed pleat and said third panel into a first pleat sewing station and sewing that formed pleat; and, repeating the above sequence of steps for additional drapery panels so that completed drapes are made in a continuous fashion.

40. A method of forming a finished drape from a drapery panel placed in a pleating machine comprising the following steps:

simultaneously forming a plurality of loops in the header portion of said panel;

advancing said panel to a corner sewing station;

sewing both corners of said header portion;

advancing said panel to a pleating station; and, successively forming and sewing pleats within each of said plurality of loops.

41. A method of forming a drape from a drapery panel placed in a pleating machine comprising the following steps:

automatically sensing the width of each drapery panel inserted into the pleating machine and simultaneously forming a plurality of loops equally spaced across the top portion of each panel in response to the sensing of the width of each panel; and thereafter forming and securing pleats within each of said plurality of loops.

42. A method as in claim 41 including the additional step of forming a header in the top portion of the drapery panel prior to simultaneously forming the plurality of loops therein.

43. A method of forming drapes from drapery panel blanks successively loaded onto an automatic pleating machine comprising the steps of feeding and securing the full width of one end of a first panel blank in the machine, simultaneously forming uniformly spaced loops across the fed end of the panel blank and thereafter successively forming and securing pleats in each of the previously formed loops in the first panel blank while simultaneously feeding and securing another panel in the pleating machine.

44. A method of forming a completed drape from a drapery panel blank in a pleating machine comprising the steps of:

simultaneously loading the drapery panel blank in the pleating machine and automatically sensing the width of the blank;

forming a header portion in said panel blank;

forming loops in the header portion, said loops being spaced uniformly across the width of the drapery panel blank;

forming and securing pleats in each of the previously formed loops, and automatically ejecting the drapery panel.

45. A method as in claim 44 wherein the full width of the panel blank is loaded into the pleating machine.

46. A method of automatically handling a drapery panel in a pleating machine during the formation of regularly spaced pleats across the width of the drapery panel comprising the steps of:

securing the top edge of the drapery panel at a loading station and producing an output signal corresponding to the width of the drapery panel, advancing the drapery panel from said loading station to a loop forming station and securing the top portion of the drapery panel in said loop forming station, forming a plurality of regularly spaced loops along the length of the top portion in response to the previously generated output signal, advancing the drapery panel to a pleating station while retaining the looped condition of the panel, securing said panel in said pleating station and thereafter successively forming and securing pleats within each of the loops, and ejecting the drapery panel after the last desired pleat is formed and secured.

47. A method as in claim 46 including the further step of forming a header in the top portion of the panel blank prior to forming the plurality of loops in the top portion.

48. A method as in claim 47 wherein the step of forming the header is completed prior to advancing the panel blank from the loading station to the loop forming station.

49. A method as in claim 46 wherein the plurality of loops are simultaneously formed along the length of the top portion.

50. A method as in claim 46 including the additional step of securing the top edge of another drapery panel in the loading station as pleats are formed in the loops of the first drapery panel at the pleating station.

51. A method as in claim 46 including the additional step of sewing the corners of the top portion after loops are formed therein.

52. A method of automatically forming loops equally spaced across the width of a drapery panel with movable loop forming means comprising the steps of inserting the top portion of the panel into the loading area of a drapery machine and simultaneously sensing the width of the top portion, moving the loop forming means from a closed position to an open position in response to the sensing of the width, transferring the top portion of the panel to the looping means and returning the looping means to the closed position while simultaneously forming loops in the top portion.

53. A method of automatically forming a plurality of equally spaced loops along the top portion of a drapery panel in an automatic pleating machine comprising the steps of:

securing the top edge of a drapery panel in the machine while simultaneously sensing the width of the panel and generating an output signal responsive to that sensed width;

moving a plurality of loop forming means from a closed position to an open position and stopping the opening movement in response to the output signal;

transferring the drapery panel to the plurality of loop forming means; and moving the plurality of loop forming means back to their closed position forming loops equally spaced across the panel.

54. A method of spacing, forming and securing pleats in making finished drapes from drapery panels in an automatic drape forming machine having a loading assembly, a loop forming assembly, an overhead transfer assembly, and at least one pleating station, said method comprising the steps of:

loading the top portion of a drapery panel in the loading assembly and automatically sensing the width thereof;

transferring the drapery panel to the loop forming assembly and forming spaced apart loops along the top portion in response to the sensing of the width;

advancing the drapery panel to the pleating station and successively forming and securing a pleat in each of said loops; and ejecting said drapery panel after the pleat in the last loop is formed and secured.

55. A method as in claim 54 wherein the full width of the drapery panel is secured in the loading assembly and the additional step of forming a header along the width of the panel.

56. A method as in claim 55 including the further step of stretching the header portion.

57. A method as in claim 54 wherein the loops formed in the top portion are equally spaced across the width of said drapery panel.

58. A method as in claim 57 wherein all the loops are formed simultaneously.

59. A method as in claim 54 wherein the loops are formed by a plurality of looping means and the step of forming the loops includes the additional steps of positioning each of the plurality of looping means at predetermined locations in response to the width sensed for each successive panel loaded in the machine so that loops will be automatically positioned uniformly across the width of each successive panel.

60. A method as claimed in claim 54 wherein the pleating machine includes a plurality of pleating stations and the step of advancing the drapery panel to a pleating station includes the additional steps of sensing which of said plurality of pleating stations is empty and ready to receive a looped drapery panel, moving the overhead transfer assembly to the empty pleating station and transferring the looped drapery panel from the overhead transfer assembly to the empty pleating station.

61. A method as in claim 60 including the further step of loading another drapery panel in the loading assembly as the first panel is being advanced from the loop forming assembly to an empty pleating station.

62. A method of forming a drape from a drapery panel placed in a pleating machine comprising the following steps:

simultaneously forming a plurality of loops equally spaced across the top portion of said panel; and thereafter successively forming and securing pleats within each of said plurality of loops wherein the step of simultaneously forming a plurality of loops includes the additional steps of sensing the full width of each panel as it is initially placed in the pleating machine, generating an output signal corresponding to the sensed width and automatically positioning loop forming means for each successive panel in response to the generated output signal corresponding to the width of each successive panel.

63. A method of forming a drape from a drapery panel placed in a pleating machine comprising the steps of inserting a panel into the pleating machine, sensing the width of that panel and automatically positioning loop forming means at positions where they are equally spaced apart for that panel in response to the sensing of the width thereof and simultaneously forming a plurality of loops equally spaced across the top portion of that panel and thereafter forming and securing pleats within each of said plurality of loops.

64. A method of forming a drape from a drapery panel placed in a pleating machine comprising the following steps:

automatically sensing the width of a drapery panel inserted into the pleating machine, generating an output signal corresponding to the sensed width of that panel, automatically positioning spacing means for determining where pleats should be placed to have them equally spaced on that panel in response to the generated output signal and thereafter forming and sewing equally spaced pleats within that panel.

65. A method of automatically determining where equally placed pleats should be formed on a drapery panel inserted into a forming device comprising the steps of automatically sensing the width of a drapery panel inserted into the device, generating an output signal corresponding to the sensed width of that panel, automatically positioning spacing means for determining where pleats should be placed to have them equally spaced across that panel in response to the generated output signal and forming a plurality of equally spaced loops in the panel in which pleats can subsequently be formed.

* * * * *